US006904885B2

(12) United States Patent
Osband

(10) Patent No.: US 6,904,885 B2
(45) Date of Patent: Jun. 14, 2005

(54) OSBAND SUPER INDUCTIONEXHAUSTION VALVESHAFT' ENGINE SYSTEM, V-TYPE, FLAT-TYPE, SINGLE-TYPE, MULTI-CYLINDER FOUR-CYCLE ENGINE(S)

(76) Inventor: Lance Ian Osband, CDC-#D-84300, San Quentin State Prison, San Rafael, CA (US) 94974

( * ) Notice: Subject to any disclaimer, the term of this patent is extended or adjusted under 35 U.S.C. 154(b) by 93 days.

(21) Appl. No.: 09/935,425

(22) Filed: Aug. 24, 2001

(65) Prior Publication Data

US 2003/0037757 A1 Feb. 27, 2003

(51) Int. Cl.[7] ..... F02B 75/22; F01L 7/00; F01P 1/06

(52) U.S. Cl. ..... 123/195 R; 123/54.4; 123/80 BA; 123/190.1; 123/41.31

(58) Field of Search ..... 123/54.4, 54.5, 123/54.6, 54.7, 54.8, 80 R, 80 BA, 190.1, 190.4, 190.5, 190.6, 190.8, 190.16, 190.17, 195 R, 41.31

(56) References Cited

U.S. PATENT DOCUMENTS 3,301,236 A * 1/1967 Bratton ..... 123/59.2
4,134,381 A * 1/1979 Little ..... 123/190.17
4,867,117 A * 9/1989 Scalise ..... 123/190.8
4,944,262 A * 7/1990 Molina et al. ..... 123/190.8
5,490,485 A * 2/1996 Kutlucinar ..... 123/190.4
5,738,051 A * 4/1998 Binversie et al. ..... 123/80 BA
5,839,411 A * 11/1998 Schoell ..... 123/446
5,899,177 A * 5/1999 Binversie et al. ..... 123/54.4
6,295,961 B1 * 10/2001 Carter ..... 123/190.1
6,443,110 B2 * 9/2002 Qattan ..... 123/80 BA

* cited by examiner

*Primary Examiner*—Hai Huynh

(57) ABSTRACT

An internal combustion engine; having block valley radiator core, with electrical water pump and air cooling fans, cooling and circulating water through block water passages, and having block valley oil reservoirs positioned under block valley radiator core for oil storage cooling and directing oil through oil passages. Includes; cylinderhead having horizontally rotating valveshaft; having separate axially spaced intake and exhaust valvepockets between ringseals, being timed rotated, centrally above dual spark plug ignition combustion chambers, over piston cylinders, and communicating centrally between cylinderhead intake and exhaust chambers—having port passageways, with connected intake and exhaust manifolds, providing strainfree; opening and closing combustion chambers, highspeed valvepocket(s) rotation, highflow air-fuel intaking and combustion exhausting—velocity capabilities. The valveshaft provides installation and removal without removing cylinderhead from engine block. The valveshaft(s) rotates by; mounted pulleygear(s) and belt(s), linking to a drive pulleygear(s)—being rotational supported in front engine mounted—oil cooling pump casing—having internal oil pumping pinion drive gear(s), driven by the crankshaft.

5 Claims, 85 Drawing Sheets

#1 cyl.
#2 cyl.
124-ML
124-MR
54-DP
170
119
120
125
202

21
8
119
123-IB
197(A)
9
209
177-S
177-S
107-G
9
198(B)
123-IB
171
120
21
8
7
6
7
6
19
19
177-H
18-H
55-SD
55-SD
80
80
80
79
90-HM
25
25
25
80
79
90-O
90-O
90-O
103
103
103

RIGHT BANK
LEFT BANK
FRONT
MID
REAR
FRONT
REAR
62-CF
64-CS
122-T

124 + 124 = 248 COOLING TUBE AVERAGE PASSAGES 30.

39-39
TOP
41-41
147
147-PDGA
147-PDGB
MID
BOTTOM
64-CS
56-C

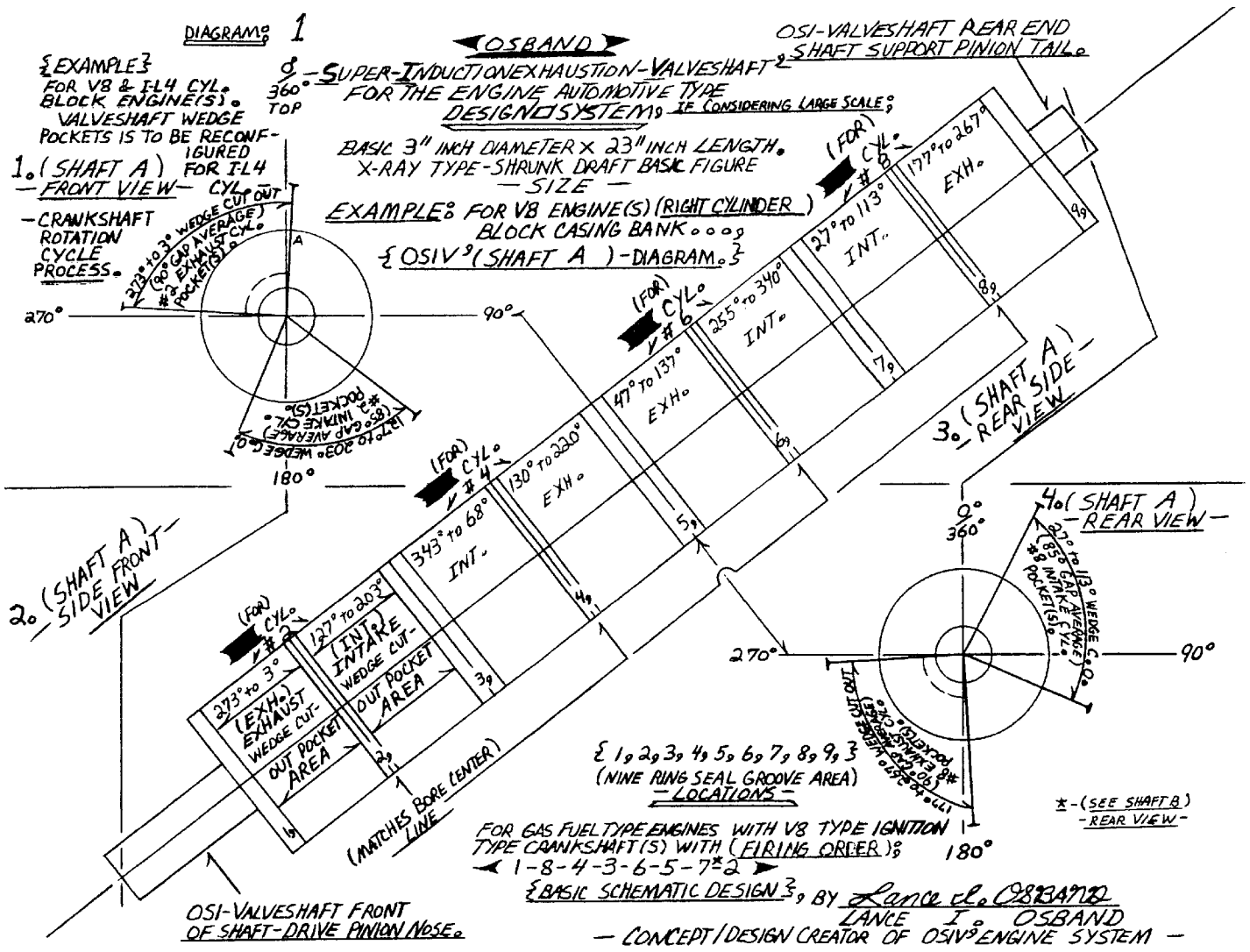
DIAGRAM 1
OSBAND
OSI-VALVESHAFT REAR END
SHAFT SUPPORT PINION TAIL
SUPER-INDUCTION EXHAUSTION-VALVESHAFT
FOR THE ENGINE AUTOMOTIVE TYPE
DESIGN SYSTEM
IF CONSIDERING LARGE SCALE
BASIC 3" INCH DIAMETER X 33" INCH LENGTH
X-RAY TYPE-SHRUNK DRAFT BASIC FIGURE
SIZE
EXAMPLE: FOR V8 ENGINE(S) (RIGHT CYLINDER)
BLOCK CASING BANK
OSIV (SHAFT A) - DIAGRAM
EXAMPLE FOR V8 & FL4 CYL. BLOCK ENGINE(S)
VALVESHAFT WEDGE POCKETS IS TO BE RECONFIGURED FOR FL4 CYL. OUT
1. (SHAFT A) FRONT VIEW
CRANKSHAFT ROTATION CYCLE PROCESS
2. (SHAFT A) FRONT SIDE VIEW
3. (SHAFT A) REAR SIDE VIEW
4. (SHAFT A) REAR VIEW
* - (SEE SHAFT B) REAR VIEW
EXAMPLE (NINE RING SEAL GROOVE AREA) LOCATIONS
FOR GAS FUEL TYPE ENGINES WITH V8 TYPE IGNITION TYPE CRANKSHAFT(S) WITH (FIRING ORDER)
1-8-4-3-6-5-7-2
BASIC SCHEMATIC DESIGN
BY LANCE I. OSBAND
CONCEPT/DESIGN CREATOR OF OSIV ENGINE SYSTEM
OSI-VALVESHAFT FRONT OF SHAFT-DRIVE PINION NOSE
MATCHES BORE (EMBER) LINE
INTAKE
EXHAUST
INT.
EXH.
WEDGE CUT OUT POCKET AREA
270°
90°
180°
360°

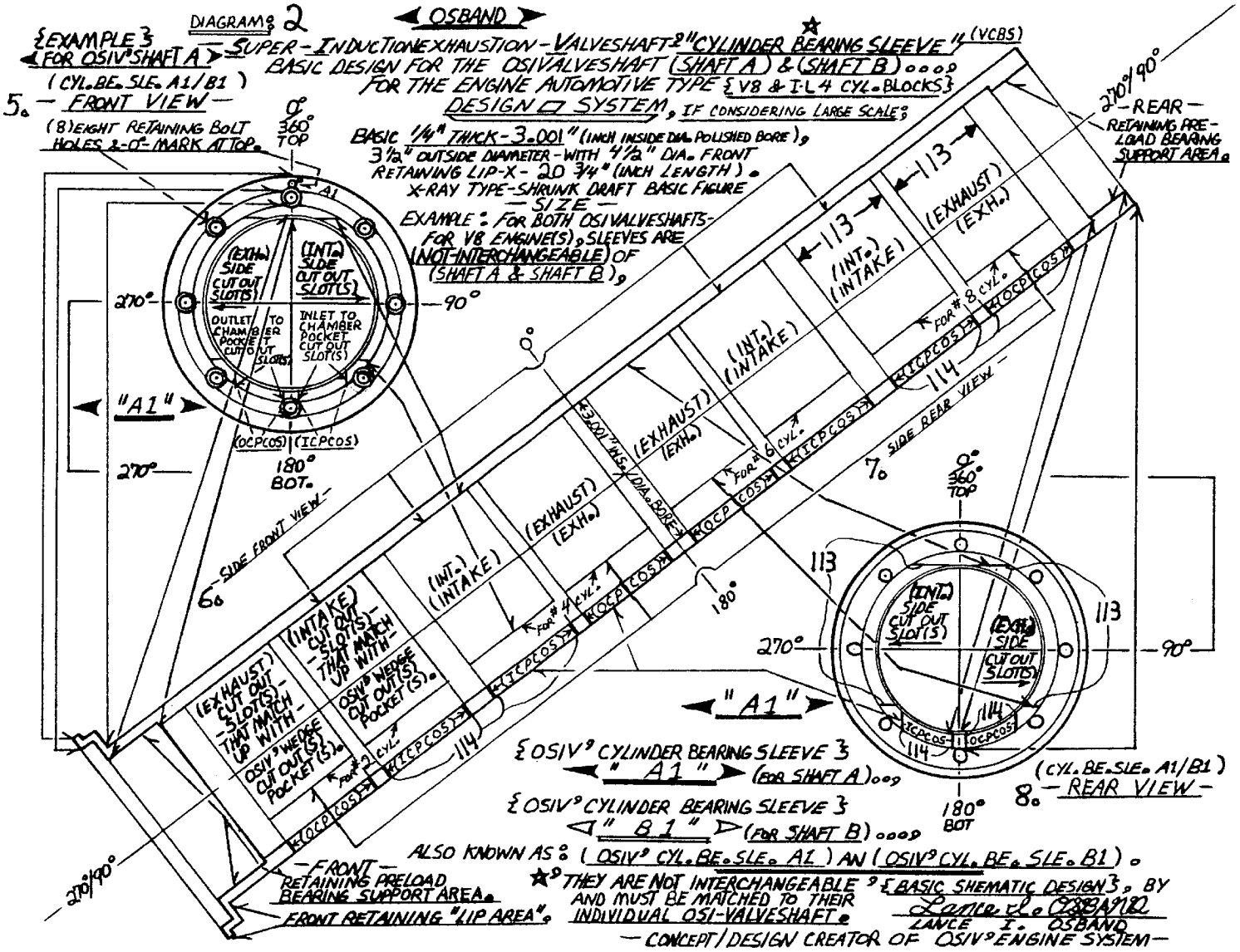
DIAGRAM 2
OSBAND
EXAMPLE 3
FOR OSIV'S SHAFT A
SUPER-INDUCTIONEXHAUSTION-VALVESHAFT "CYLINDER BEARING SLEEVE" (VCBS)
BASIC DESIGN FOR THE OSIVALVESHAFT (SHAFT A) & (SHAFT B)
FOR THE ENGINE AUTOMOTIVE TYPE { V8 & T-L 4 CYL. BLOCKS }
DESIGN SYSTEM, IF CONSIDERING LARGE SCALE
BASIC 1/4" THICK-3.001" (INCH INSIDE DIA. POLISHED BORE),
3 7/8" OUTSIDE DIAMETER-WITH 4 1/2" DIA. FRONT
RETAINING LIP-X-2.0 3/4" (INCH LENGTH).
X-RAY TYPE-SHRUNK DRAFT BASIC FIGURE
EXAMPLE: FOR BOTH OSI VALVESHAFTS-
FOR V8 ENGINES, SLEEVES ARE
(NOT-INTERCHANGEABLE OF
SIZE
(SHAFT A & SHAFT B),
(CYL. BE. SLE. A1/B1)
FRONT VIEW
(8) EIGHT RETAINING BOLT
HOLES-&-OF-MARK AT TOP
(EXH.) SIDE CUT OUT SLOTS
INLET TO CHAMBER POCKET CUT OUT SLOTS
OUTLET CHAMBER POCKET CUT OUT SLOTS
(OCPCOS) (TCPCOS)
0° 360° TOP
90°
180° BOT.
270°
"A1"
SIDE FRONT VIEW
SIDE REAR VIEW
(INTAKE)
(EXHAUST)
113
114
111
FOR # 8 CYL.
FOR # 6 CYL.
FOR # 4 CYL.
BORE-3
DIA. BORE-3
5 1/4" (100CF)
FRONT
REAR
270° 90°
REAR
RETAINING PRE-LOAD BEARING SUPPORT AREA
(CYL. BE. SLE. A1/B1)
REAR VIEW
{ OSIV'S CYLINDER BEARING SLEEVE 3
"A1" (FOR SHAFT A)
"B1" (FOR SHAFT B)
ALSO KNOWN AS: (OSIV'S CYL. BE. SLE. A1) AN (OSIV'S CYL. BE. SLE. B1).
THEY ARE NOT INTERCHANGEABLE { BASIC SCHEMATIC DESIGN 3, BY
AND MUST BE MATCHED TO THEIR
INDIVIDUAL OSI-VALVESHAFT.
CONCEPT/DESIGN CREATOR OF OSIV'S ENGINE SYSTEM
FRONT RETAINING "LIP AREA"
FRONT RETAINING PRELOAD BEARING SUPPORT AREA
OSIV'S SLEEVE WITH-TWO-SLOTS-WIDE WITH-OIL CUT OUT POCKET (S)
OSIV'S SLEEVE WITH-TWO-SLOTS-WIDE WITH-OIL CUT OUT POCKET (S)
OSIV'S SLEEVE WITH-TWO-SLOTS-WIDE WITH-OIL CUT OUT POCKET (S)

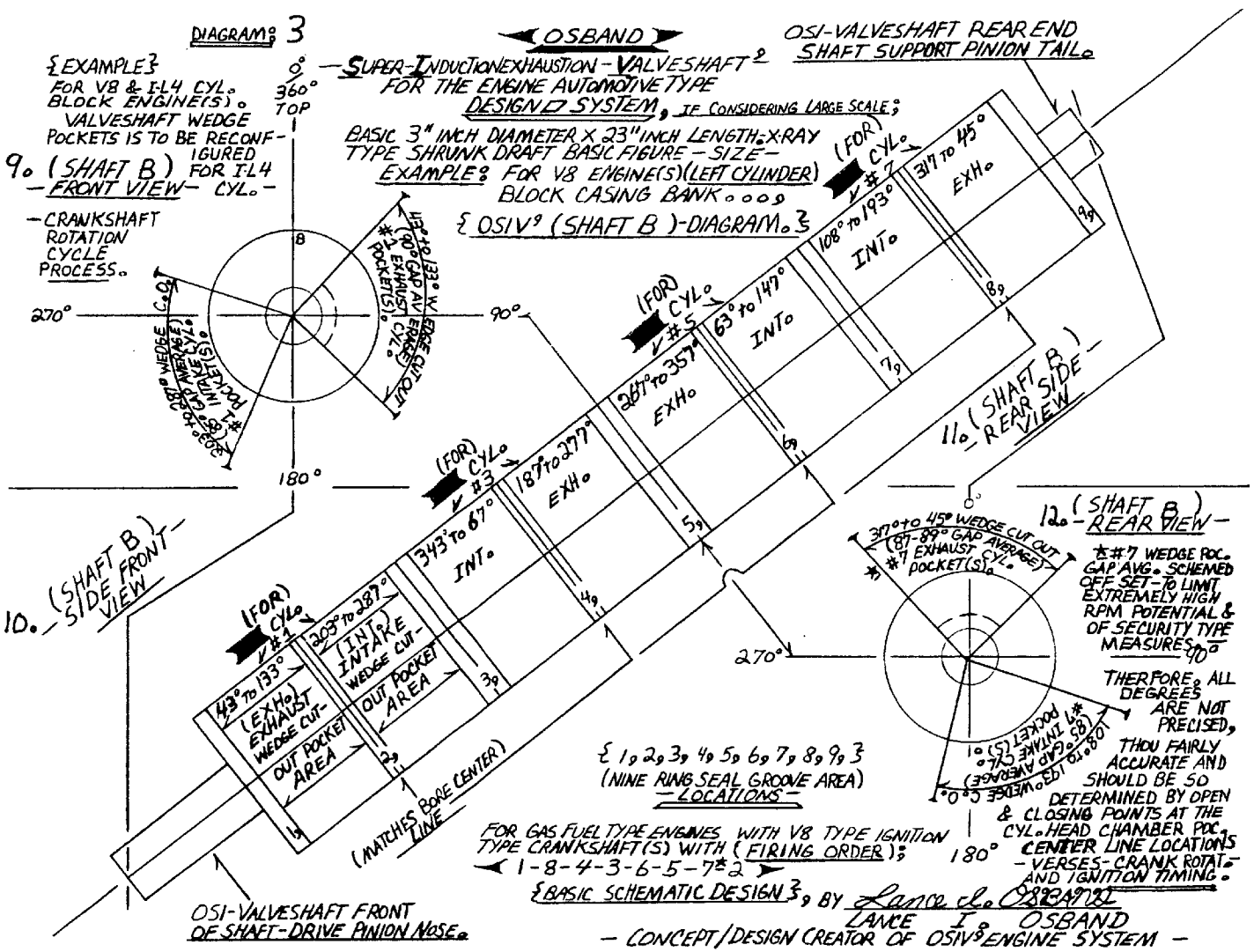
OSBAND
SUPER-INDUCTION EXHAUSTION-VALVESHAFT
FOR THE ENGINE AUTOMOTIVE TYPE
DESIGN SYSTEM, IF CONSIDERING LARGE SCALE;
OSI-VALVESHAFT REAR END
SHAFT SUPPORT PINION TAIL.
DIAGRAM 3
EXAMPLE 3
FOR V8 & F-L4 CYL.
BLOCK ENGINES.
VALVESHAFT WEDGE
POCKETS IS TO BE RECONFIGURED FOR F-L4 CYL.
9. (SHAFT B) FRONT VIEW
CRANKSHAFT ROTATION CYCLE PROCESS.
BASIC 3" INCH DIAMETER X .23" INCH LENGTH X-RAY TYPE SHRUNK DRAFT BASIC FIGURE-SIZE-
EXAMPLE: FOR V8 ENGINE(S) (LEFT CYLINDER) BLOCK CASING BANK .009
{OSIV's (SHAFT B)-DIAGRAM 3
(FOR CYL. #1)
(FOR CYL. #3)
(FOR CYL. #4)
(FOR CYL. #2)
EXH.
INT.
11. (SHAFT A) REAR VIEW
12. (SHAFT B) REAR VIEW
#7 WEDGE POC. GAP AVG. SCHEMED OFF SET-TO LIMIT EXTREMELY HIGH RPM POTENTIAL & OF-SECURITY TYPE MEASURES
THEREFORE, ALL DEGREES ARE NOT PRECISED, THOU FAIRLY ACCURATE AND SHOULD BE SO DETERMINED BY OPEN & CLOSING POINTS AT THE CYL.-HEAD CHAMBER POC. CENTER LINE LOCATIONS -VERSES- CRANK ROTATION AND IGNITION TIMING.
{1, 2, 3, 4, 5, 6, 7, 8, 9, 3 (NINE RING SEAL GROOVE AREA) LOCATIONS
FOR GAS FUEL TYPE ENGINES WITH V8 TYPE IGNITION TYPE CRANKSHAFT(S) WITH (FIRING ORDER); 1-8-4-3-6-5-7-2
{BASIC SCHEMATIC DESIGN 3, BY LANCE I. OSBAND
- CONCEPT/DESIGN CREATOR OF OSIV's ENGINE SYSTEM -
OSI-VALVESHAFT FRONT DE SHAFT-DRIVE PINION NOSE.
10. (SHAFT A) SIDE VIEW

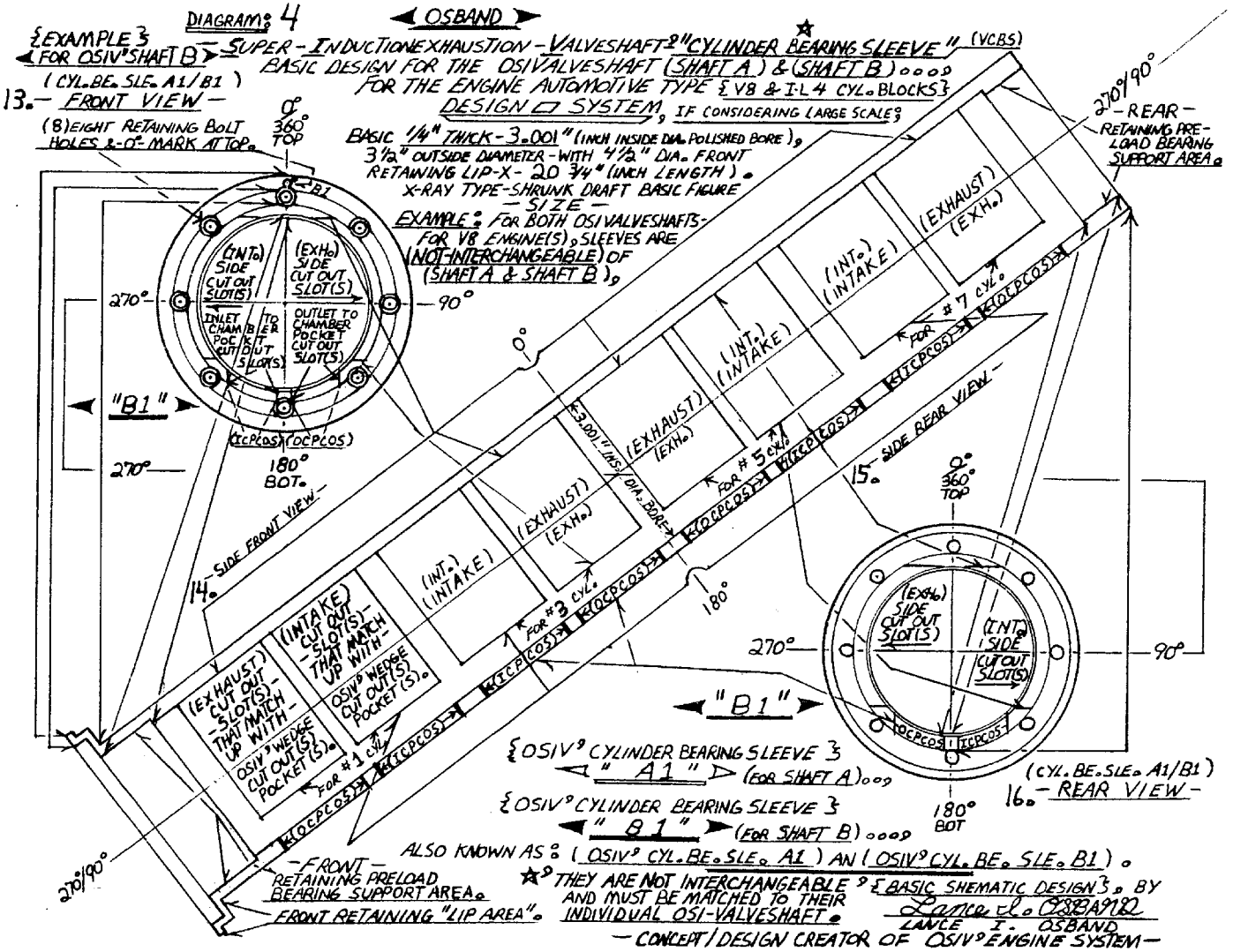
DIAGRAM: 4
EXAMPLE 3 FOR OSIV SHAFT B
SUPER-INDUCTIONEXHAUSTION-VALVESHAFT "CYLINDER BEARING SLEEVE" (VCBS)
BASIC DESIGN FOR THE OSIVALVESHAFT (SHAFT A) & (SHAFT B)
FOR THE ENGINE AUTOMOTIVE TYPE & V8 & I-L 4 CYL. BLOCKS
DESIGN SYSTEM, IF CONSIDERING LARGE SCALES
OSBAND
BASIC 1/4" THICK - 3.001" (INCH INSIDE DIA. POLISHED BORE)
3 1/2" OUTSIDE DIAMETER - WITH 4 1/2" DIA. FRONT RETAINING LIP-X- 2.0 3/4" (INCH LENGTH)
X-RAY TYPE-SHRUNK DRAFT BASIC FIGURE
EXAMPLE: FOR BOTH OSIVALVESHAFTS-FOR V8 ENGINE(S), SLEEVES ARE SIZE (NOT-INTERCHANGEABLE) OF (SHAFT A & SHAFT B)
(8) EIGHT RETAINING BOLT HOLES 2-CT-MARK AT TOP
13. - FRONT VIEW -
(CYL. BE. SLE. A1/B1)
(EXH.) SIDE CUT OUT SLOT(S)
(INT.) SIDE CUT OUT SLOT(S)
OUTLET TO CHAMBER POCKET CUT OUT SLOT(S)
INLET TO CHAMBER POCKET CUT OUT SLOT(S)
"B1"
"A1"
(EXHAUST)
(INT.)
(INTAKE)
SIDE FRONT VIEW
14.
SIDE REAR VIEW
15.
16. - REAR VIEW -
(CYL. BE. SLE. A1/B1)
OSIV CYLINDER BEARING SLEEVE 3 "A1" (FOR SHAFT A)
OSIV CYLINDER BEARING SLEEVE 3 "B1" (FOR SHAFT B)
ALSO KNOWN AS: (OSIV CYL. BE. SLE. A1) AN (OSIV CYL. BE. SLE. B1)
THEY ARE NOT INTERCHANGEABLE & BASIC SHEMATIC DESIGN, BY AND MUST BE MATCHED TO THEIR INDIVIDUAL OSI-VALVESHAFT
LANCE I. OSBAND
CONCEPT/DESIGN CREATOR OF OSIV ENGINE SYSTEM
REAR - RETAINING PRE-LOAD BEARING SUPPORT AREA
FRONT - RETAINING BEARING SUPPORT AREA
FRONT RETAINING "LIP AREA"
ALSO KNOWN AS: (OSIV CYL. BE. SLE. A1) AN (OSIV CYL. BE. SLE. B1)

OSBAND SUPER INDUCTIONEXHAUSTION VALVESHAFT' ENGINE SYSTEM, V-TYPE, FLAT-TYPE, SINGLE-TYPE, MULTI-CYLINDER FOUR-CYCLE ENGINE(S)

CROSS-REFERENCE TO RELATED APPLICATIONS

"NOT APPLICABLE"

STATEMENTS REGARDING FEDERALLY SPONSORED RESEARCH OR DEVELOPMENT

"NOT APPLICABLE"

REFERENCE TO A MICROFICHE APPENDIX

NOT APPLICABLE

BACKGROUND OF THE INVENTION

This Osband Super Inductionexhaustion Valveshaft' Engine System and engine—relates towards two stages of innovative usage to a V-type, Inline-type, Flat-type, Single-type, Multi-cylinder, type of four-cycle or four stroke design method type engine—particularly in the High Performance and Professional Racing World field of endeavor.

This invention and method system of discovery towards Induction-(intake) and Exhaustion-(exhaust)—Engine system(s) which uses a simple basic Brick Wedge Shape Cylinderhead with a simple internal cylinder bore and rotating shaft—with Wedge Pocket type cut outs or formulated area(s)—for the valves—to create Free-Flow of intake and exhaust functionality—in and out of the Piston Cylinder area(s), of any standard or modified casting or forge engine cylinder block—of a gas fuel type, car, truck, boat, motorcycle, aircraft, etc., type motor engine—which to allow intake Fuel Air Mixture into the Piston's cylinder block area much simpler to be ignited and burned and then exit the Piston's cylinder block area—much simpler, easier and faster—at a greater operating flow rate—than Old Poppet type Valve & Spring-overhead camshaft and camshaft & lifter push rod rocker arm system.

The OSIV' Engine System is based on a Two Stage system as well. The STAGE ONE SYSTEM is the—ADAPTION—of particular OSIV' Engine component part (s)—to existing ready available Engine Blocks with Crankshaft Rotating Reciprocating Piston Connecting Rod Assemblies—with basic type skilled machining work done to those type existing market & after market Engine Blocks. The STAGE TWO System—is the entire OSIV' Engine—and—System Design & Structure presented—of such engine, except for accessories like Spark Plugs, Ignition System(s), Gas/Fuel Injection and Carburetor and Fuel Pump type system(s), or "ACCESSORIES—NEEDS".

The OSIV' Engine System and Drawings, Figures, and Schematic Diagrams—are being presented in STAGE TWO Form. U.S. lettering & numbers are use to Pin-Point and Identify parts—components—or assemblies of this invention—in the most simplest terms I could define—basically calling or naming such parts and components or assemblies—of what it is.

The Description Of Information That Is Known To Me is basically a—Choice Selected Ads Of Companies—here in the U.S.A. and mostly here in the State Of California who are capable of producing such components, parts, and assemblies of this OSIV' Engine System Invention and its basic materials.

Title Heading(s): "CHOICE SELECTED COMPANY"

Other References To Specific Documents Known To Me And My Invention—is retained in my presented PTO DISCLOSURE DOCUMENTS No. 469282 PTO-1652(8/99) and my created drawing draft type items & Figure(s) Fig.—being presented here with Application Forms.

Because of my limited abilities, indigence, prison status, old school knowledge skills,—The OSIV' Engine System can only be presented in simple Hand Written & Typing and Drawing Draft & Copying—with low quality level form—and different views;

OSIV' ENGINE AND SYSTEM—Non-Colored Drawings

DRAWING PAGES 1 thru 6 of 85 (basic front V-type viewing areas);

DRAWING PAGES 7 thru 12 of 85 (basic rear V-type viewing areas);

DRAWING PAGES 13 thru 16 of 85 (basic rightside bank—front to rear V-eight and or, inline Four Cylinder Block—type viewing areas);

DRAWING PAGES 17 thru 19 of 85 (basic leftside bank—rear to front V-eight and or, inline Four Cylinder Block—type viewing areas);

DRAWING PAGES 20 thru 25 of 85 (basic top—left bank to valley to right bank, rear to valley front, On V-Center Line Cylinder Bore Spacing V-eight and or, inline Four Cylinder Block(s)—type viewing areas);

DRAWING PAGES 26 thru 28 of 85 (basic bottom—rear to front On V-Center Line Bore Spacing V-eight and or, inline Four Cylinder Block(s)—type viewing areas);

DRAWING PAGES 29 thru 34 of 85 (basic Piston Assembly front, top, bottom, center, side-type viewing areas, for Block cylinder #2cyl., #6cyl., RIGHT BANK-and-#3cyl., #7cyl., LEFT BANK, V-eight Represented Configuration);

DRAWING PAGES 35 thru 40 of 85 (basic Piston Assembly front, top, bottom, center, side-type viewing areas, for Block cylinder #4cyl., #8cyl., RIGHT BANK-and-#1cyl., #5cyl., LEFT BANK, V-eight Represented Configuration);

DRAWING PAGE 41 of 85 (advance Piston Components and Piston Cylinder Block Sleeve Component—viewing areas, Piston Pin—front, side, top and or bottom—shaded type view, Piston Pin Cup Lock—and —Cup Lock Lock Ring Seal—frontside shaded type view, Cylinder Block Sleeve Springboot Seal—center and frontside—shaded type viewing areas);

DRAWING PAGES 42 thru 44 of 85 (basic front, front, center, V-Lockfork Connecting Rod Assembly—type viewing areas);

DRAWING PAGES 45 thru 48 of 85 (advance rightside, leftside, leftside off center, leftside center, V-Lockfork Connecting Rod Assembly—with and without Crankshaft Arm & Pin—shaded type viewing areas);

DRAWING PAGES 49 thru 52 of 85 (basic & advance V-Lockfork Connecting Rod component—viewing areas, Rod Fork, Fork Cap, Fork Pin Lock, front—side—top—center half piece, type view of rightside V-Rod, and front—side—top—center half piece, type view of leftside V-Rod Fork, Cap, Fork Pin Lock, and Free Spin Bearing & Seal—type viewing areas);

DRAWING PAGES 53 thru 67 of 85 (basic & advance—front, back, front Cover, front Cover back—advance shaded, rightside center, rightside off center, top and bottom—advance shaded,—type viewing areas of Unique "R.G.TDOP.SUCH"—Roller Gear—Timing Drive Oil Pump—System Unit Case Housing);

*DRAWING DIAGRAM SCHEMATIC PAGES 68 thru 69 of 85 (basic front, side front, rear side, rear, type viewing areas of the Unique—OSIV' SHAFT (A) & OSIV' Cylinderhead Bearing Sleeve (A1);

DRAWING PAGES 70 thru 75 of 85 (basic Intake Port side—front to rear and bottom, off center and center—leftside view areas, Exhaust Port side—rear to front and bottom, off center right side and rightside—type viewing areas of right bank Cylinderhead Assembly);

*DRAWING DIAGRAM SCHEMATIC PAGES 76 thru 77 of 85 (basic front, side front, rear side, rear, type viewing areas of the Unique—OSIV' SHAFT (B) & OSIV' Cylinderhead Bearing Sleeve (B1);

DRAWING PAGES 78 thru 83 of 85 (basic Intake Port side—rear to front and bottom, off center and center—rightside view areas, Exhaust Port side—front to rear and bottom, off center left side and leftside—type viewing areas of left bank Cylinderhead Assembly);

DRAWING PAGE 84 of 85 (advance front side—and or rear side view areas of OSIV' Engine & System—Main Strength Bulkhead Rib structure between Piston Cylinder Block Bore, which also represents—Single and Inline Cylinder—type view, right bank cut away from left bank—type viewing areas);

DRAWING PAGE 85 of 85 (basic front V-type viewing areas).

"CHOICE SELECTED COMPANY"—SECTION—PAGES are separated from SPECIFICATION; Copy Pages 1 thru 52—of the 52 TOTAL Pages, (provides plenty of information within the "Choice Selected Company" section) which aid in—toward producing & developing a Professional Safe Quality OSIV' Engine-and-Professional Safe Quality System.

Reference To Specific Problems Involved In The Prior Art (or State Of Technology) Which Are Solved By Your Invention (or this invention);

In the Automotive High Performance World and World Of Racing, there are always problems to be solved—in which such a World Of Racing of endeavor is extremely vast. However, I have provided a professional document of one of the best Tech Council's latest articles I've read—which pin-points specific problems involved in the Prior Art, Technology Of Racing Engines, and good—good problem solving, "CHOICE SELECTED COMPANY" pages 27 thru 31 of the 52 pages—"TRACK TECH", which must be read entirely—as I have noted many words with underlines.

Problems That Would & Could Be Factually Solved By This New Invention OSIV' ENGINE SYSTEM and such discovered New Method Techniques;

Blown Leaky Cylinderhead Gaskets,

Blown-Seized-Spun Crank Main and Rod Bearings, (OSIV' Engine System Piston Cylinder Block Sleeve, Cylinderhead—Deep-O'Ring Half Moon Grooves for Cylinder Block Sleeve top tall lip formed areas, Cylinderhead(s) DO NOT REQUIRE oil—nor water coolant, Engine Block Deck Surface need NO water NOR oil passages—to oil or water cool OSIV' Cylinderhead(s), "FREE-SPIN Bearing and Seal Technique"—Crankshaft & Rod Bearings always spin in formed Track Groove—with Low to No oil pressure, No sticky Head Gasket required—only Shim-Spacer types required—for Quick Compression Ratio Tune Changes. No leaky blown head gaskets—No blown spun bearings, Problem Solved, though not the OSIV' Engine System Invented Endeavor, Nor the OSIV' Engine System objective.);

Lower End Block Flexing & Cracking,

Crank Main Bearing Cap Walk,

Over Weight Oil Pan and Oil Pan Block Crank Case Rail—that extend to wide and long—beyond Crankshaft Main Journal Block Bore Cap Bolts, (OSIV' Engine System—Fork Main and Fork Cap(s) & Groove Track—Crank Main Journal Bore Rib Bulkhead Block and Half-Moon Scavenge Oil Pan Technique, was of the OSIV' Engine Block Design Of Thought—of NOT having those problems. Though my objective here—were Maximum Strength Shape Structure with Lightest Block Lower End Overall Weight—using Aluminum—Iron—or Steel.), Blown-Seized-Spun or Cracked Camshaft(s) and Camshaft Bearing(s), (The OSIV' Engine & System operates without such.), Camshaft Lobe(s) problems—Camshaft Timing Sprocket Chain Set problems—Tappet Lifters—Pushrods—Rocker Arms—Valve Locks—Valve Retainers—Valve Springs—Valve Seals—Valve Guides—Valve Seats—and the Poppet Valve & Stem DRASTIC PROBLEM of falling into the Piston Cylinder area at any operating RPM engine range, (OSIV' Engine and System operates without such of those problems to never occur, though the OSIV' Engine System Objective here were 15,000 and above—RPM gas—fuel type engine operations without those problems—"NONE EXISTING", thus depending on how well developed-and-how much the Crankshaft—Connecting Rods—Pistons—Rotation Reciprocating Assembly can withstand under such Ultra Extreme RPM Running.).

The Old Style Problems could be considered solved of world gas/fuel type racing-to-standard use type engines of such Worldly Market and Industrial Job Place by the Objective OSIV' Engine System & Method Technique—amongst Pro's, Expert Specialist—type Engine Designer & Builders—to generate another another Profit Field, Jobs and Purchase Sales, and another Mechanic Field. Thus so without eliminating others on such same Playing Field of endeavor.

Thoughtfulness of realizing—that also went into the OSIV' Engine System—is that there is plenty of Worldly room for such OSIV' Engine System to compete in—by enjoying Two System Methods, OLD STYLE verses NEW STYLE, a concept that's been amongst the racing world since racing began.

BRIEF SUMMARY OF THE INVENTION

This Newly founded Osband Super Inductionexhaustion Valveshaft' Engine System—invention and Method System Techniques of discovery towards U.S.A. and Worldly Gas Fuel Engines—(Intake & Exhaust, Internal Combustion type)—is based upon the "OSIV' Brick Wedge Shape Cylinderhead(s)" Assembly, which has a Internal Cylinder Bore—which houses such Valveshaft—which are Rotation Driven from it's Flex Drive Belt(s), by it's (Roller-Gear—Timing Drive Oil Pump—System Unit Case Housing) & it's Drive Pulley-Gear(s) or Sprocket(s), by it's Crankshaft and Connecting Rod(s) and Piston(s)—Rotation Reciprocating Assembly, which is all supported by it's Crank Case Main Rib Bulkhead and Cylinder Casing & Cylinder Barrel(s)—Engine Cylinder Block Casing or Deck, which such Block's Valley—houses Oil Reservoir(s) and Radiator type water/coolant—Cooling Core area Unit and Electric water type Pump System-and-Base area with Crankcase Ventilation Inlet & Outlet Passages—and Oil Pressure Regulator By-Pass Valve Sending Unit, for support valley strength, which is further supported by a "Multi Position Changeable" Intake Manifold Base & Support Runner(s)—which are attached to the OSIV' Brick Wedge (shape) Cylinderhead(s)—Intake Port Runner surface side—which OSIV' Brick Wedge Heads (short title name), supports it's Cylinder Bore Bearing (Sleeve)—(with or without)—though which support & houses it's Internal Osband Super Inductionexhaustion Valveshaft—for mode of engine' simple objective-and-of Highly Smooth Precision Quiet Operation with "Choice Selected Company" Accessories;

Crankshaft or Valveshaft—Trigger Ignition System-to-Spark Plug(s);

Carburetor and Fuel Injection, Fuel Pump, Fuel-Air—Intake Mixture type & Electric Management Systems;

Engine—Gas—Oil—and Air Filters;

Electric-Starter, Fans, Water Pump/Motor, Electric Distributor Ignition—Coil and Battery Unit, Wire Connection System(s), 10,000 RPM PLUS Flywheel and Clutch Systems and Balancers or Fluid Harmonic type Crankshaft Damper(s)—coincide with crankshaft Rotation—Reciprocating Component Parts Assemblies of Manufactures and Producers; All for complete engine—for operating on Gas/Fuel, Ultra Extreme RPM Running while generating constant High-and-Very High Torque Levels and Horsepower Ratings using Premium & Race Gas/Fuel Air Mixtures—on a standard type logical—Highly Fuel Efficient Engine method, and racing fuel type Racing setup Performance OSIV' Engine, to which creates a true "Internal Valveshaft Engine"—Cylinderhead type OSIV' System and engine.

BRIEF DESCRIPTION OF THE SEVERAL VIEWS OF THE DRAWING

Number Of Sheets: 85

Number Of Drawing Figures: 133

Number Of Drawing Schematic Diagram Sheets: 4

Number Of Drawing Schematic Views: 16

Number of Ruff Sketches: 7

Ruff Sketches On "Choice Selected Company" Section Pages; (1., 3., 10., 32., 46., 47., (* * *))

Number Of "Choice Selected Company" Section—Page Sheets: 52

Small Scale Figures—FIGS.; **1, 2, 3, 4, 5, 6, 7, 8, 9, 10, 11, 12, 13, 14, 15, 16, 17, 18, 19, 20, 21, 22, 23, 24, 25, 26, 27, 28, *, 133,—DIAGRAM 1, DIAGRAM 2, DIAGRAM 3, DIAGRAM 4,—108, 109, 110, 111, 112, 113, 114, 115, 116, 117, 118, 119, 120, 121, 122, 123, 124, 125, 126, 127, 128, 129, 130, 131, Ruff Sketches: 1., 2., 3., 4., 5., 6., 7., (*).

Medium Scale Figure—FIG.; 132

Large Scale Figures—FIGS.; 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 83, 84, 85, 86, 87, 88, 89, 90, 91, 92, 93, 94, 95, 96, 97, 98, 99, 100, 101, 102, 103, 104, 105, 106, 107, **.

DRAWINGS AND SCHEMATIC DIAGRAMS—FIGURE DEPICTION

Figure 1:
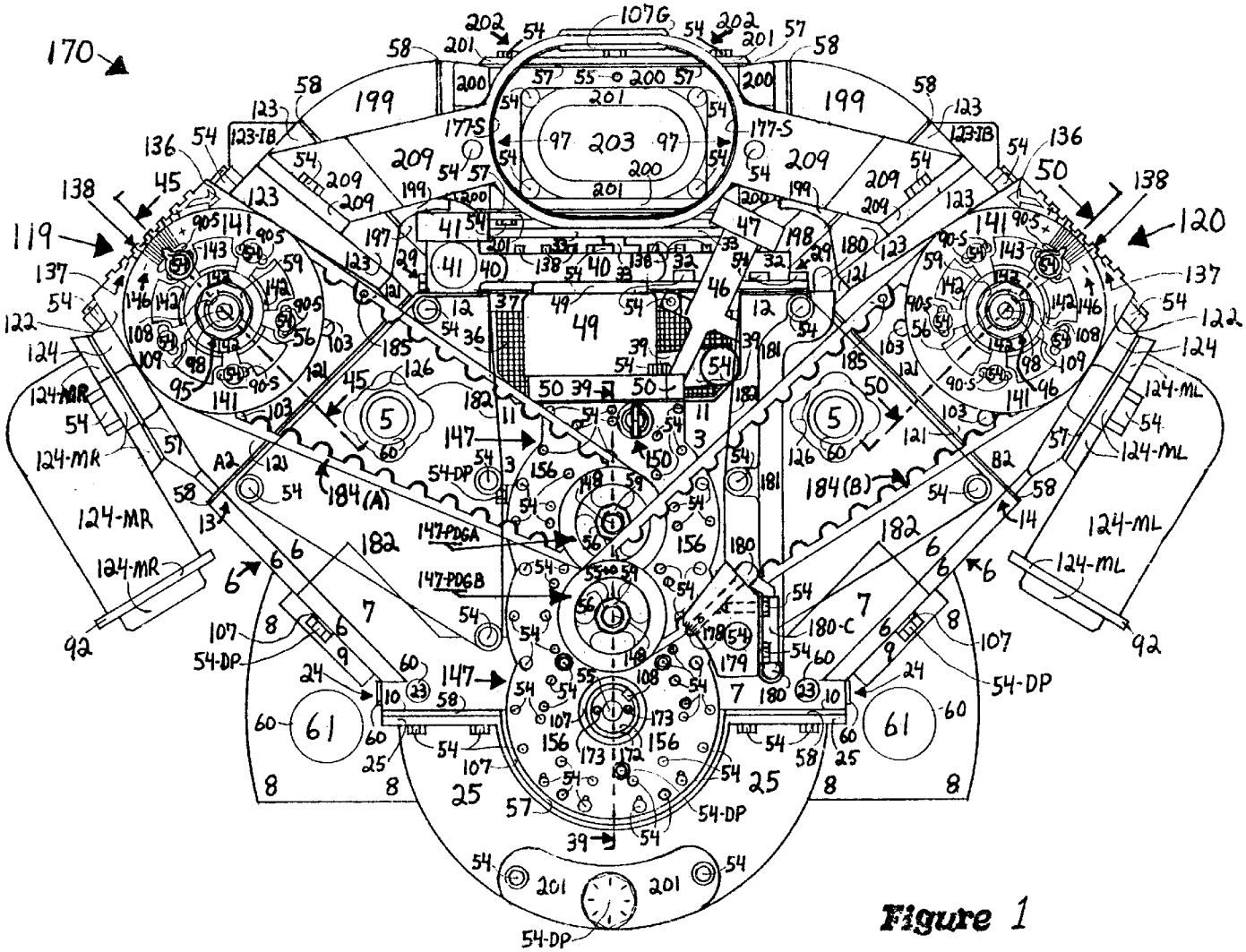

FIG. 1 Depicts front view, the V-type multiple piston cylinder, internal combustion—Osband Super Inductionexhaustion Valveshaft Engine & System—set-up, Stage Two form outer appearance construction, (OSIV' ENGINE SYSTEM, short title named).

Figure 2:
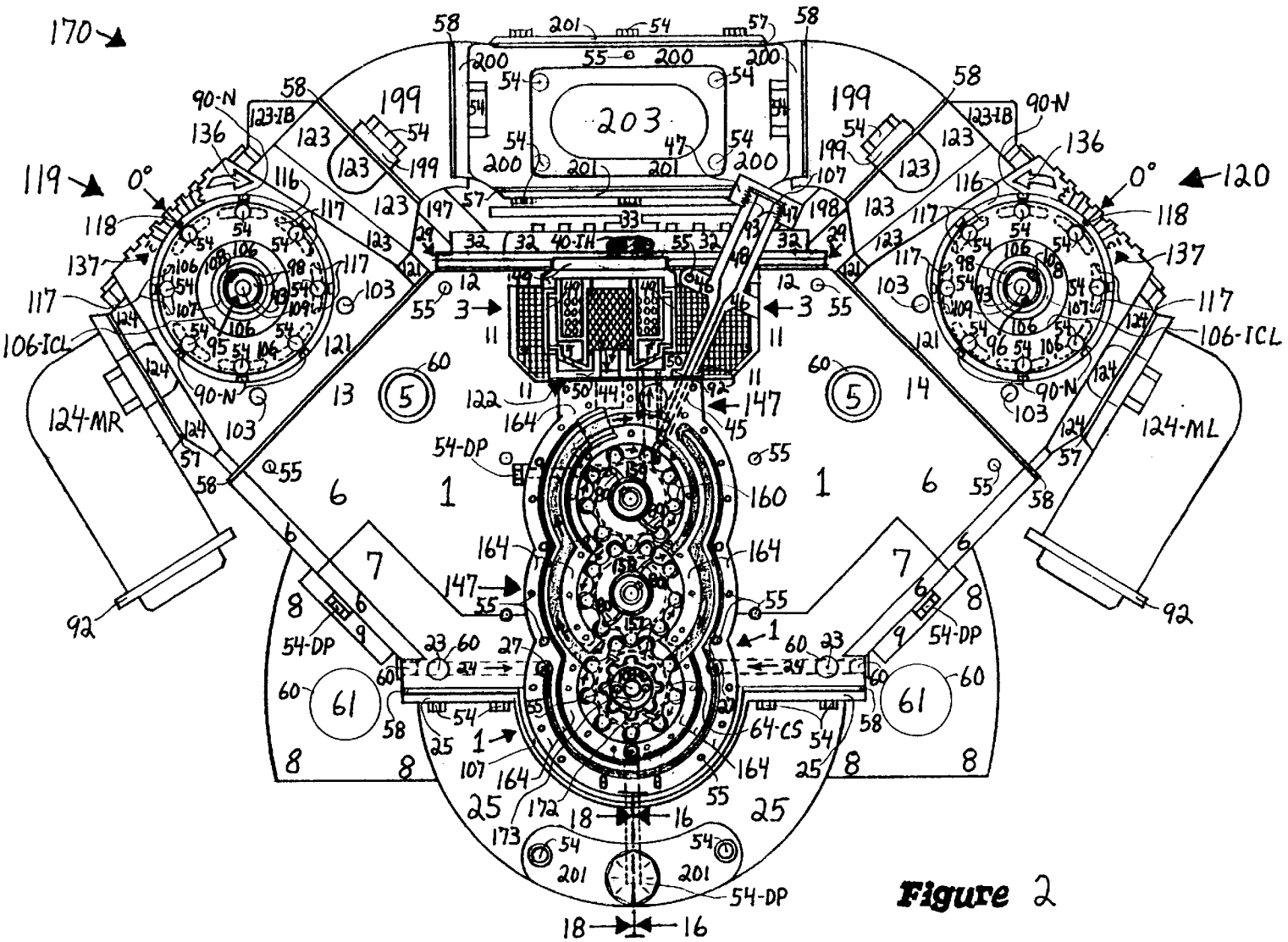
Figure 3:
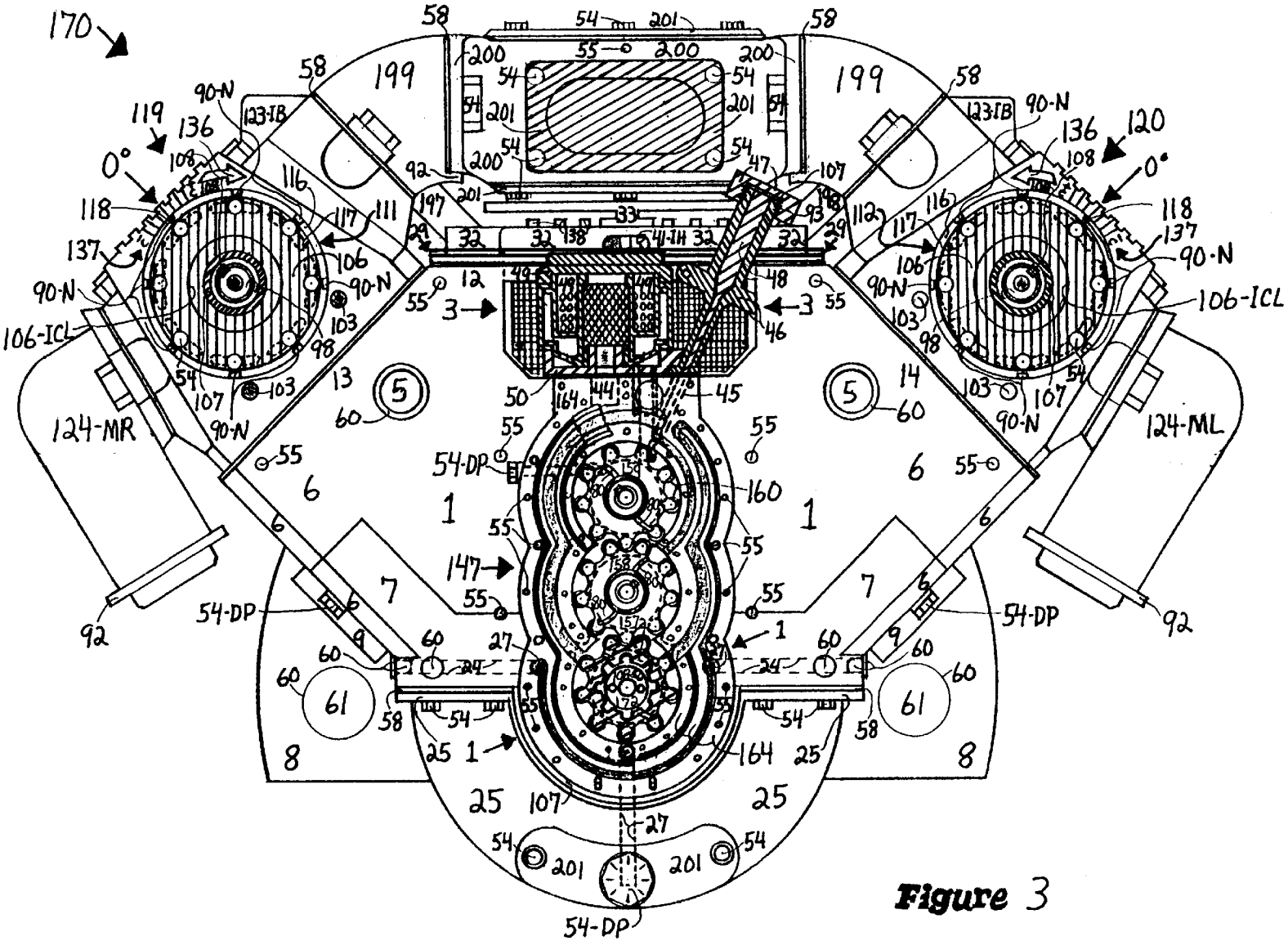

FIG. 2 Depicts front view area(s)—of FIG. 1 without-or-removal of: Crank Ignition Trigger—Bracket—Tube—Wire; flex timing drive belt—Guards; Adjustable Timing Flex Drive Belt—Pulley Gear(s) Sprocket(s) Assembly—System; Roller Gear—Timing Drive Oil Pump—Cover Plate; Oil Filter & Housing Base Plate—Oil Filler Cap Dipstick & Tube—front half area non-hatch cutaway view 3-3 down vertical plane line 3-3 of FIG. 21 (and hatch view is shown in FIG. 3); Fresh Air Internal Combustion Chamber Cooling Inlet Manifold; Valley Radiator filler neck & Pressure Overflow Cap; ROLLERGEAR front surface area non-hatch cutaway view 1-1 down vertical plane line 1-1 of FIG. 104 (and hatch view shown in FIG. 3 and 1-1 of FIG. 93, 1-1 of FIG. 94);. FIG. 2 further depicts broken line phantom areas of locations—of; lower Block & Oil Pan—oil scavenge passages to (RG.TDOP.SUCH.) Base-or-(Rollergear—Timing Drive Oil Pump—System Unit Case Housing) Base, Roller Gear(s) Oil Groove diameter circle passage area, (RG.TDOP.SUCH.) upper rightside—Oil Drain Plug passage route to block's rightside High Pressure Oil Reservoir, partial phantom of Oil Dipstick & Tube—interring & at a slanted angle—in the front Valley area of the Block's leftside Low Pressure Oil Reservoir, (RG.TDOP.SUCH.) upper left off center—oil passage route through Oil Pressure & Volume Adjuster hole-circle—to Oil Filter Housing Base Plate, front Valley Deck—right off center side—High Oil Pressure & Volume Inlet Hole to high pressure side—Right Reservoir, broken line phantom of Eight Adjustable—Oval type Slots—in both OSIV' Cylinderhead Cylinder Bearing Sleeve—front Seat Lip area; front Block area-or-these items are within close range of Block's front Main Bulkhead Rib.

FIG. 3 Depicts the similar view area(s) of FIG. 2 with cross-hatch lines to show structure area of the Oil Filter & Oil Filter Housing Base Plate-and-Oil Filler Tube & Level Check Dipstick Cap, hatch lines to show area surface of—OSIV' VALVESHAFT (A) & (B) Preload Roller Bearing Retainer & Neoprene type Seal, Carburetor & Throttle Body type—removable Block Off Base Plate(s)—upon front inlet area of this OSIV' Engine System Multi Position Changeable Intake Manifold Base.

Figure 4:
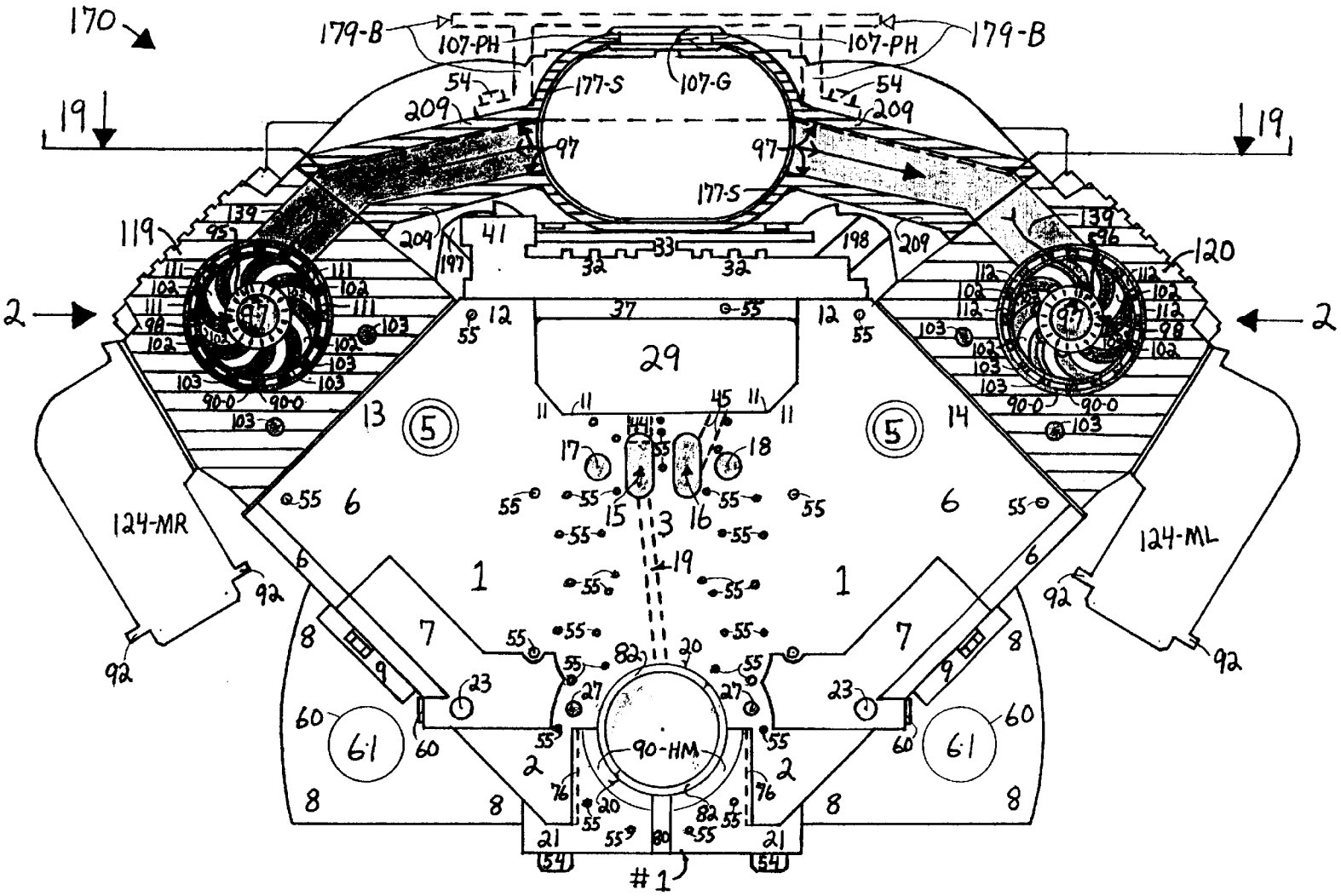

FIG. 4 Depicts similar front view area(s) of FIG. 3 with the ADDITION OF; Fresh Air Inlet Manifold and cutaway cross-hatch area-&-structure and Air Passage Route to Cylinderheads—through Cylinderhead's Cylinder Bearing Sleeve(s) Air Holes—to Valveshaft (A)&(B) front air inlet suction Turbine Fan—through to Valveshaft's Center Bore Air Passage—which links to Intake Valve Wedge cutout—type Pocket(s), cross-hatch area cutaway—removed material of front area—view 2-2 of the Cylinderhead Assembly—down vertical plane line 2-2 of FIG. 20, and further Depicts the REMOVAL OF; (RG.TDOP.SUCH.)-&-(Oil Cooling Scavenge Pan)-&-(Crankshaft Rotation Reciprocating Assembly)-&-(Oil Filter—Filter Housing Plate—Oil Filler Tube & Level Checker Dipstick Cap), leaving the OSIV' Engine System fork style—Fork Lock Cap—Freespin Bearing & Seal—connected to—Crank Main block journal bore Rib Bulkhead Fork-Technique-basic view exposed, in position with broken line Phantom of Fork & Cap matching groove Rail Track-and-Block Main Rib Bulkhead Oil Passage—upward route to rightside High Pressure Oil Reservoir, view area(s), with Intake Manifold Base & Port Runner(s)-&-Exhaust Manifold/Headers-and-Valley Radiator Core Cooling Unit System-&-rear Fresh Air Outlet Manifold Pipes—Ghost Phantomed Out, broken line phantom of—Ignition Coil Bracket Mount—top location area.

Figure 5:
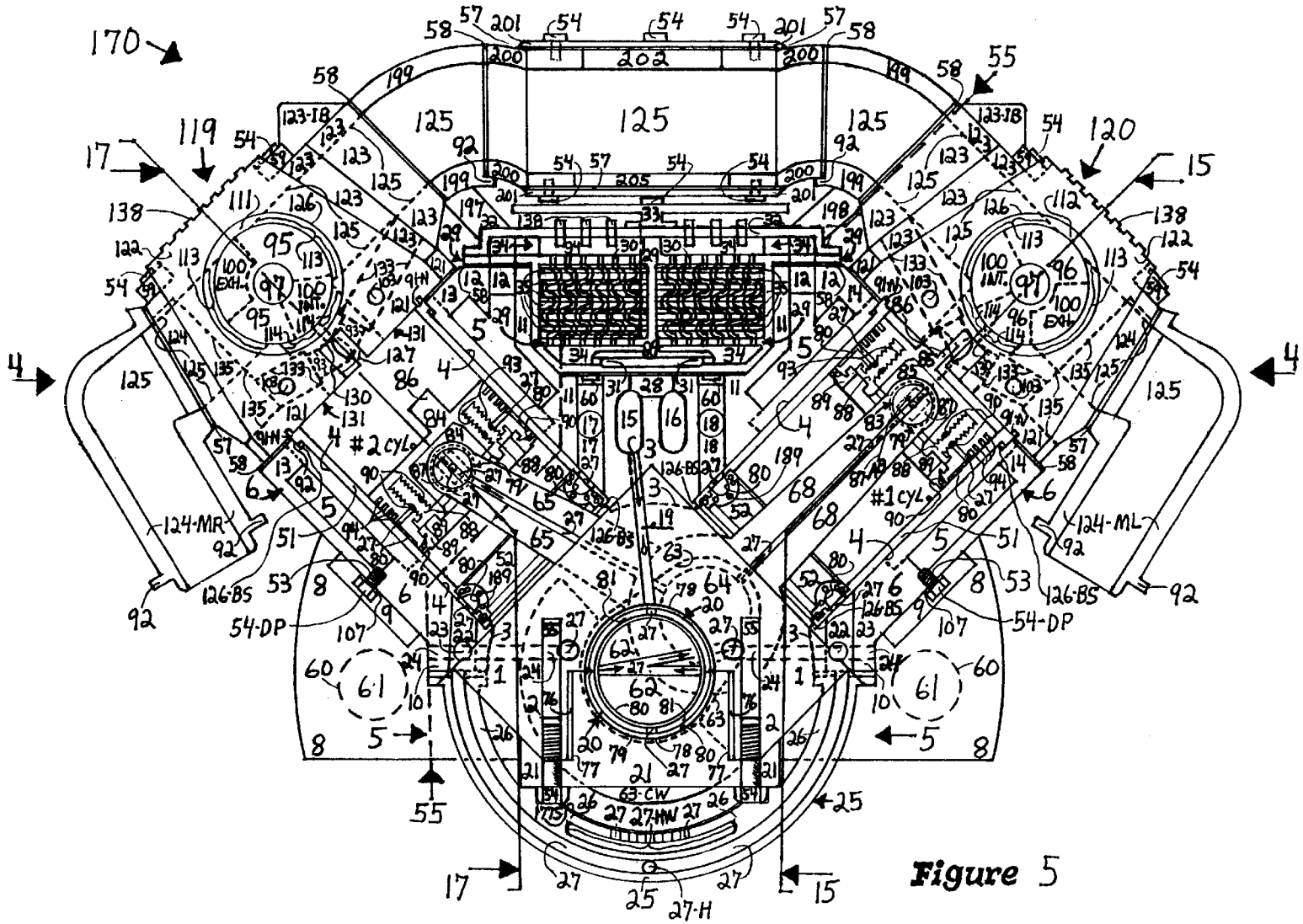
Figure 6:
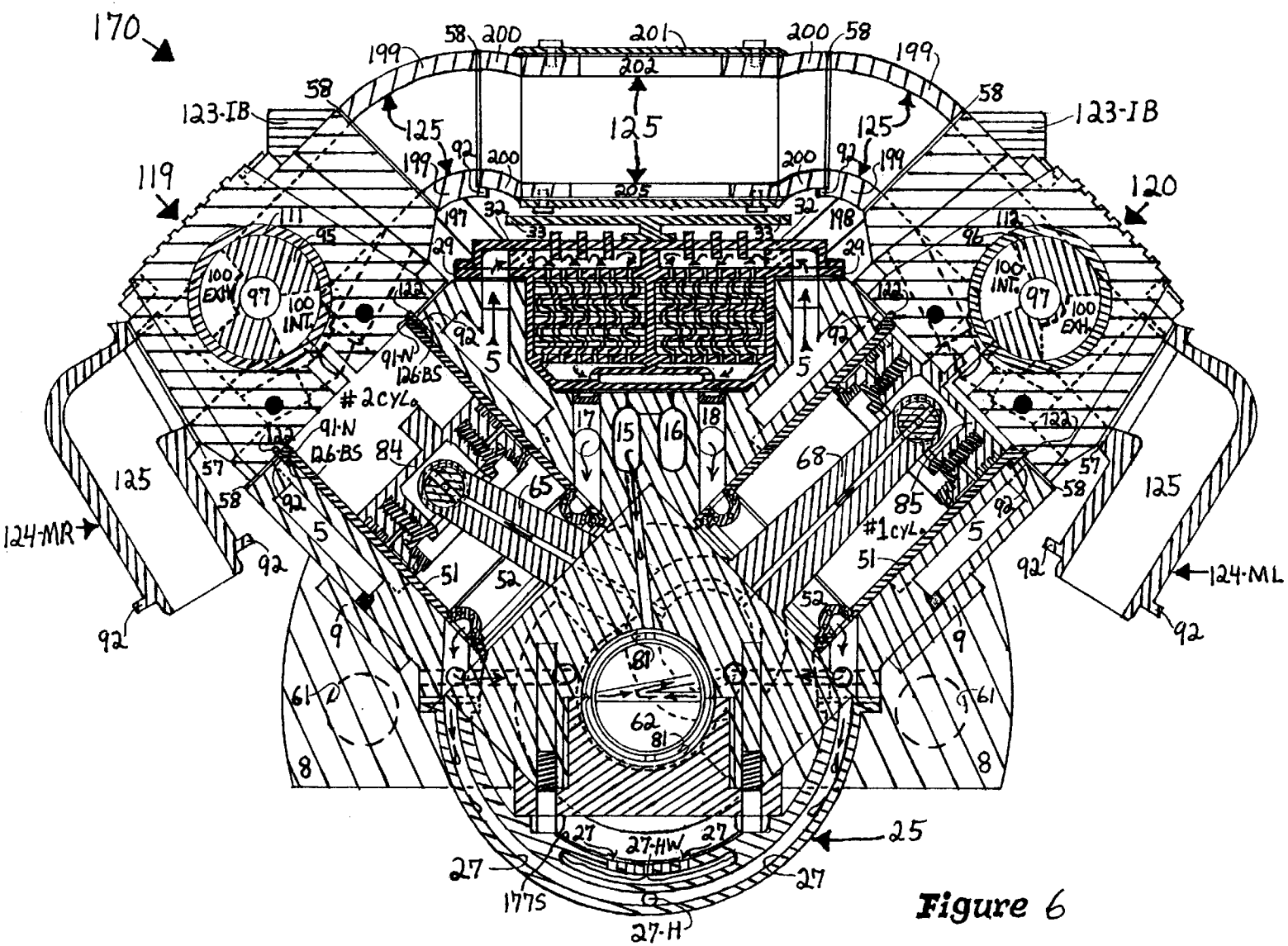
Figure 14:
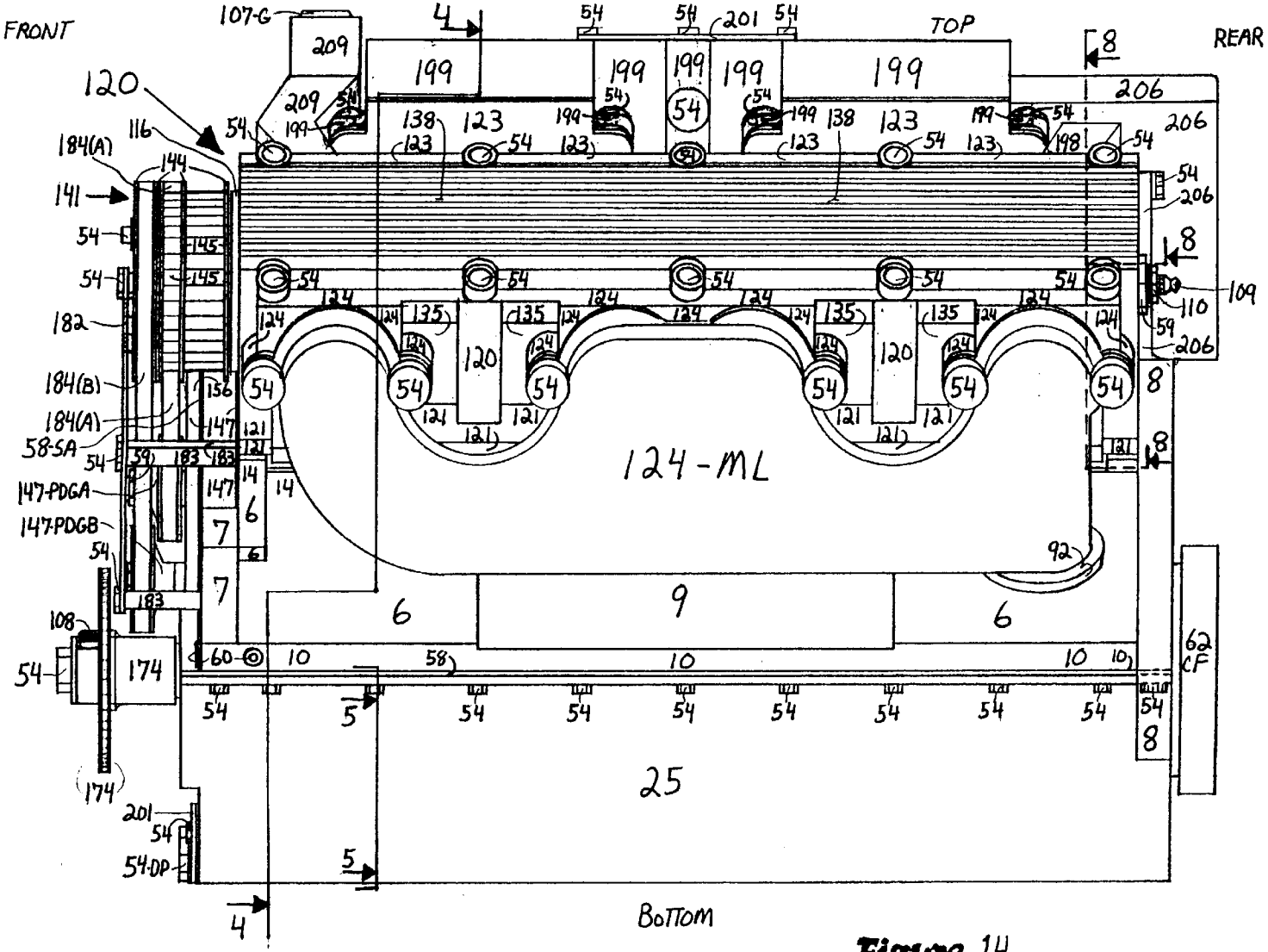

FIG. 5 Depicts the basic main cutaway and broken line Phantom X-ray type view drawing of the V-type Multiple Internal Combustion Cylinder OSIV' Engine System set-up, area 4-4 and 5-5 set-up structure, NON-Cross Hatch Lines, drawn as when to cut this OSIV' Engine in-half Down the vertical plane and Forward along horizontal plane and Down vertical plane and Forward along horizontal plane and Down vertical plane line 4-4 of FIG. 14 to remove front Engine Section, then to cut Upward—Up the vertical plane line 5-5 of FIG. 14—to remove the rest of OIL SCAVENGE PAN front section—to conclude FIG. 5 and FIG. 6 taken view(s).

FIG. 6 Depicts similar view of FIG. 5 with the ADDITION OF Cross-Hatch Structure areas and Arrows to show Direction Flow of—Water-Air To Oil-Oil—Flow Route Passages, FIG. 5 & FIG. 6 Should Be Viewed Closely Together—both being Main Internal Structure OSIV' Engine view(s).

Figure 7:
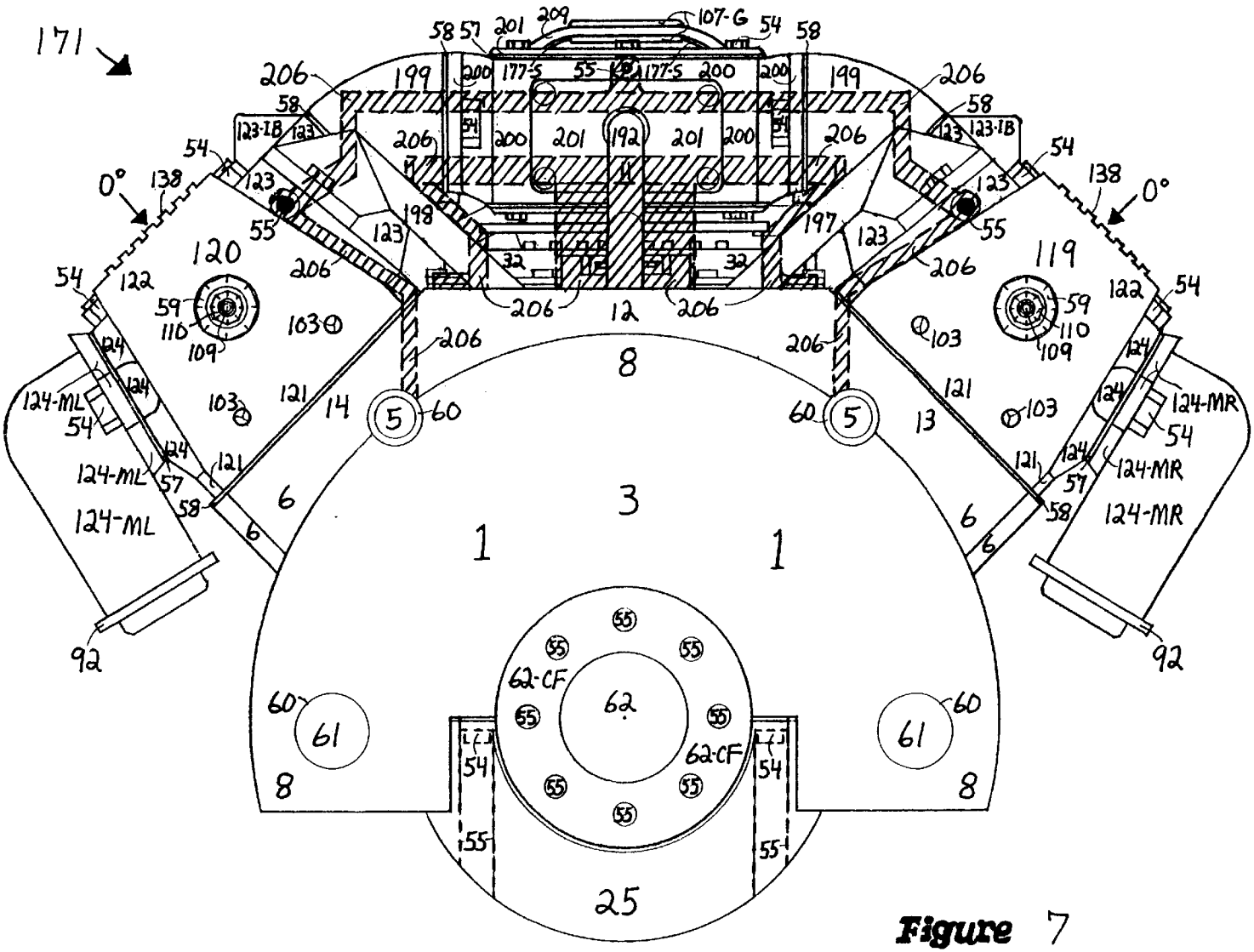

FIG. 7 Depicts basic REAR OSIV' Engine outer area structure view of FIG. 1, a cross-hatch Phantom broken line area(s) of Rear Valley Radiator Cooling Fan Shroud—BASIC SUPPORT FRAME STRUCTURE MINIMUM CLEARANCE LOCATIONS to clear other rear Engine Valley Parts—while sealing off rear Block Valley areas—(so the Three Electric Fans can draw air or produce suction through Block Valley Radiator Core and Upper Block Valley Air-Stream cooling flow areas, from Front to Rear-and-from Front and Side Upper Valley—to Rear).

Figure 8:
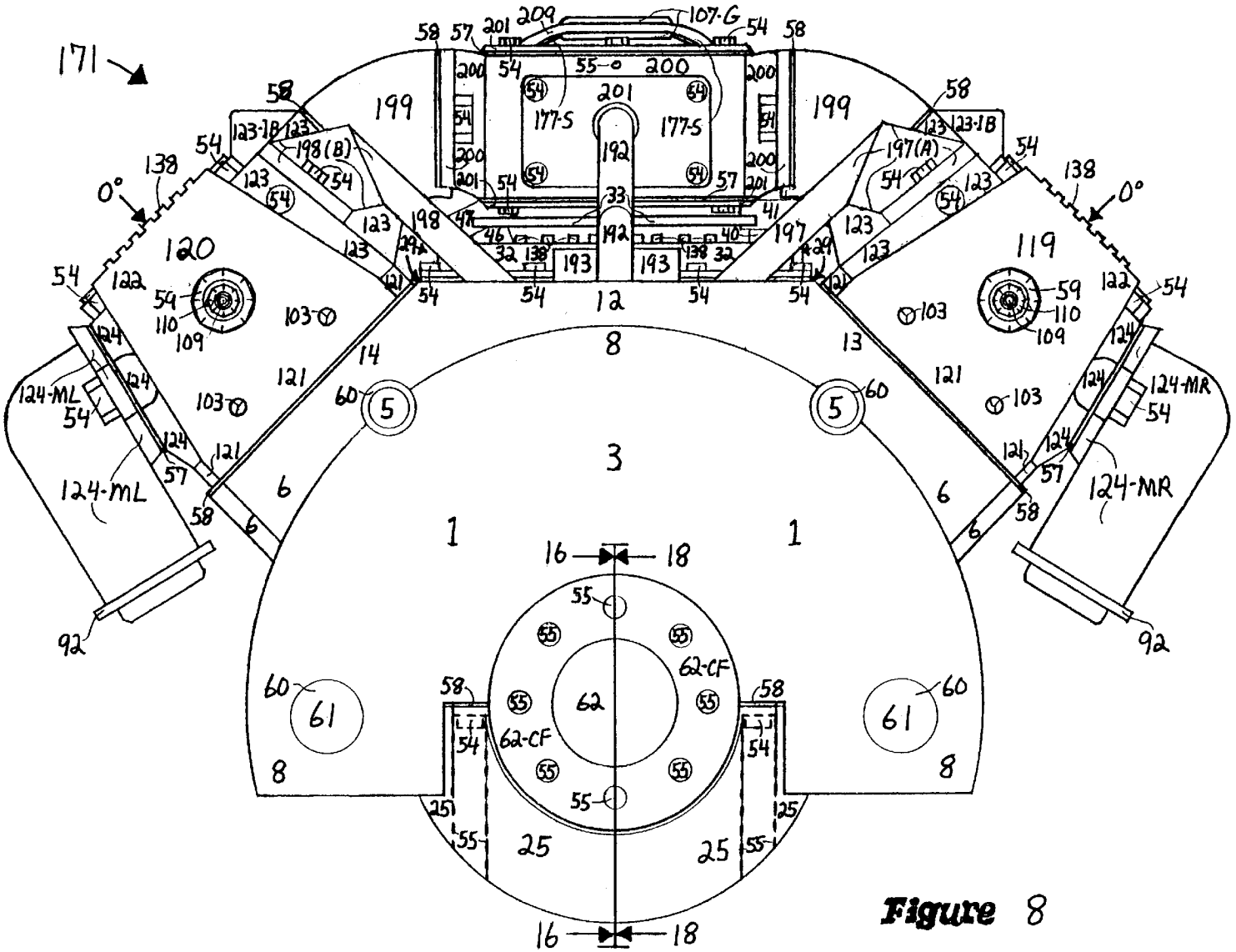

FIG. 8 Depicts similar basic REAR view of FIG. 7 WITHOUT the Cross-hatch Phantom Broken Line area of rear Valley Radiator Cooling Fan Shroud—basic Frame Structure.

Figure 9:
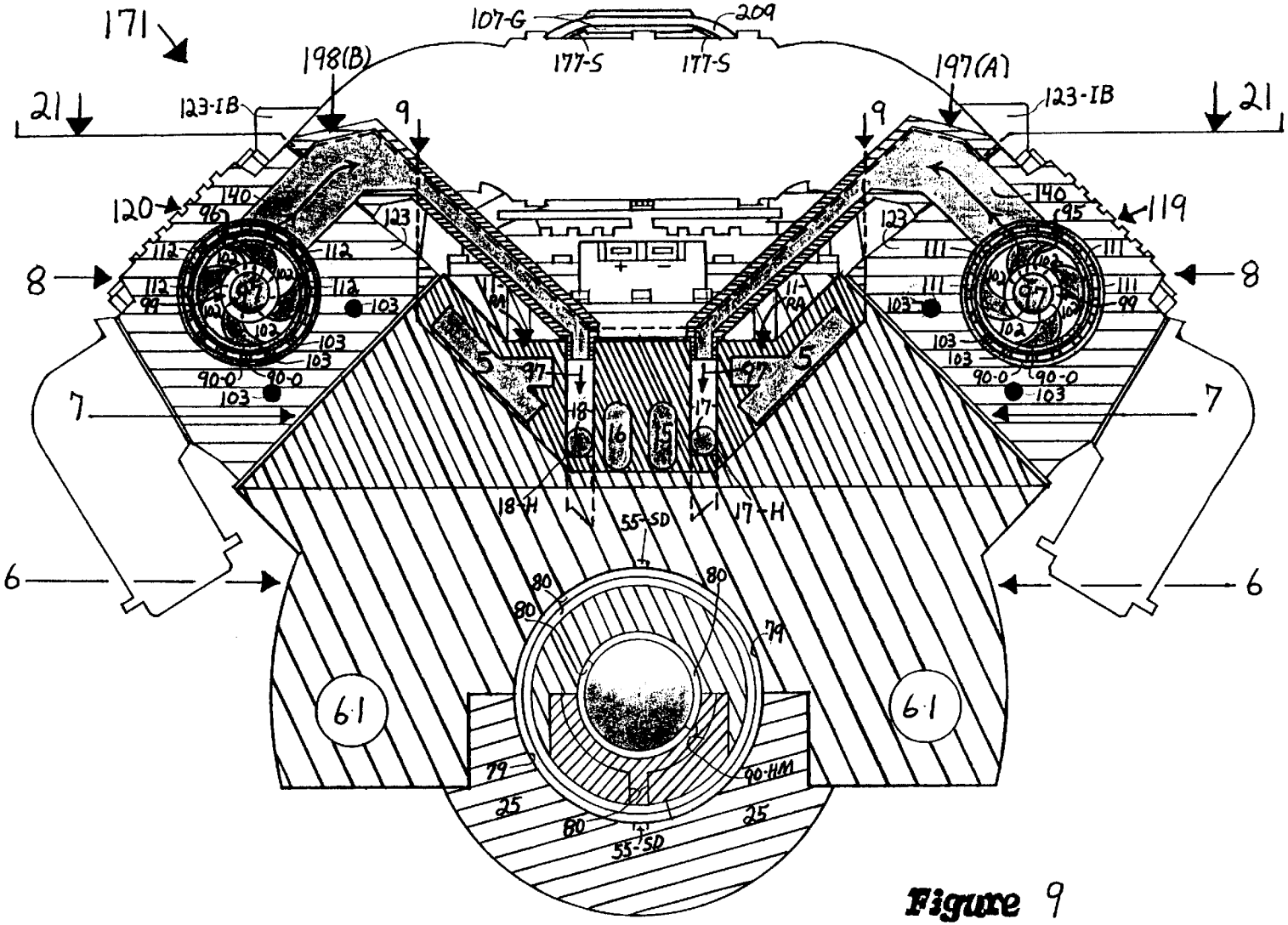
Figure 16:
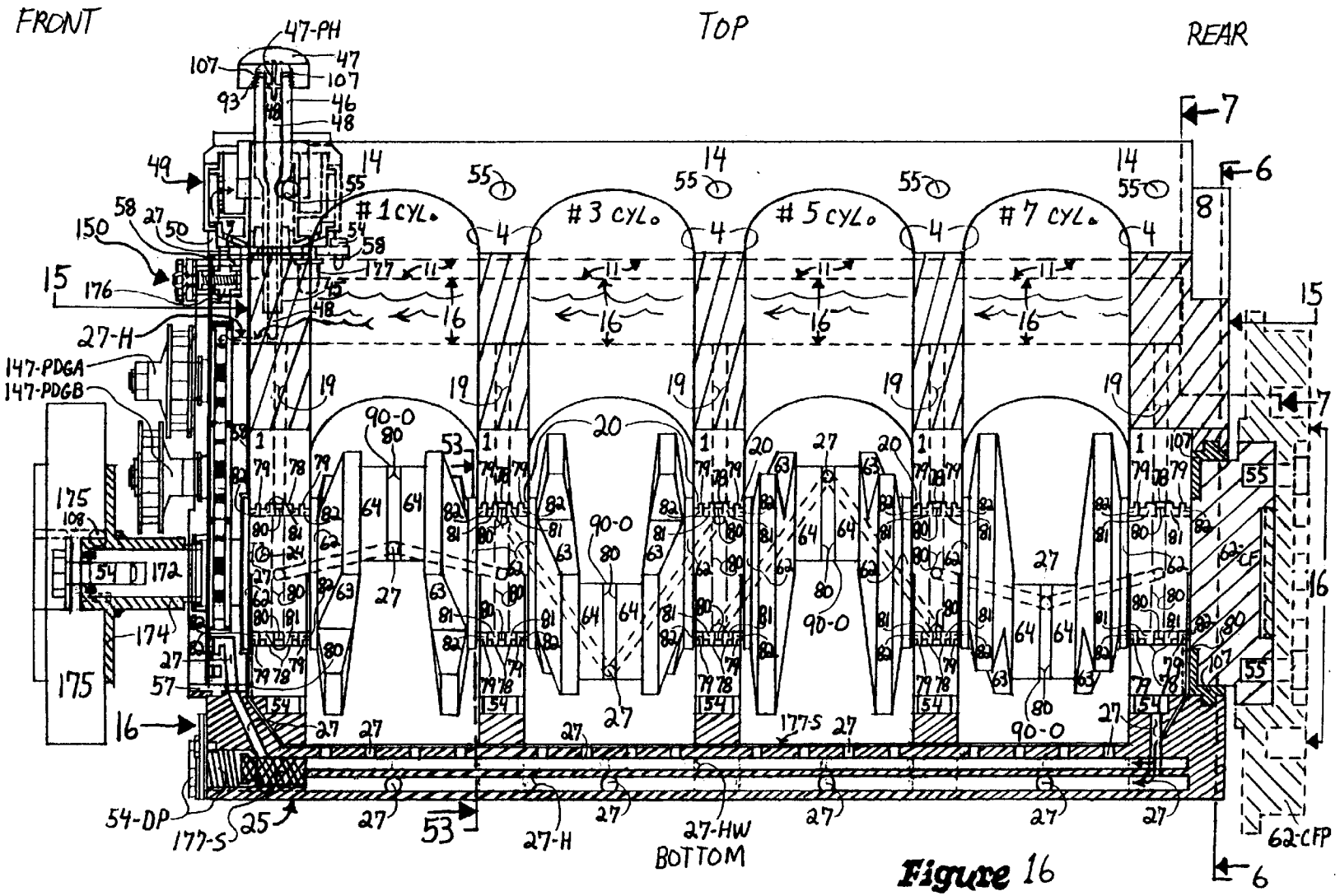
Figure 21:
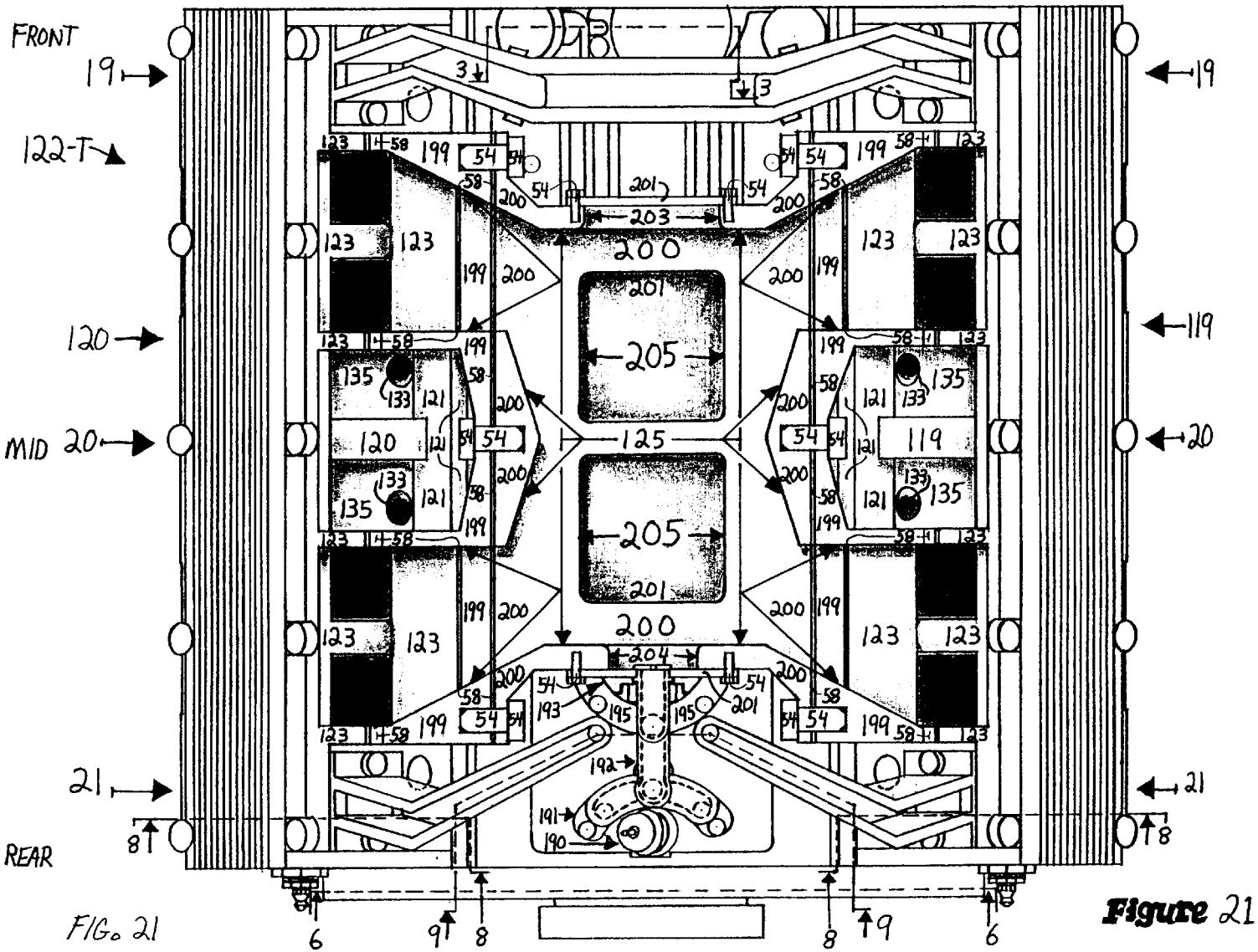

FIG. 9 Depicts similar REAR view area of FIG. 8 WITH cross-hatch line section areas—drawn as to REMOVE rear Engine Material—section area 6-6 Down vertical plane line 6-6 of FIG. 16 & Down vertical plane line 6-6 of FIG. 21,—section area 7-7 Down vertical plane line 7-7 of FIG. 16 & REARWARD along horizontal plane line 7-7 of FIG. 16,—section area 8-8 Down vertical plane line and Rearward along horizontal plane 8-8 of FIG. 14 & 8-8 of FIG. 21,—section area 9-9 Vertical—Diagonal—Horizontal—Plane cutout—Block Valley section Rear area—along line 9-9 of FIG. 9 and 9-9 of FIG. 21, further Depiction WITHOUT Crankshaft—to show Free-Spin Bearing & Seal Location and Block-to-Oil Scavenge Pan—One Piece Neoprene Seal, the two Direction Arrows shown within basic structure area of Fresh-Air Outlet(s) passage route to Air-Oil Passage (s), from Valveshaft's Center Air Internal Passage—through it's Outlet Turbine Fan Blower and Cylinderhead—Cylinderhead Cylinder Bearing Sleeve Air Outlet Holes—through Outlet Manifold Pipes to Valley Block Air-Oil Passage hole bore(s).

Figure 10:
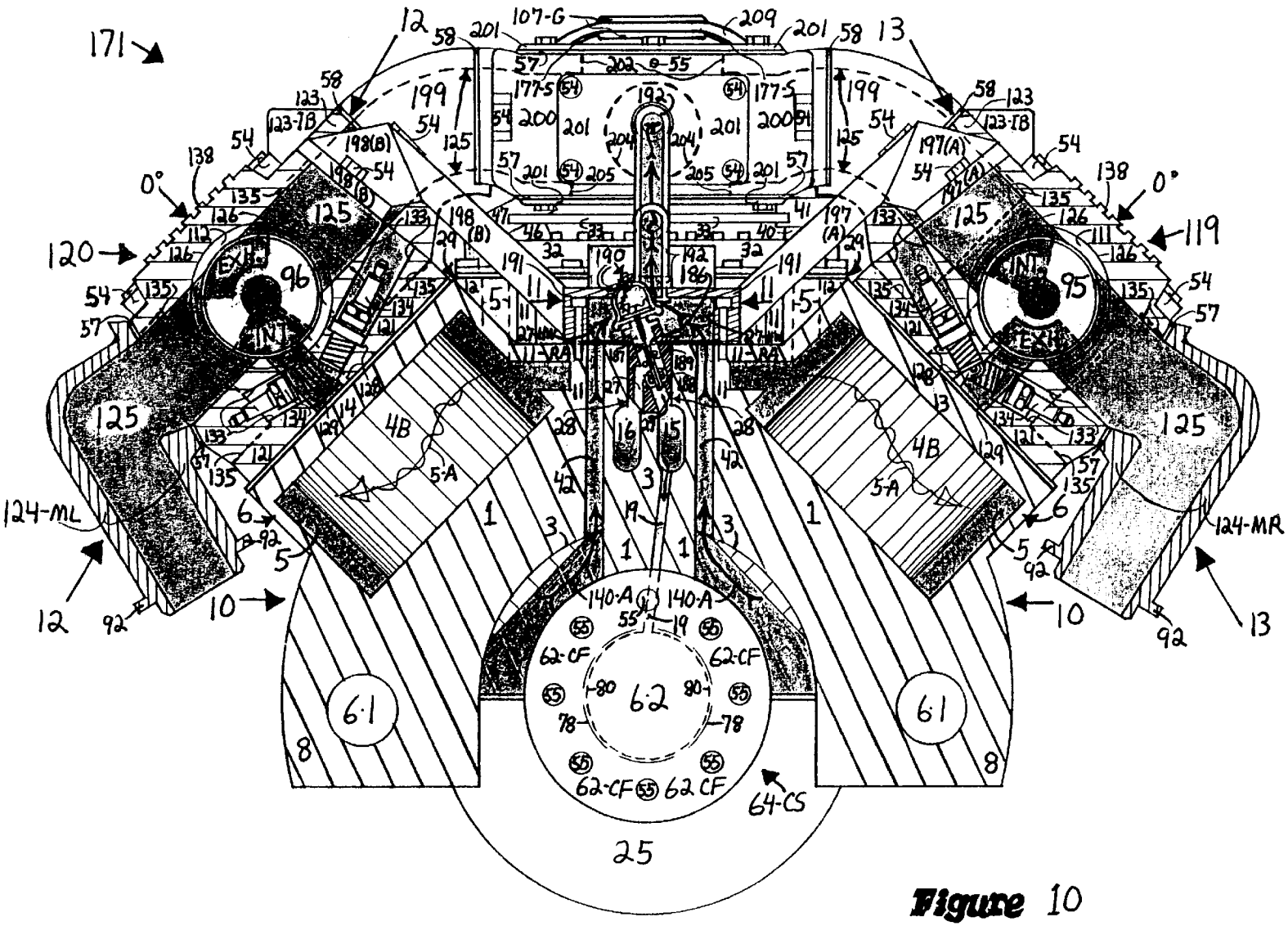
Figure 23:
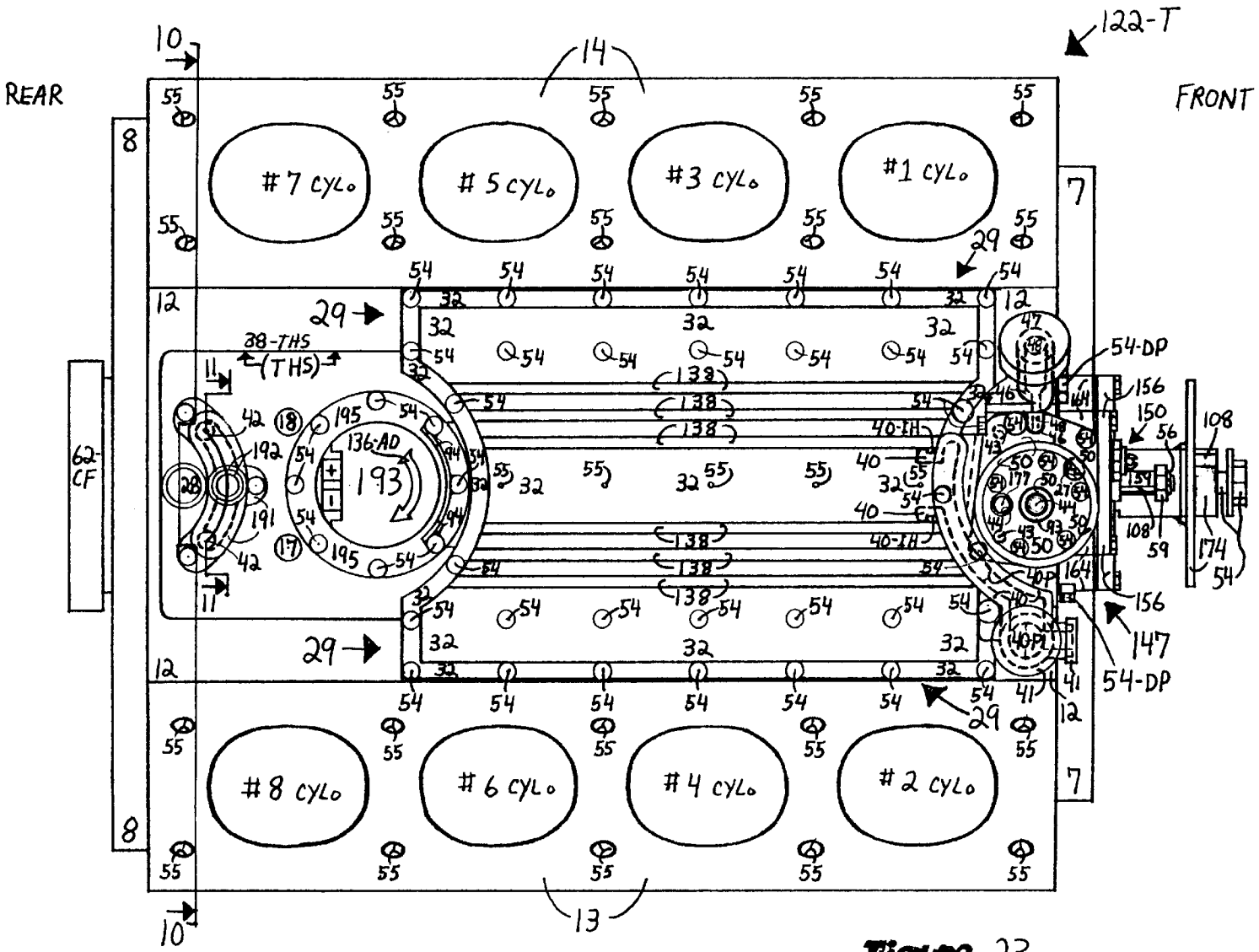
Figure 113:
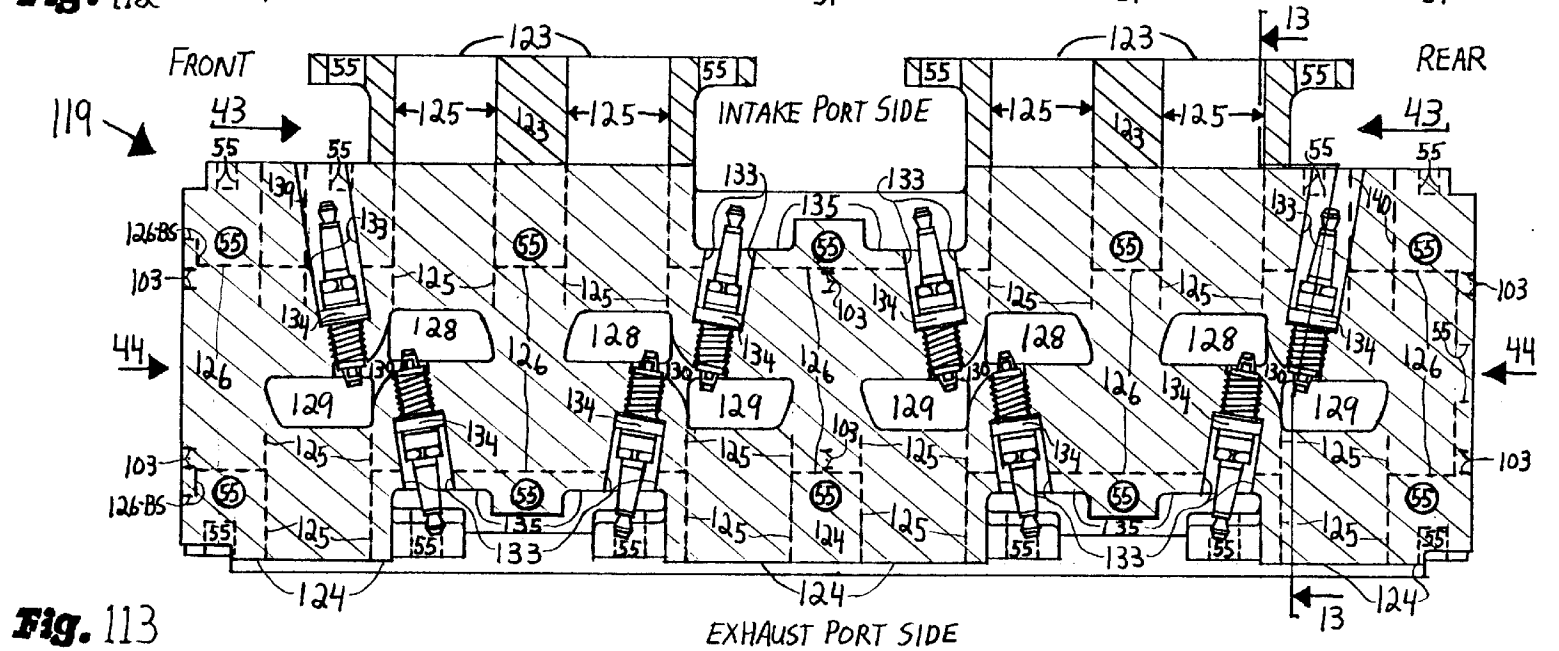
Figure 125:
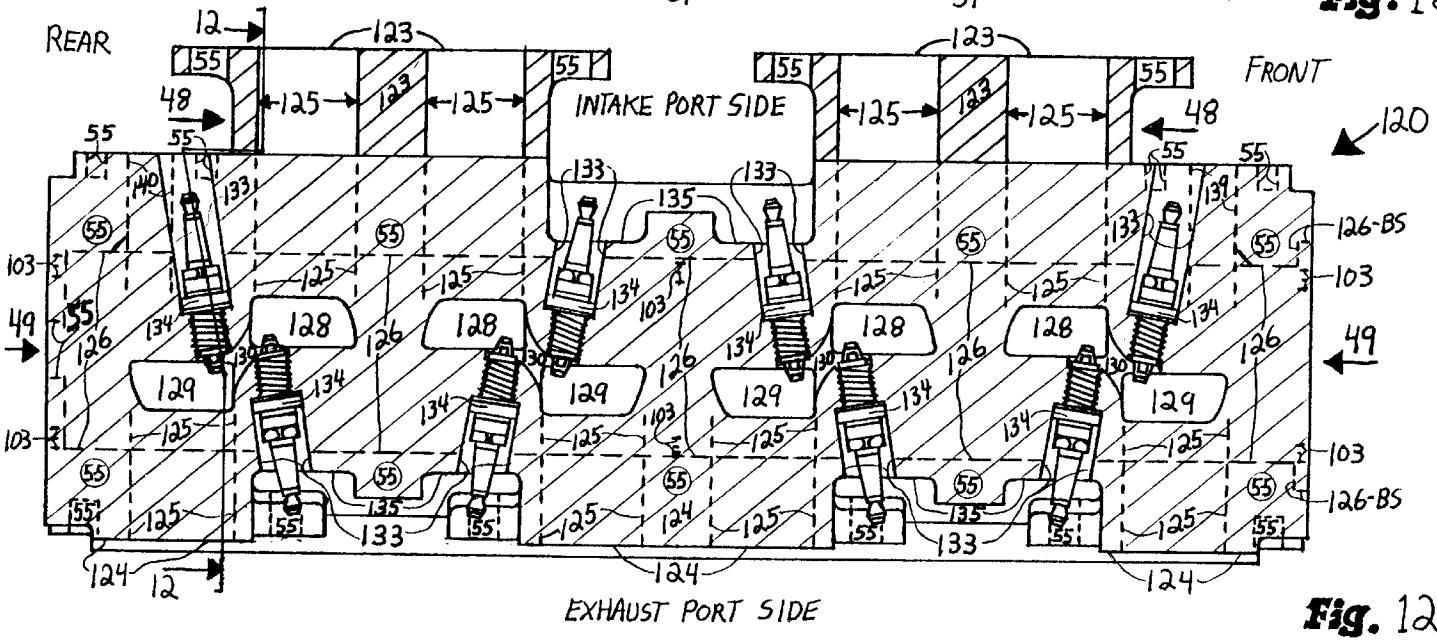

FIG. 10 Depicts similar REAR view area of FIG. 8 WITH Cross-Hatch line section area—drawn as to REMOVE Rear Engine Material—section 10-10 Down vertical plane line 10-10 of FIG. 23,—section area 11-11 Down vertical plane line 11-11 of FIG. 23, section area 12-12 Down or Up vertical plane line 12-12 of FIG. 125,—section area 13-13 Down or Up vertical plane line 13-13 of FIG. 113, to Expose: Oil Pressure Regulator By-Pass Valve Sending Unit; Crankcase Ventilation Passage Flow Route—Cap & Tube; Block Cylinder Barrel(s) & Water Jacket(s); Dual Spark Plug—Combustion Chamber location set-up & angle; Valveshaft (A) & (B)—Valve Wedge Cutout Pocket area(s)-and-Cylinderhead Bearing Sleeve(s); typical Exhaust Manifold/Header structure & Outlet Passage area(s); other various broken line phantom structures—and Oil, Water, Intake Manifold Base & Support Runner(s)—Internal Air-type passages.

Figure 11:
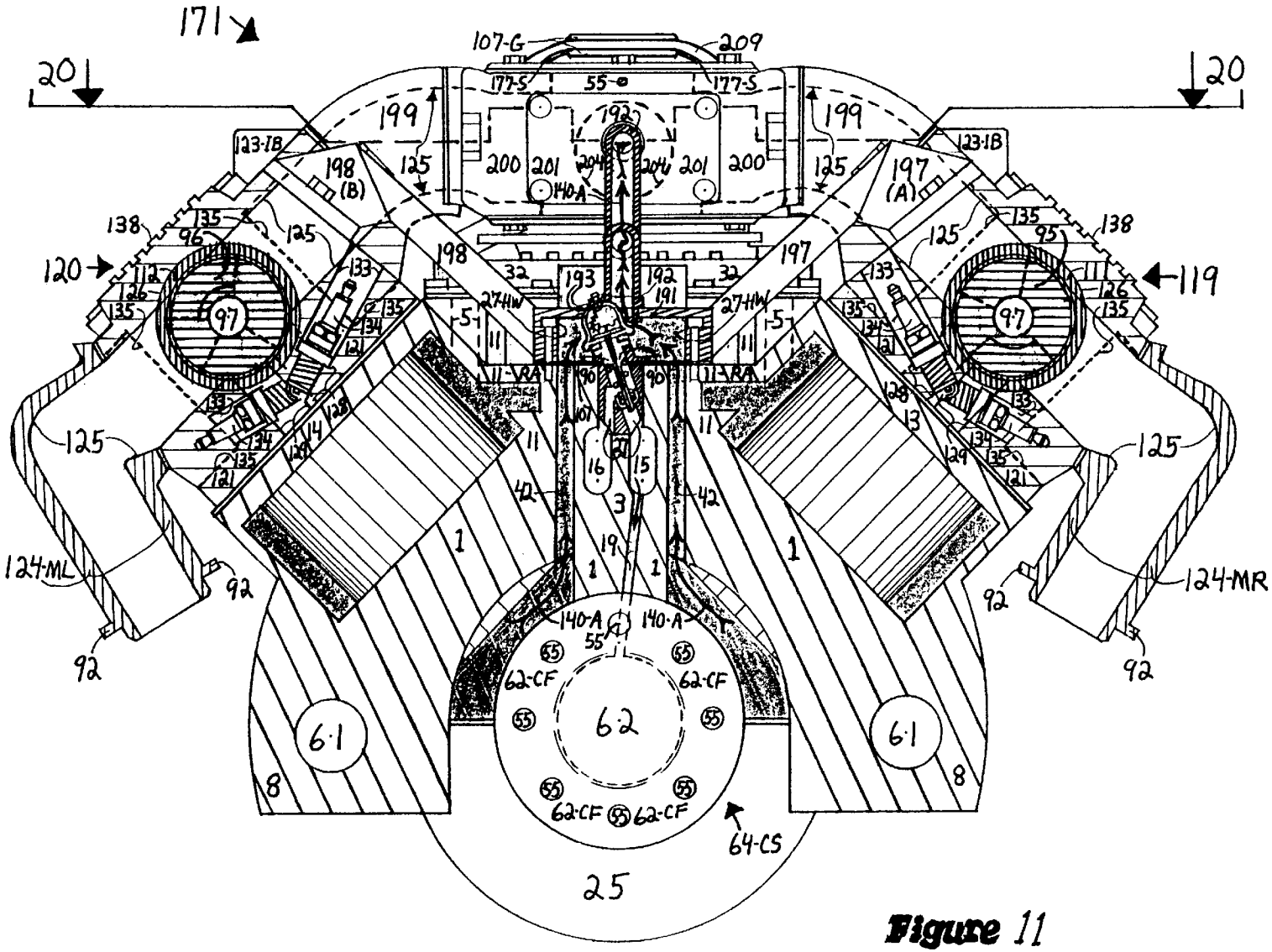

FIG. 11 Depicts same similar REAR view area of FIG. 10 with the ADDITION of Cross-Hatch lines to show structure of the Crankcase Ventilation Cap Tube, Valveshaft (A) and (B), Cylinderhead Bearing Sleeve(s)—basic surrounding fit Assembly.

Figure 12:
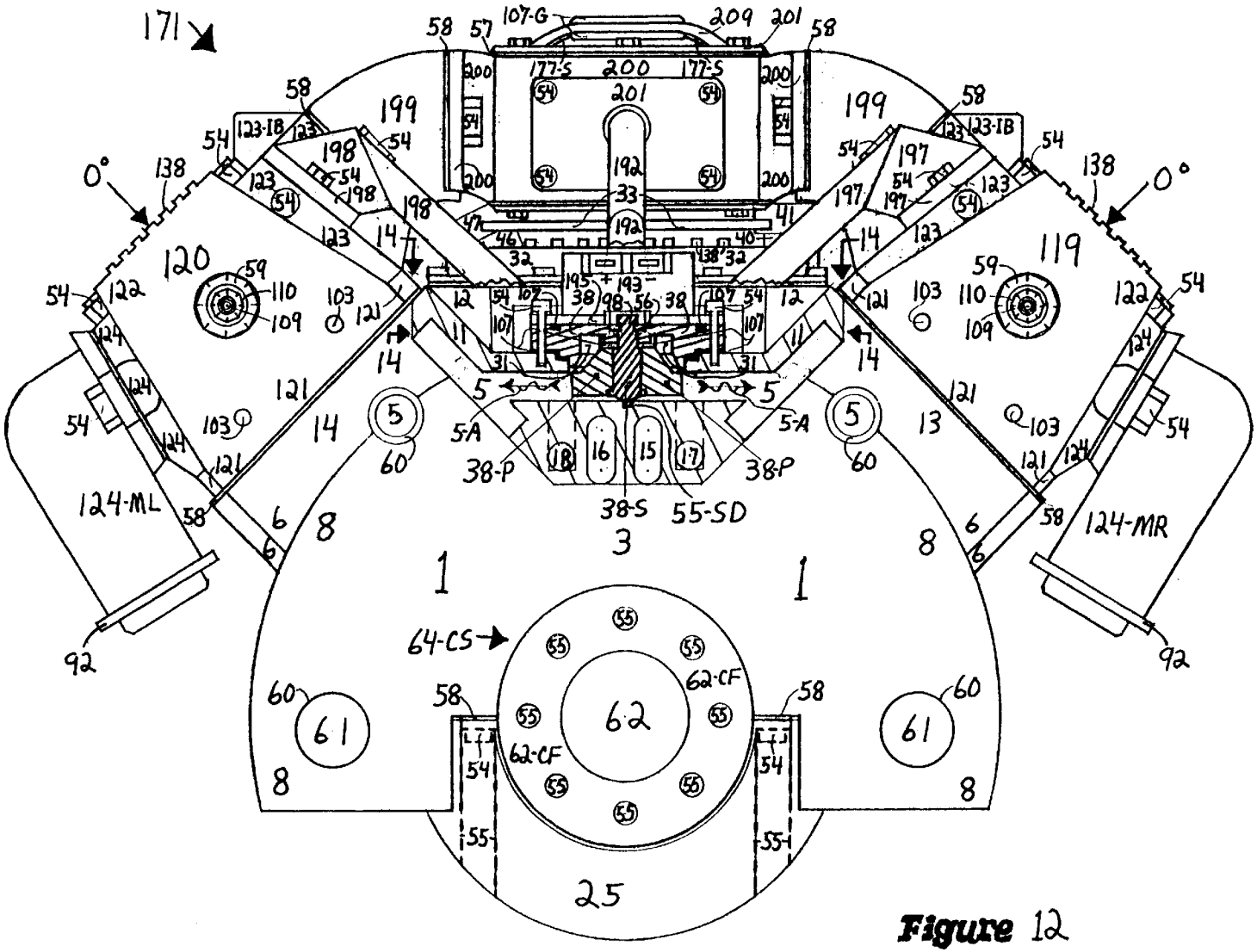
Figure 24:
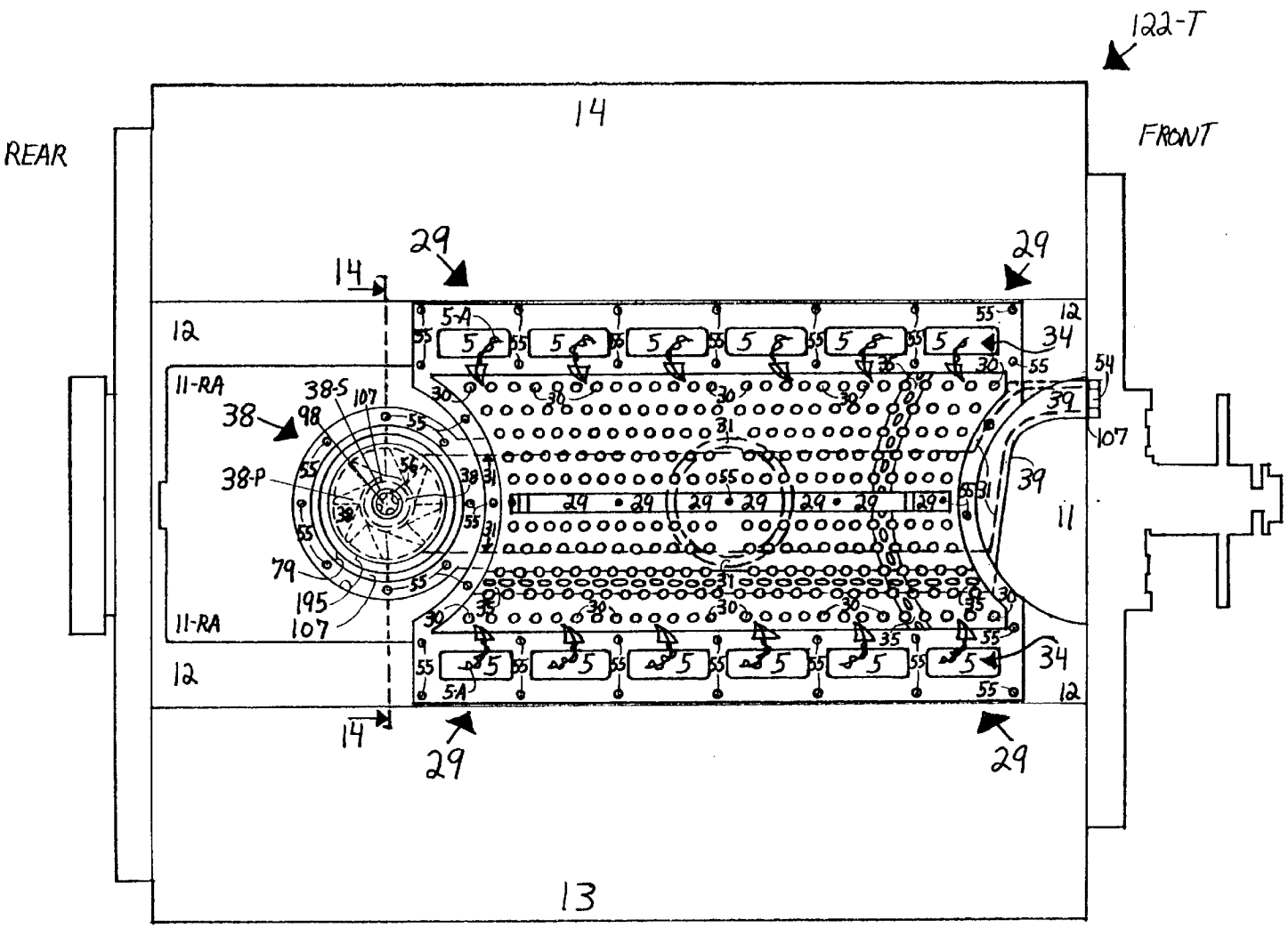
Figure 25:
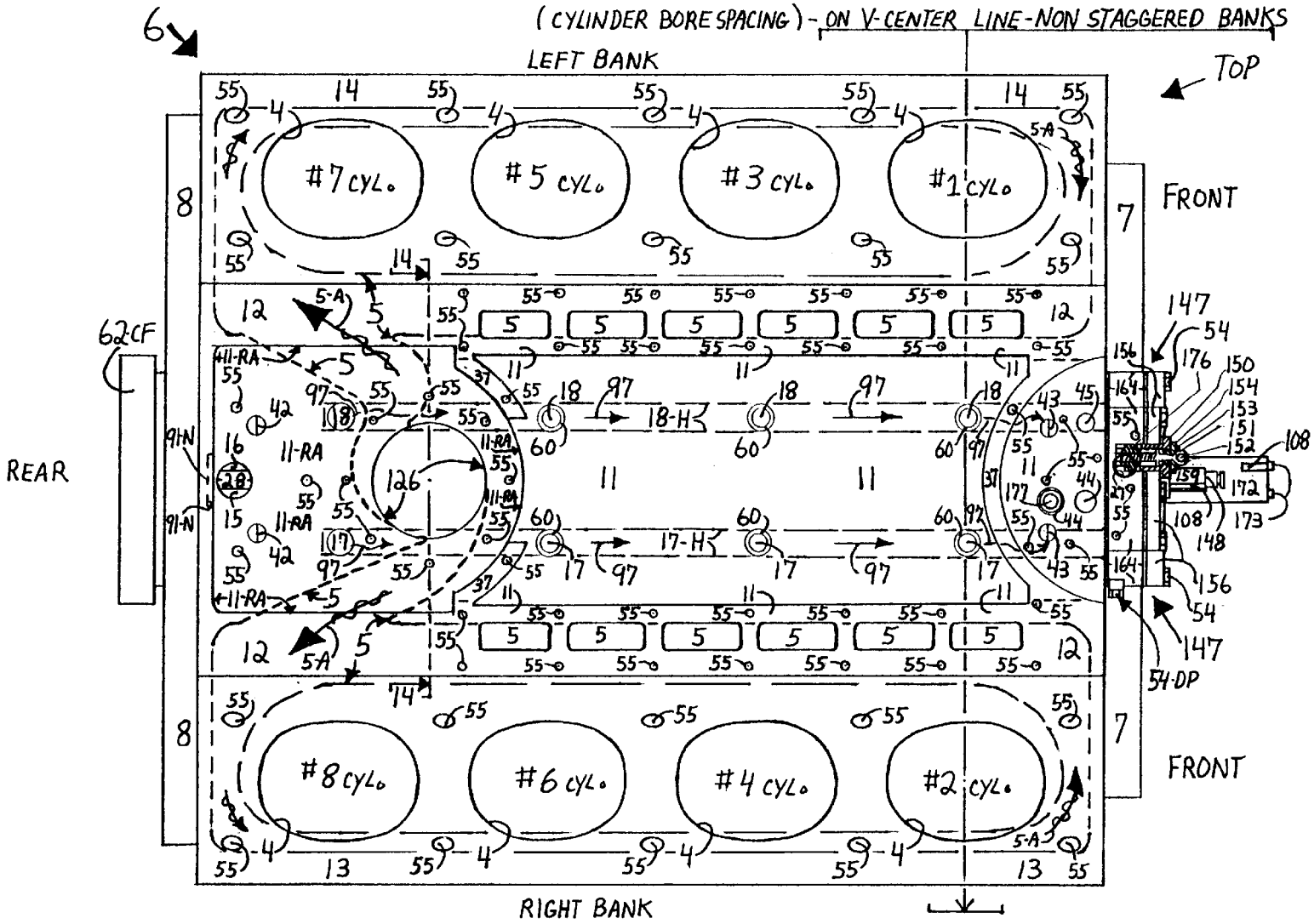

FIG. 12 Depicts same similar REAR view area of FIG. 8 WITH Cross-hatch line section areas—drawn as to REMOVE Rear Valley Water Propeller Pump Base Housing Engine Block Material—section area 14-14 vertical—diagonal—horizontal—plane cutout Valley section Rear area—along lines 14-14 of FIG. 12 and 14-14 of FIG. 24 and 14-14 of FIG. 25, for such exposure view. Arrows of direction—of Water Flow to Cylinder Block Barrel(s) Water Jackets, Partial Broken Line Phantom of Air-Oil Passag areas.

Figure 13:
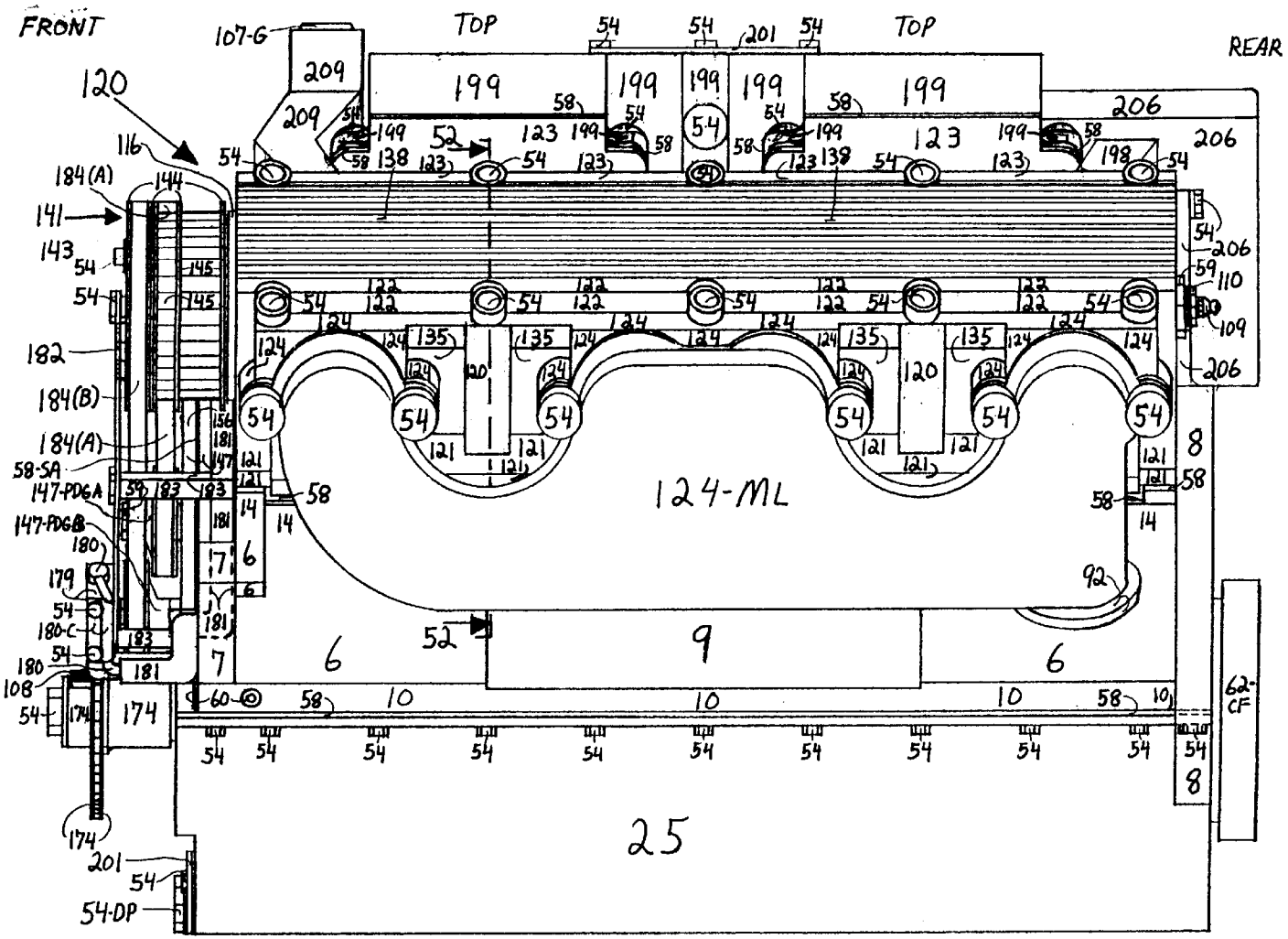

FIG. 13 Depicts basic LEFT SIDE ENGINE BANK and Exhaust Manifold/Header—Oil Scavenge Pan—Crank Trigger Ignition Pick-up & Nose Wheel Hub, Belt Guard—Flex Timing Drive Belt Pulley Gear set-up for V-type Multiple Piston Cylinder Engine and Inline Four Piston Cylinder Engine—of the OSIV' Engine System outer structure, Front to Rear—Top to Bottom—SIDE View, broken line Phantom view, Bolt(s), Ignition Wire Protector Tube area. Valveshaft (B) and Cylinderhead Side—LEFT Bank of Engine V-eight type presented.

FIG. 14 Depicts similar LEFT BANK view area of FIG. 13 WITHOUT: Crank Trigger Ignition Pick-up, Wire & Protector Tube.

Figure 15:
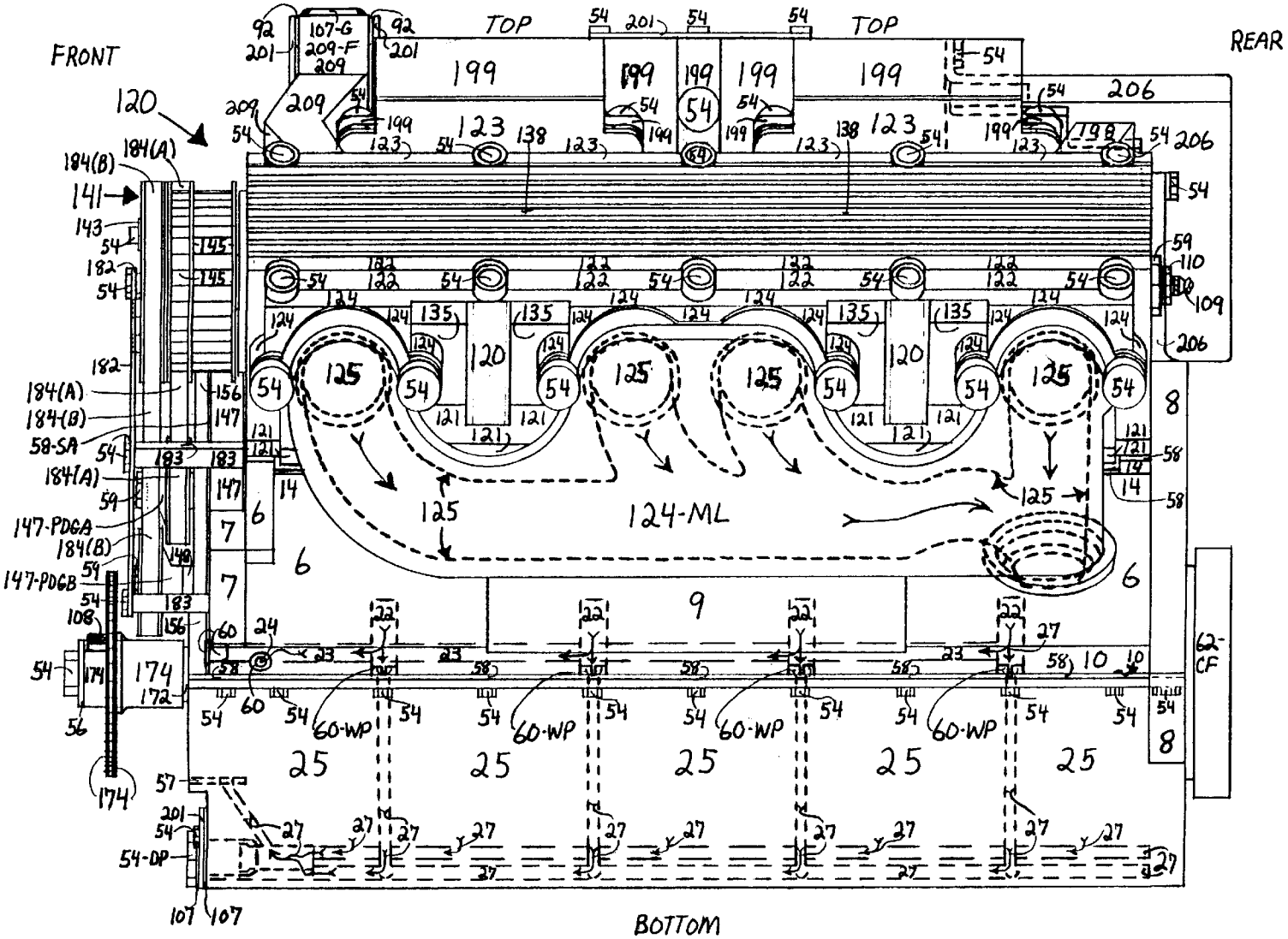

FIG. 15 Depicts similar LEFT BANK view area of FIG. 14 with the ADDITION OF: Broken Line Phantom Areas Of; Electric Fan Shroud (top rear), Exhaust Manifold/Header—Basic Structure Internal Flow Outlet Route—with Arrows—(middle front to rear), Oil-Air Internal Flow Route to Front Engine area—(Lower Block-&-Oil Scavenge Pan—Front to rear), view—with Arrows Of Direction—of OIL and OIL-AIR FLOW, in the passages.

FIG. 16 Depicts LEFT BANK Block Cylinder—Cutaway Material View to expose Five Main Rib Block Bulkhead Structures—and basic Crankshaft and Oil Scavenge Pan bottom structure—setup, for OSIV' Engine & System V-type & V-eight and Inline-type & Inline Four—Piston Cylinder—type Engine—WITH Cross-hatch line section area(s)—drawn as to REMOVE; Intake Manifold items—Cylinderhead items—Valley Radiator Core & Water Pump & Fan Shroud items—Crankshaft/Rod & Piston Reciprocating Assembly—Belt Guard Shield & Flex Drive Belts, and Engine Block Material—section area 15-15 Diagonal plane—view, Cutaway Section Side View area—along lines 15-15 of FIG. 5,—section area 16-16 Vertical Plane view—along lines 16-16 of FIG. 2 and 16-16 of FIG. 8. Further Depiction of Cross-hatch and X-ray type Phantom Broken line areas—Oil Reservoir Oil Wave Flow Arrows towards Front Engine area Outlet (small) hole, Oil Filter & Housing Plate, Oil Filler Tube—Dipstick Cap, Main Rib Block Bulkhead Oil Passage to Crank Main Journal Bores, Crankshaft Internal Cross Drilled Oil Passage, Basic Crank Fly Wheel or Flex Plate (at REAR), Crank Nose Ignition Trigger Wheel Hub (Front & Cross-hatch area)—with Fluid Balancer or Damper—type(s)—and Key-Groove area.

Figure 17:
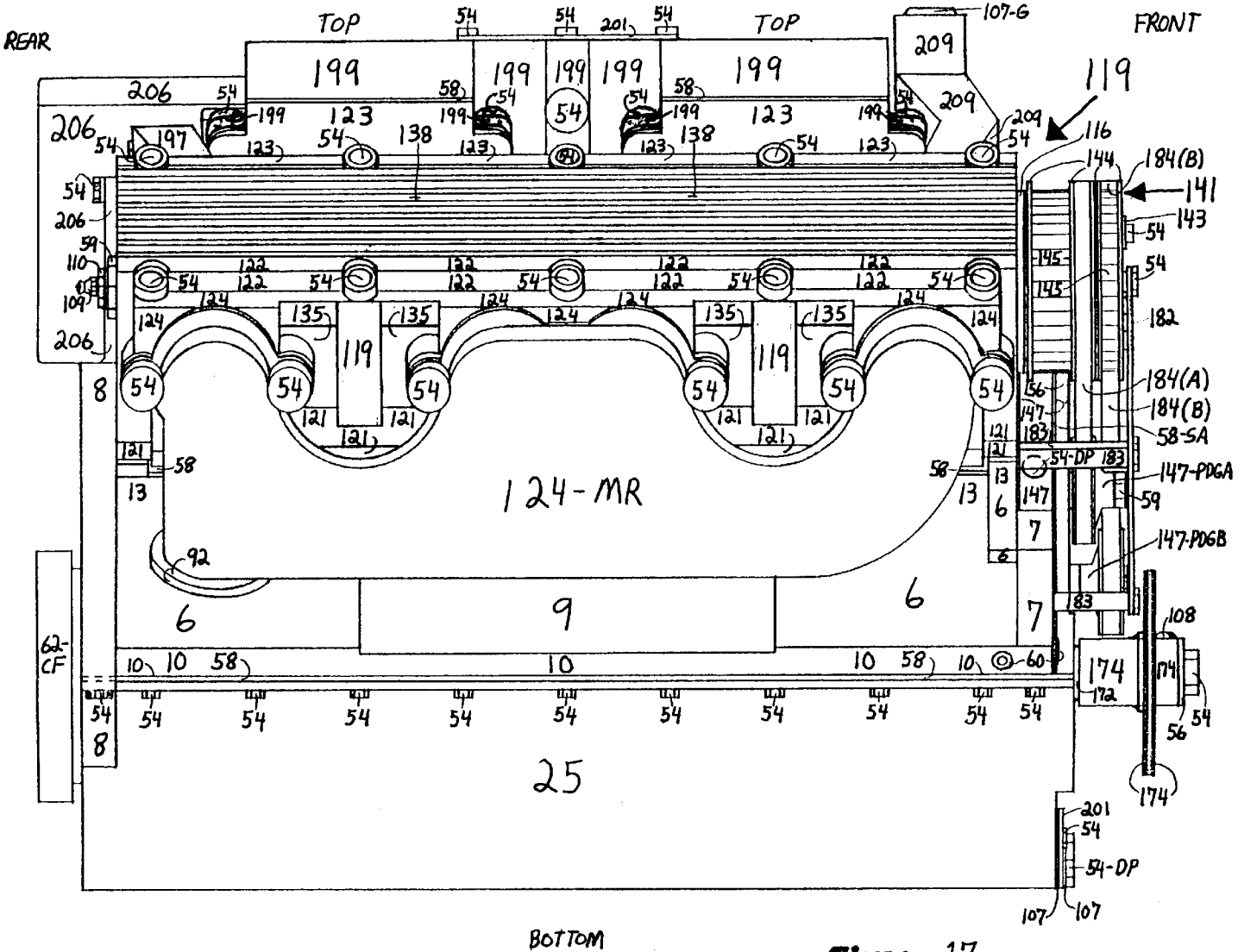

FIG. 17 Depicts basic RIGHT Side Engine Bank and Exhaust Manifold/Header—Oil Scavenge Pan—Crank Nose Ignition Trigger Wheel Hub—Belt Guard(s)—Flex Timing Drive Belt Pulley Gear setup for V-type Multiple Piston Cylinder Engine and Inline Four Piston Cylinder Engine—of the OSIV' Engine System outer structure,—Rear to Front—Top to Bottom—SIDE View, partial Phantom broken line area of Rear Bolt Head & Oil Scavenge Pan Rail Lip—and (RG.TDOP.SUCH.) Oil Reservoir Drain Plug Bolt Head, view for Valveshaft (A) and Cylinderhead Side—RIGHT bank of Engine V-eight type presented.

Figure 18:
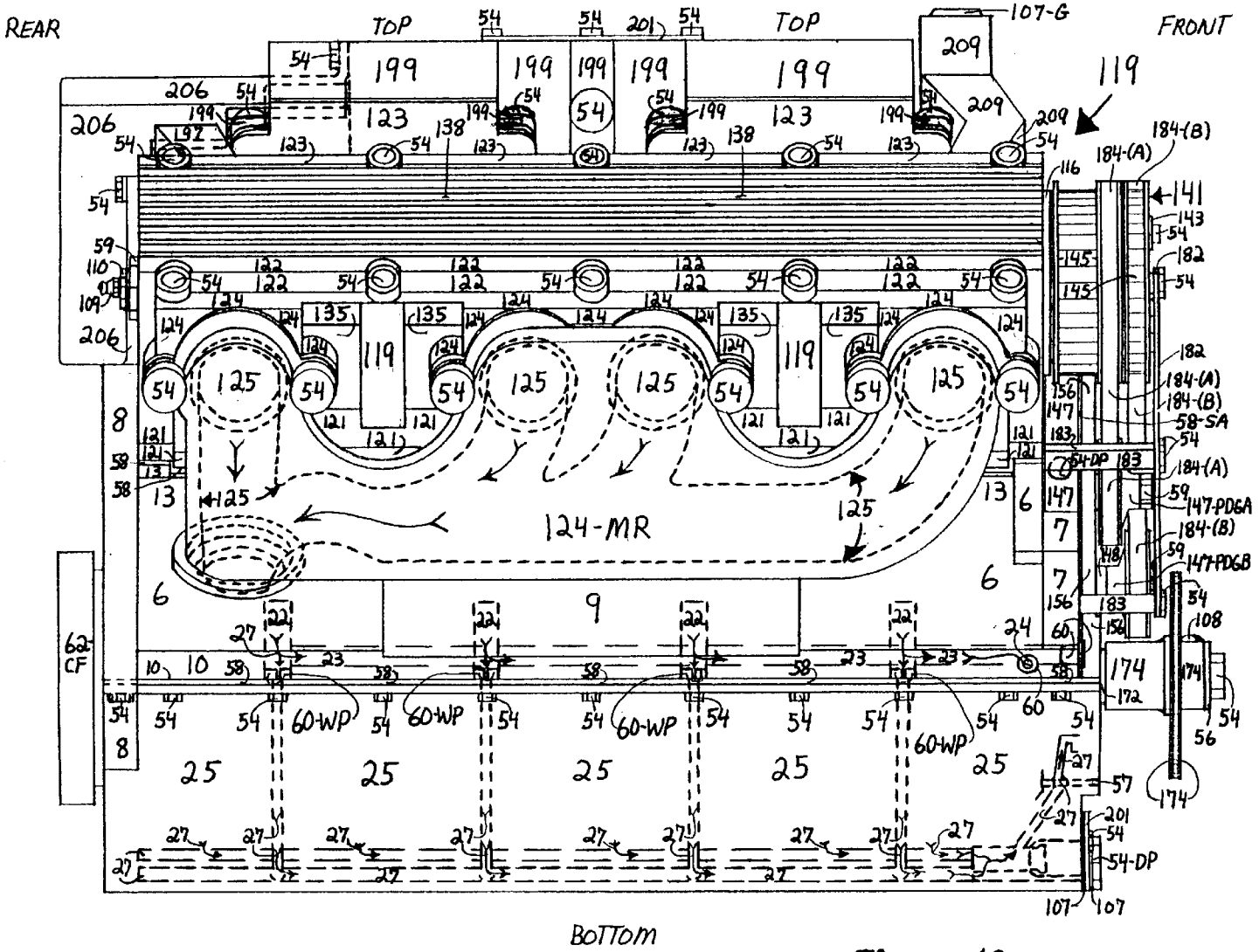

FIG. 18 Depicts same similar RIGHT SIDE ENGINE BANK—side view area of the FIG. 17—with the ADDITION OF: Broken Line Phantom Areas Of; Electric Fan Shroud (top rear), Exhaust Manifold/Header Basic Structure Internal Flow Outlet Route—with Arrows—(middle rear to front), Oil-Air Internal Flow Route to Front Engine area—(Lower Block & Oil Scavenge Pan—Rear to Front), view with Arrows of Direction of OIL and OIL-AIR FLOW in the passages.

Figure 19:
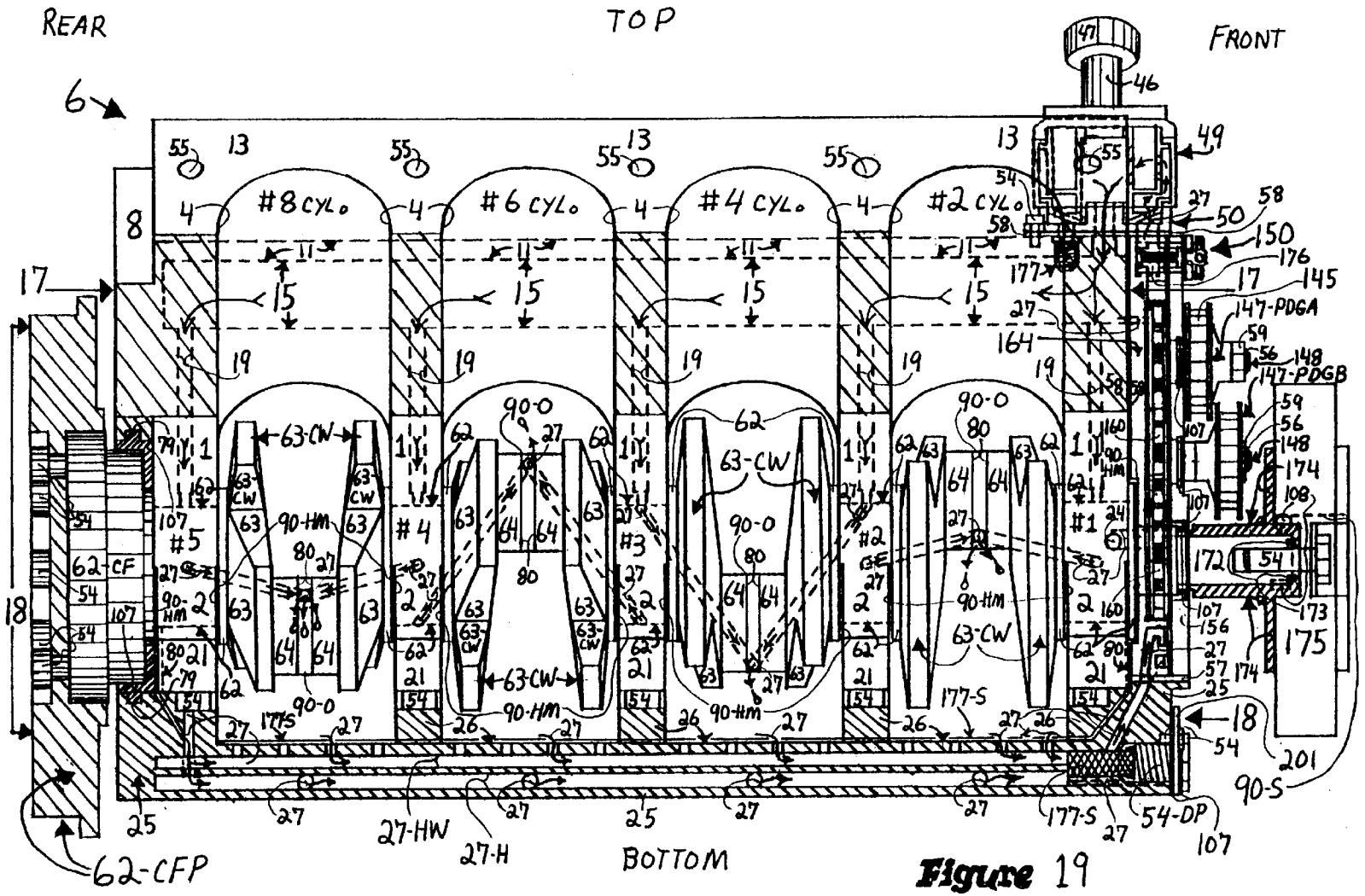

FIG. 19 Depicts RIGHT BANK Block Cylinder—Cutaway Material View to expose Internal Block Main Rib Structure Bulkhead—and Crankshaft—Oil Scavenge Pan bottom structure—Flywheel to Crankshaft Flange mate up structure—Crankshaft Nose Ignition Trigger mate up—structure. This view is the reverse—similar to FIG. 16. Cross-hatch section & Phantom Broken Line Areas & Arrows complete view.—Section area 17-17 Diagonal—Plane view, Cutaway Section SIDE VIEW area—along lines 17-17 of FIG. 5,—Section Area 18-18 Vertical Plane View—along lines 18-18 of FIG. 2 and 18-18 of FIG. 8. Further Depiction of this SIDE—High Oil Pressure & Volume Oil Reservoir—Broken Line Phantom View and Arrows of Direction of Oil Flow to Block Main Rib Structure Bulkhead—Internal Oil Passages to Crank Main Journal Bore areas.

Figure 20:
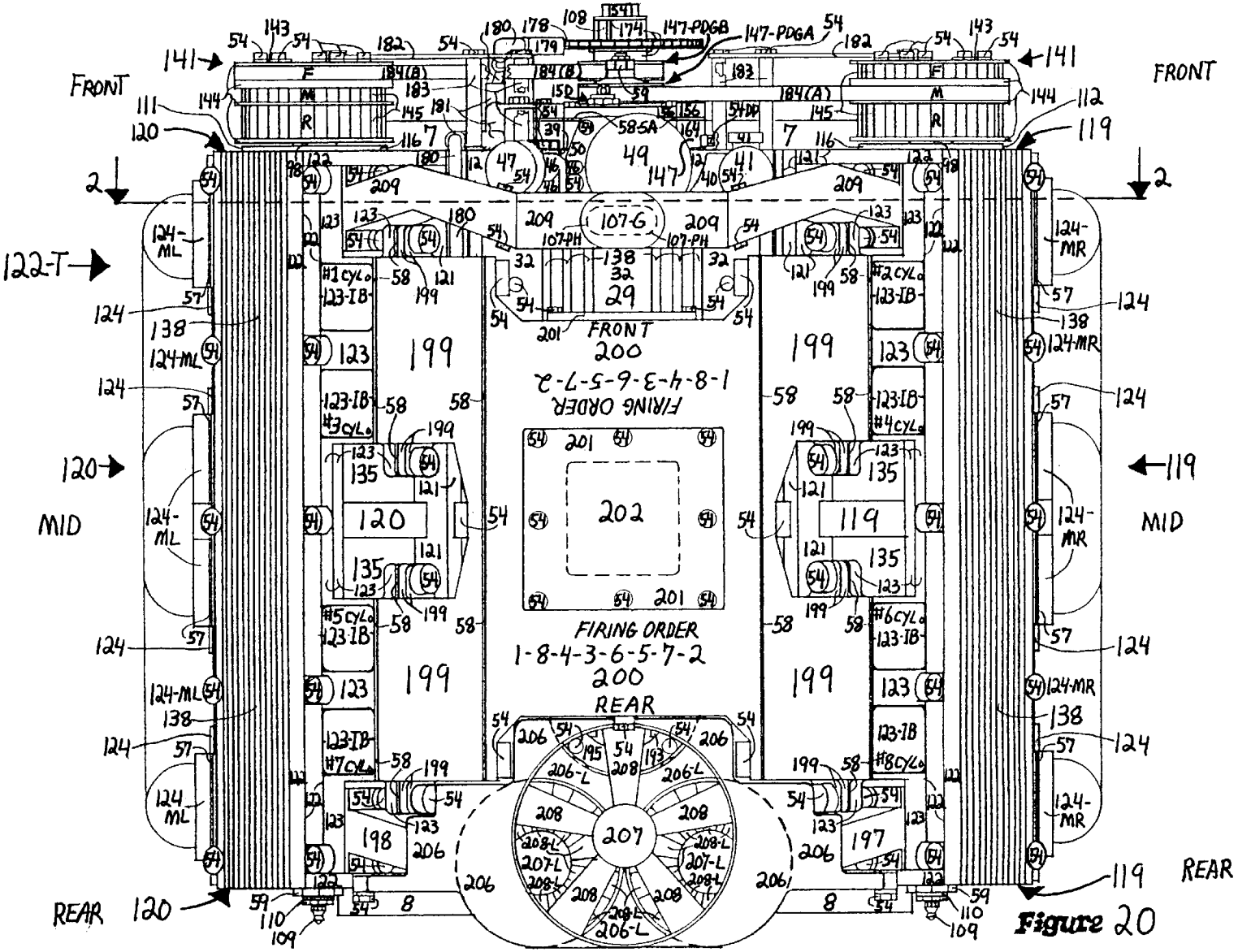

FIG. 20 Depicts the basic TOP VIEW Outer Structure setup of this V-eight OSIV' Engine System, LEFT BANK—VALLEY—RIGHT BANK,—FRONT of Engine (top of page),—REAR of Engine (bottom of page), VALVESHAFT (B) Cylinderhead LEFT BANK Flex Timing Drive Belt—cutout section REMOVED to show Crank Trigger Ignition Wire—basic location, Belt Guard Bolt cutout & Spacer Tube section REMOVED to show Trigger Ignition Bracket and Wire Protector Tube—mate up and Bolt Head TOP VIEW area, RIGHT BANK Belt Guard Bolt Spacer Tube cutaway—to show basic Internal type Bolt area-and-to show Oil Drain Plug Bolt head, on (RG.TDOP.SUCH) Right Side. Broken Line Phantom areas on: Fresh Air Inlet Manifold GROMMET—Multi Position Change Intake Manifold Base—Electric Fan Shroud, (Drive Belt(s)—Pulley Gear—setup—VIEW).

FIG. 21 Depicts TOP VIEW of exposed Internal Air Passages and Strength Structure Of: FRONT Fresh Air Inlet Manifold mated to Cylinderhead(s); Middle Valley Multi Position Changeable Intake Manifold Base—mated to Support Runner(s)—mated to Cylinderhead(s) Intake Port Runners (bolt area Removed to show "New Technique Of Cylinderhead" Intake Portside of "The Spark Plug Bore Area Location"; the FRONT and REAR Spark Plug Bores are in Partial Broken Line Phantom); REAR Fresh Air Outlet Valley Pipes mated to Cylinderheads—and Press Fitted into the Middle Block Valley Rear Base Hole area locations; Phantom Broken Line View of REAR Valley Middle Crankcase Ventilation Cap and Tube internal outlet passages—routed to Rear Intake Manifold Base Removable Block Off Plate. (FRONT Valley Fresh Air Inlet Manifold TOP section areas 19-19 material REMOVED—across Horizontal Plane Line 19-19 of FIG. 4), (Middle Valley Intake Manifold Base—Support Runner(s)—Cylinderhead Intake Port Runner(s)—TOP section areas 20-20 material REMOVED—Across—Up—Across—Down—Across—Up—Across—Down—Across Horizontal Plane Line 20-20 of FIG. 11), (REAR Valley Fresh-Air Outlet Pipe(s) TOP section areas—21-21 material REMOVED—Across—Diagonal Down—Across—Diagonal Up—Across Horizontal Plane Line 21-21 of FIG. 9). FIG. 21 is drawn as Partial Shaded—Non-Cross Hatched Represented View and should be viewed closely with it's Cross Hatched View FIG. 22.

Figure 22:
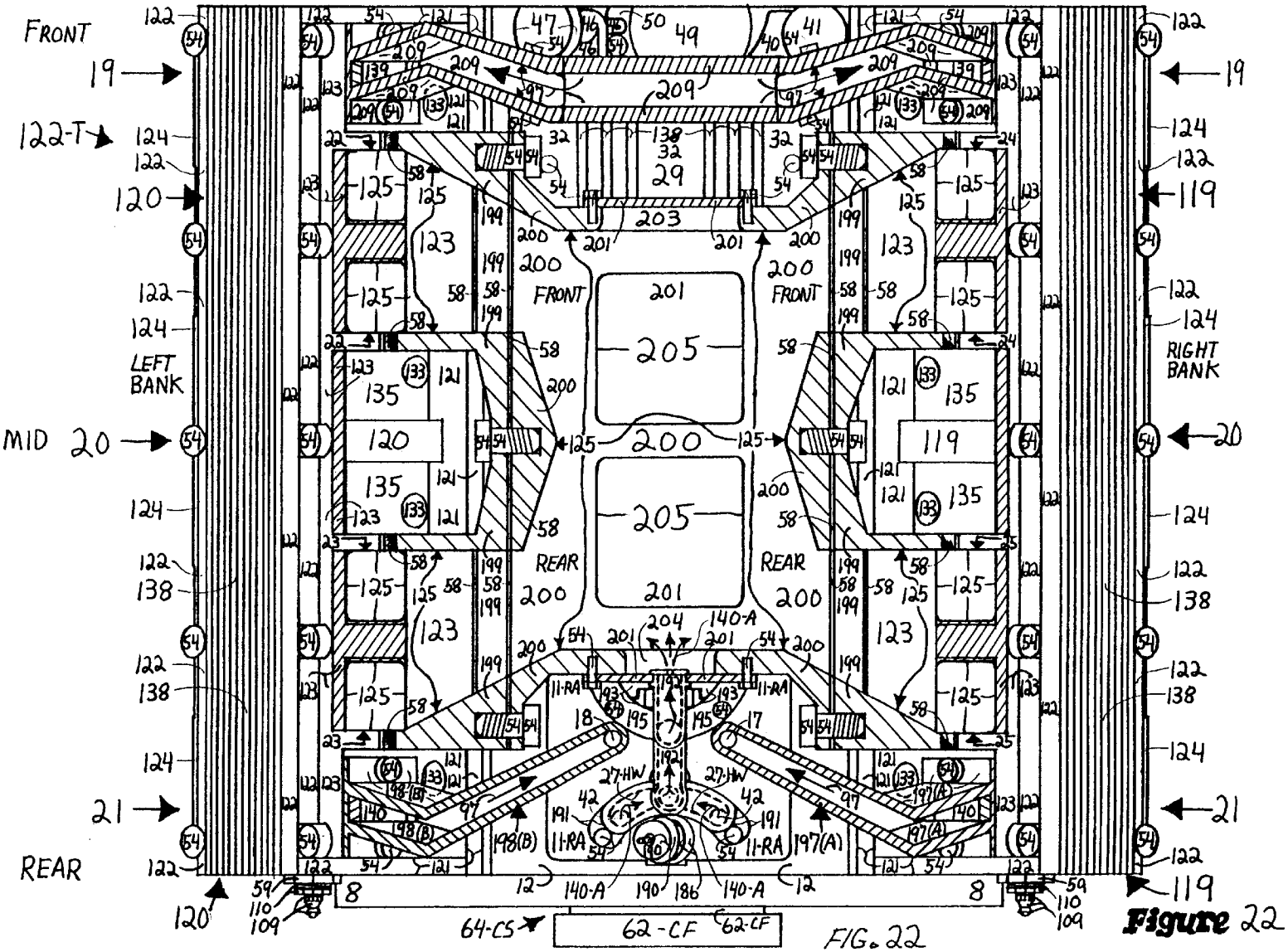

FIG. 22 Depicts same similar TOP View areas of FIG. 21 with ADDITION OF Cross-hatch Areas & Section areas: (22-22 Cylinderhead Intake Port Runner—TOP PART REMOVED), (23-23 Cylinderhead Intake Port Runner—TOP PART REMOVED), (24-24 Cylinderhead Intake Port Runner—TOP PART REMOVED), (25-25 Cylinderhead Intake Port Runner—TOP PART REMOVED).

FIG. 23 Depicts TOP Block Valley Area view (REAR to FRONT Engine)—(LEFT BANK Cylinders at Top)—(RIGHT BANK Cylinders at Bottom) of Figure page, V-8 Cylinder Block view setup, drawn as which to REMOVE: Belt GUARD(S)—FLEX TIMING DRIVE BELT(S)—PULLEY GEAR(S)—Components, TRIGGER IGNITION PICK-UP—BRACKET & WIRE & PROTECTOR TUBE, Front VALLEY FRESH-AIR INLET & INTAKE MANIFOLD(S) & SUPPORT RUNNER(S)—Rear VALLEY FRESH-AIR OUTLET MANIFOLD PIPE(S) & CRANKCASE VENTILATION TUBE, CYLINDERHEAD (S) (part(s)), OIL PRESSURE BY-PASS VALVE REGULATOR SENDING UNIT, OIL FILTER, VALLEY RADIATOR HEAT DEFLECTER SHIELD, ELECTRIC FAN(S) & SHROUD—Components. Further Depictions of Phantom Broken Line Areas of Crankcase Ventilation Valley HOLES & Outlet Passage in VENTILATION CAP, Radiator Filler Neck & Pressure Relief CAP—inlet passage to Top Front Valley Radiator Core Unit COVER, Oil Filler Tube internal area Oil Passage, Front Valley Area Crankcase Ventilation HOLES, Partial Phantom Broken Line of; Oil Filter Housing Plate CORNER & Bolt Head and Oil Inlet Passage, Top Radiator Front Filler Neck Auxiliary Inlet/Outlet CAP area, Bottom Radiator Front Auxiliary Inlet/OUTLET Neck.

FIG. 24 Depicts similar Main Line Valley Structure and Outline Block Structure of FIG. 23—though Intended Focus as drawn is Middle(Mid.) Valley Hot Water/Coolant(W/C)—Quick Cooling Radiator Core and Water/Coolant Propeller & Propeller Shaft—Housing-Unit, The- many amounts of Circle Holes of water/coolant Separator Tubes or Passages—and the Six Hot Water/Coolant Inlet Passages—Per Cylinder Bank Side and Center Line Valley Radiator water/coolant (W/C) Separator Wall—is expose as drawn—as which Radiator Lid COVER PLATE is removed. Further Depictions of Phantom Broken Lines of BOTTOM Radiator (W/C) Outlet Passage from Center to Rear to Propeller Housing—and from the Center to Front Auxiliary Outlet Neck, the CENTER CIRCLE Bottom Plate water/coolant Inlet & water/coolant Holes Around Diameter Area is to allow equal Water/Coolant Flow Control to CENTER TUNNEL OUTLET PASSAGE.

FIG. 25 Depicts similar TOP VALLEY & Block view as FIG. 23 though drawn with REMOVED ITEMS: Water/Coolant Electric Pump Motor, Valley Radiator Core Unit, Crankcase Ventilation Valley Cap, Oil Filter Housing Plate and Oil Filler Tube—Dipstick Cap, Crankshaft Nose Trigger Ignition Hub. Further Depictions of Phantom Broken Line view of (W/C) passage to each BANK Water/Coolant Cylinder Jackets at REAR Block Valley Area, and Air Flows from FRONT to REAR in Valley SIDE CLEARANCE AREA at Three BROKE lines each side of FRONT Valley and One BROKE line each side of REAR Valley—under (item 37), Phantom Cross-hatch view of FRONT Oil Pressure Volume Adjuster LOCATION on TOP (RG.TDOP.SUCH), Cylinder BANK Broken Line Phantom water/coolant (w/c) Jacket & Flow Arrow—area(s).

Figure 26:
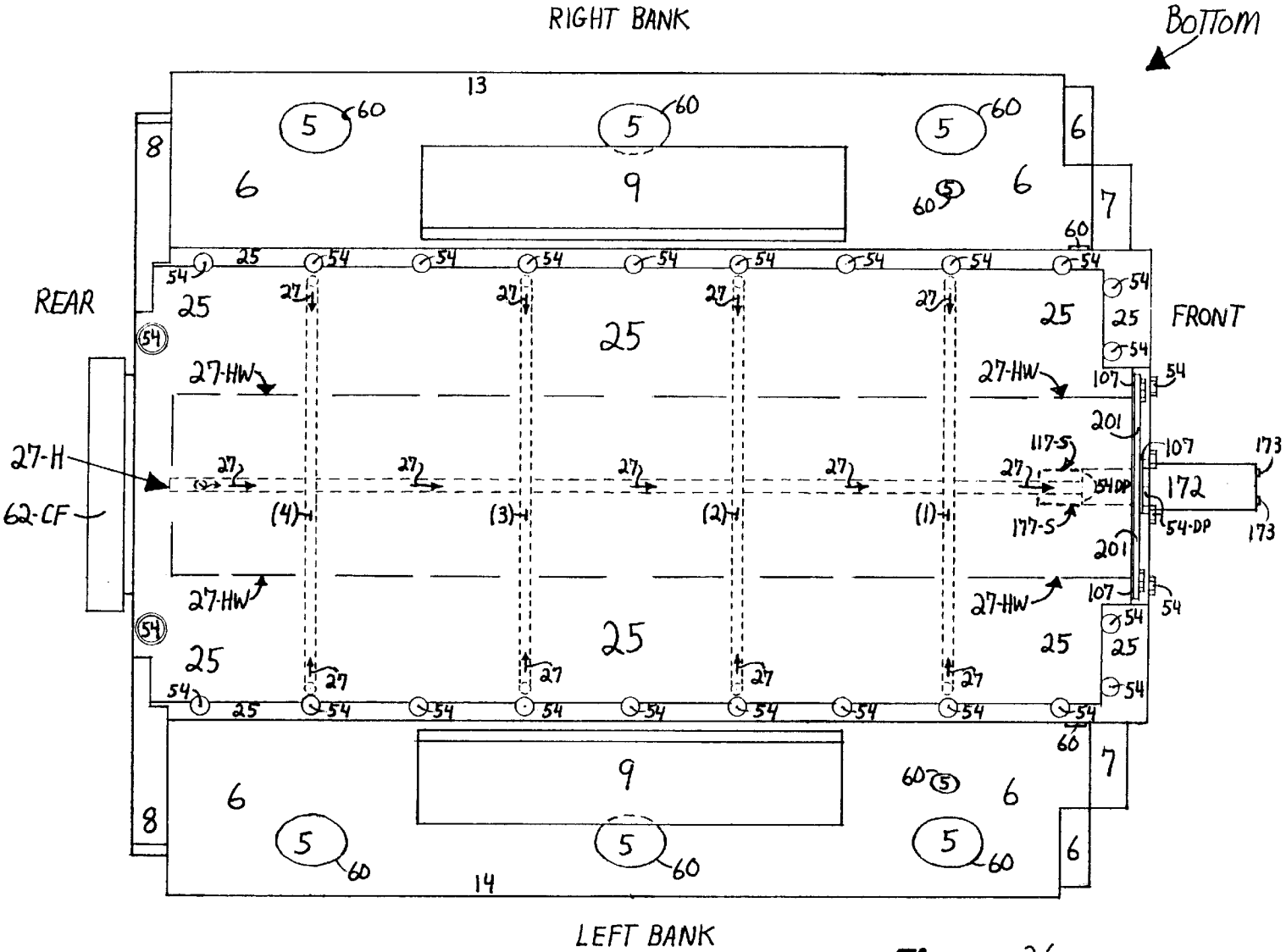

FIG. 26 Depicts BOTTOM V-eight type BLOCK & Oil Scavenge Pan view of the OSIV' Engine, (Leftside of view page is the REAR), (REAR to FRONT) and (TOP is Right BANK—BOTTOM is Left BANK), Phantom Broken Line(s) of Oil Scavenge Pan OIL PASSAGES to Center and toward FRONT Engine Area—which is also the direction of Oil Flow (arrows), Internal Oil Cooling Passages, Partial Phantom Broken Line of basic Freeze Plug areas (both BANKS).

Figure 27:
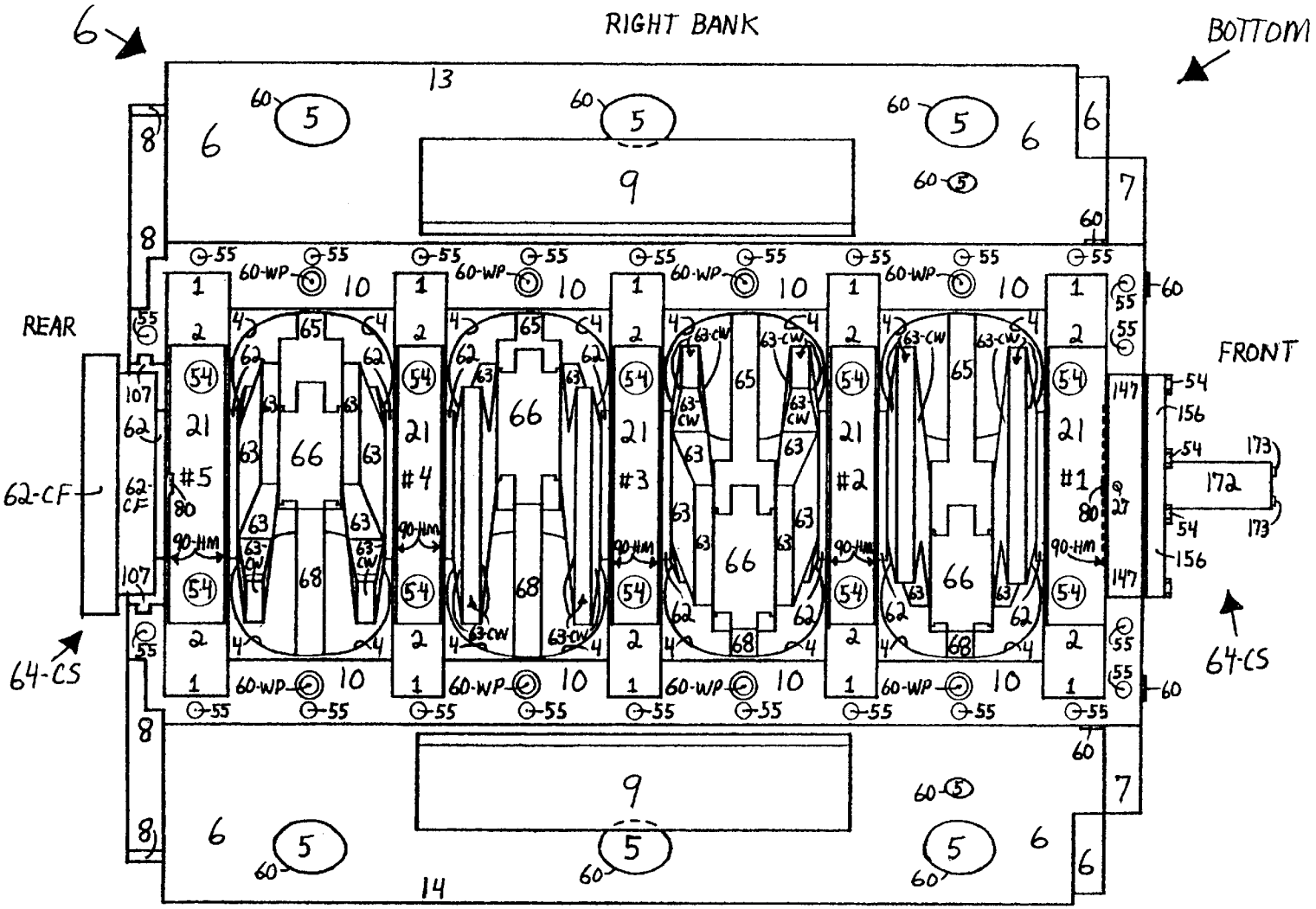

FIG. 27 Depicts similar BOTTOM View of FIG. 26 WITHOUT Oil Scavenge Pan—to Expose: CRANKCASE, of the V-eight-type OSIV' Engine Block—FIVE Fork Crank Main Block Rib Bulkheads and Fork Lock CAPS—Crankshaft Rotation Reciprocating Assembly, basic line outer structure of main items and parts Area Locations. Partial Broken Line Phantom of Freeze Plug location(s) and Front Fork Lock CAP area. This is the ON V-CENTER LINE CYLINDER BORE SPACING OSIV' Engine Block setup NEW SYSTEM TECHNIQUE—view.

Figure 28:
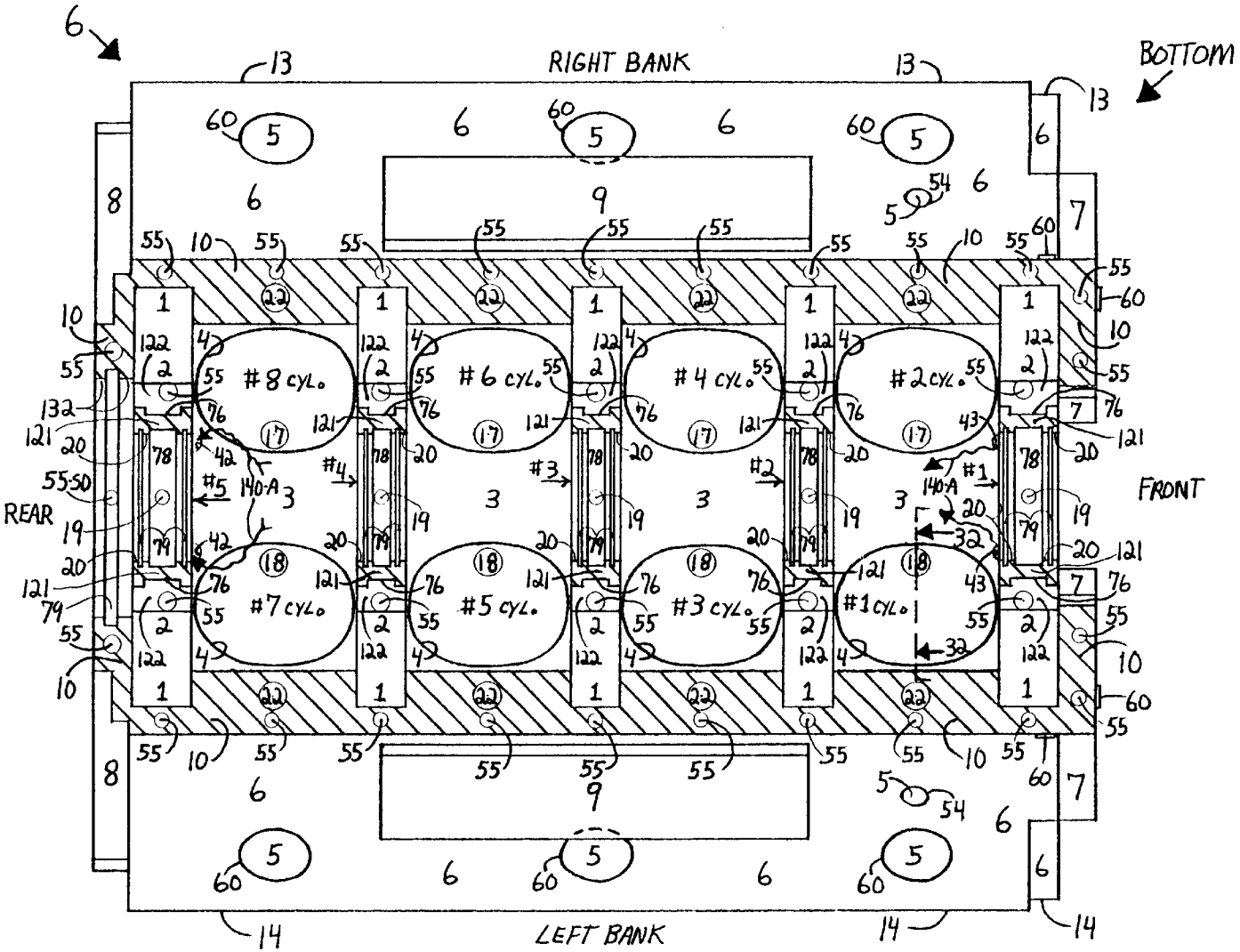

FIG. 28 Depicts same basic similar view as FIG. 27 WITHOUT Engine Part(s)/ASSEMBLIES, BARE BLOCK—type BOTTOM view With Cross-Hatch Line Area of Block's Crank Main Journal Bore "CENTER AREA MATE UP SURFACE BASE—and—OIL PAN RAIL BULKHEAD AREA—for—OIL SCAVENGE PAN and FORK LOCK CAP on each BLOCK MAIN RIB BULKHEAD JOURNAL BORE location". Groove Tracks are exposed—which are for "FREE-(SPIN) BEARING & SEAL" seating, and FORK MAIN RIB GUIDE RAILS for FORK LOCK CAP matching type Groove and Seating. The OSIV' Engine System STAGE TWO form begins here—with the On-V-Center Line Cylinder Bore Spacing Block and Fork Crank Main Journal Bore Bulkhead Rib Block, as VIEWED—setup.

*Fig.(s) ONE thru Fig. TWENTY EIGHT—CONCLUDES all basic main views of this Invention—and —basic Technique Viewing simple setup of this OSIV' Engine System Invention as for SHORT FORM BRIEF VIEW INFORMATION of this invention, including Figure(FIG.) 133.

Proceed to—DETAILED DESCRIPTION OF THE INVENTION—Specification Section—or—Continue this—BRIEF DESCRIPTION OF THE SEVERAL VIEWS OF THE DRAWING—Specification Section—for complete Awareness Of All Figures & Views.

Figure 29:
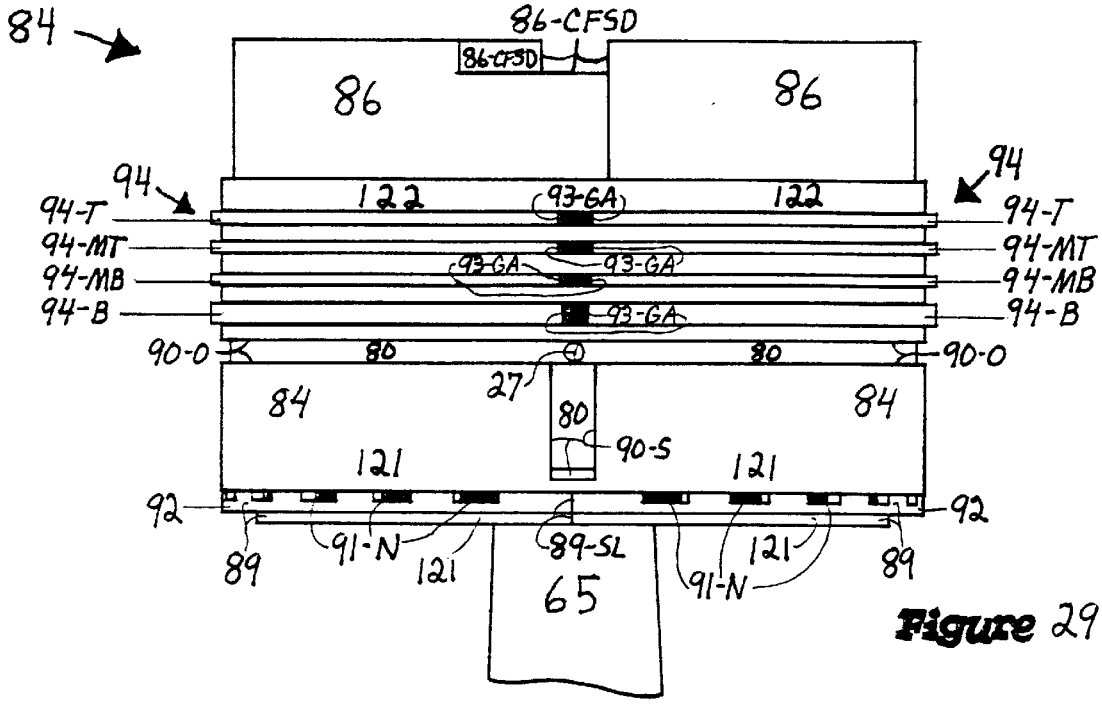

FIG. 29 Depicts basic FRONT Outer Structure View of the OSIV' CROSS FORCE PISTON and RINGS-and-Upper Connecting Rod-and-Appearance Assembly—for Block Cylinders; #2cyl., #6cyl., RIGHT BANK, #3cyl., #7cyl., LEFT BANK.

Figure 30:
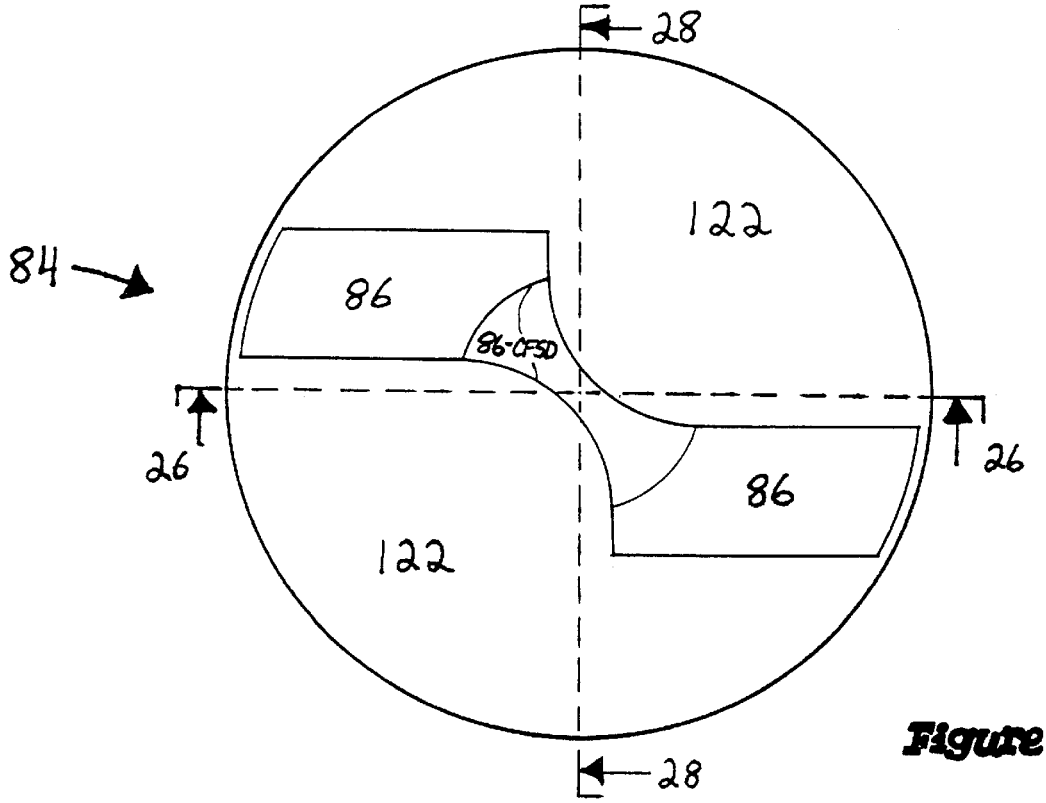

FIG. 30 Depicts FIG. 29 TOP LAND View of OSIV' Cross Force Piston DOME and TYPE—basic Line Structure Appearance.

Figure 31:
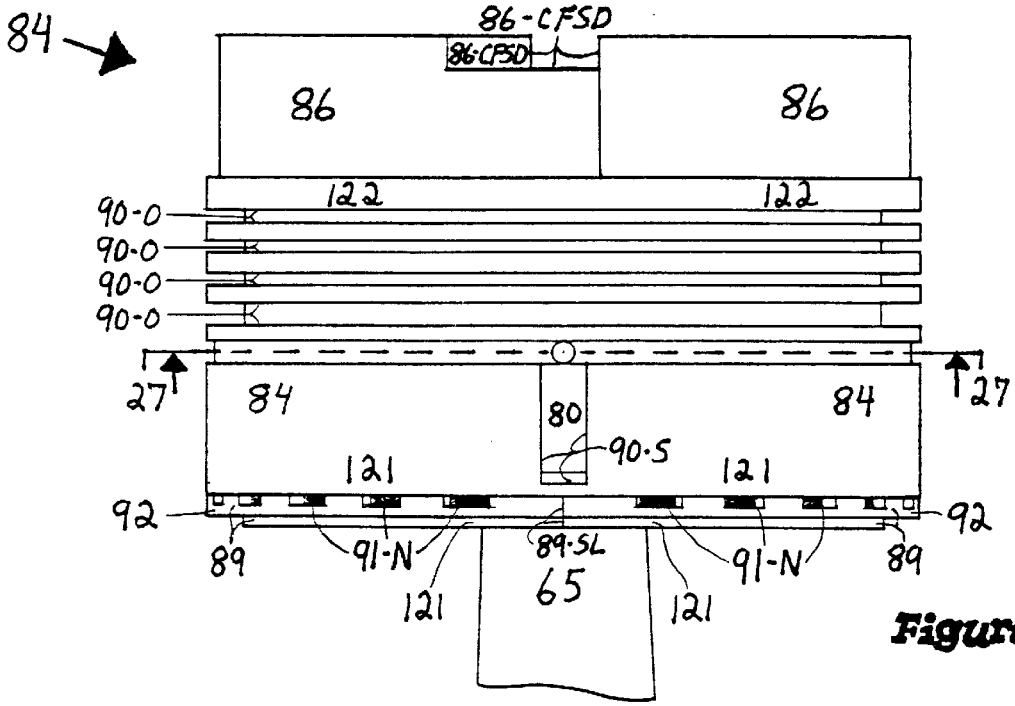

FIG. 31 Depicts FIG. 29 WITHOUT the FOUR—Medium Tension PISTON RING Set.

Figure 32:
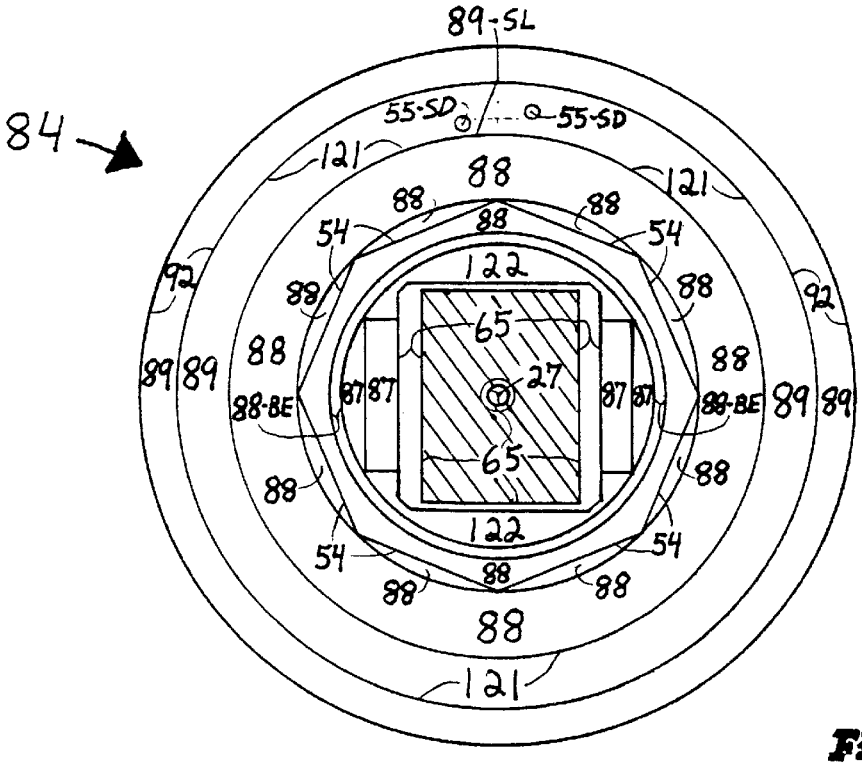

FIG. 32 Depicts FIG. 29 BOTTOM LAND View, and Upper Rod—High or Low Compression Ratio Position Piston PIN—CUP LOCK Bolt Head—CUP LOCK LOCK RING SEAL with Two Pin Hole Areas for Installation & Removal—Center Line OIL PASSAGE—inner circle is Minimum Diameter Oil Hole—outer circle is Maximum Diameter Oil Hole—test limit depending upon MATERIAL ROD THICKNESS & STRENGTH.

Figure 33:
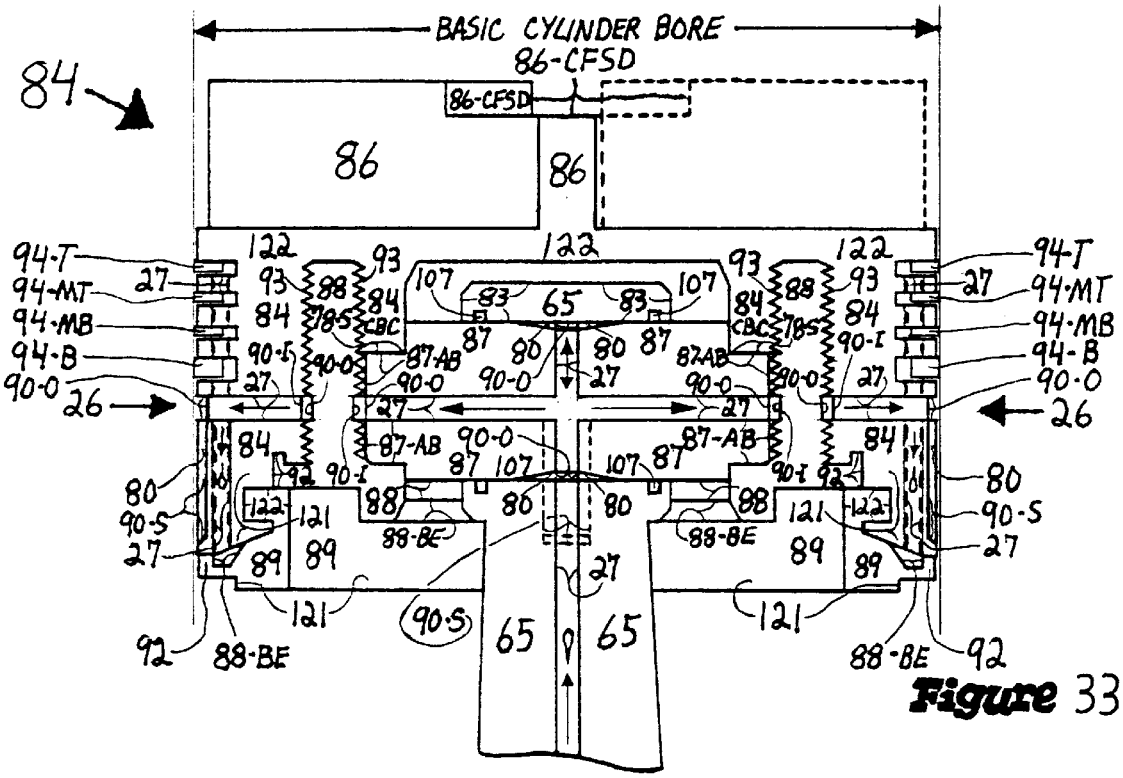

FIG. 33 Depicts FIG. 31 though to show Cutaway NON-Cross-Hatch Internal Strength Structure section 26-26, Down Vertical Plane Line 26-26 of FIG. 30 (BROKE L. PHTMS.).

Figure 34:
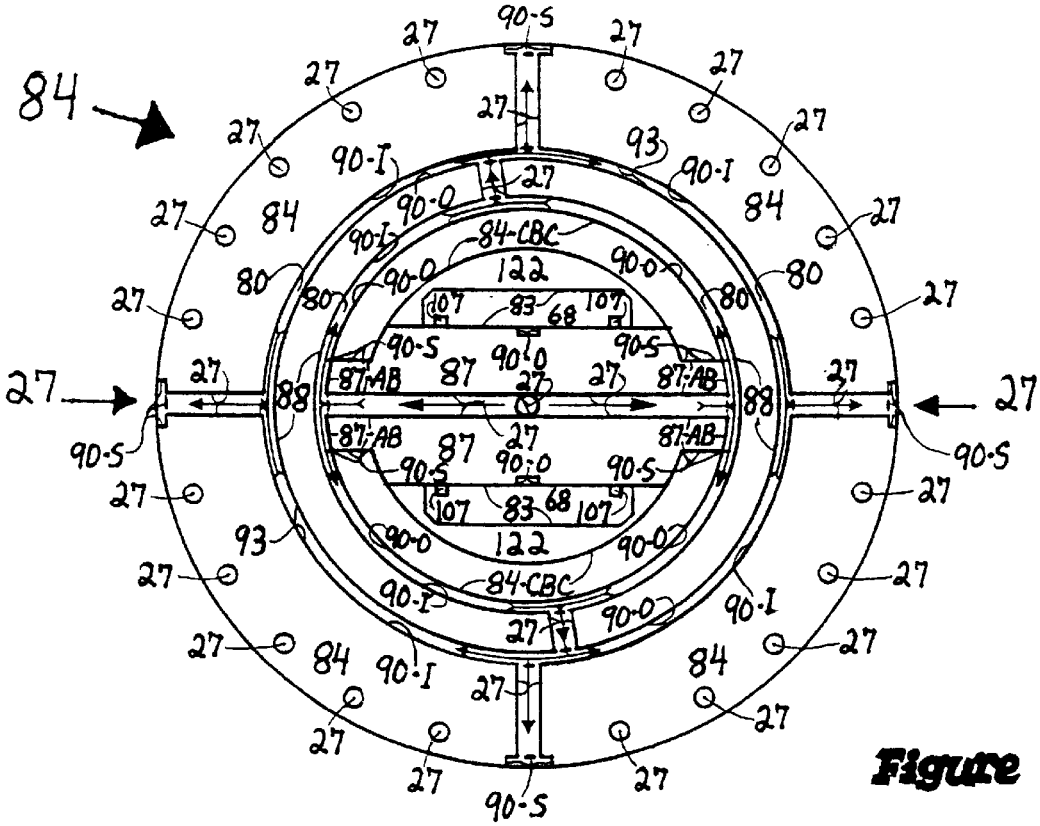

FIG. 34 Depicts FIG. 32 though to show Cutaway NON-Cross-Hatch Internal Strength Structure section 27-27, Across Horizontal Plane Line 27-27 of FIG. 31.

Figure 35:
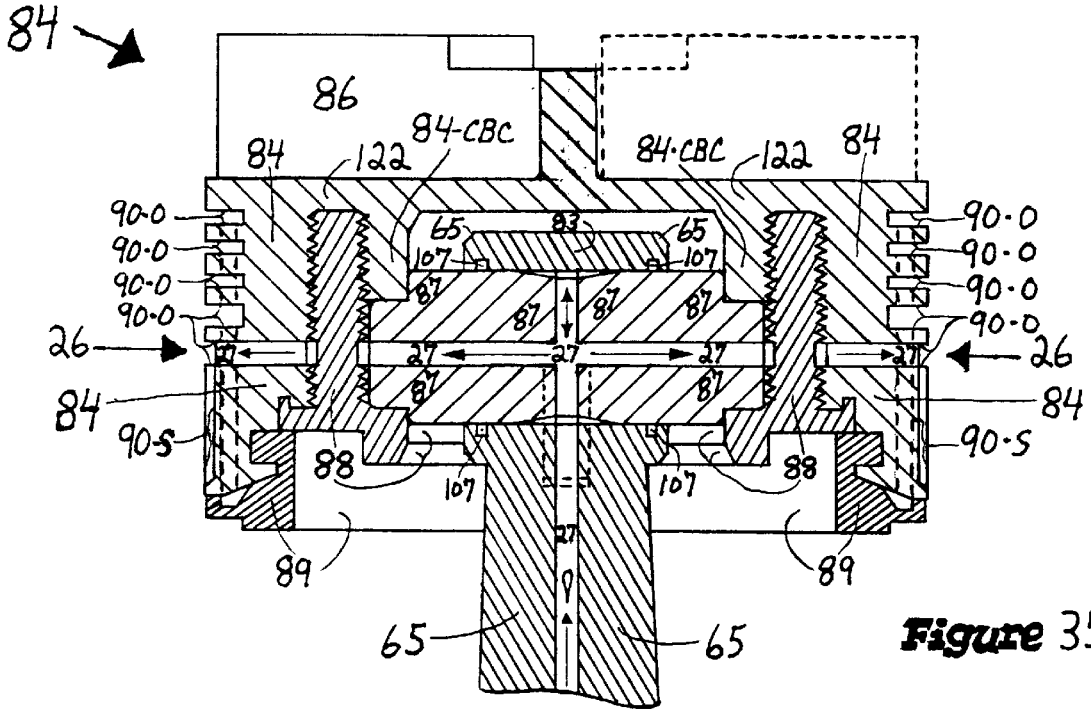

FIG. 35 Depicts FIG. 33 WITH Cross-Hatch Lines—Internal Strength Structure section 26-26, with (BROKE L. PHTMS.).

Figure 36:
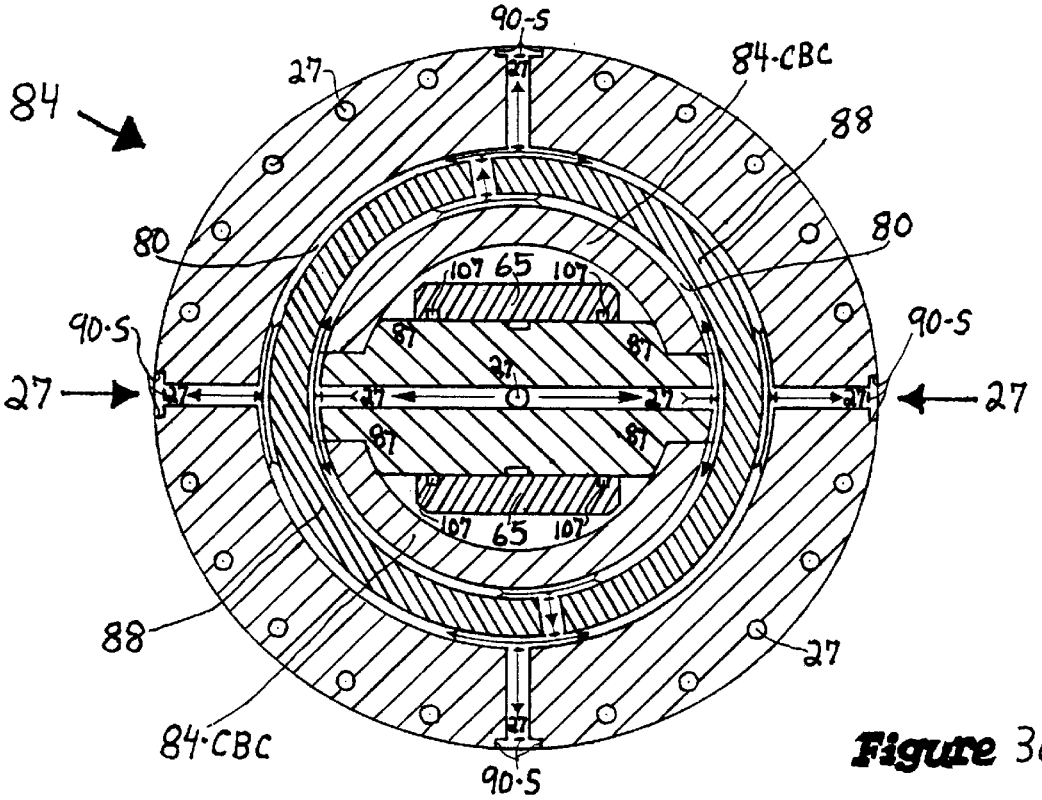

FIG. 36 Depicts FIG. 34 WITH Cross-Hatch Lines—Internal Strength Structure section 27-27.

Figure 37:
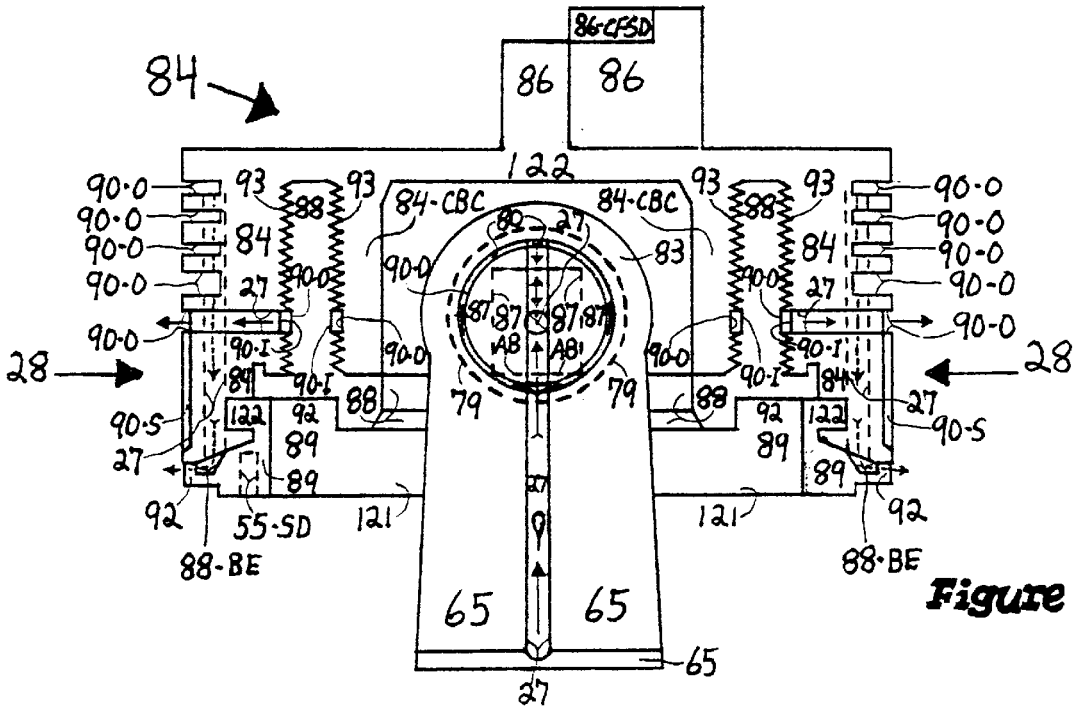

FIG. 37 Depicts NON-Cross-Hatch—Cross Cutaway View of FIG. 31, Internal Strength Structure section 28-28, Down Vertical Plane Line 28-28 of FIG. 30 (BROKE L. PHTMS).

Figure 38:
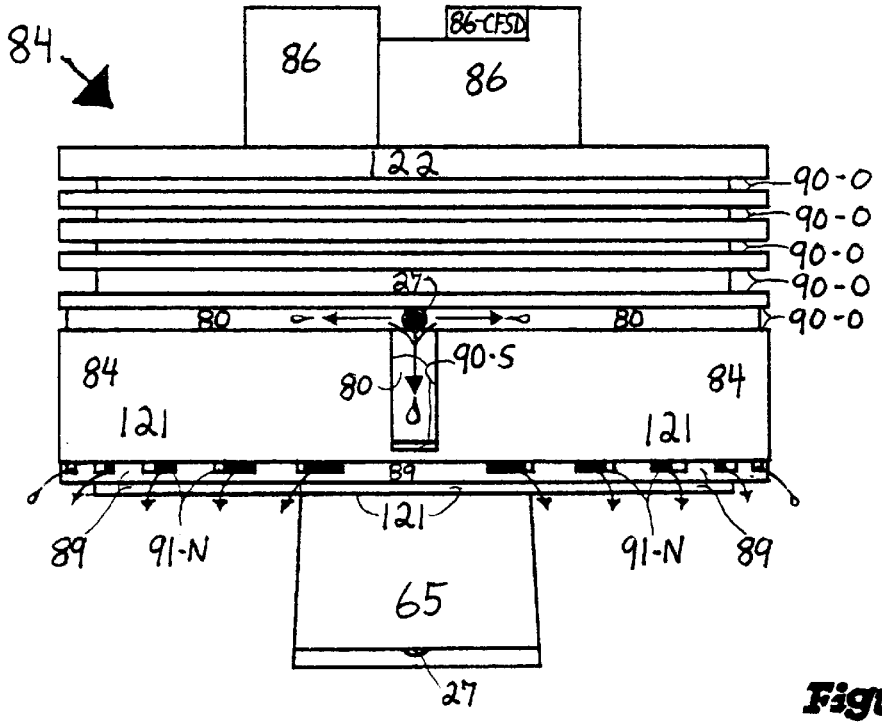

FIG. 38 Depicts SIDE View of FIG. 31.

Figure 39:
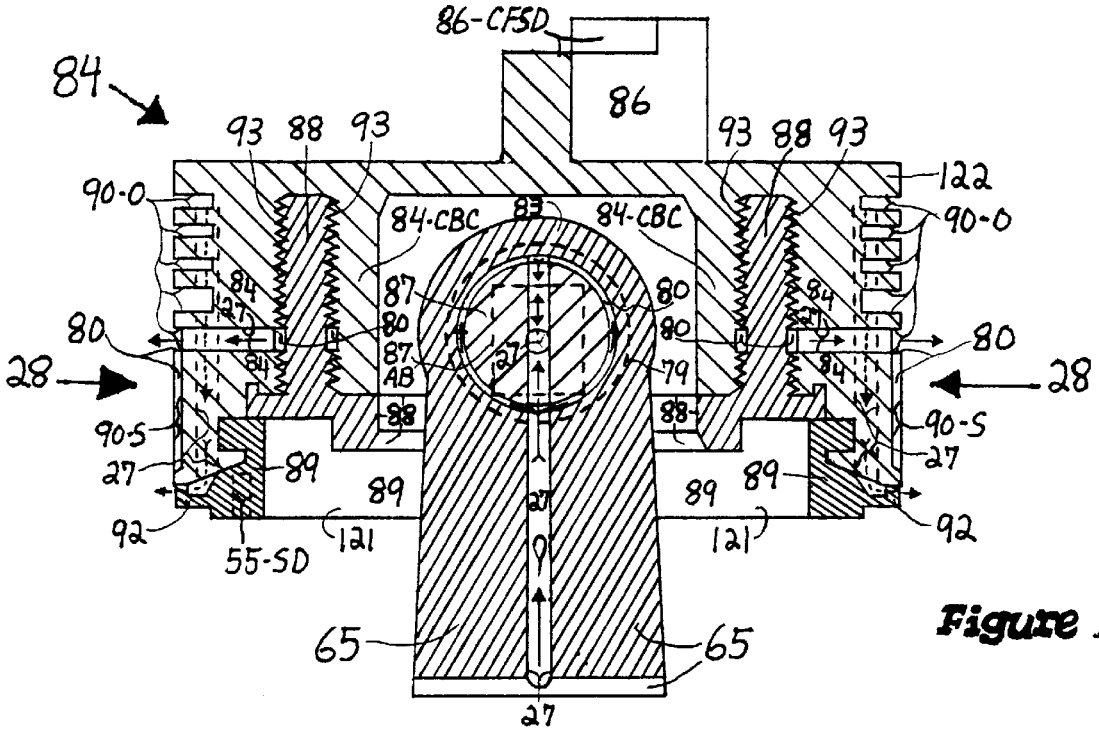

FIG. 39 Depicts Cross-Hatch—Cross Cutaway View of FIG. 37, Internal Strength Structure section 28-28, Down Vertical Plane Line 28-28 of FIG. 30, (BROKE L. PHTMS.).

Figure 40:
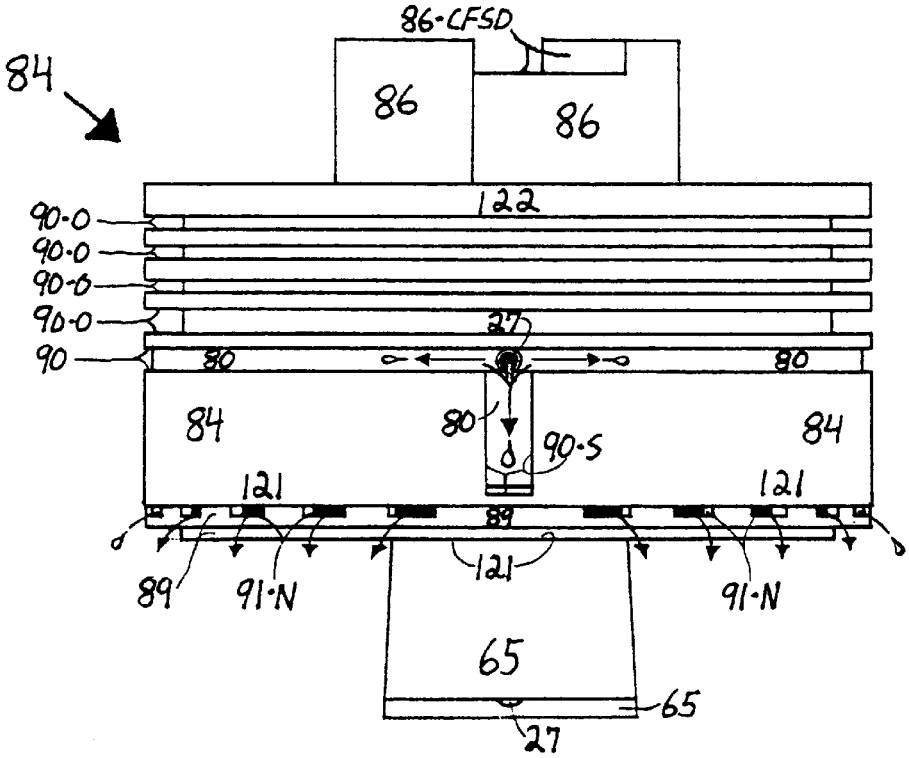

FIG. 40 Depicts SIDE View of FIG. 31.

Figure 41:
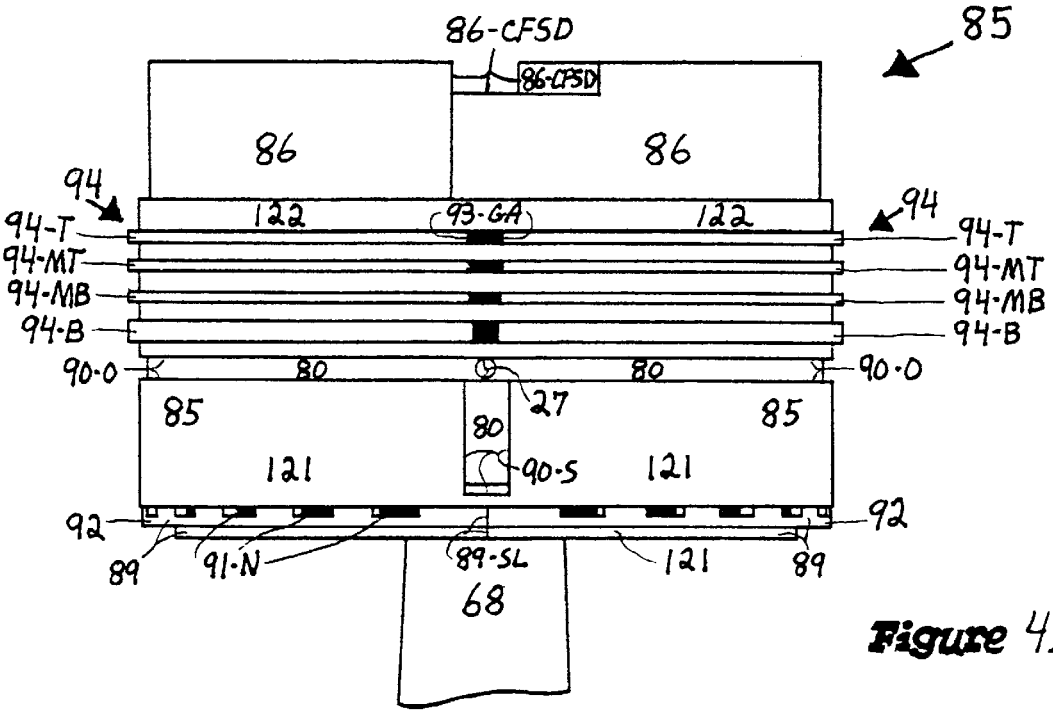

FIG. 41 Depicts basic FRONT Outer Structure View of OSIV' CROSS FORCE PISTON and RINGS-and-Upper Connecting Rod-and-Appearance Assembly for Block Cylinder; #4cyl., #8cyl., RIGHT BANK, #1cyl., #5cyl., LEFT BANK.

Figure 42:
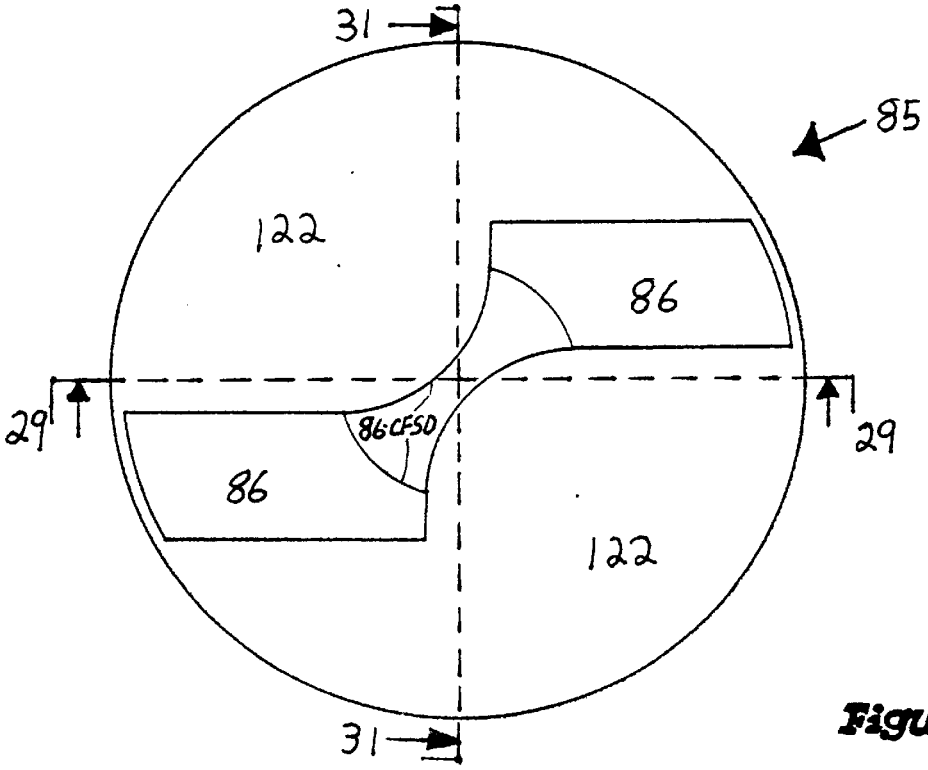

FIG. 42 Depicts FIG. 41 TOP LAND View of OSIV' Cross Force Piston DOME and TYPE—basic Line Structure Appearance.

Figure 43:
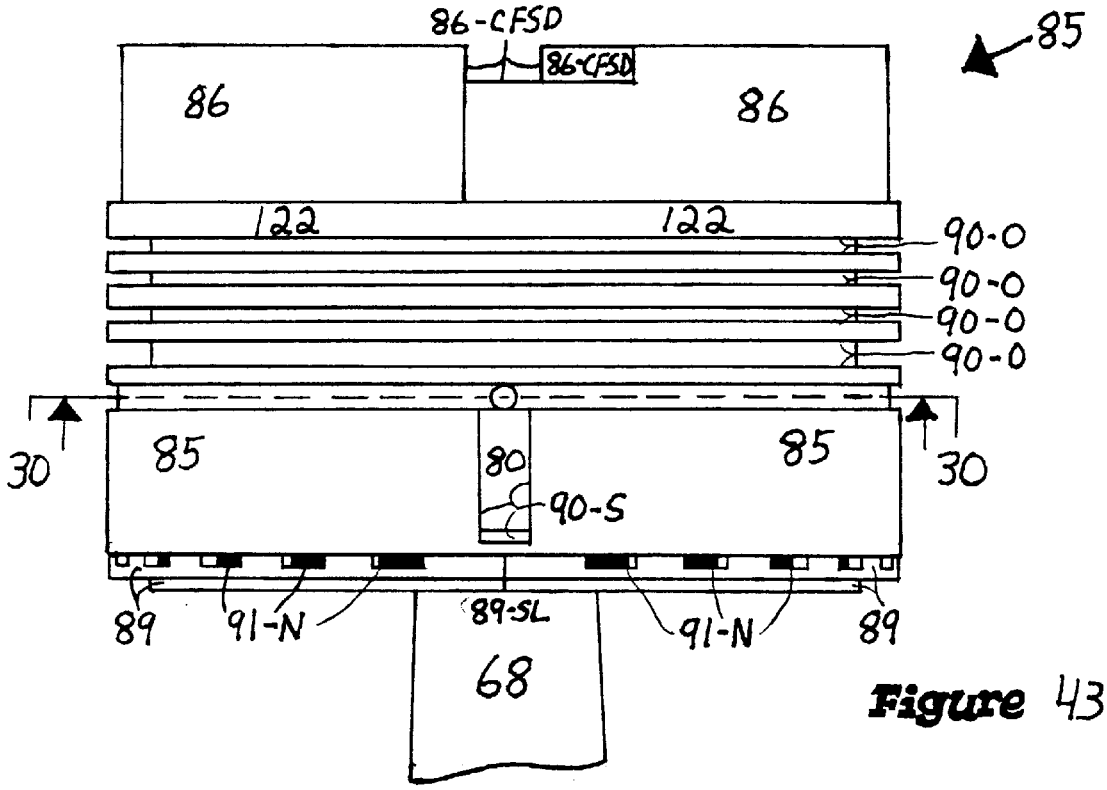

FIG. 43 Depicts FIG. 41 WITHOUT the FOUR—Medium Tension PISTON RING Set.

Figure 44:
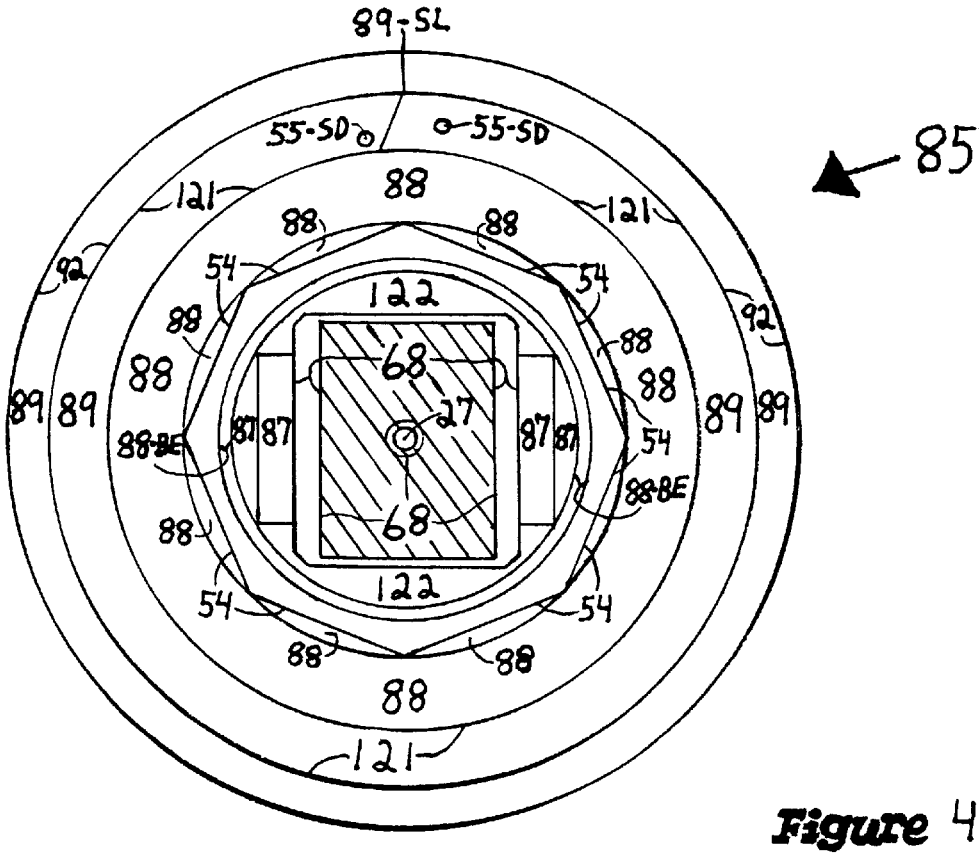

FIG. 44 Depicts FIG. 41 BOTTOM LAND View, and Upper Rod—High or Low Compression Ratio Position Piston PIN—CUP LOCK Bolt Head—CUP LOCK LOCK RING SEAL—with Two Pin Hole Areas for Installation & Removal—Center Line OIL PASSAGE—inner circle is Minimum Diameter Oil Hole—outer circle is Maximum Diameter Oil Hole—test limit depending upon MATERIAL ROD THICKNESS & STRENGTH.

Figure 45:
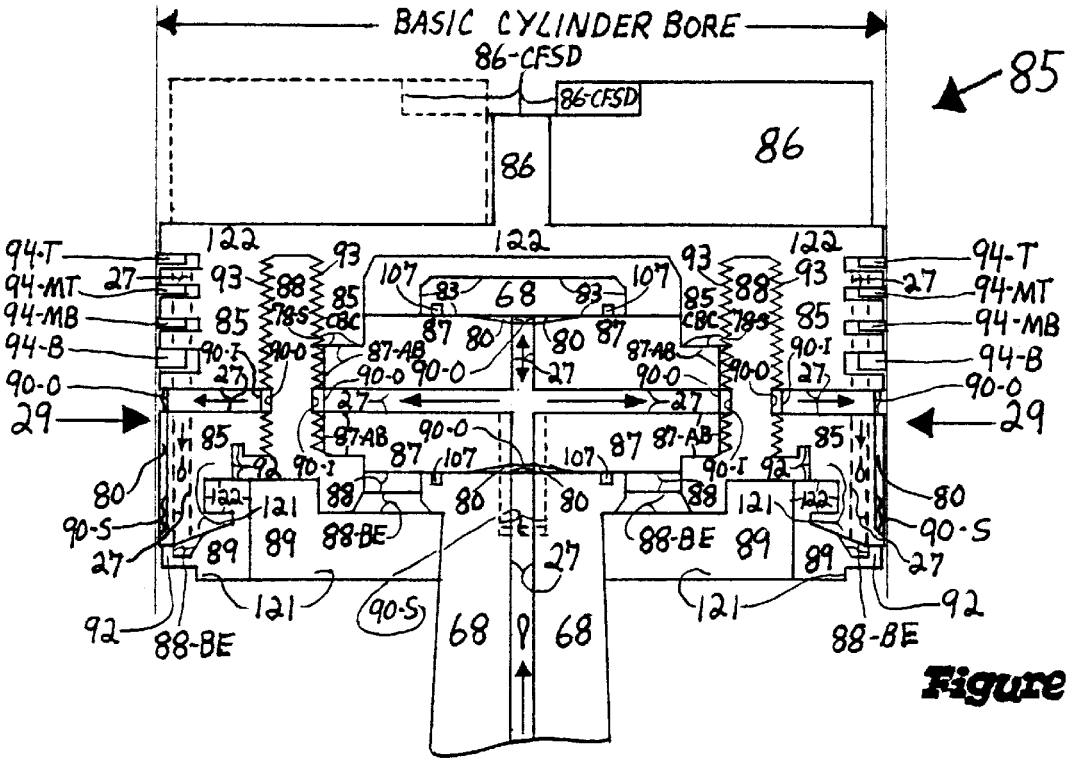

FIG. 45 Depicts FIG. 43 though to show Cutaway NON-Cross-Hatch Internal Strength Structure section 29-29, Down Vertical Line 29-29 of FIG. 42, (BROKE L. PHTMS.).

Figure 46:
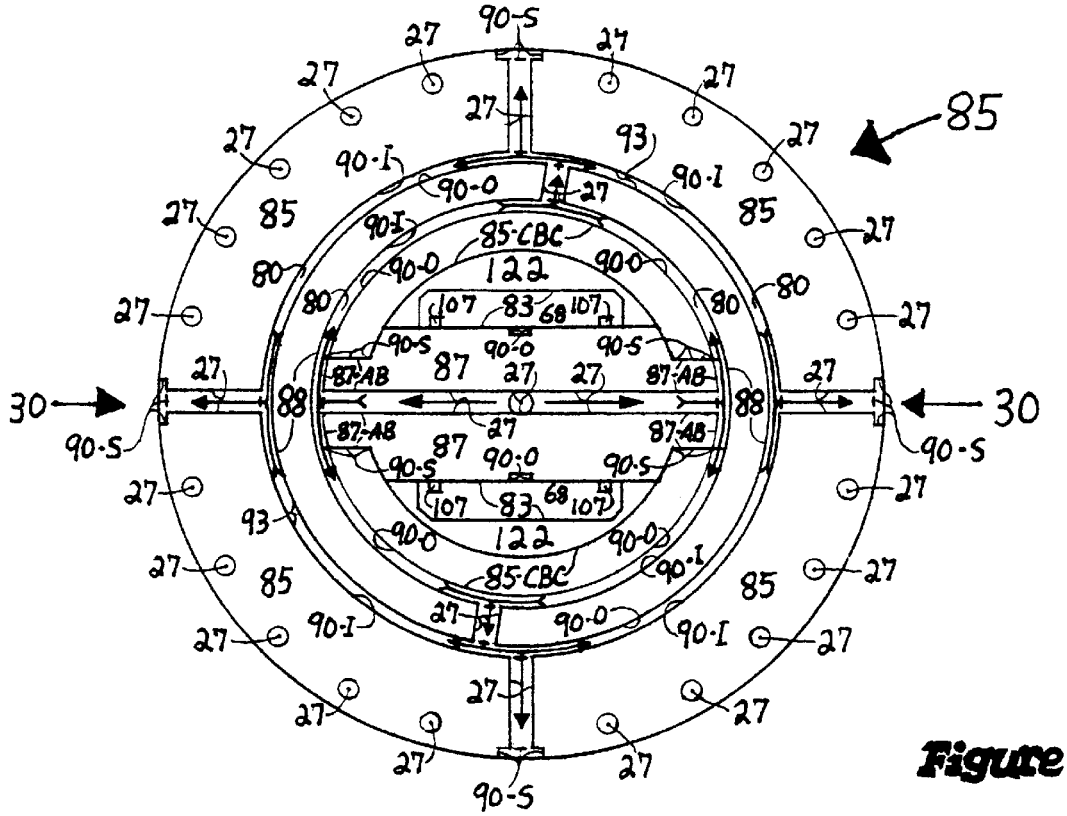

FIG. 46 Depicts FIG. 44 though to show Cutaway NON-Cross-Hatch Internal Strength Structure section 30-30, Across Horizontal Plane Line 30-30 of FIG. 43.

Figure 47:
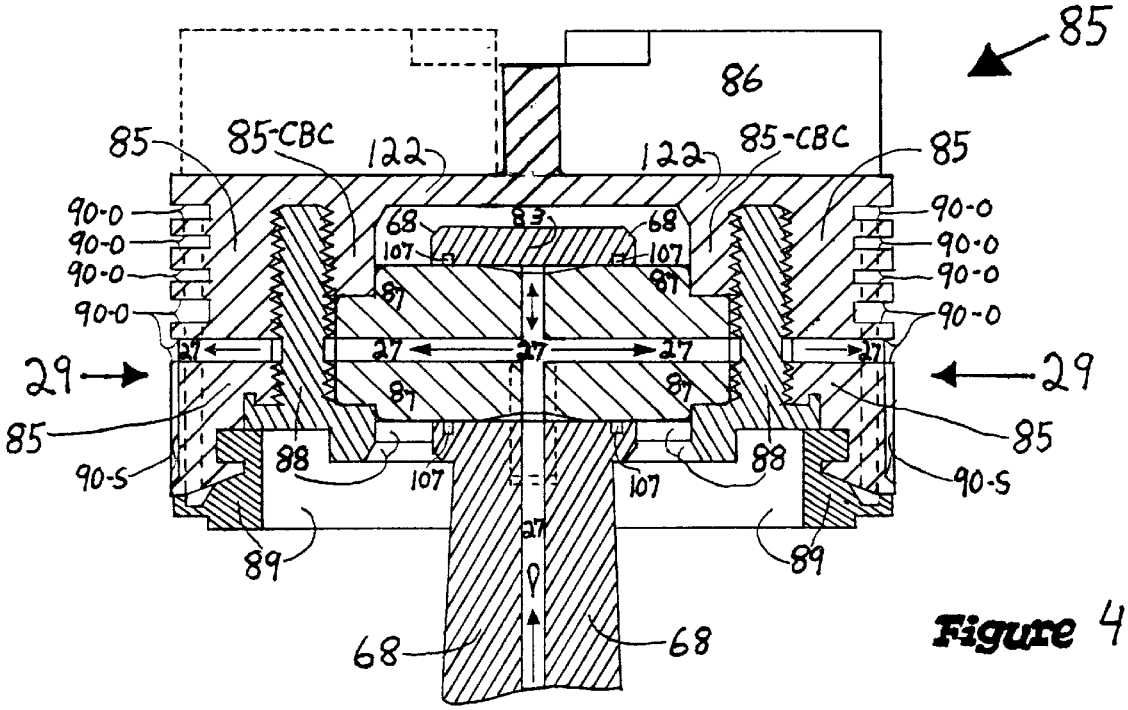

FIG. 47 Depicts FIG. 45 WITH Cross-Hatch Lines—Internal Strength Structure section 29-29, with (BROKE L. PHTMS.).

Figure 48:
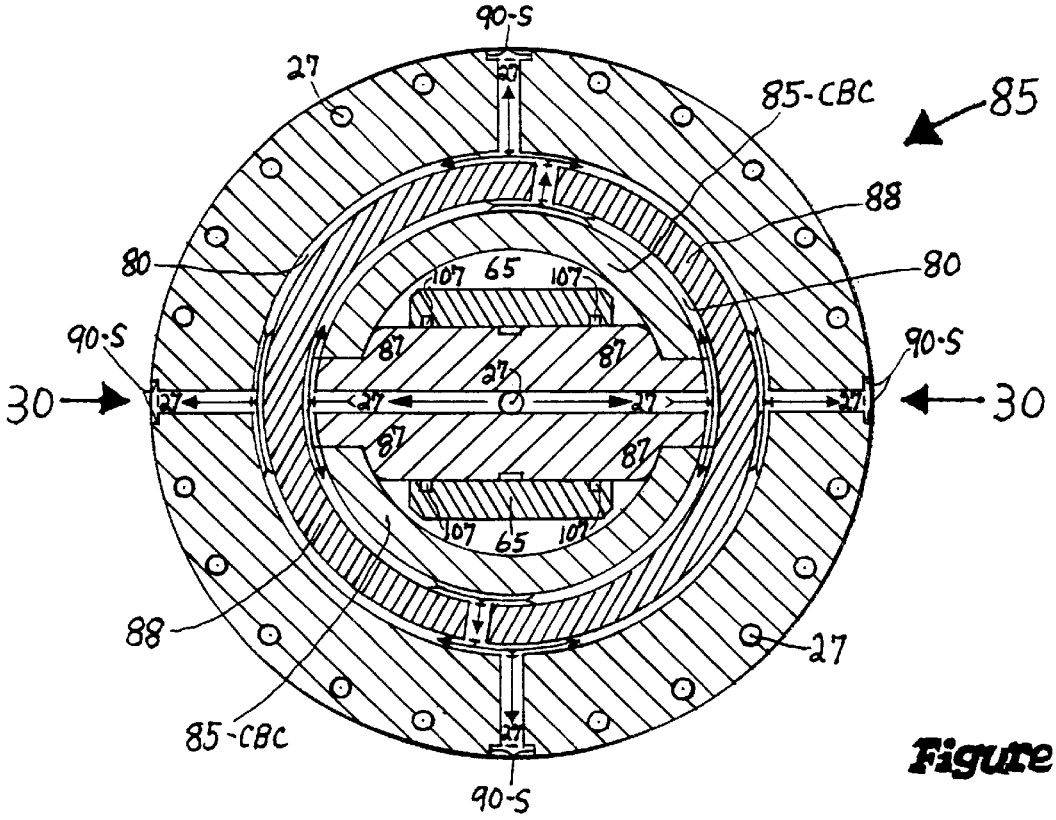

FIG. 48 Depicts FIG. 46 WITH Cross-Hatch Lines—Internal Strength Structure section 30-30.

Figure 49:
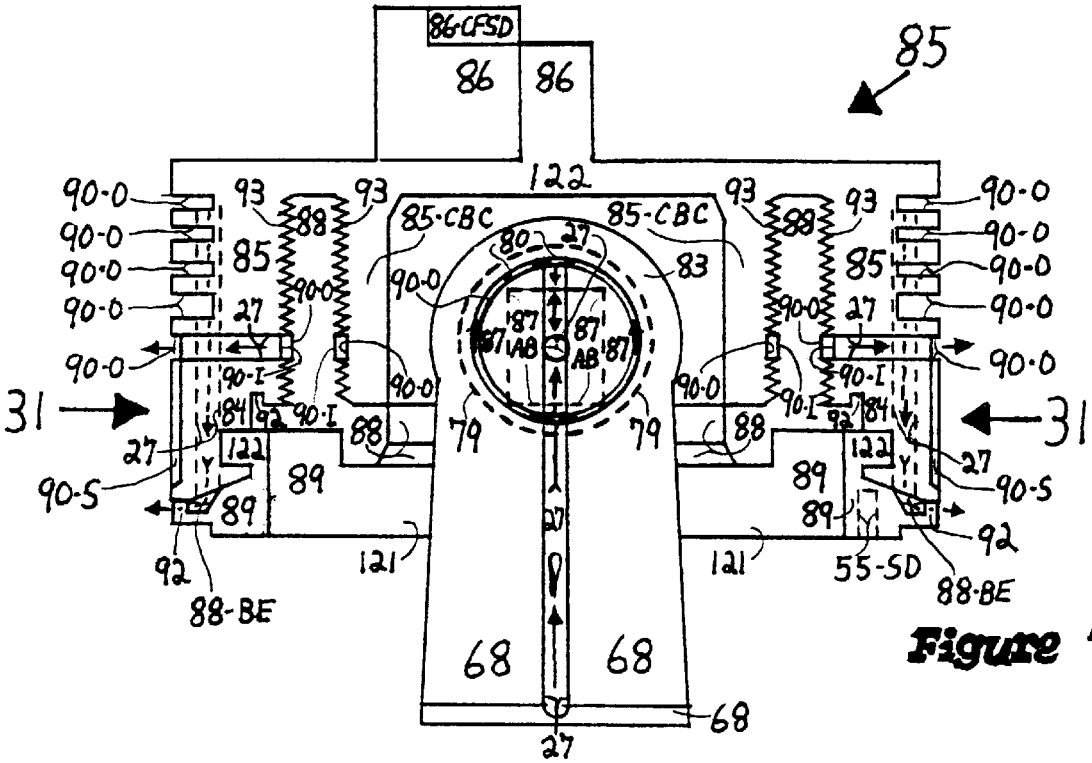

FIG. 49 Depicts NON-Cross-Hatch—Cross Cutaway View of FIG. 43, Internal Strength Structure section 31-31, Down Vertical Plane Line 31-31 of FIG. 42, (BROKE L. PHTMS.).

Figure 50:
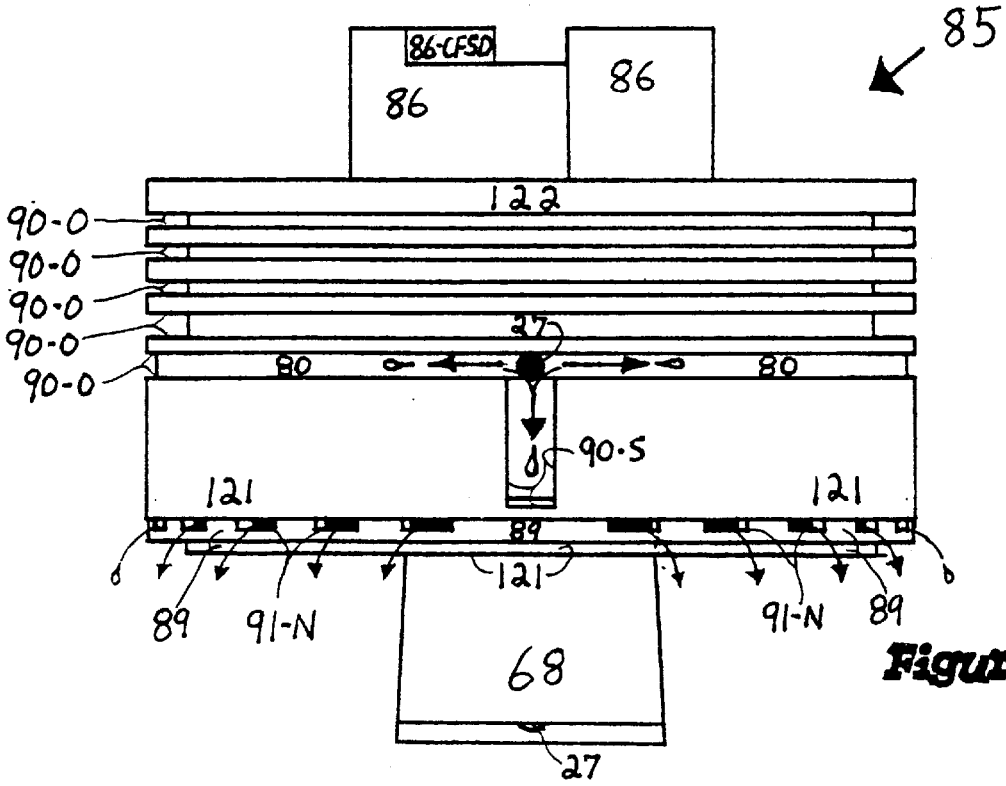

FIG. 50 Depicts SIDE View of FIG. 43.

Figure 51:
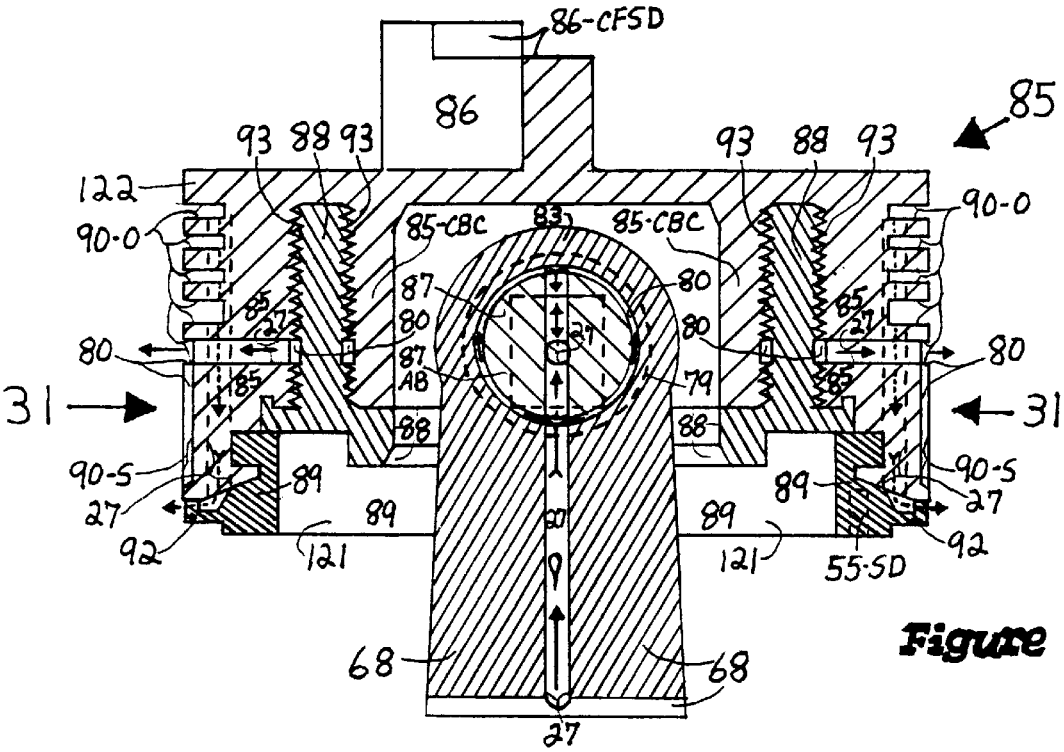

FIG. 51 Depicts Cross-Hatch—Cross Cutaway View of FIG. 49, Internal Strength Structure section 31-31, Down Vertical Plane Line 31-31 of FIG. 42, (BROKE L. PHTMS.).

Figure 52:
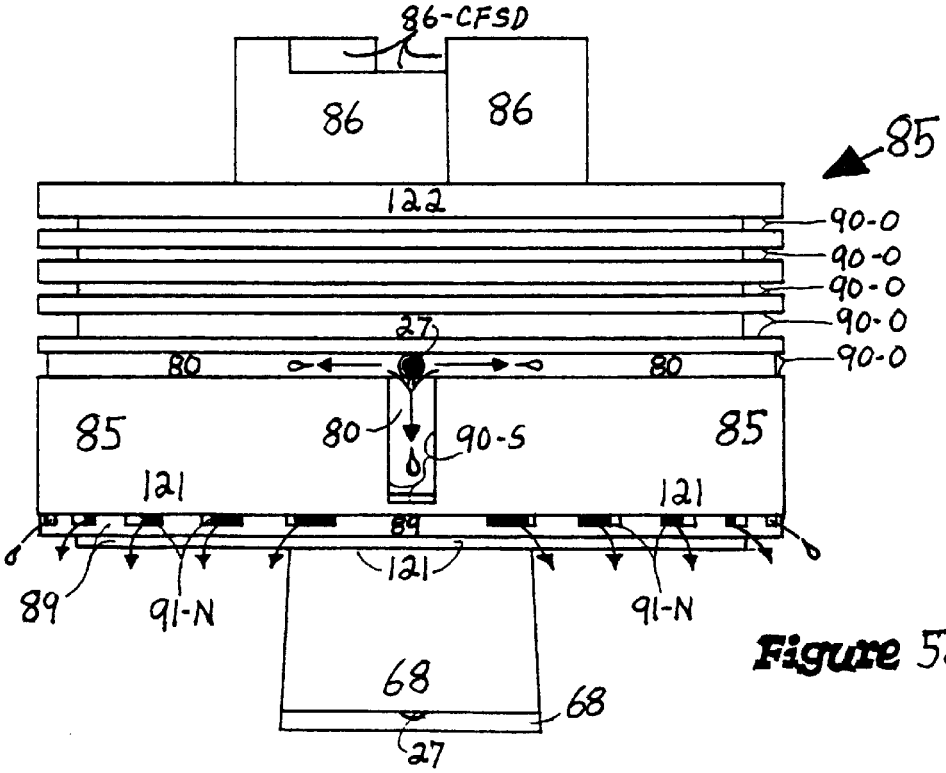

FIG. 52 Depicts SIDE View of FIG. 43.

Figure 53:
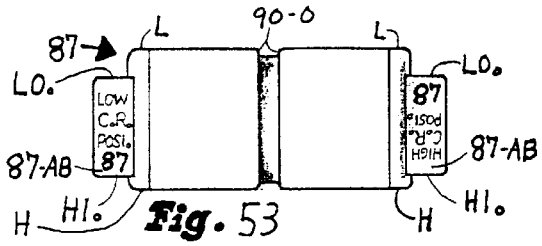

FIG. 53 Depicts FRONT or REAR View of High or Low C.R. (Compression Ratio) Position Piston PIN (viewed in LOW position—Compression Ratio(s)).

Figure 54:
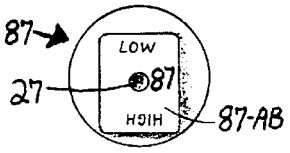

FIG. 54 Depicts SIDE View of FIG. 53.

Figure 55:
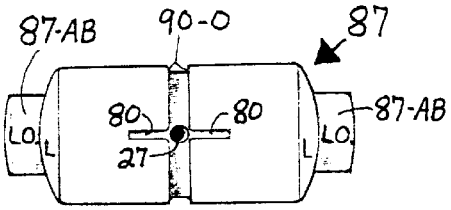

FIG. 55 Depicts TOP or BOTTOM View of FIG. 53.

Figure 56:
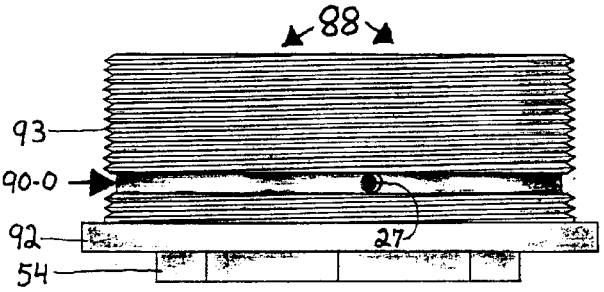

FIG. 56 Depicts SIDE View of Piston Pin CUP LOCK, Advance Shaded Outer Structure.

Figure 57:
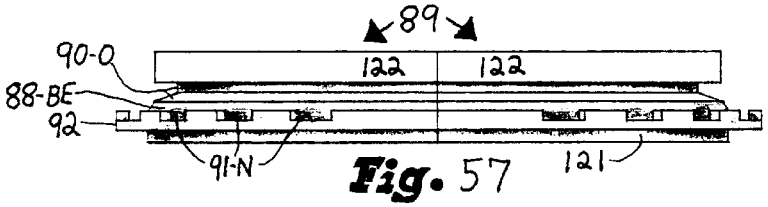

FIG. 57 Depicts SIDE View of Piston Pin CUP LOCK LOCK RING SEAL, Advance Shaded Outer Structure.

Figure 58:
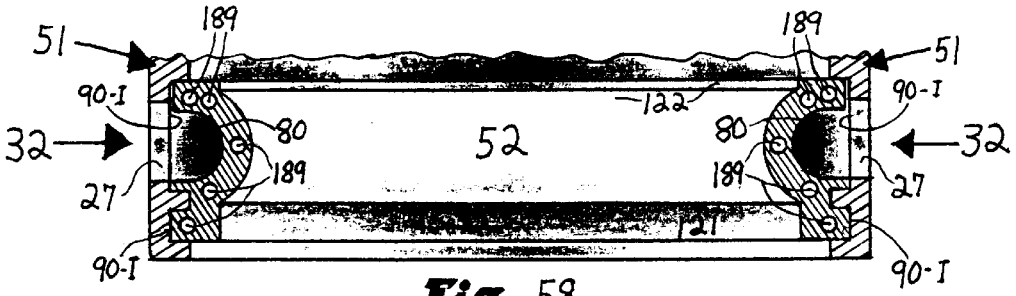

FIG. 58 Depicts Cross Cut—Cross-Hatch—Inner Diameter Structure Backside View of BOTTOM Cylinder: Block CYLINDER SLEEVE & SPRING BOOT SEAL (Laminated Neoprene type), taken Down Vertical Plane Line 32-32 of FIG. 28 area, for this section 32-32 view.

Figure 59:
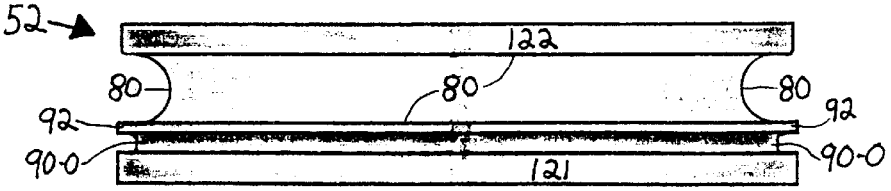

FIG. 59 Depicts Outer Diameter SIDE View of FIG. 58, Laminated Neoprene SPRINGBOOT SEAL Structure, Advance Shaded View.

Figure 60:
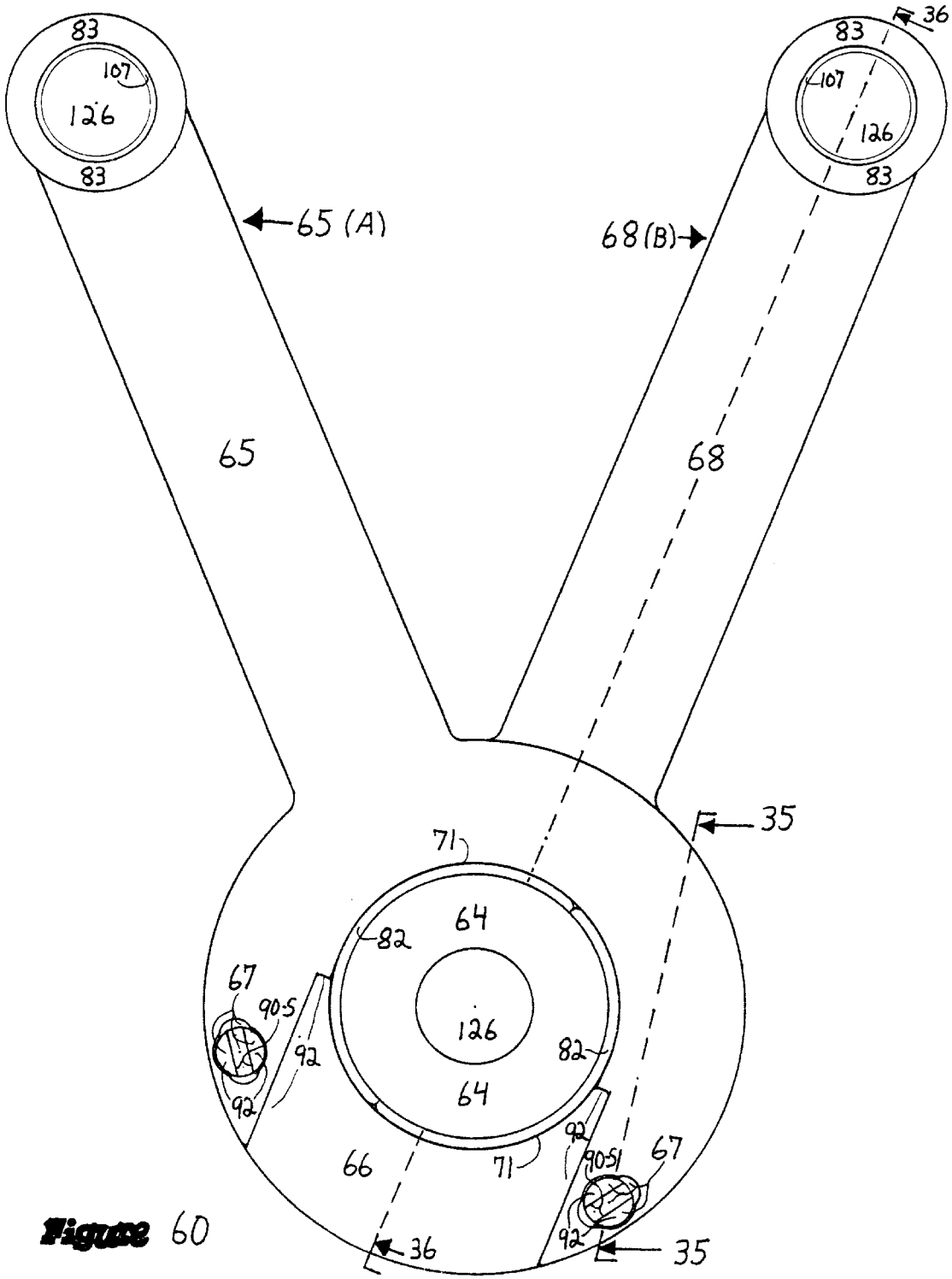

FIG. 60 Depicts FRONT OSIV' V-LOCK FORK CONNECTING ROD(S) Assembly-View, positioned on Crankshaft Throw Arm Pin—BOTTOM Center Area.

Figure 61:
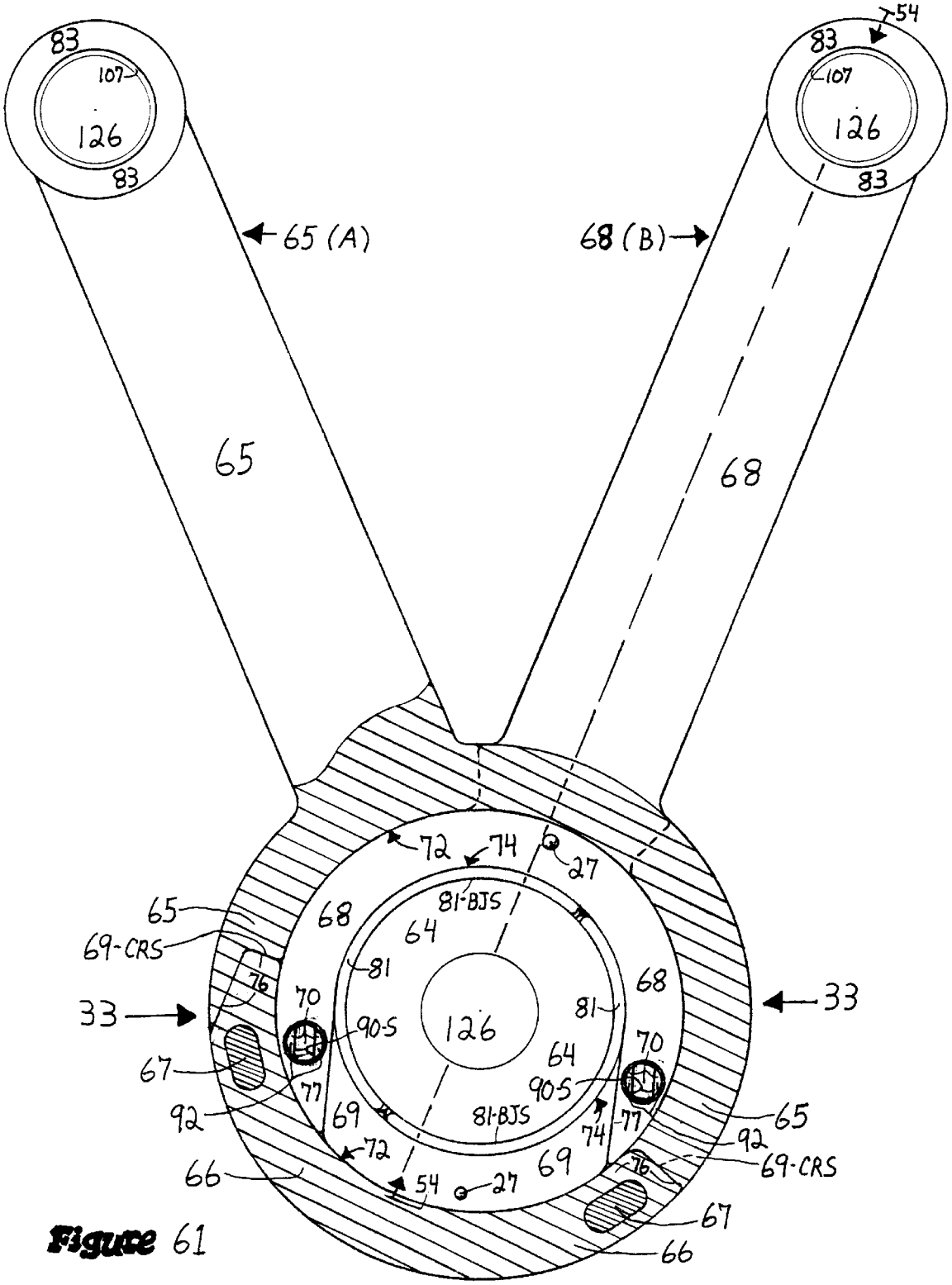
Figure 63:
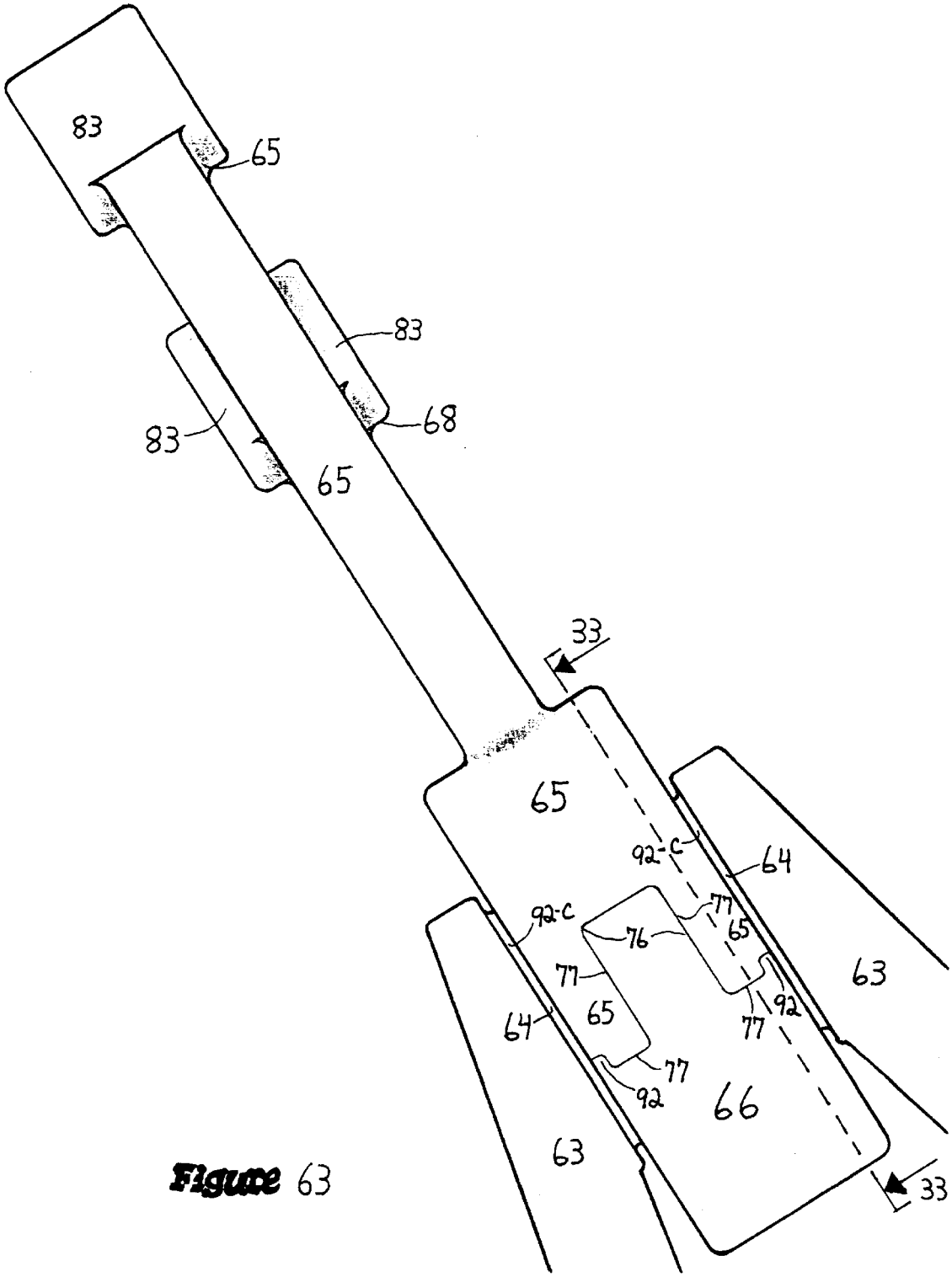

*FIG. 61 Depicts FRONT Fork & Cap—Big End Material REMOVED and WITH Cross-Hatch Area—of FIG. 60, section area 33-33 taken Down Vertical Plane Line 33-33 of FIG. 63.

Figure 62:
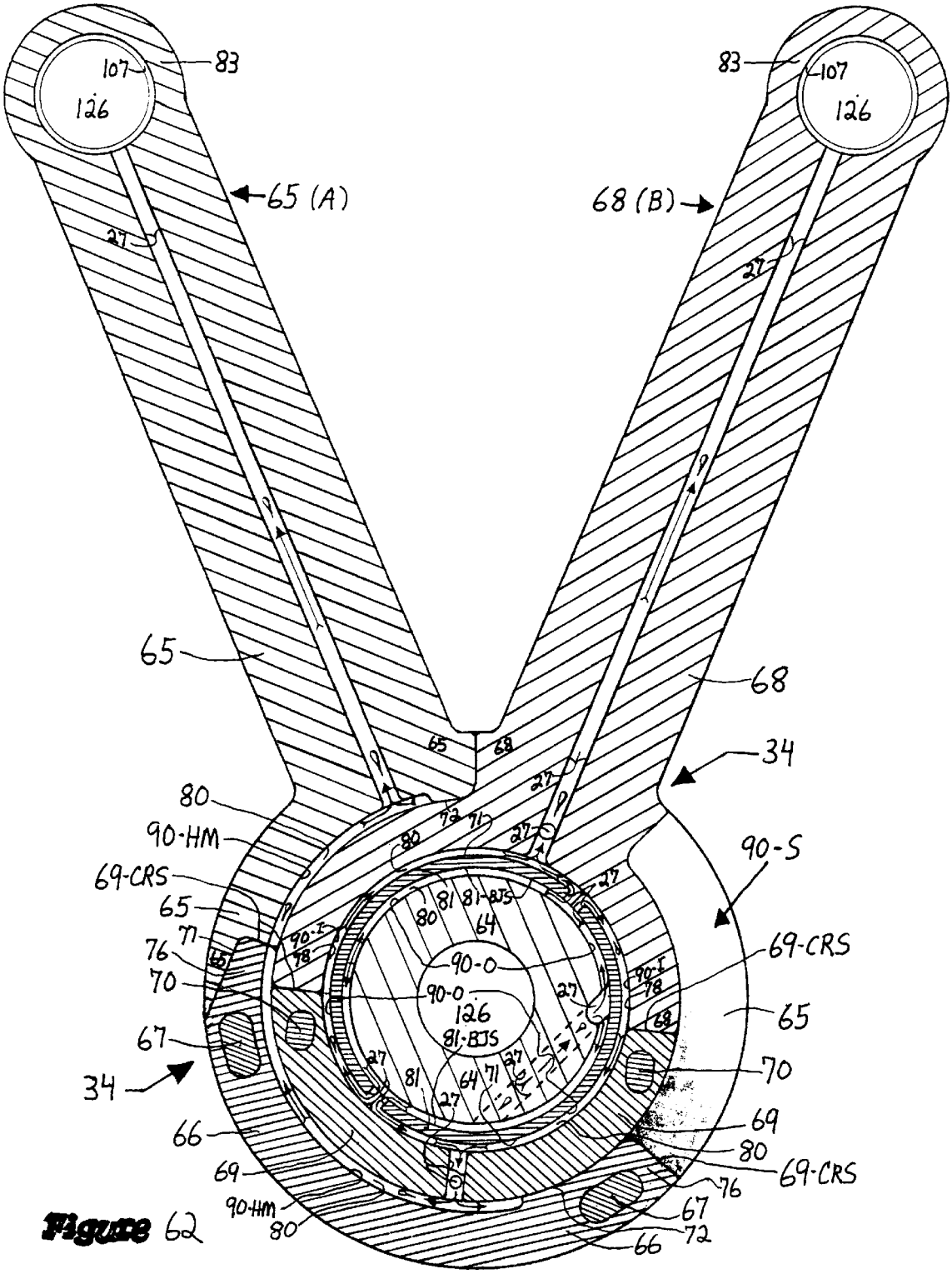
Figure 64:
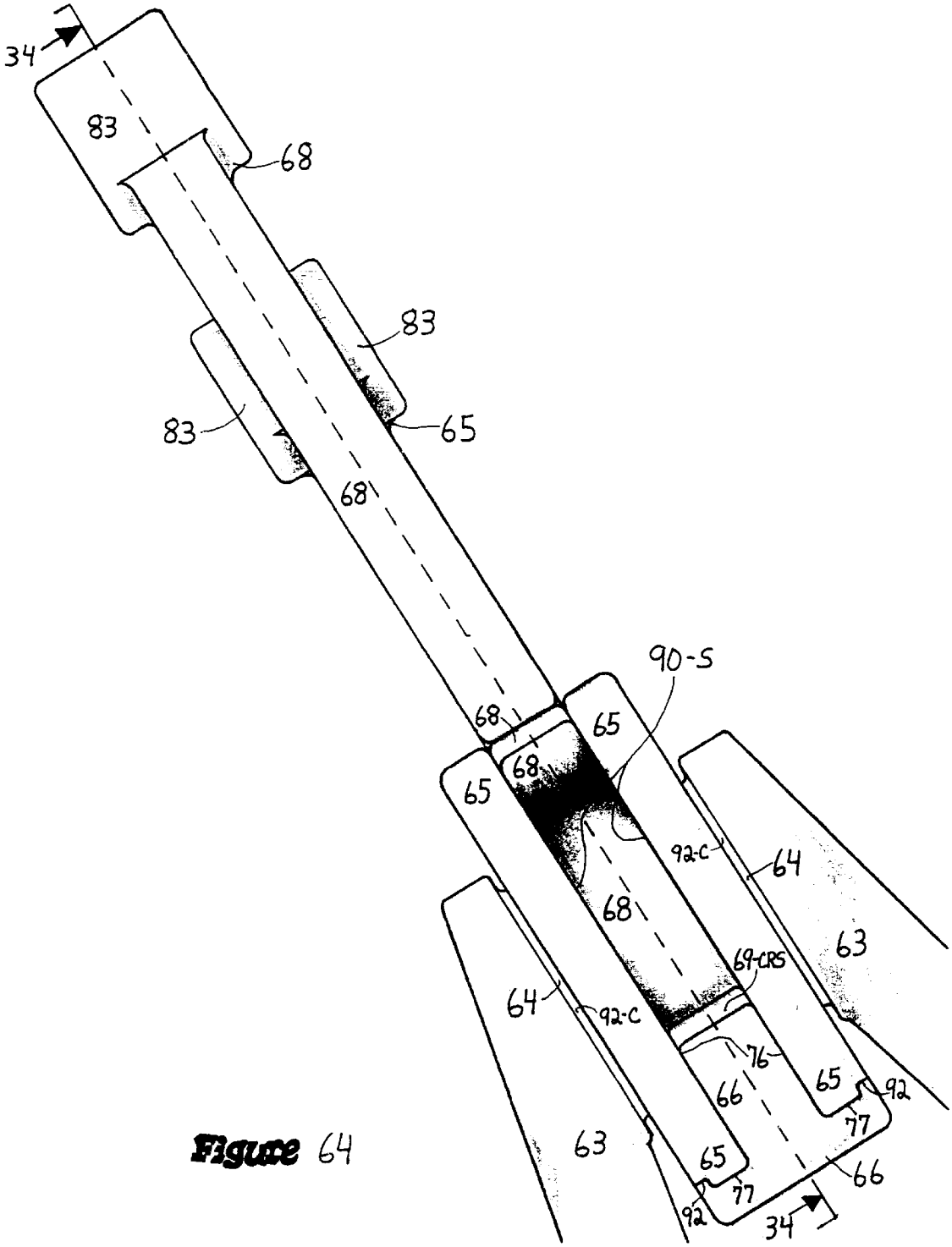

*FIG. 62 Depicts Cross-Cutaway—Cross-Hatch Internal Structure section area 34-34 of FIG. 60, taken Down Vertical Plane Line 34-34 of FIG. 64.

FIG. 63 Depicts RIGHT BANK Engineside of V-LOCK FORK CONNECTING ROD(S) Assembly of FIG. 60—on Crankshaft Throw Arm Pin.

FIG. 64 Depicts LEFT BANK Engineside of V-LOCK FORK CONNECTING ROD(S) Assembly of FIG. 60—on Crankshaft Throw Arm Pin.

Figure 65:
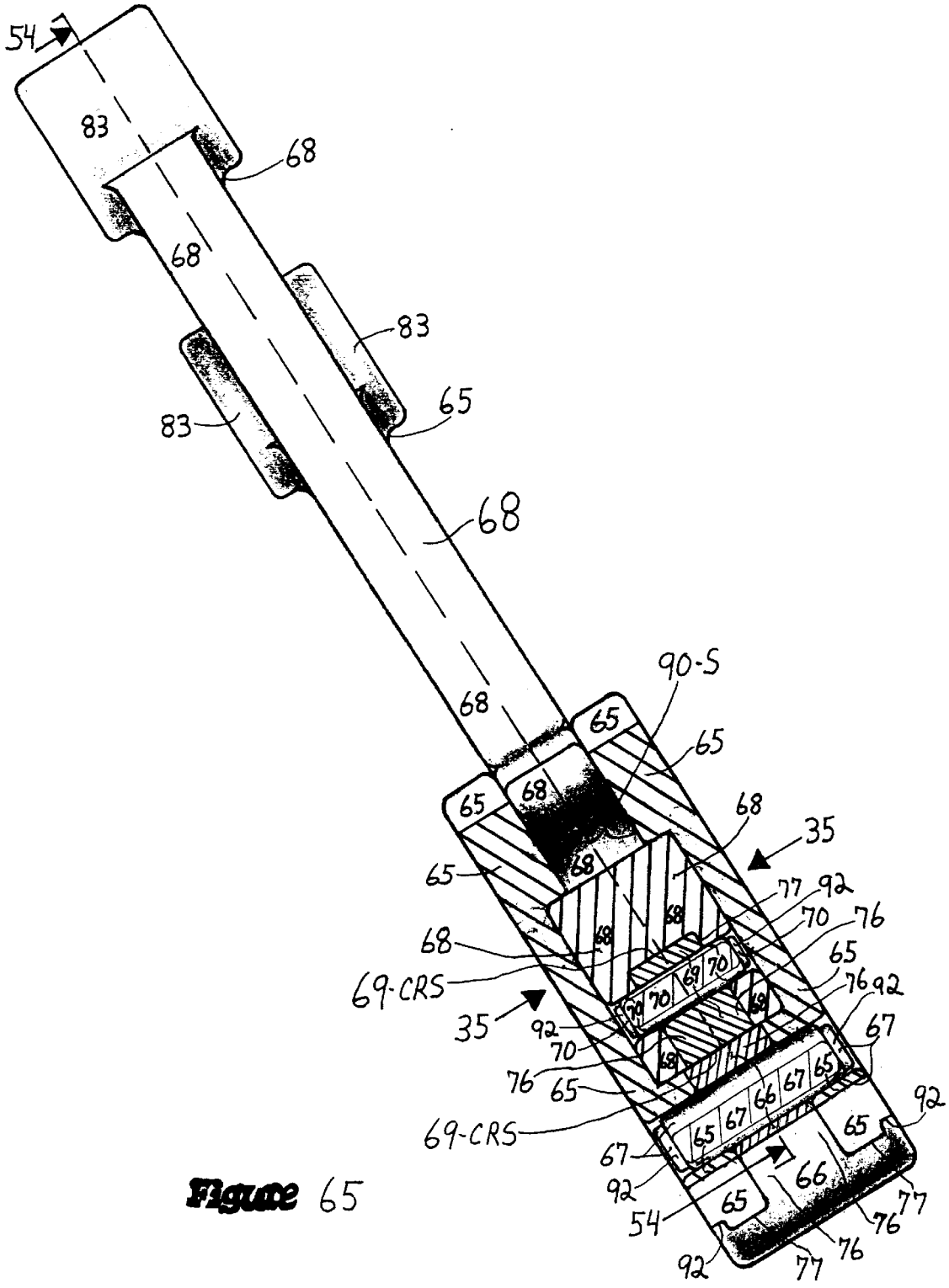

FIG. 65 Depicts Cross-Hatch section area 35-35, Cutaway Down Vertical Plane Line 35-35 of FIG. 60 LEFT BANK Engineside of V-LOCK FORK CONNECTING ROD(S) Assembly to Expose basic Structure and both PIN LOCKS—Mate-Up Area.

Figure 66:
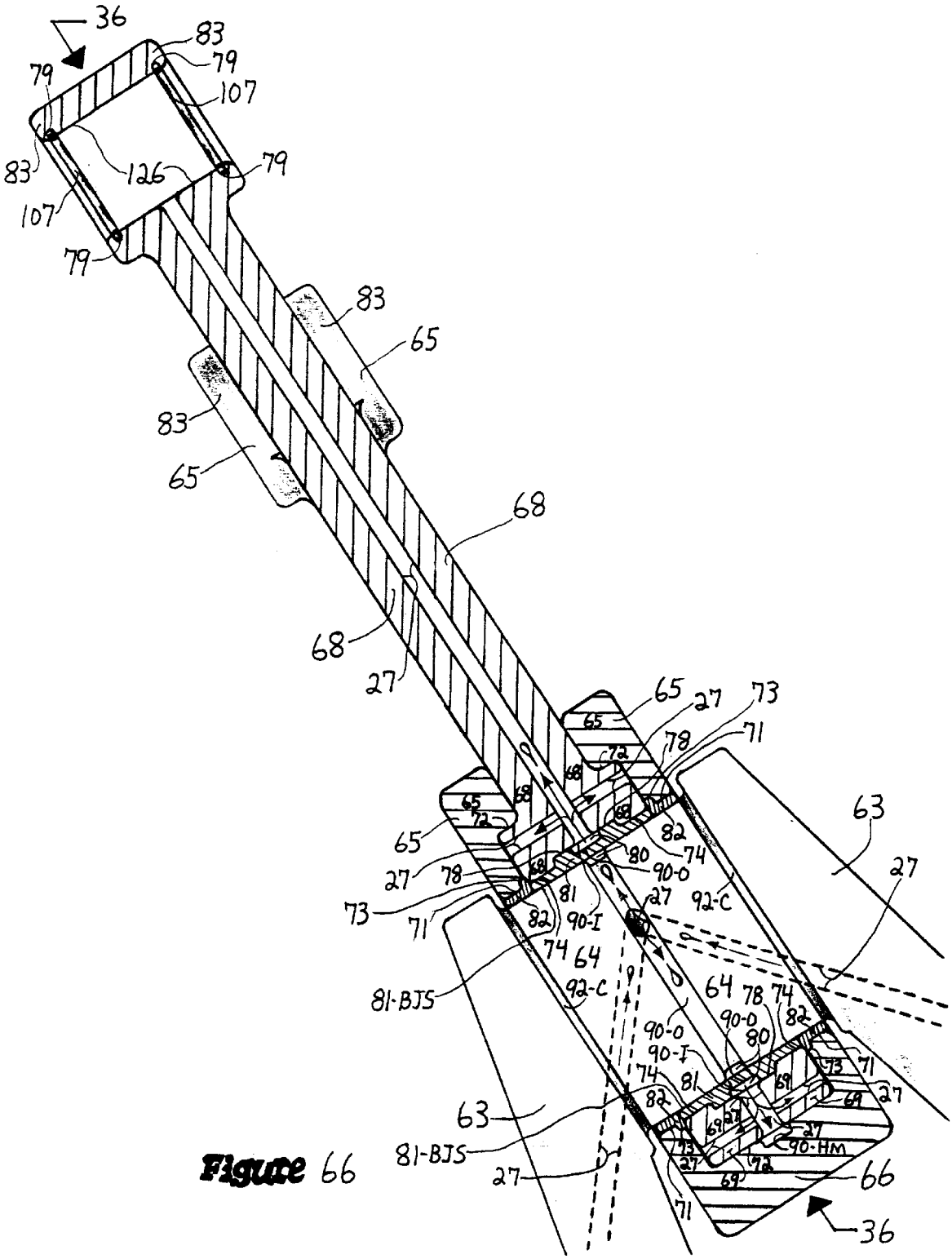

FIG. 66 Depicts Cross-Cutaway—Cross-Hatch section area Structure 36-36, Down Vertical Plane Line 36-36 of FIG. 60.

*Some of these Drawing Views include basic Broken Line Phantom areas and Arrows—of OIL Passage Areas and Oil Flow Routes—and Partial Broken Line Phantom (BROKE L. PHTMS.)—view—FIG. 61, FIG. 62, FIG. 65, and the FIG. 66.

Figure 67:
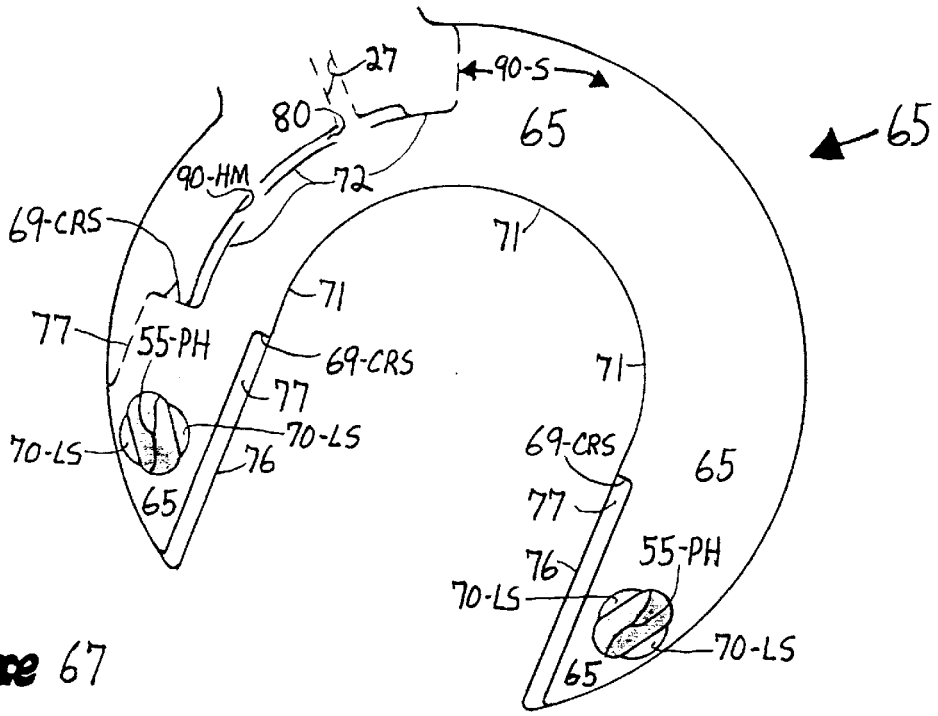

FIG. 67 Depicts BIG End Front View of Fork Lock Rod (FORK ROD (A)) Structure Part of FIG. 60, and—the REAR is the same.

Figure 68:
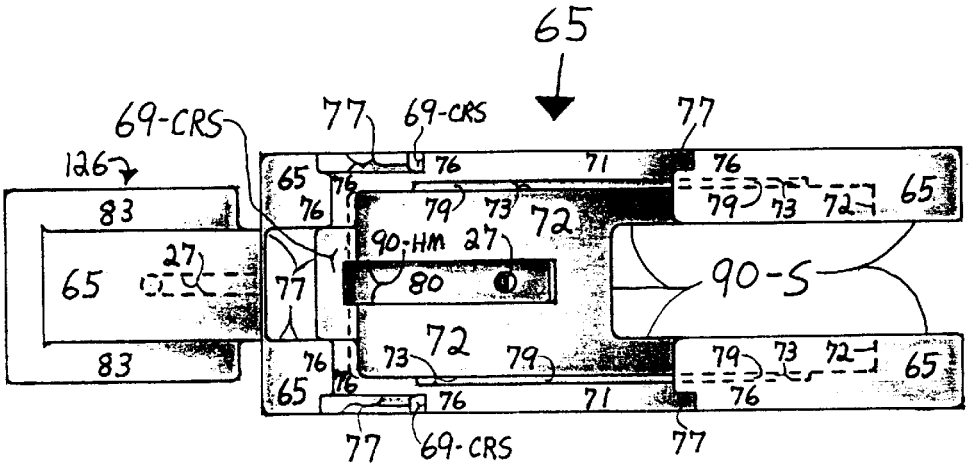

FIG. 68 Depicts Horizontal Plane Position—BOTTOM & SIDE View with Phantom Broken Line Partial View of Inner Structure Grooves and Oil Passage to Small End Of ROD—of FIG. 60 & others.

Figure 69:
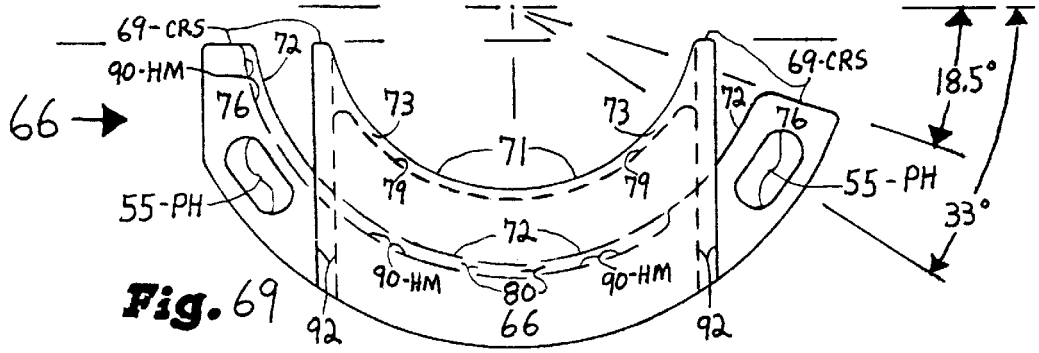

FIG. 69 Depicts FRONT View Structure of the Big End ROD FORK LOCK CAP (ROD LOCK CAP (A)) Part of FIG. 60.

Figure 70:
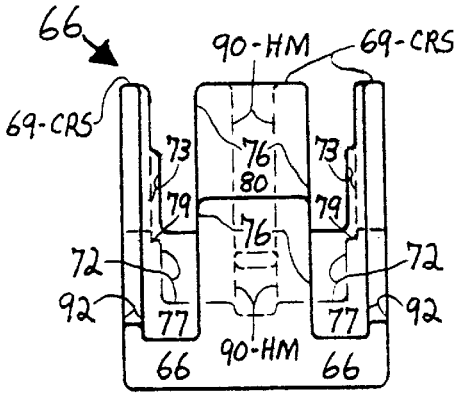

FIG. 70 Depicts RIGHTSIDE View of FIG. 69.

Figure 71:
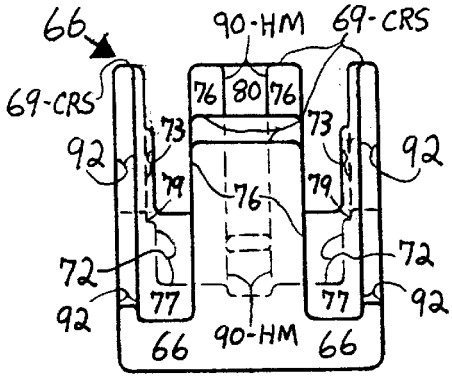

FIG. 71 Depicts LEFTSIDE View of FIG. 69.

Figure 72:
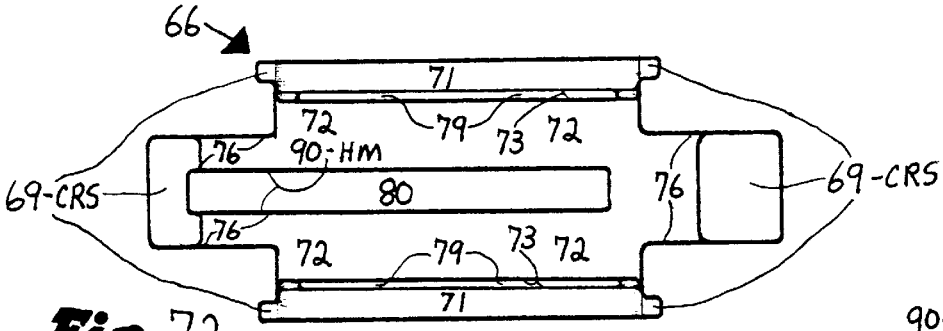

FIG. 72 Depicts TOP & INNER Diameter View of FIG. 69.

Figure 73:
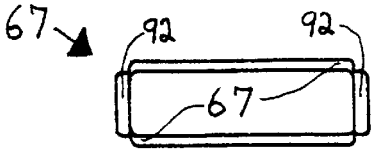

FIG. 73 Depicts FRONT or REAR—Horizontal Position View of FORK PIN LOCK (PIN LOCK (A)) Part of FIG. 60.

Figure 74:
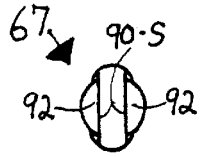

FIG. 74 Depicts SIDE—RIGHT & LEFT view Structure Area of FIG. 73.

Figure 75:
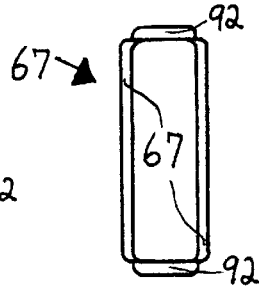

FIG. 75 Depicts FRONT or REAR Vertical Position View of (PIN LOCK (A)) of FIG. 73.

Figure 76:
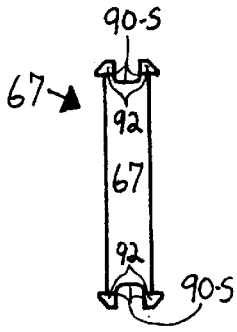

FIG. 76 Depicts TOP or BOTTOM Side—Vertical Position View of (PIN LOCK (A)) of FIG. 75.

Figure 77:
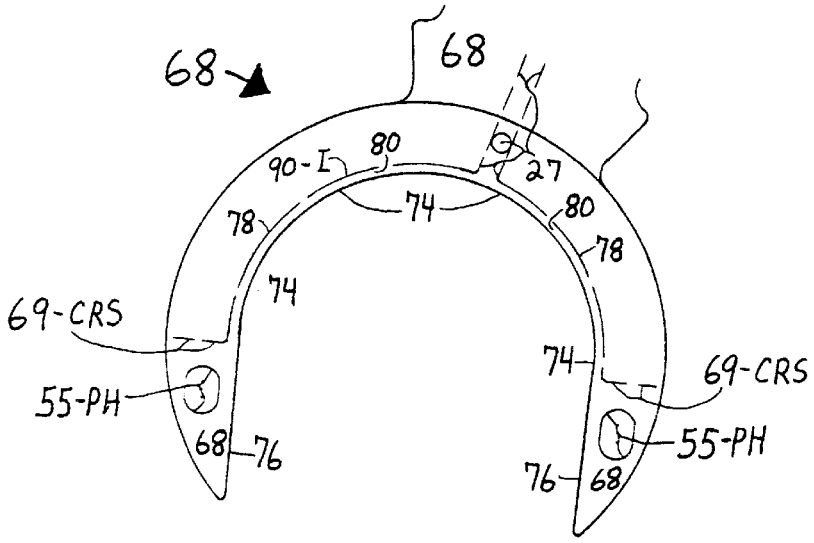

FIG. 77 Depicts Big End FRONT View of FORK LOCK ROD (FORK ROD (B)) Structure of FIG. 60, FIG. 61, View(s), the REAR is the same.

Figure 78:
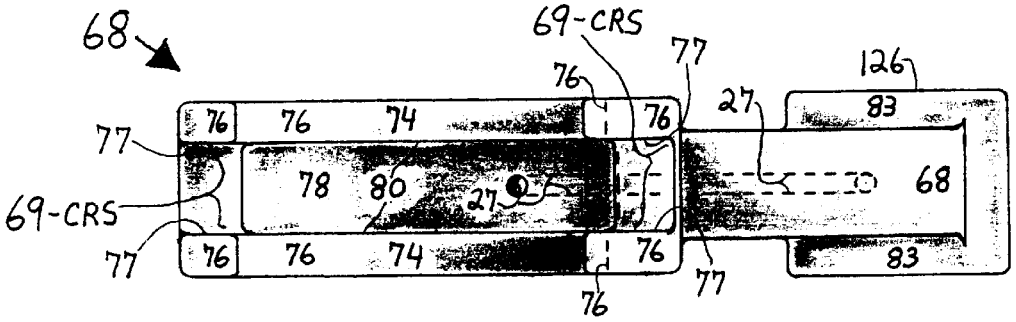

FIG. 78 Depicts Horizontal Plane BOTTOM & SIDE View WITH Phantom Broken Line Partial View of Inner Structure GROOVE and OIL Passage to Small End of ROD, of FIG. 60, and FIG. 61 View.

Figure 79:
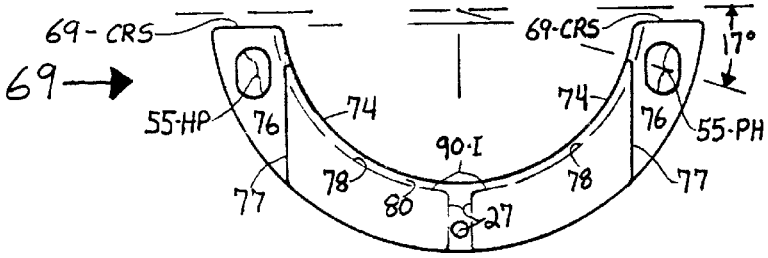

FIG. 79 Depicts FRONT or REAR Structure of the Big End ROD FORK LOCK CAP (ROD LOCK CAP (B)) Part of FIG. 60 and FIG. 61 View.

Figure 80:
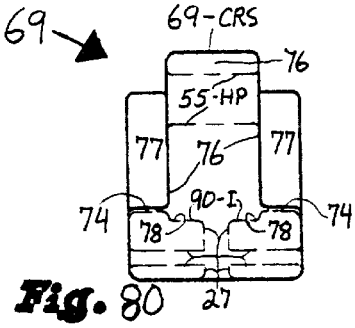

FIG. 80 Depicts RIGHT or LEFT Side View of FIG. 79.

Figure 81:
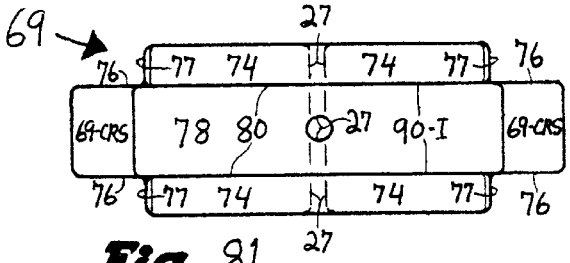

FIG. 81 Depicts TOP & Inner Diameter GROOVE View of FIG. 79.

Figure 82:
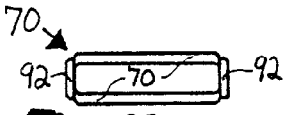

FIG. 82 Depicts FRONT or REAR—Horizontal Position View of FORK PIN LOCK (PIN LOCK (B)) Part of FIG. 60 and FIG. 61 View.

Figure 83:
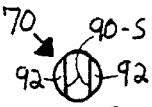

FIG. 83 Depicts RIGHT or LEFT Side View of FIG. 82.

Figure 84:
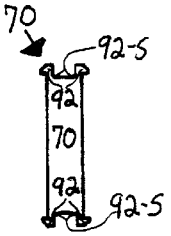

FIG. 84 Depicts TOP or BOTTOM Side—Vertical Position View of (PIN LOCK (B)) of FIG. 82.

Figure 85:
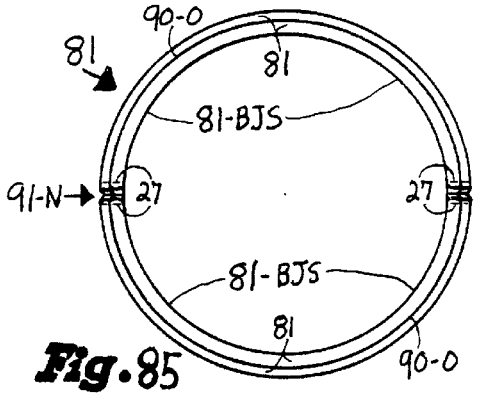
Figure 86:
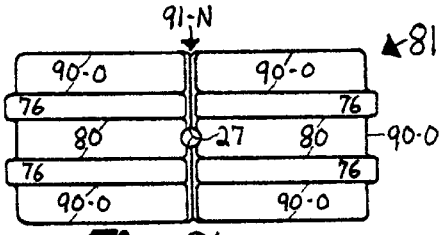

FIG. 85 Depicts FRONT or REAR Side View Structure of the Two Piece—FREE SPIN BEARING—for Crank Pin Bearing Journal and for Crank Main Bearing Journal—type Technique Setup—Vertical Position, FIG. 86 Horizontal Position.

FIG. 86 Depicts Outer Diameter SIDE Mate-Up Area of FIG. 85. (Two Piece FREE-SPIN BEARINGS).

Figure 87:
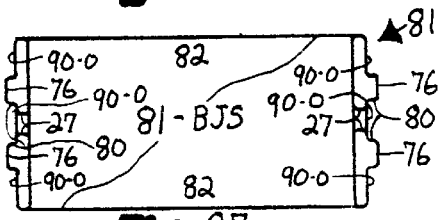

FIG. 87 Depicts Inner Diameter of One Piece—BOTTOM View Piece of FIG. 85, FREE-SPIN BEARING, Horizontal Position.

Figure 88:
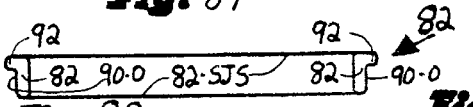
Figure 90:
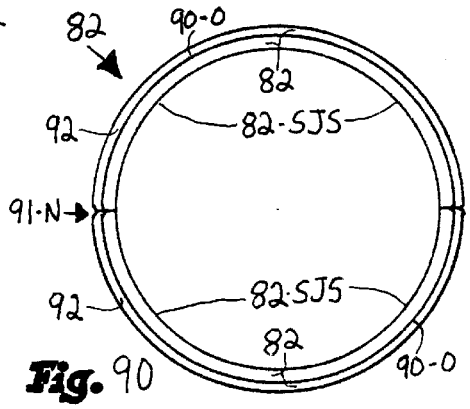

FIG. 88 Depicts Inner Diameter of One Piece—BOTTOM View Piece of FIG. 90, Free-Spin Bearing type SEAL, Horizontal Position.

Figure 89:
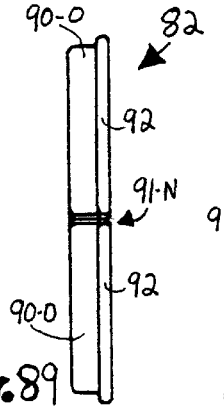

FIG. 89 Depicts Outer Diameter SIDE Mate-Up Area of FIG. 90, depicts LEFT SIDE Two Piece SEAL(S), Left LIP (REAR Area), and RIGHT Side is (FRONT Area), Vertical Position.

FIG. 90 Depicts FRONT View Side—Structure Area of the Two Piece Free-Spin SEAL for—Crank Throw ARM PIN & Crank Main JOURNAL(S)—Bearing SEAL type Technique Setup. Vertical Position.

Figure 91:
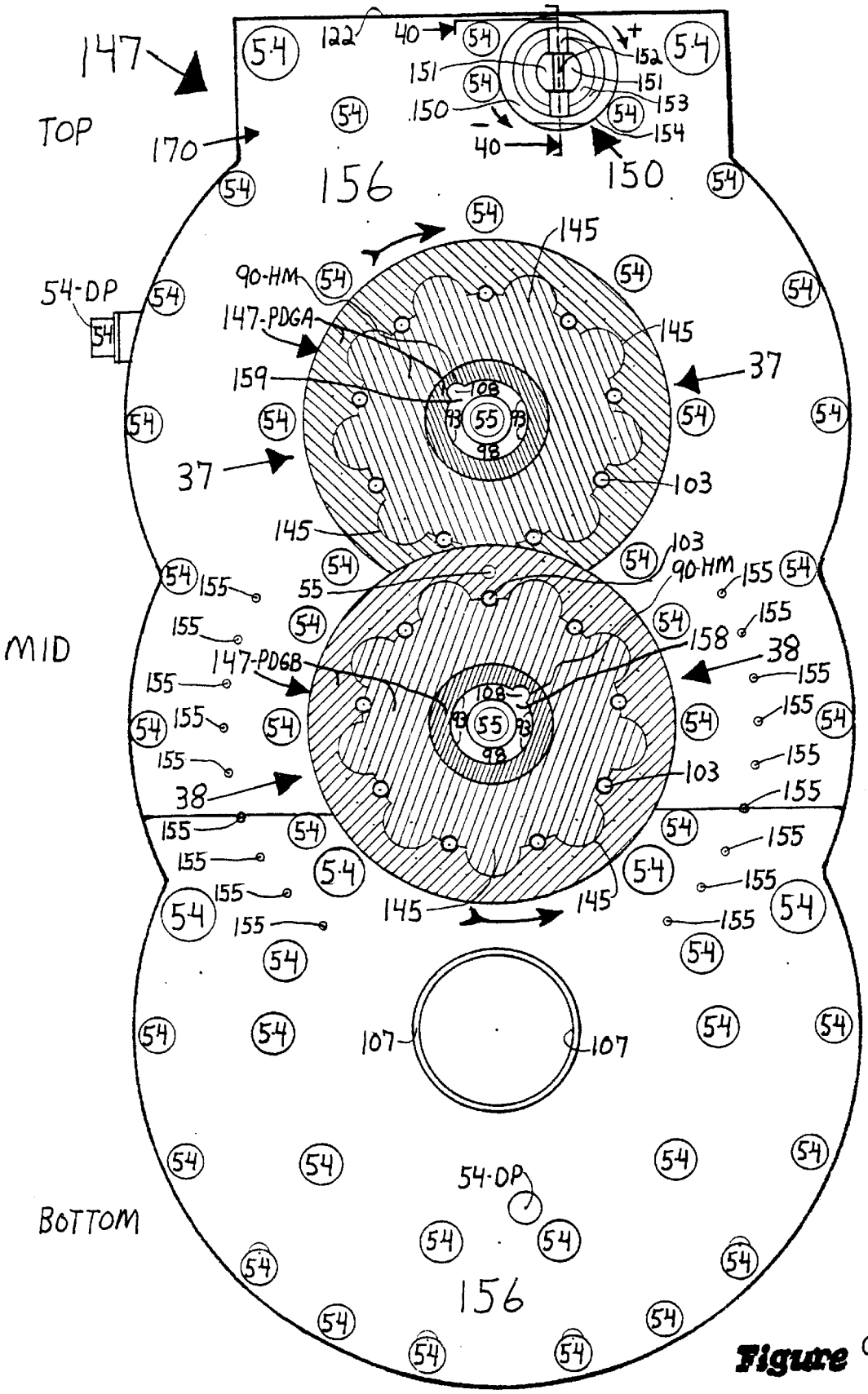

FIG. 91 Depicts FRONT Vertical View of Unique (RG.TDOP.SUCH.) (ROLLER GEAR—TIMING DRIVE OIL PUMP—SYSTEM UNIT CASE HOUSING) WITH Cross-Hatch—Cutaway section area 37-37 and 38-38, of the Two Drive PULLEY GEARS—for the Flex Drive BELTS, with Bolt or Nut & C-Clip LOCK WASHER(S) Removed—view, section Area 37-37 and 38-38 taken Down & Along Vertical—Horizontal Plane Line 37-37 of FIG. 104, and 38-38 of FIG. 104.

Figure 92:
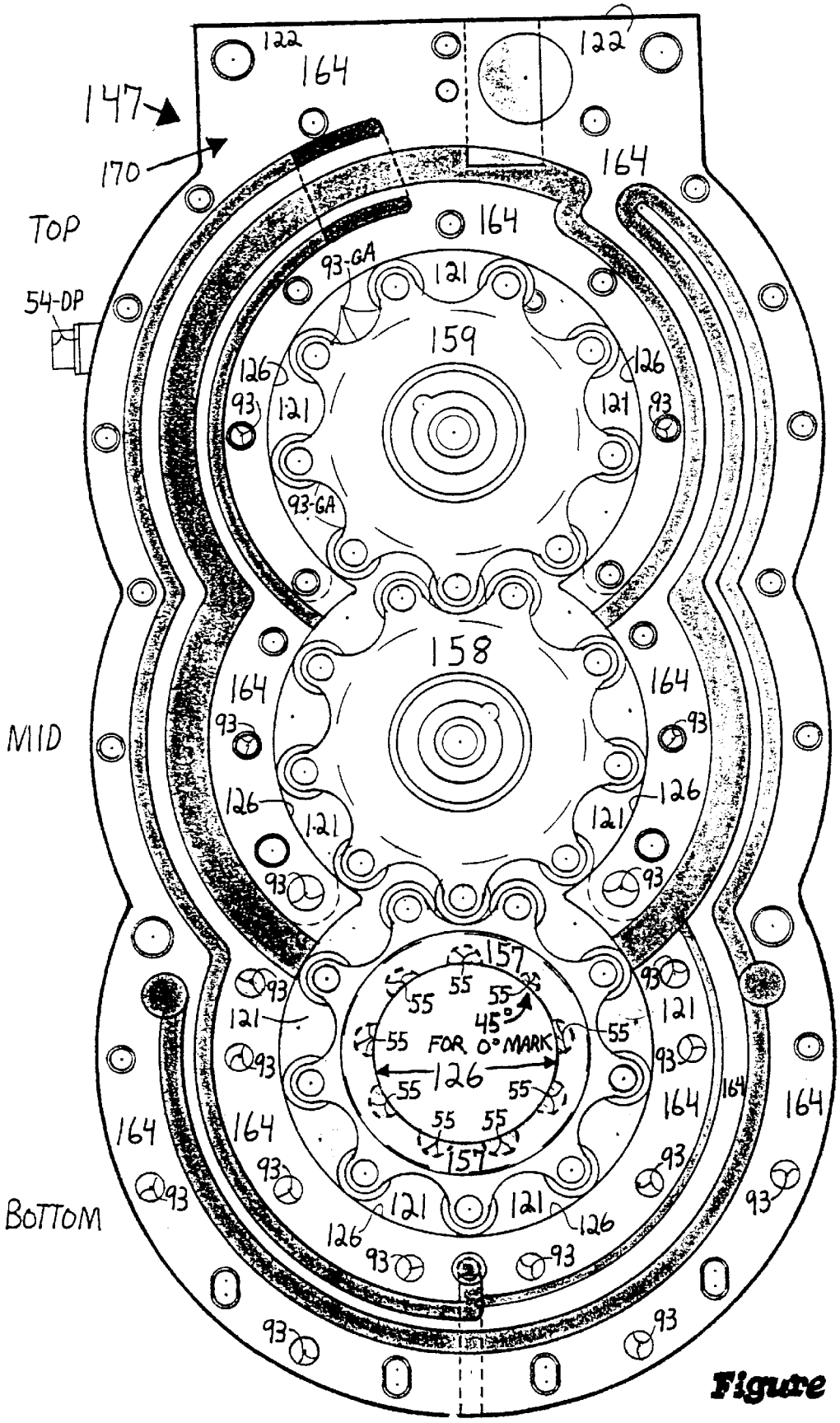

FIG. 92 Depicts FRONT Inside basic Roller Bearing type GEAR Drive OIL PUMP and GROOVE Passage—type SETUP of FIG. 91 WITHOUT it's FRONT Pulley Gears and FRONT Cover Plate SHIM GASKET & COVER PLATE. Phantom Broken Line Areas of Half-Moon SLOTS for matching Crankshaft Pinion TEETH NOSE—behind Bottom ROLLER GEAR FRONT Surface Area, OIL GROOVE within Material Areas, OIL Passage/HOLE areas.

Figure 93:
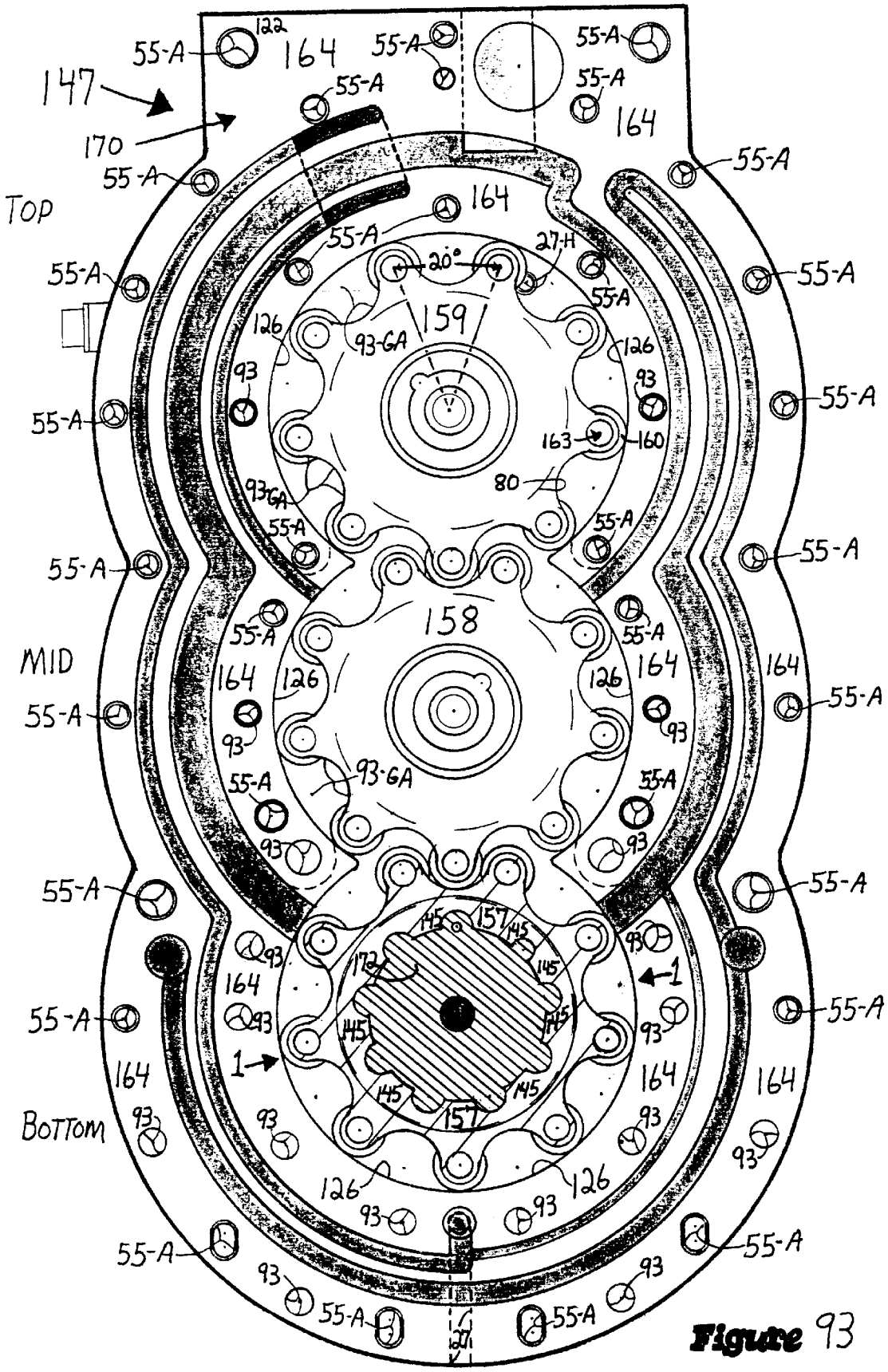
Figures 104, 105:
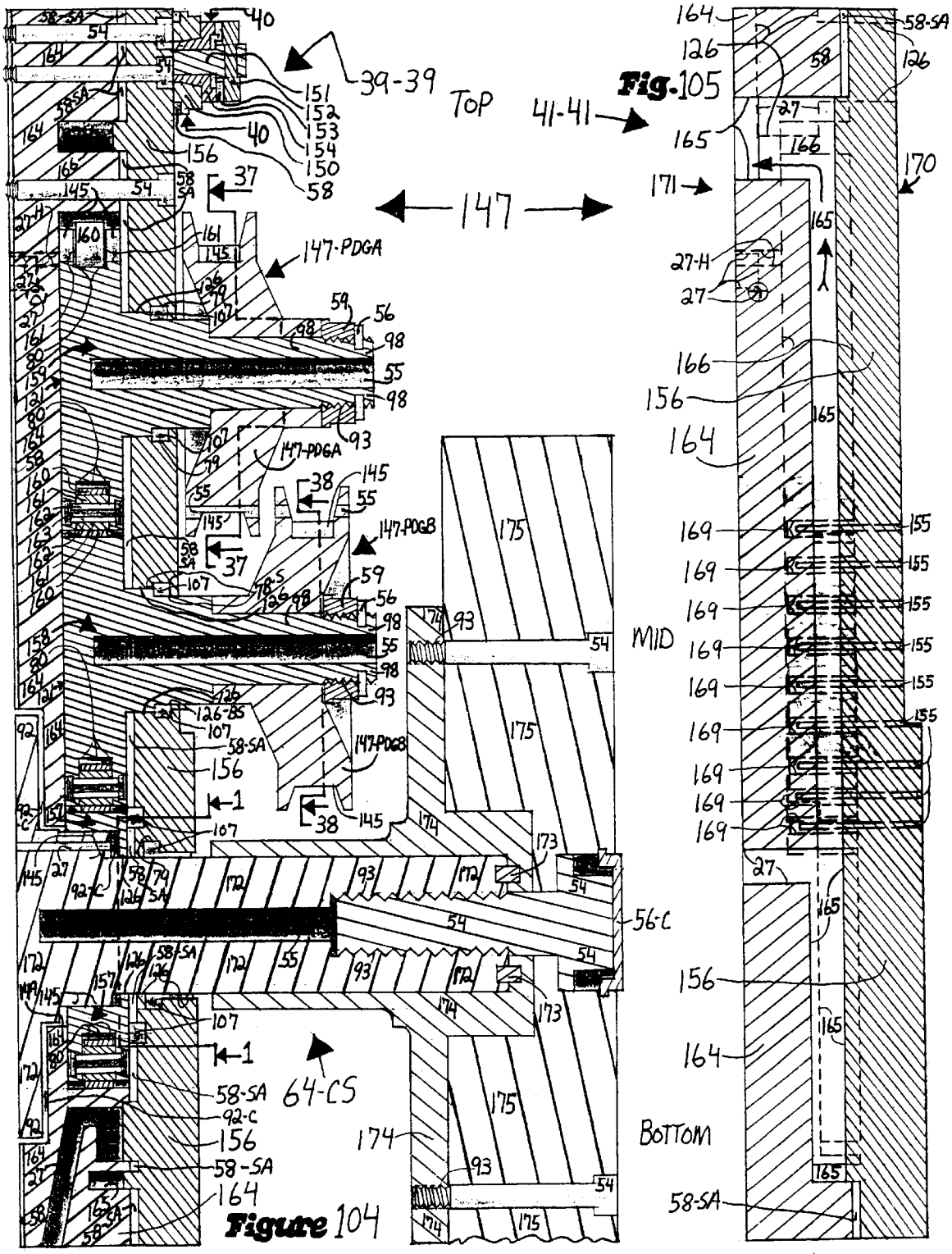

FIG. 93 Depicts same similar view of FIG. 92 WITH Cross-Hatch Cutaway section Area 1-1, taken ALONG Vertical Plane Line 1-1 of FIG. 104.

Figure 94:
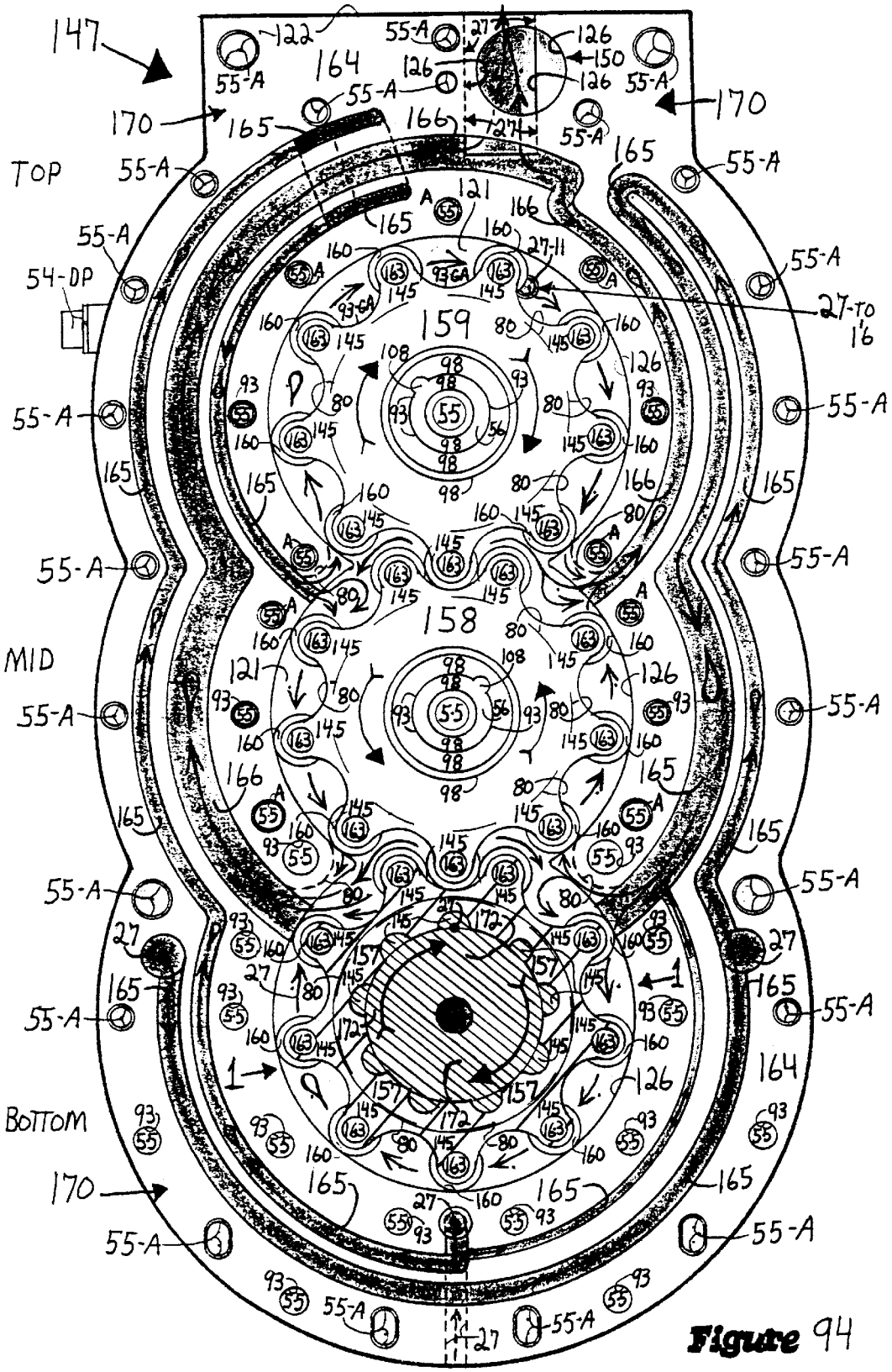

FIG. 94 Depicts same similar view of FIG. 93 WITH the ADDITION of ARROWS of the Direction of Intended OIL FLOW Control within the System Unit Case Housing—PASSAGES, and the basic Rotation of Crankshaft & Roller Gears.

Figure 95:
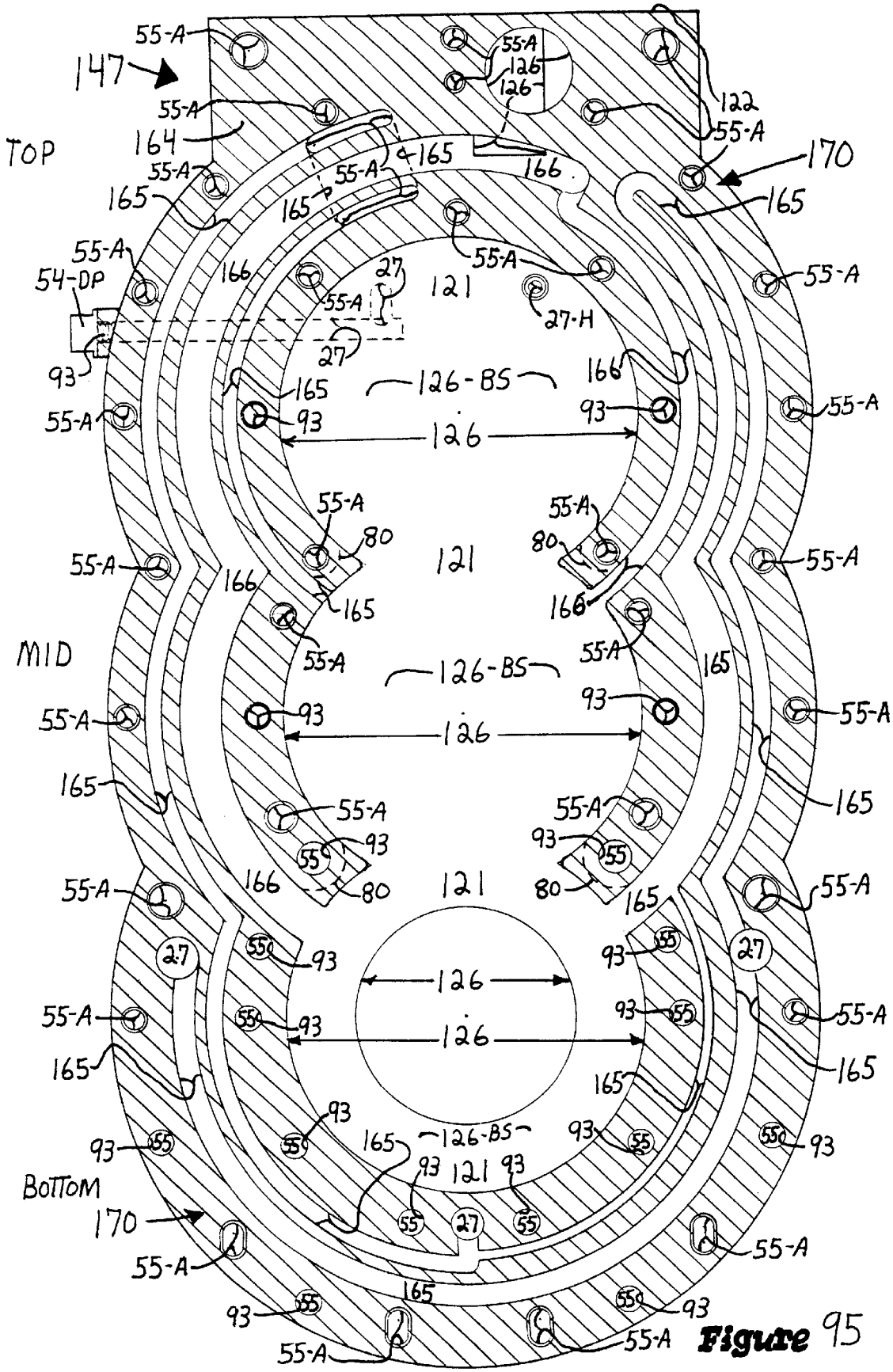

FIG. 95 Depicts Cross-Hatch Structure and Surface Area of FIG. 92 WITHOUT the ROLLERGEARS, a Phantom Broken Line OIL INLET Bottom Scavenge Passage and Top OIL OUTLET Passage (Rightside Off Center—TOP Area), & the ADDITION of Broken Line Phantom View of—OIL DRAIN PLUG BOLT-&-Oval HOLE for Passage of Oil from High Pressure Side RESERVOIR—Oil DRAINING.

Figure 96:
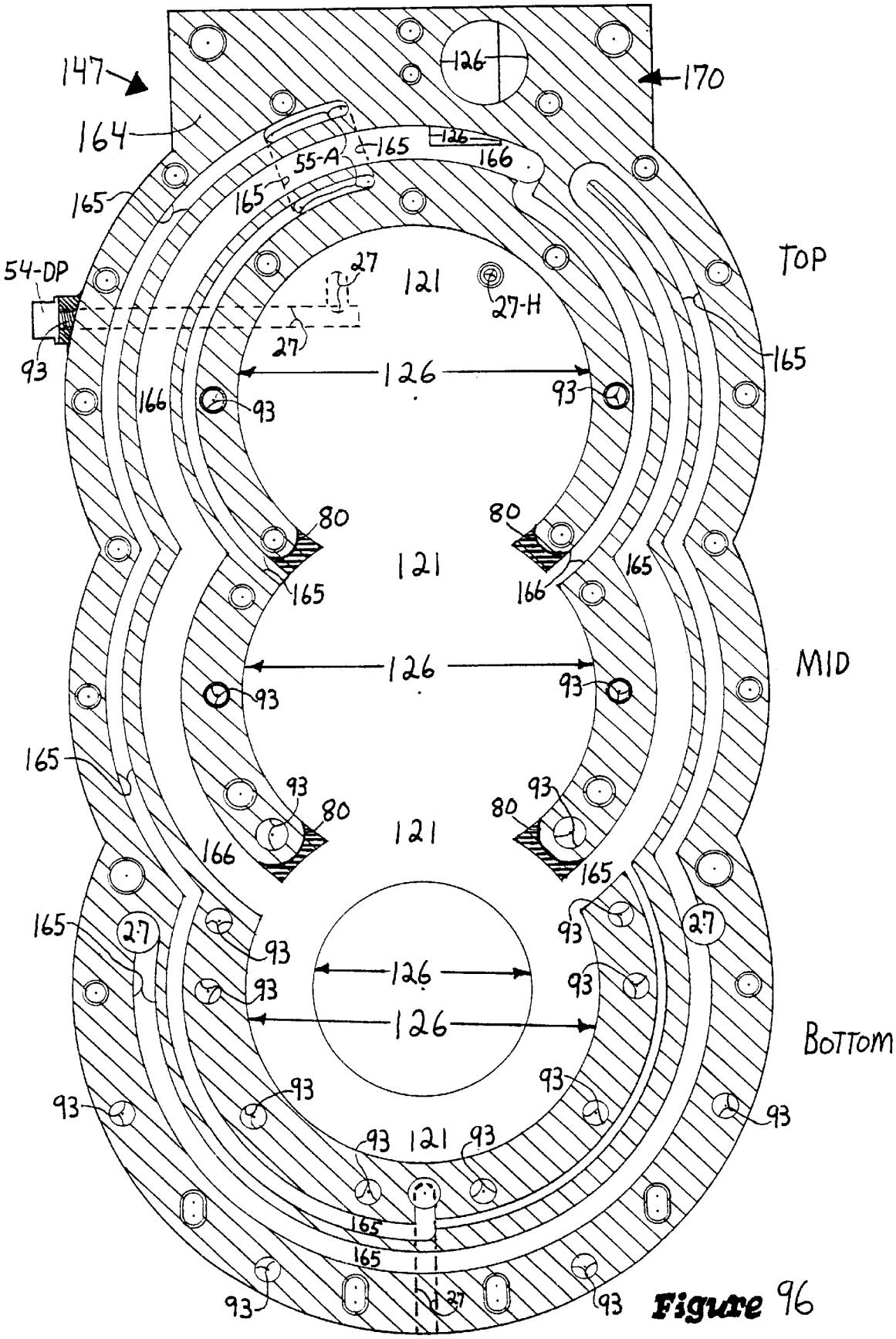

FIG. 96 Depicts same similar view of FIG. 95 WITH the ADDITION of extra Cross-Hatch Lines on—Oil Drain Bolt Plug BOSS/BASE—and the Four Inner EDGE Oil GROOVE Areas, BOTTOM Broken Line Phantom Oil Scavenge Passage INLET Area.

Figure 97:
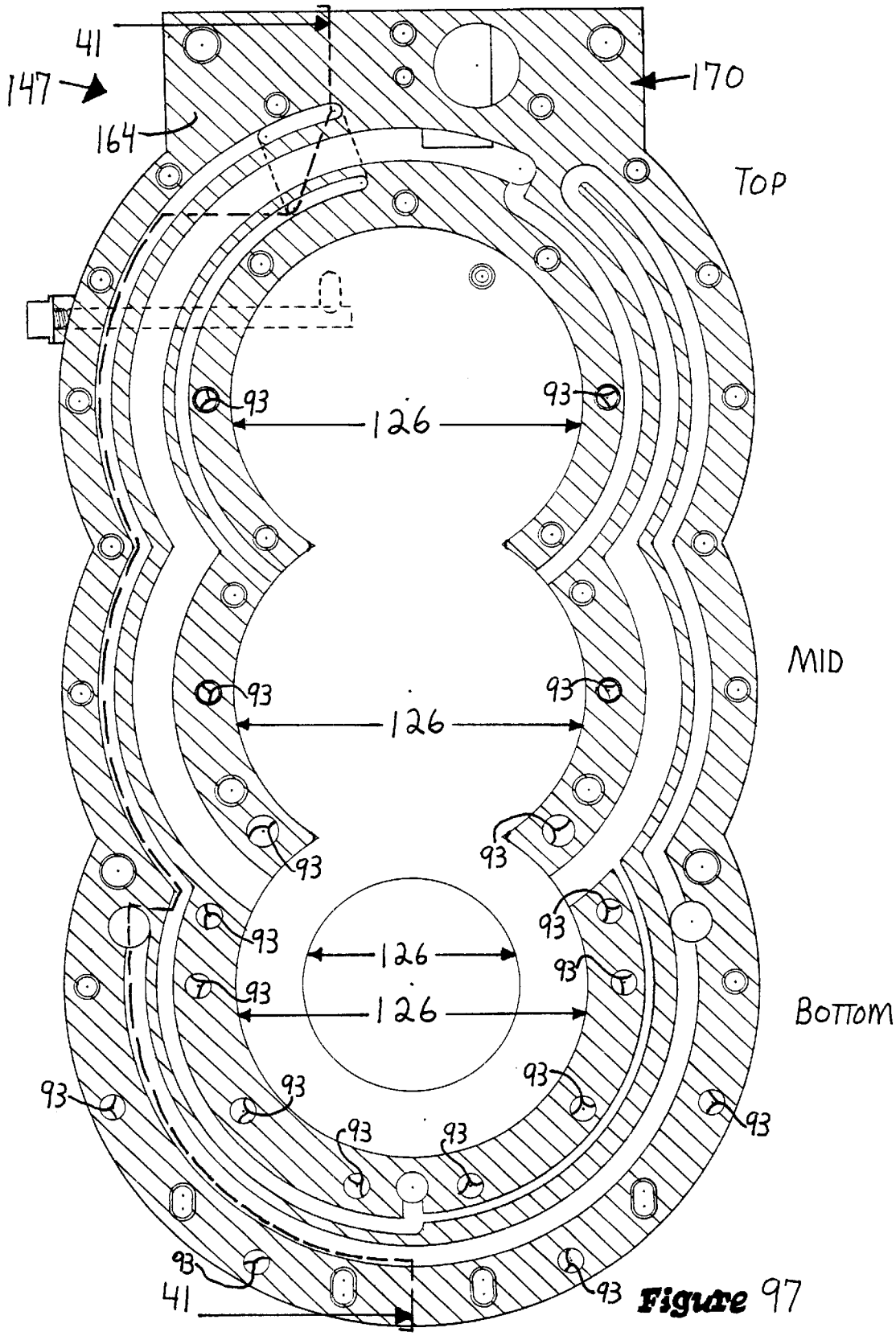

FIG. 97 Depicts same similar view of FIG. 95 WITHOUT the FOUR INNER EDGE Oil GROOVE(S) Phantom Broken Line Areas.

Figure 98:
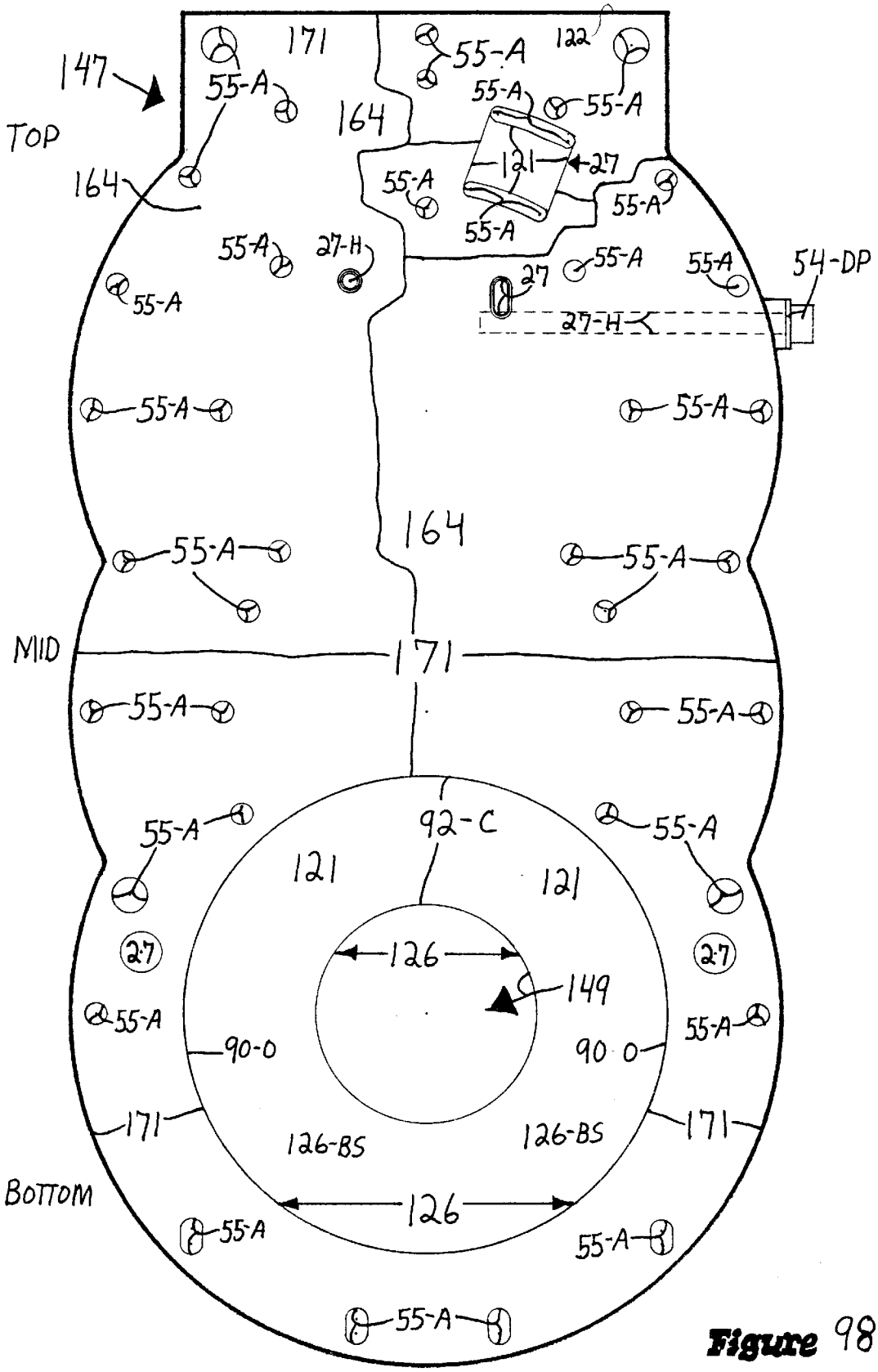

FIG. 98 Depicts the BACKSIDE of FIG. 97 basic view Structure Area—which mates to FRONT Engine Block(s) with a Appropriately Made SHIM Matching GASKET.

Figure 99:
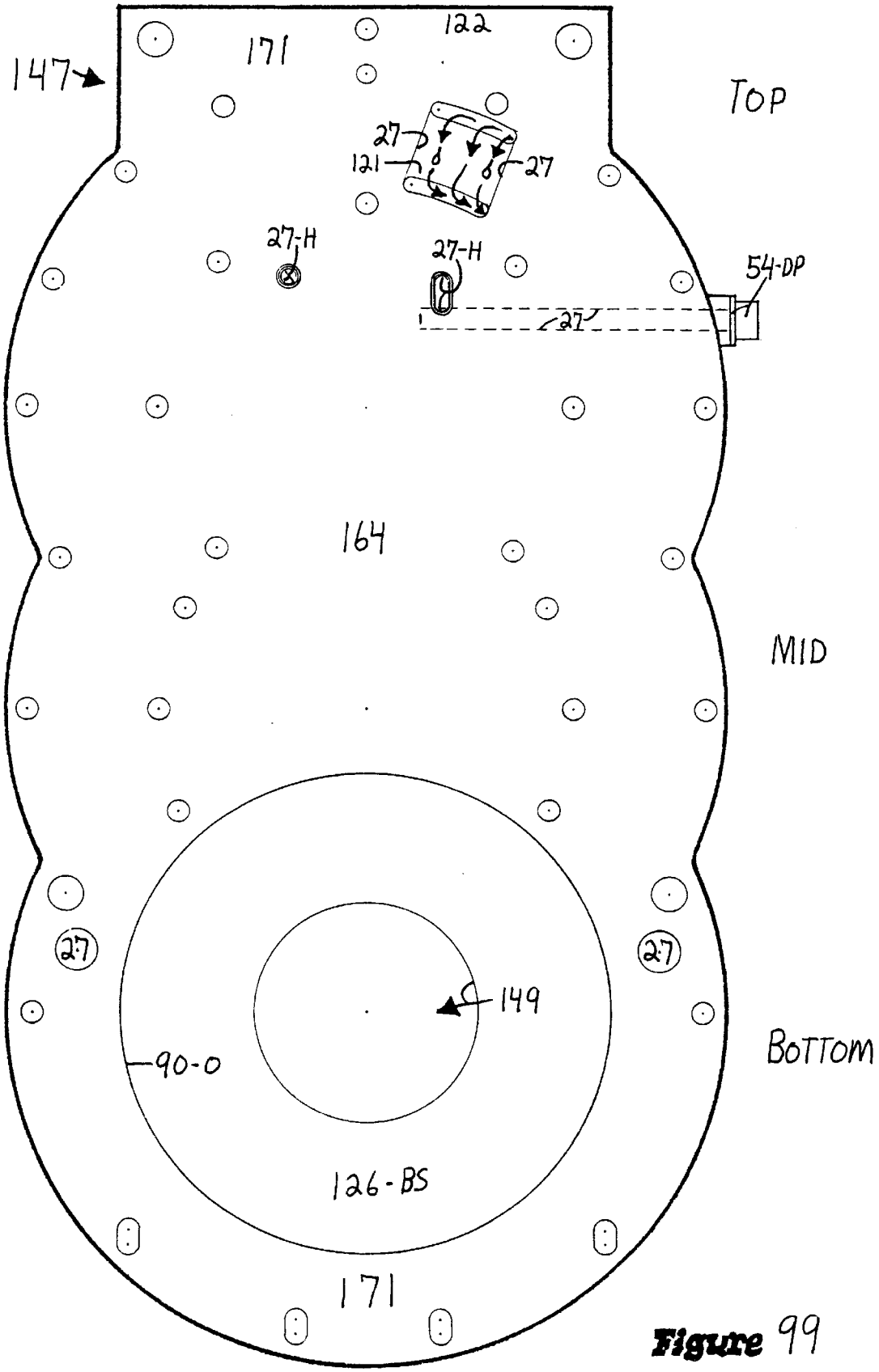

FIG. 99 Depicts same view of FIG. 98 (RG.TDOP.SUCH.) BACKSIDE Area WITHOUT main hair Lines.

Figure 100:
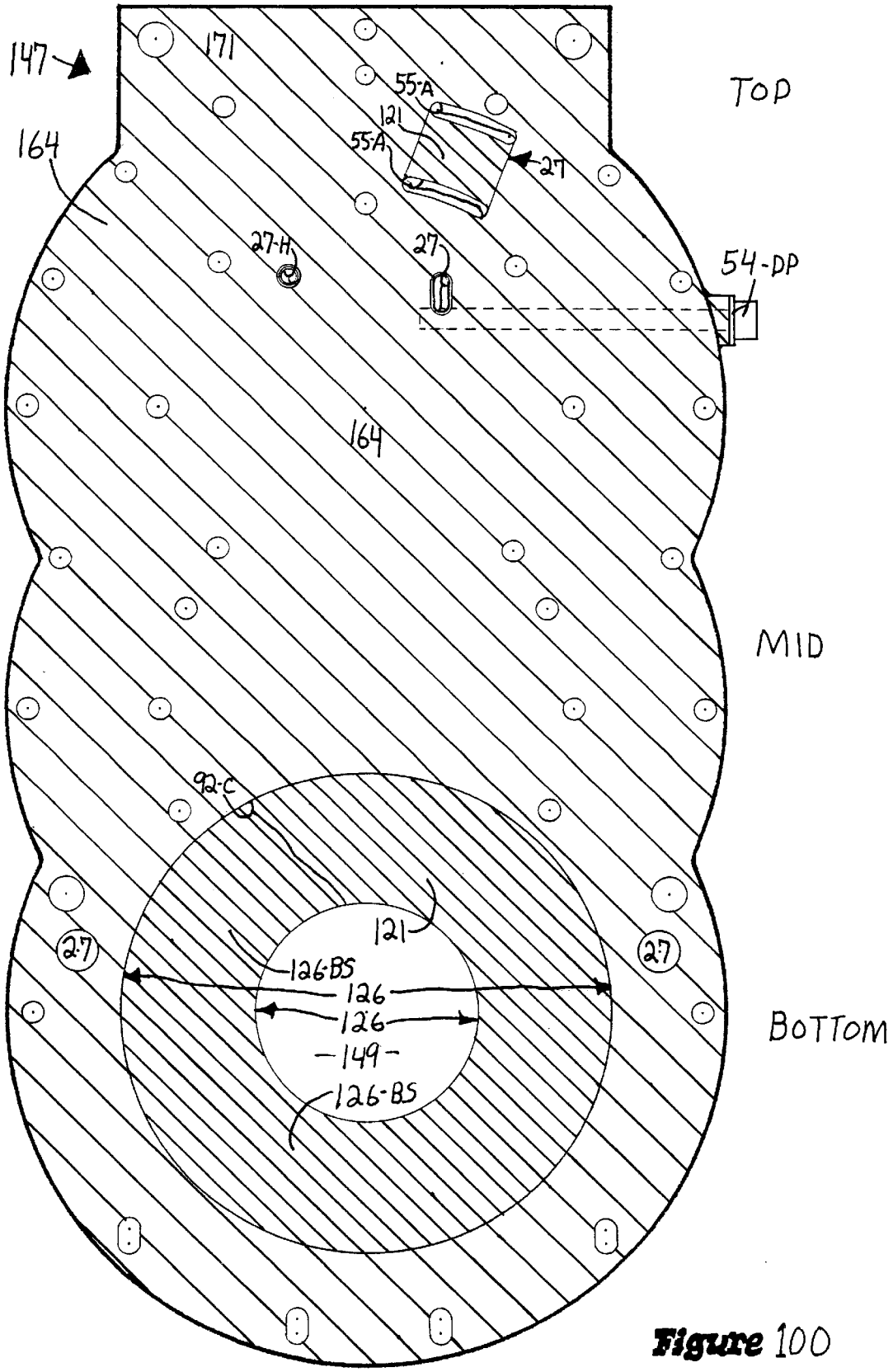

FIG. 100 Depicts same similar view of FIG. 99 WITH the ADDITION of Cross-Hatch Lines to show basic BACK Surface and BACK SURFACE Areas—Structure View.

Figure 101:
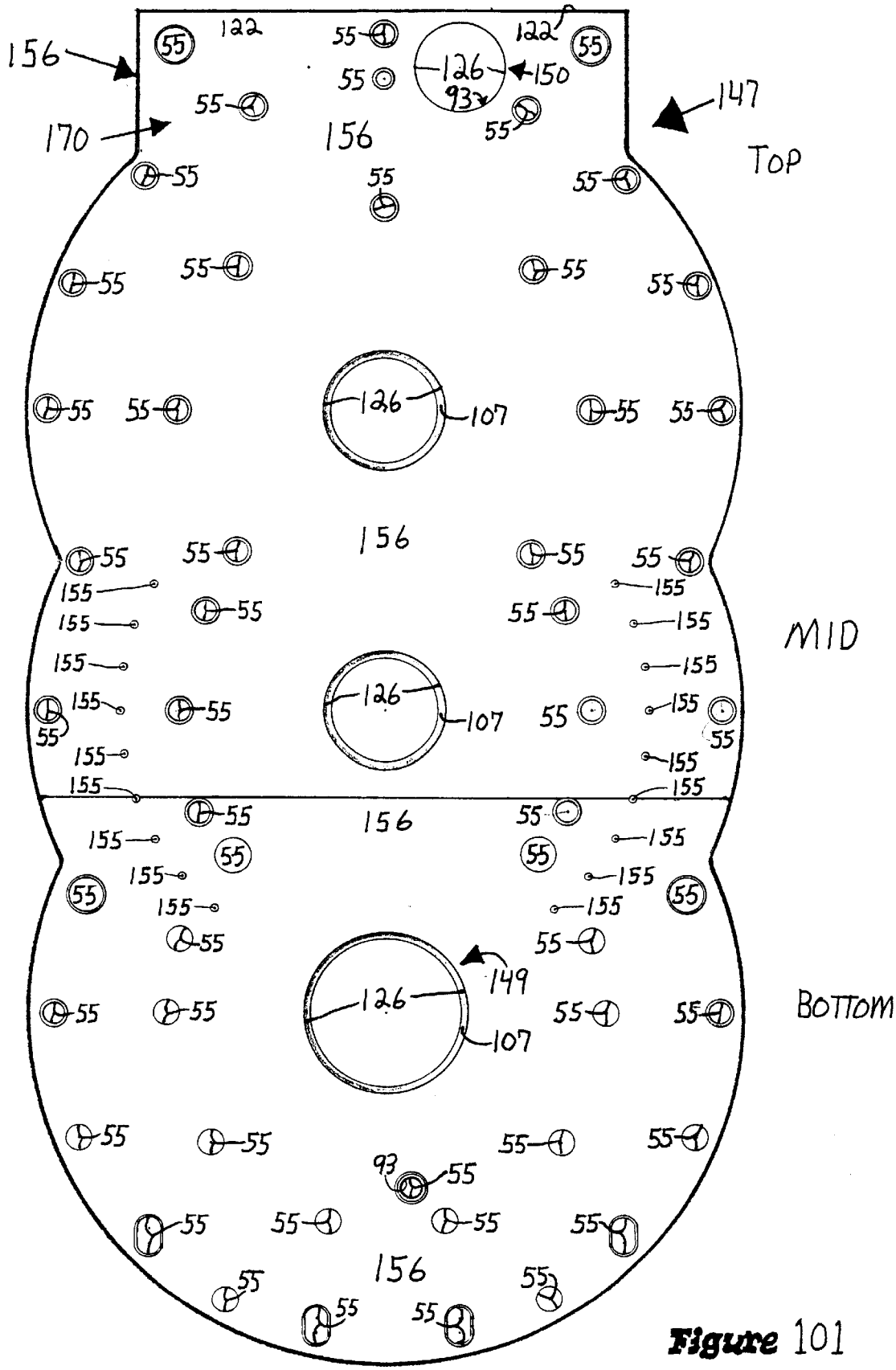

FIG. 101 Depicts the FRONT SURFACE Area View of the (RG.TDOP.SUCH.) Front COVER PLATE with it's Neoprene O-RING type OIL SEALS—Three-Main CENTER Location Areas.

Figure 102:
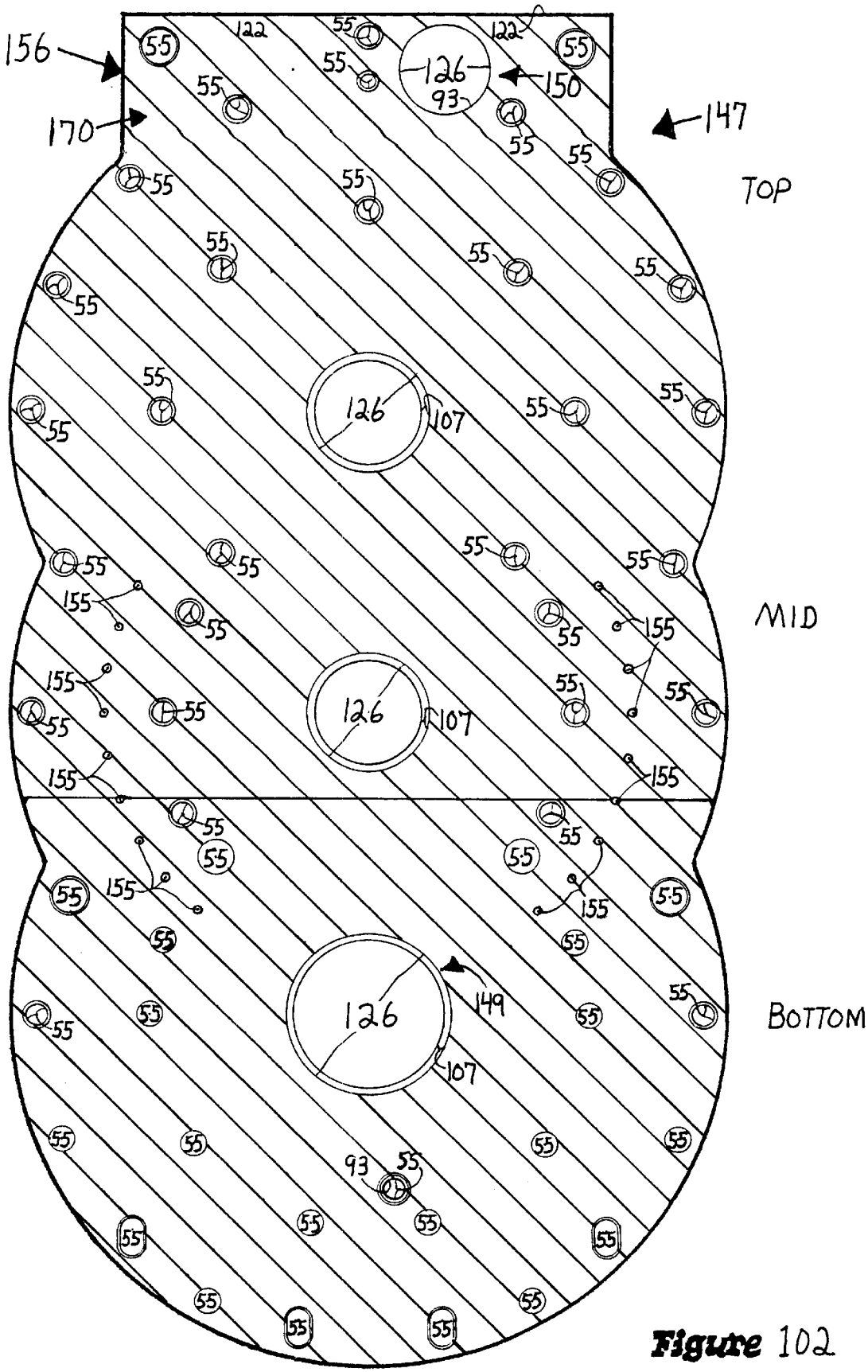

FIG. 102 Depicts same similar view of FIG. 101 WITH the ADDITION of Cross-Hatch Lines to Show Main Structure Area of Front Cover Plate.

Figure 103:
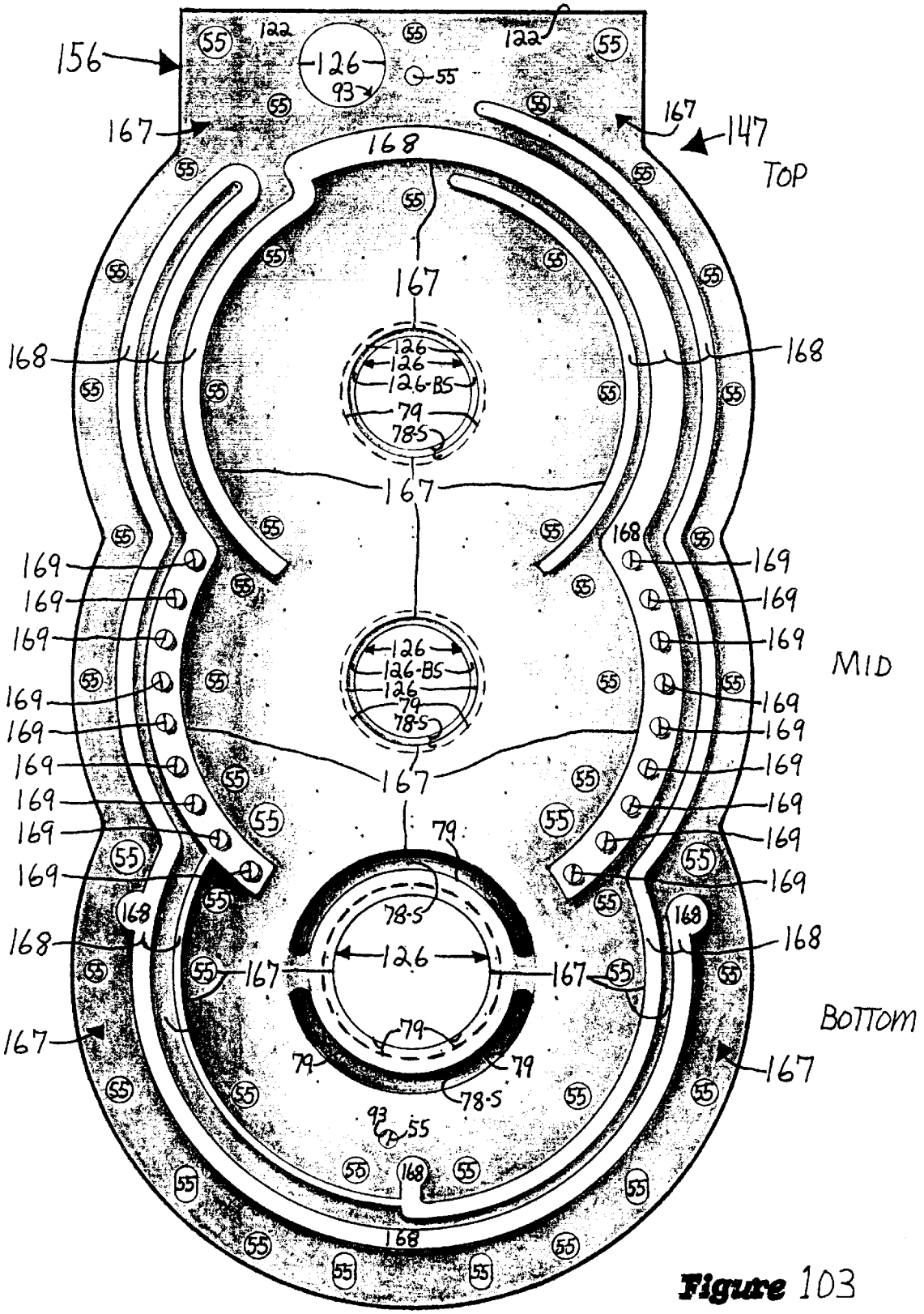

FIG. 103 Depicts—Advance Shaded View INSIDE or BACKSIDE of FIG. 101 and FIG. 102 WITHOUT the Three Neoprene O-RING type OIL SEALS—Main Center Location Areas—of the Broken Line Phantom Areas which is there to Indicate Seal SEAT GROOVE Location Area Diameter(s). Further Depictions of Raised GROOVE Area Structure of (Cooling Oil PINS—Nine PINS Per Side) and (Raised Oil GROOVE RAILS to match Fit Precisely within Oil Passage of FIG. 93—WITH a corresponding SHIM SPACER type Gasket (NOT SHOWN)—to create TIGHT—Cover to Case—Sealing Technique with NO SHARP Edges, Sunken Diameter GROOVE Depth of BOTTOM O-RING SEAL GROOVE Area Plate. (Vertical Cross section Cutaway View of Mate-Up is viewed of FIG. 104).

FIG. 104 Depicts Cross-Hatch—Cross-Cutaway View Structure Setup of (RG.TDOP.SUCH.) ROLLER GEAR—TIMING DRIVE OIL PUMP—SYSTEM UNIT CASE HOUSING, FRONT Engine Drive section area 39-39 Down Vertical Plane 39-39 of FIG. 1, and the Oil Pressure Volume Adjuster—section Area 40-40—Down Vertical Plain Line 40-40 of FIG. 91.

FIG. 105 Depicts Cross-Hatch Cutaway and Broken Line Phantom View of the RIGHTSIDE Area (RG.TDOP.SUCH.) Basic Structure Area 41-41 taken ALONG the Vertical Plane CURVED LINE 41-41 of FIG. 97.

Figure 106:
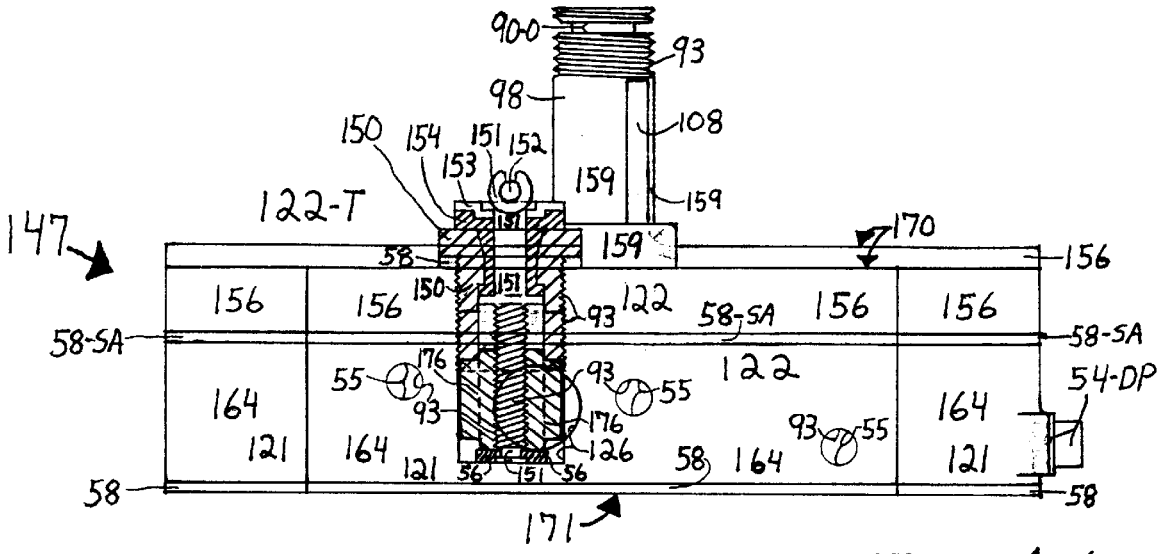

FIG. 106 Depicts Horizontal Plane Position—TOP View Outer Structure Area (RG.TDOP.SUCH.) of FIG. 92/95 and FIG. 103 as MATED TOGETHER—with Appropriate SHIM GASKET(S), Phantom Cross-Hatch of OIL PRESSURE & VOLUME ADJUSTER UNIT—(typical area view).

Figure 107:
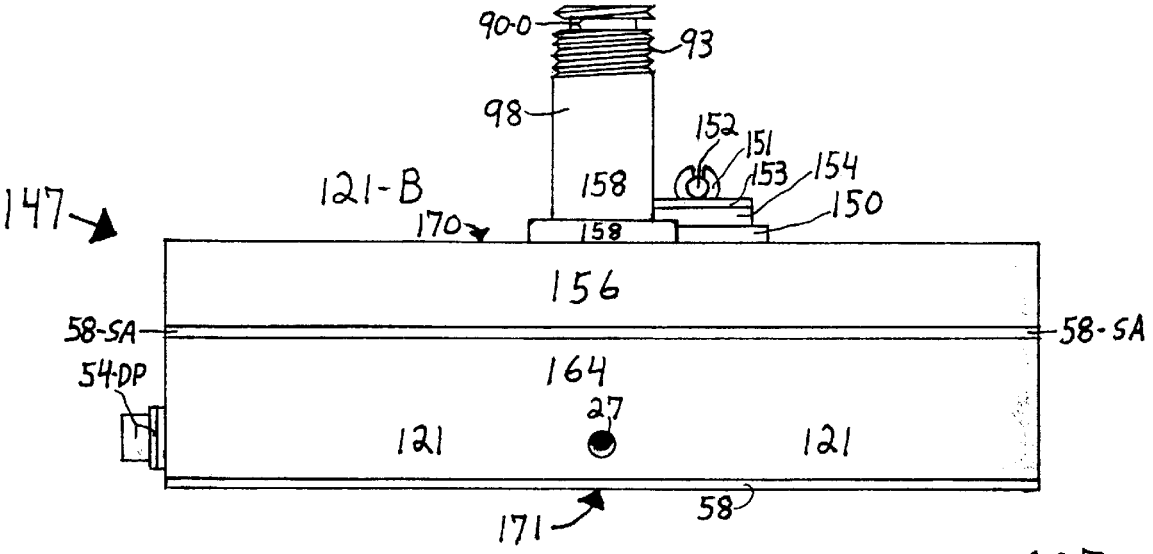

FIG. 107 Depicts Horizontal Plane Position—BOTTOM View Outer Structure Area (RG.TDOP.SUCH.) of FIG. 92/95 and FIG. 103 as MATED TOGETHER—with Appropriate SHIM GASKET(S).

**Fig.(s) TWENTY NINE thru Fig. ONE HUNDRED SEVEN—CONCLUDES all Large Scale Internal Engine Block—Piston Rod—Cylinder Sleeve Laminated Spring Boot Seal—(R.G.or,RG.TDOP.SUCH.)—Free-Spin Bearing & Seal(s)—components or assembly Parts basic Technique which of viewing simple Setup of this OSIV' ENGINE SYSTEM Invention—as for Short Form BRIEF VIEW INFORMATION of this Invention.

DIAGRAM: 1 Depicts SCHEMATIC SETUP for Valveshaft (A) WITH Written Words or Legends and Numbers as to show How and or Where the VALVE—Wedge Pocket Cutout(s)—Are To Be Simply LOCATED or MADE On A Cylinder Shape SHAFT—Express With DEGREE NUMBERS for the Outer Diameter Size of a SHAFT, a basic Line Drawing of the VALVESHAFT Positioned Diagonally Center of View Page—with FRONT View FACE located TOP LEFT Area of View Page—with REAR View FACE located BOTTOM RIGHT Area of View Page—with the Inventor's Name TOP CENTER and Name Signature at BOTTOM RIGHT CORNER. (Depicts 1., 2., 3., 4., Numbered Views).

DIAGRAM: 2 Depicts SCHEMATIC SETUP for Valveshaft (A) CYLINDER or CYLINDERHEAD BEARING SLEEVE (A1)—WITH Written Words or Legends and Numbers as to show How and or Where the Cutout SLOT(S)—are to be simply LOCATED or MADE On A Cylinder Shape SLEEVE or LINER, a basic Line Drawing of the SLEEVE Position Diagonally Center of View Page—with FRONT View FACE located TOP LEFT Area of View Page—with REAR View FACE located BOTTOM RIGHT Area of View Page—with the Inventor's Name TOP OFF-CENTER LEFT—and Name Signature at BOTTOM RIGHT CORNER. (Depicts 5., 6., 7., 8., Numbered Views).

Figure 108:
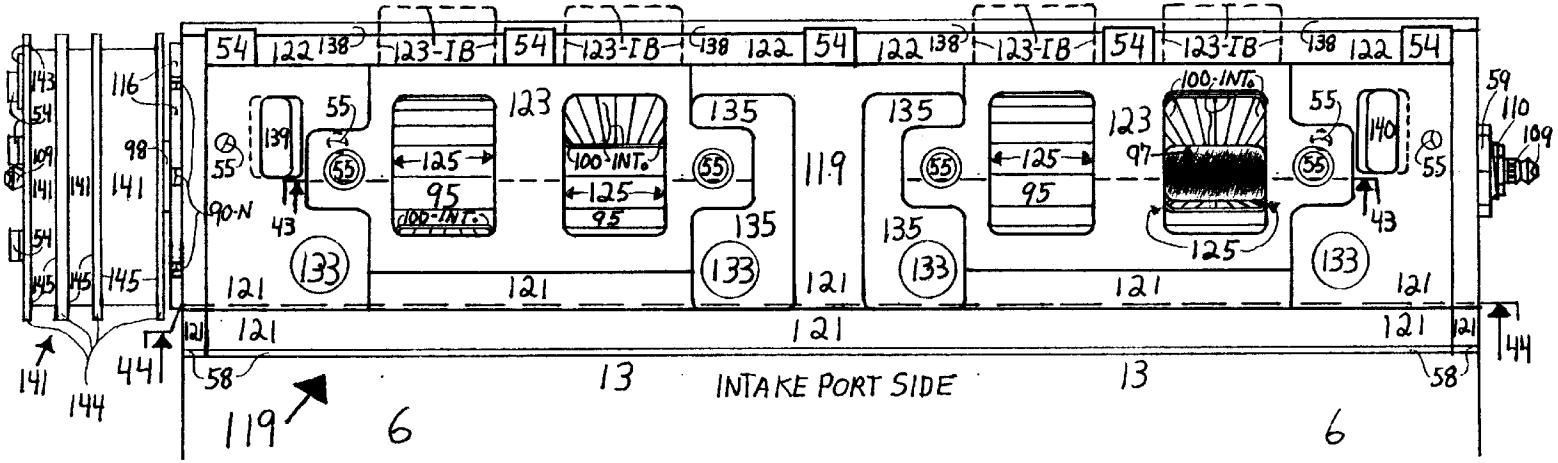

FIG. 108 Depicts RIGHT Engine Bank SIDE Cylinderhead & Valveshaft (A) Assembly View Structure—Cylinderhead INTAKE PORT—SPARK PLUG BORE—SIDE, Front Area and ADJUSTABLE TIMING PULLEY GEAR at (Leftside of View Page), Rear Area and PRELOAD BOLT & LOCK NUT and GREASE FITTING at (Rightside of View Page), Partial Phantom Broken Line View Area of—Front FRESH AIR INLET PASSAGE and Bolt Hole Location—and Rear FRESH AIR OUTLET PASSAGE and Bolt Hole Location. Viewed and Position ON Horizontal Plane. (TOP—Phantom Broken Line Area of Injector BOSSES/BASES).

Figure 109:
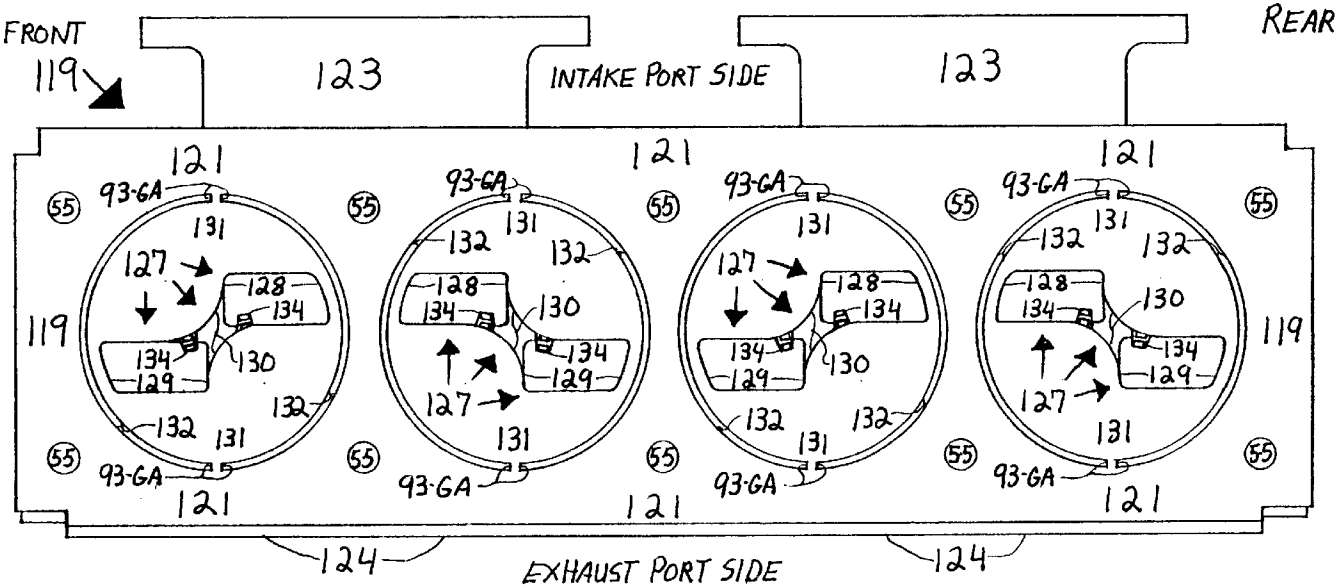

FIG. 109 Depicts BOTTOM DECK SURFACE View of the OSIV' Engine Brick Wedge (shape) Cylinderhead with it's basic New Discovered—"CROSS-FORCE"+"CROSS-FIRE" "STAR*BURST COMBUSTION CHAMBER" Setup Design & Name Technique, DEPICTED as WITHOUT Other Parts—Except Spark Plug TIPS within OUTLET and INLET COMBUSTION CHAMBER POCKETS. Viewed—Tilt Up Left Position (from) Deck Horizontal Plane. (Half Moon Diameter Grooves Around Combustion Chamber Area(s)).

Figure 110:
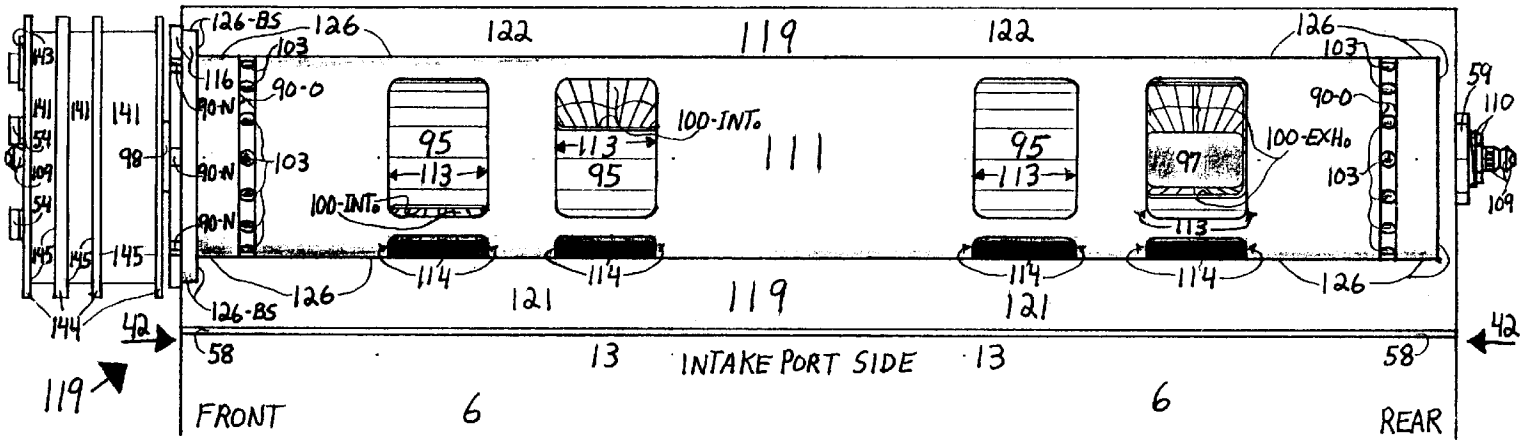
Figure 111:
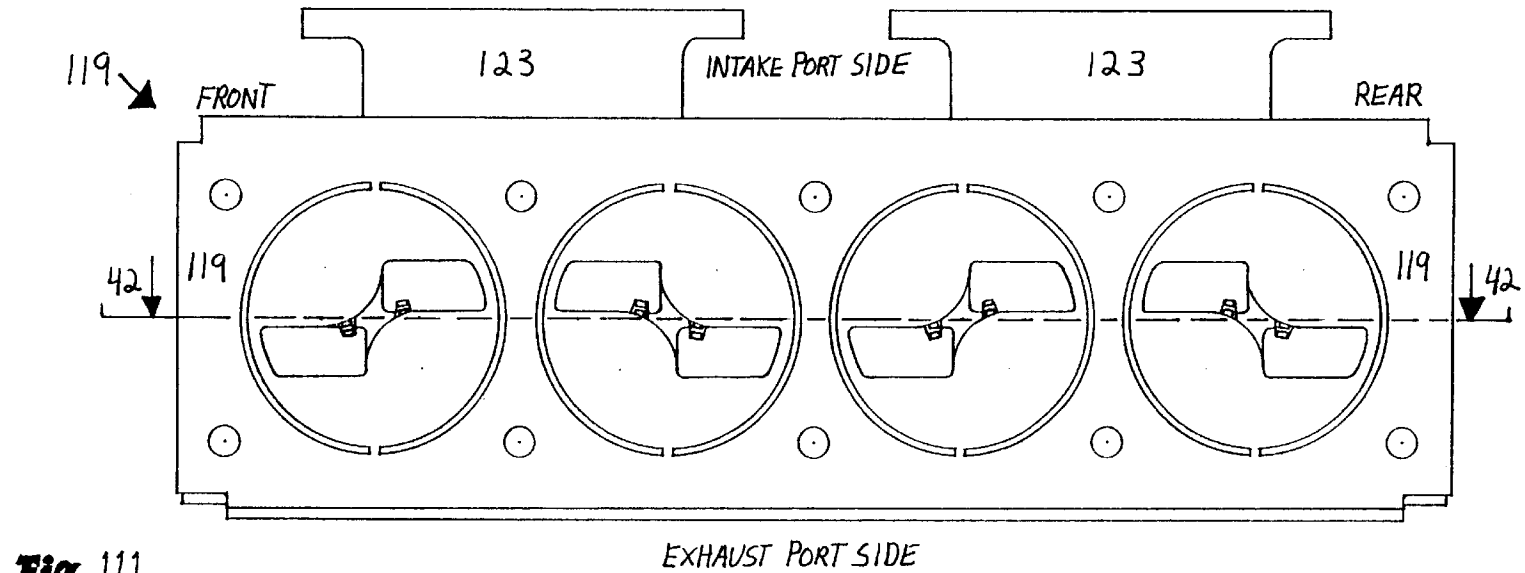

FIG. 110 Depicts similar View of FIG. 108 WITHOUT Intake Port Runner side—STRUCTURE, section Area 42-42, to Expose Internal Cylinderhead Bearing Sleeve OUTER Diameter Casing & Fit, Cylinder Sleeve—Front FRESH AIR INLET HOLES & GROOVE, Intake Port Inlet Cutout Passage SLOTS, Rear FRESH AIR OUTLET HOLES & GROOVE, and Front Cylinder Bearing Sleeve LIP SEAT Area, 42-42 of FIG. 111 Vertical Plane Line.

FIG. 111 Depicts same View Area of FIG. 109.

Figure 112:
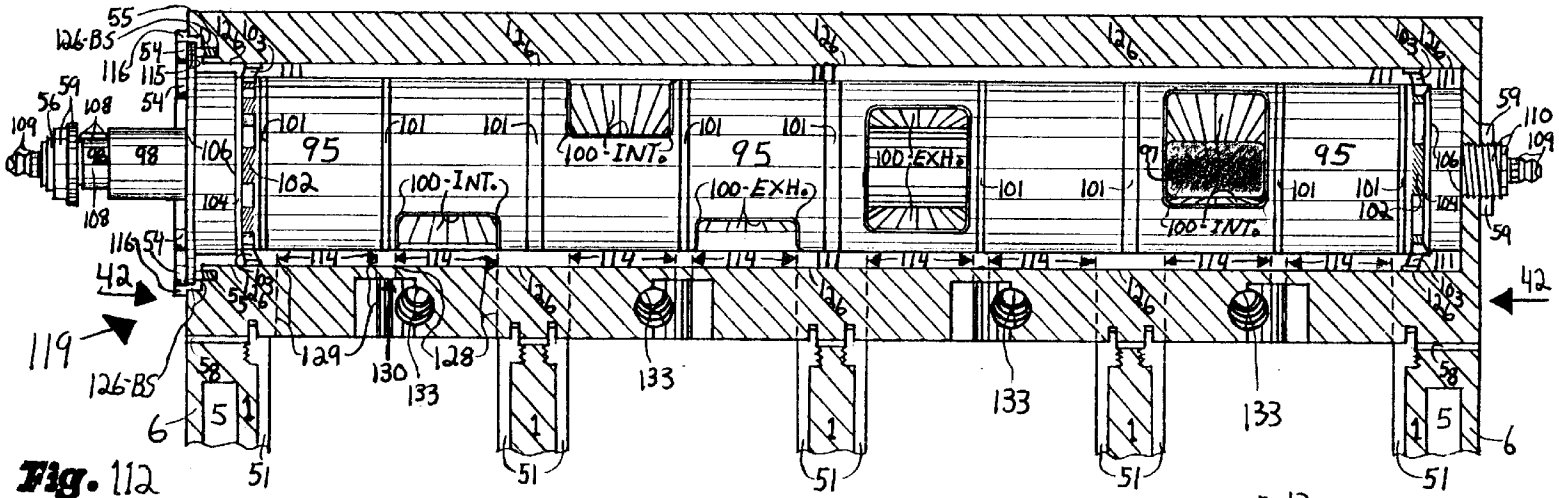

FIG. 112 Depicts similar View Casing Structure as FIG. 110 WITHOUT Adjustable Timing Pulley Gear and Intake Port side of the Cylinderhead Bearing Sleeve—to Expose Valveshaft (A) Front Drive Pinion Area—Front Preload Retainer—Seated Fit within Cylinder Bearing Sleeve Lip Area, Preload Bearing Backseal, Fresh Air Inlet Turbine Cooling Fan Slots & Grooves, Valveshaft (Piston type) Ring(s) Seal(s), Valveshaft Wedge Pocket Cutouts (VALVE POCKET(S)), and Rear Fresh Air Outlet Turbine Blower Fan Slots & Grooves, Preload Bearing Backseal, Rear Preload Bearing Retainer—fitted in Rear Cylinderhead Bearing Sleeve Inner Lip Diameter Bore Area, Rear Preload Bolt/Locknut/Grease Fitting, WITH CrossHatch CrossCutaway section Area and NON-Cross-Hatch Area section 42-42 DOWN Vertical Plane Line 42-42 of FIG. 111, (Cylinderhead Bearing Sleeve is NON-Cross Hatched), (Piston Cylinder Block Cylinder Sleeve NON-Cross Hatch), (Spark Plug Removed).

FIG. 113 Depicts similar View Area of FIG. 111 WITH Cross-Hatch Cutaway section Area 43-43 ALONG Horizontal Plane Line 43-43 of FIG. 108, and BASE section Area 44-44 ALONG Horizontal Plane Line 44-44 of FIG. 108, WITH Broken Line Phantom Area of Internal Cylinderhead BORE, Intake & Exhaust PORTS, Fresh Air Inlet & Outlet & Bolt Hole LOCATION—PASSAGE Area.

Figure 114:
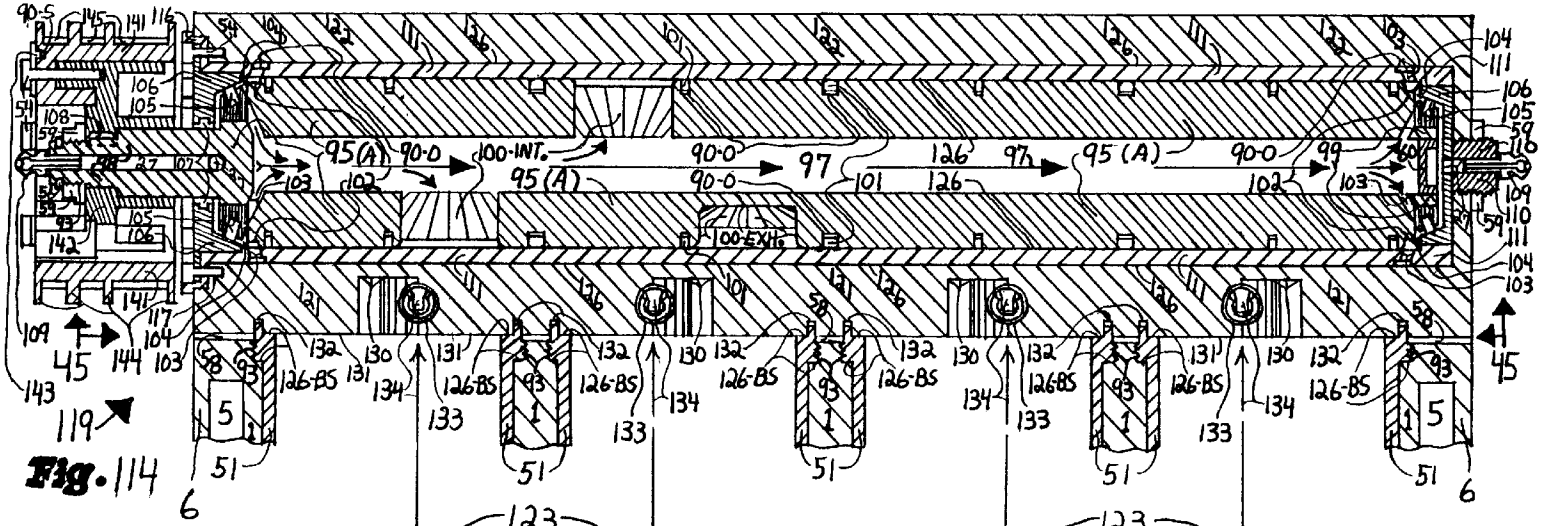

FIG. 114 Depicts Complete CROSS-HATCH—CROSS-CUTAWAY View of INTERNAL Structure—OSIV' CYLINDERHEAD ASSEMBLY—and Upper RIGHT Engine Block Cylinder BANK (WITHOUT Piston & Rods)—, Setup Mated Together—section Area 45-45 Taken DOWN Vertical Plane Line 45-45 of FIG. 1.

Figure 115:
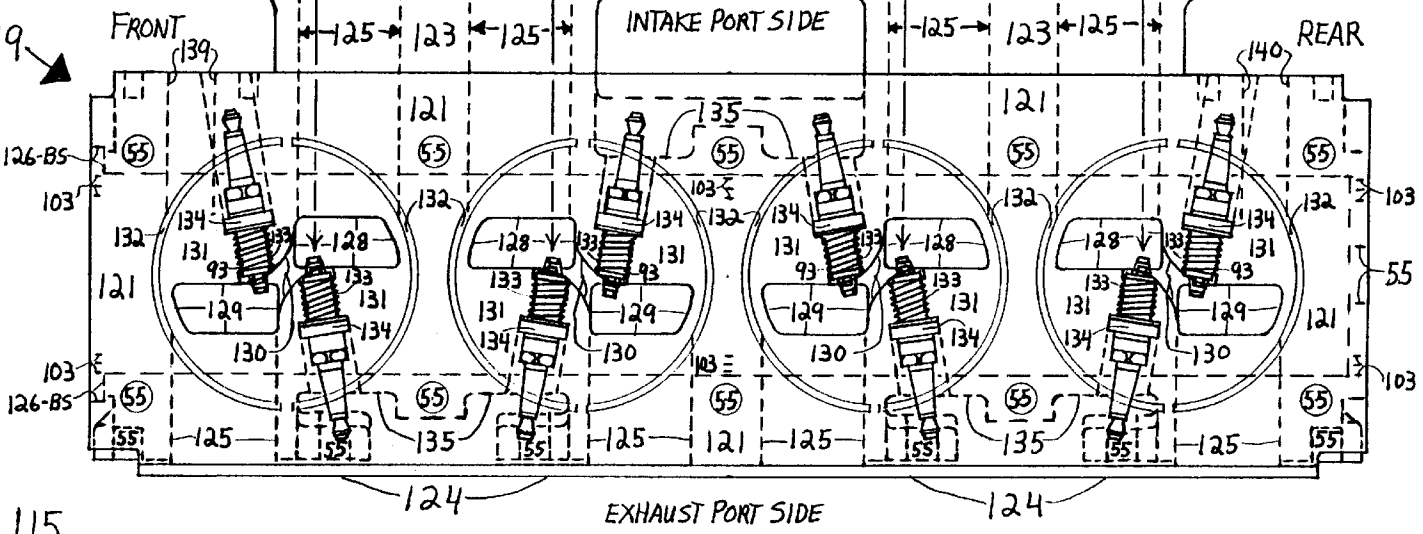

FIG. 115 Depicts similar View of FIG. 109 WITH X-Ray type Phantom Broken Line type View Structure Setup, WITHOUT the Valveshaft (A) and Cylinderhead Bearing Sleeve(A1), Preload Rear Bolt/Locknut Assembly.(Spark Plug LOCATION ARROWS Added).

Figure 116:
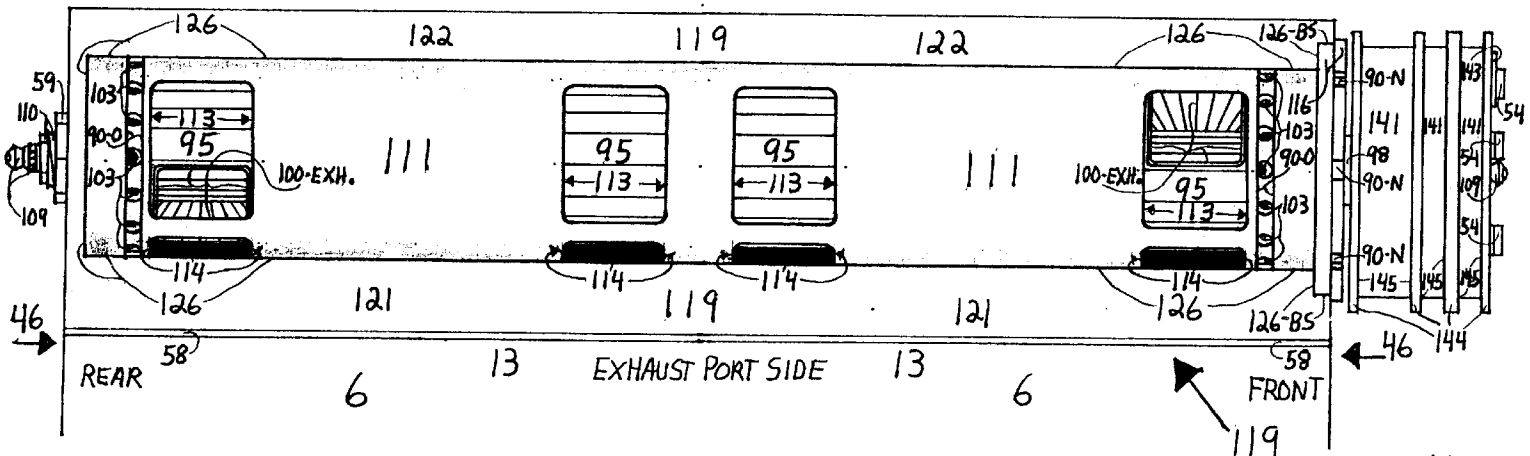
Figure 117:
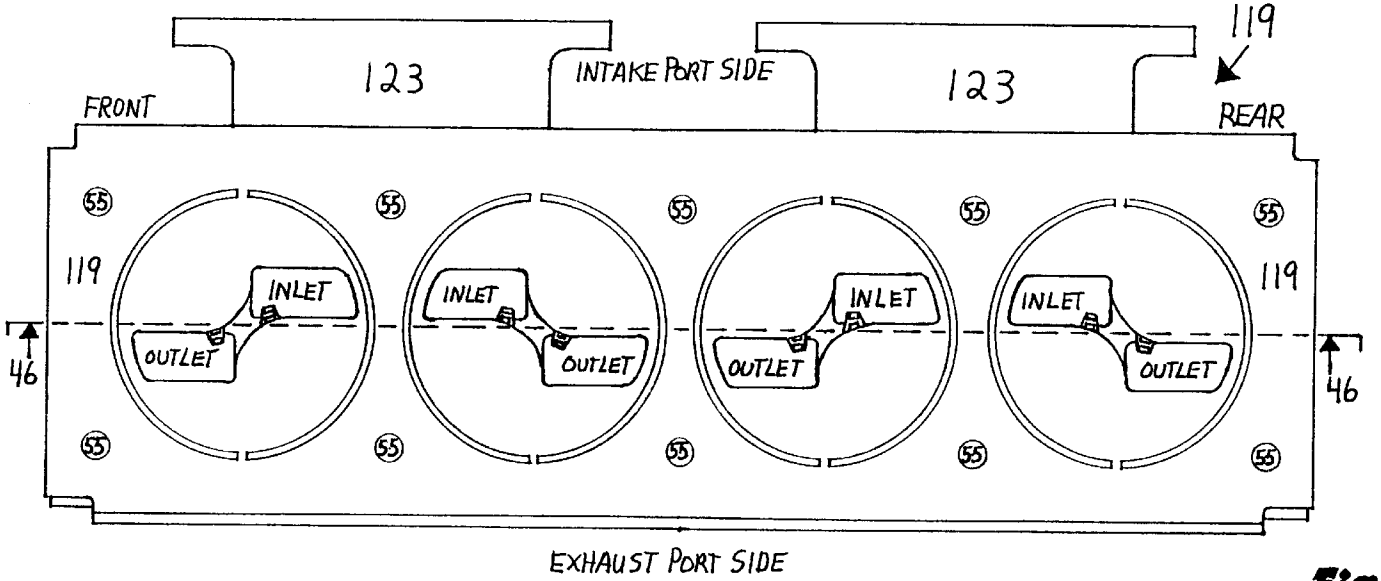
Figure 118:
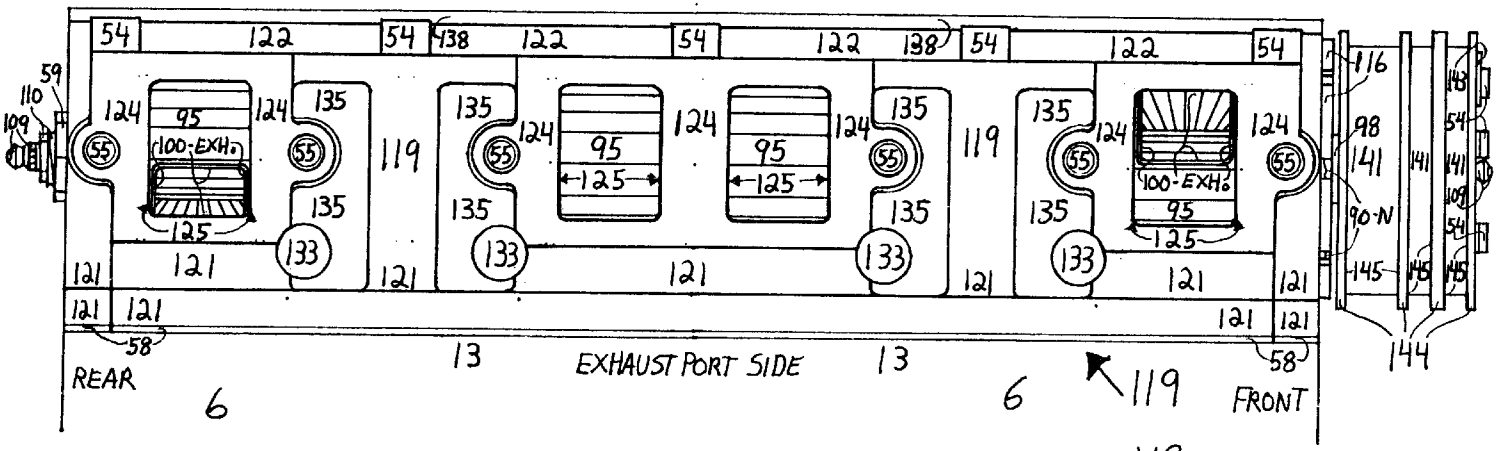

FIG. 116 Depicts CYLINDERHEAD BEARING SLEEVE—Exhaust Outlet Cutout SLOT(S)—side Setup Structure AREA 46-46 WITHOUT Exhaust Port Runner side Structure of FIG. 118 to Expose Internal Cylinderhead Bearing Sleeve OUTER Diameter Casing & Fit, Cylinderhead Bearing Sleeve Rear Fresh Air Outlet HOLES & GROOVE, Exhaust Port Outlet Passage SLOTS, Front Fresh Air Inlet HOLES & GROOVE, FRONT Cylinderhead Bearing Sleeve LIP SEAT Area, 46-46 of FIG. 116 view—taken From Vertical Plane Line 46-46 of FIG. 117.

FIG. 117 Depicts same View Area of FIG. 109.

FIG. 118 Depicts the Exhaust Port side Structure Area of FIG. 116 to Complete OSIV' BRICK WEDGE CYLINDERHEAD of RIGHT Engine Block BANK—Cylinderhead (A2) Assembly.

Figure 119:
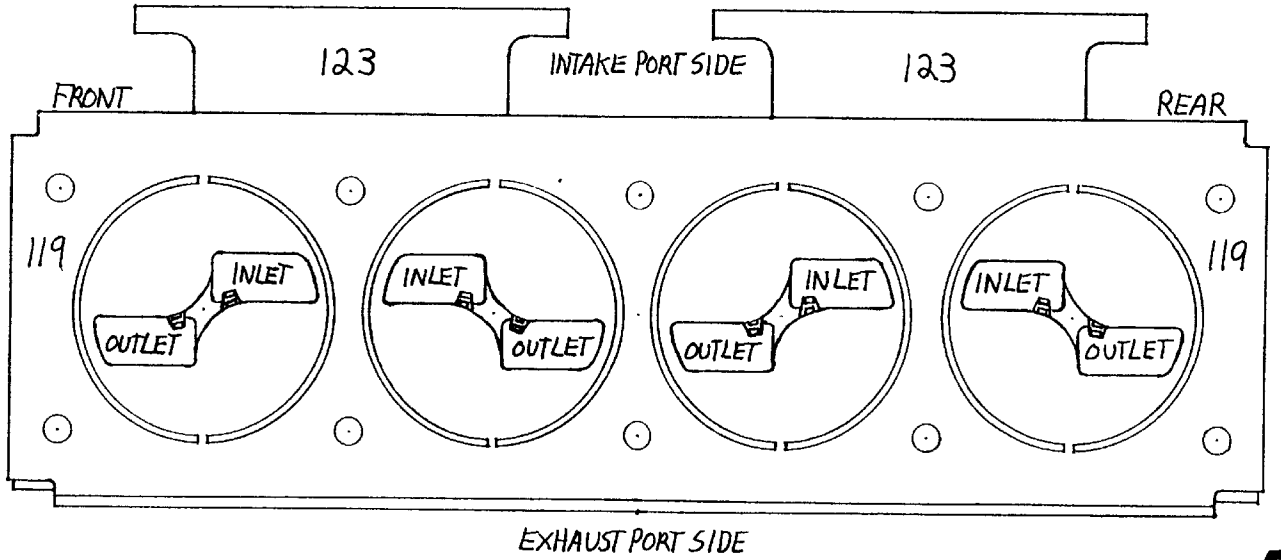

FIG. 119 Depicts same View Area of FIG. 109.

DIAGRAM: 3 Depicts SCHEMATIC SETUP for Valveshaft (B) WITH Written Words or Legends and Numbers as to show How and or Where the VALVE—Wedge Pocket Cutout(s)—Are To Be Simply LOCATED or MADE On A Cylinder Shape SHAFT—Express With DEGREE NUMBERS for the Outer Diameter Size of a SHAFT, a basic Line Drawing of the VALVESHAFT Position Diagonally Center of View Page—with FRONT View FACE located TOP LEFT Area of View Page—with REAR View FACE located BOTTOM RIGHT Area of View Page—with the Inventor's Name TOP CENTER and Name Signature at BOTTOM RIGHT CORNER. (Depicts 9., 10., 11., 12., Numbered Views).

DIAGRAM: 4 Depicts SCHEMATIC SETUP for Valveshaft (B) CYLINDER or CYLINDERHEAD BEARING SLEEVE (B1)—WITH Written Words or Legends and Numbers as to show How and or Where the Cutout SLOT(S)—are to be simply LOCATED or MADE On A Cylinder shape SLEEVE or LINER, a basic Line Drawing of the SLEEVE Position Diagonally Center of View Page—with FRONT View FACE located TOP LEFT Area of View Page—with REAR View FACE located BOTTOM RIGHT Area of View Page—with the Inventor's Name TOP OFF-CENTER LEFT—and Name Signature at BOTTOM RIGHT CORNER. (Depicts 13., 14., 15., 16., Numbered Views).

Figure 120:
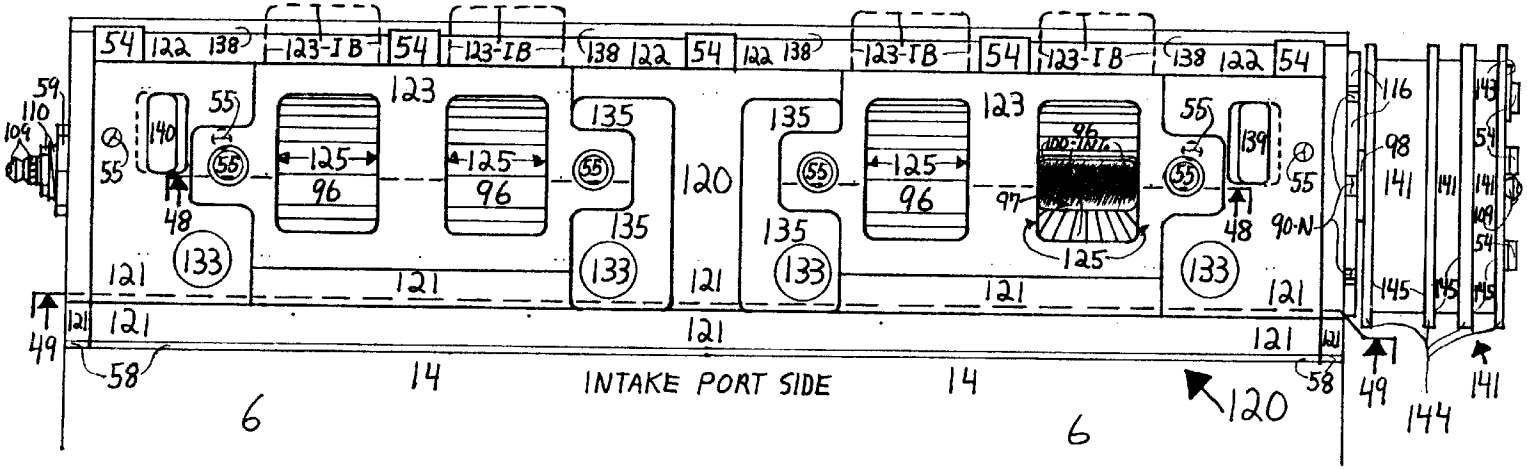

FIG. 120 Depicts LEFT Engine Bank SIDE Cylinderhead & Valveshaft (B) Assembly View Structure—Cylinderhead INTAKE PORT—SPARK PLUG BORE—SIDE, Rear Area & PRELOAD BOLT & LOCK NUT & GREASE FITTING at (Leftside of View Page), Partial Broken Line Phantom View Area of—Rear FRESH AIR OUTLET PASSAGE and Bolt Hole Location—Front FRESH AIR INLET PASSAGE and Bolt Hole Location, Front Area & ADJUSTABLE TIMING PULLEY GEAR at (Rightside View Page), Viewed and Position ON Horizontal Plane. (TOP—Phantom Broken Line Area of Injector BOSSES/BASES).

Figure 121:
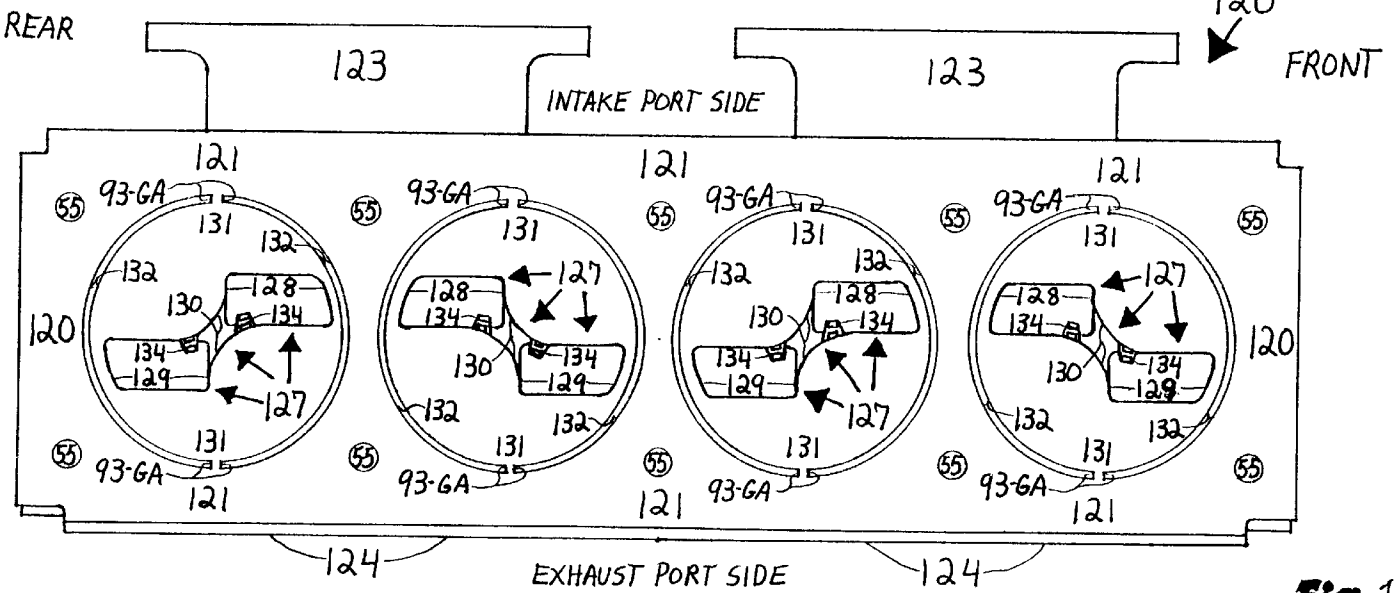

FIG. 121 Depicts BOTTOM DECK SURFACE View of the OSIV' Brick Wedge (shape) Cylinderhead with it's basic New Discovered—"CROSS-FORCE"+"CROSS-FIRE" "STAR*BURST COMBUSTION CHAMBER" Setup Design & Name Technique, as FIG. 109—though for LEFT Engine Block BANK. Viewed—Tilt Up Right Position (from) Deck Horizontal Plane.

Figure 122:
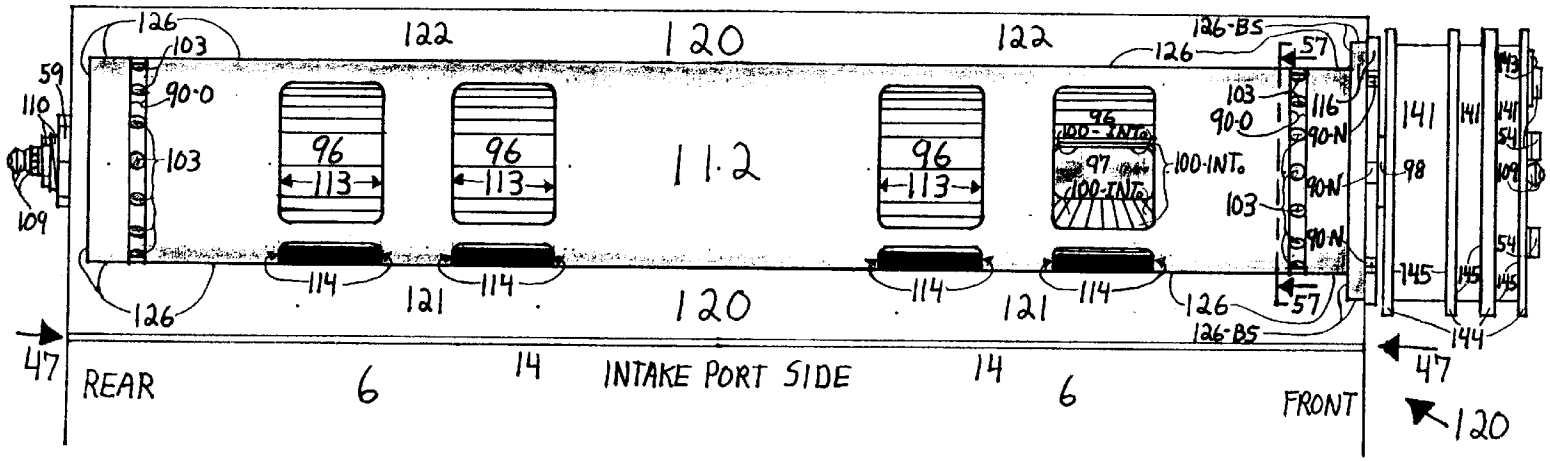
Figure 123:
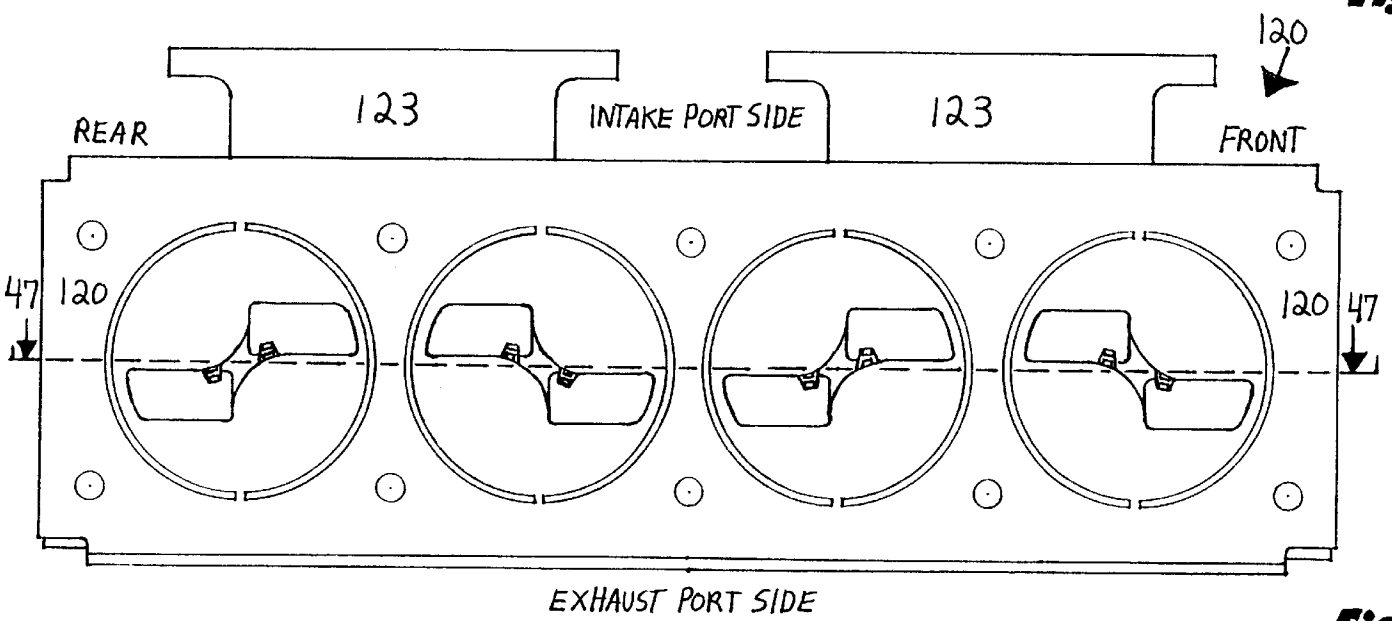

FIG. 122 Depicts similar View of FIG. 120 WITHOUT Intake Port Runner side Structure, section Area 47-47, to Expose Internal Cylinderhead Bearing Sleeve OUTER Diameter Casing & Fit, Cylinder Sleeve—Front FRESH AIR INLET HOLES & GROOVE, Intake Port Inlet Cutout Passage SLOTS, Rear FRESH AIR OUTLET HOLES & GROOVE and Front Cylinderhead Bearing Sleeve LIP SEAT Area, section Area 47-47 taken from Vertical Plane Line 47-47 of FIG. 123.

FIG. 123 Depicts same View Area of FIG. 121.

Figure 124:
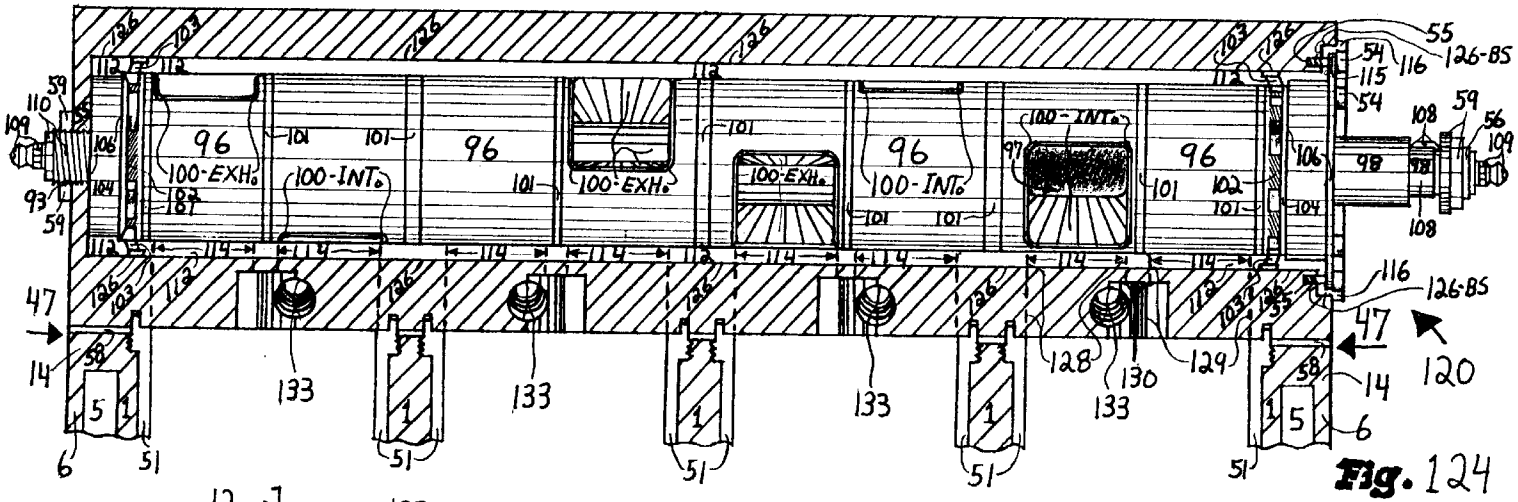

FIG. 124 Depicts similar View Casing Structure as FIG. 122 WITHOUT Adjustable Timing Pulley Gear and Intake Port side of the Cylinderhead Bearing Sleeve—to Expose Valveshaft (B) & Front Drive Pinion Area—Front Preload Bearing Retainer—Seated Fit within Cylinder Bearing Sleeve Lip Area, Preload Bearing Backseal, Fresh Air Inlet Turbine Cooling Fan Slots & Grooves, Valveshaft (Piston type) Ring(s) Seal(s), Valveshaft Wedge Pocket Cutouts (VALVE POCKET(S)), and Rear Fresh Air Outlet Turbine Blower Fan Slots & Grooves, Preload Bearing Backseal, Rear Preload Bearing Retainer—fitted in Rear Cylinderhead Bearing Sleeve Inner Lip Diameter Bore Area, Rear Preload Bolt & Lock Nut & Grease Fitting, WITH Cross-Hatch Cross Cutaway section Area and NON-Cross-Hatch Area, section Area 47-47 taken From Vertical Plane Line 47-47 of FIG. 123, (Cylinderhead Bearing Sleeve is NON-Cross Hatched), (Piston Block Cylinder Sleeve—NON-Cross Hatched), and (Spark Plug Removed).

FIG. 125 Depicts similar View Area of FIG. 123 WITH Cross-Hatch Cross Cutaway section Area 48-48 ALONG Horizontal Plane Line 48-48 of FIG. 120, BASE section Area 49-49 ALONG Horizontal Plane Line 49-49 of FIG. 120, WITH Broken Line Phantom Area of Internal Cylinderhead BORE, Intake & Exhaust PORTS, Fresh Air Inlet & Outlet & Bolt Hole LOCATION-PASSAGE Areas.

Figure 126:
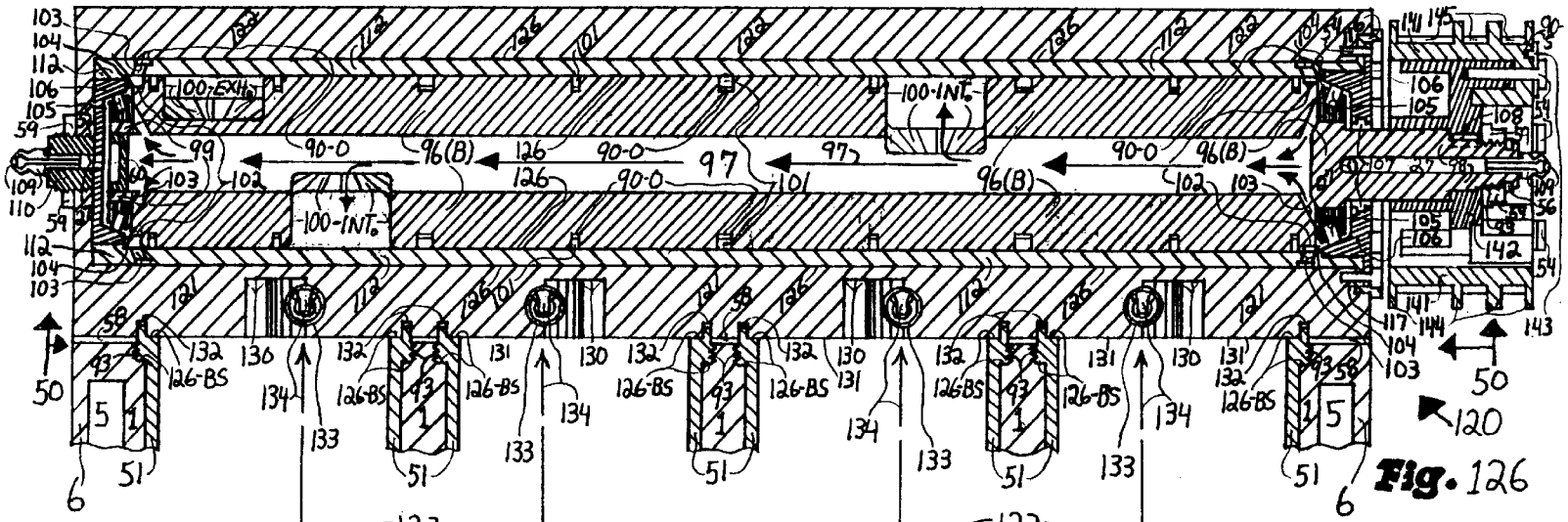

FIG. 126 Depicts complete Cross-Hatch—Cross Cutaway View of Internal Structure OSIV' CYLINDERHEAD Assembly and Upper LEFT Engine Block Cylinder Casing BANK (WITHOUT Piston & Rods)—, Setup Mated Together—section Area 50-50 Taken DOWN Vertical Plane Line 50-50 of FIG. 1.

Figure 127:
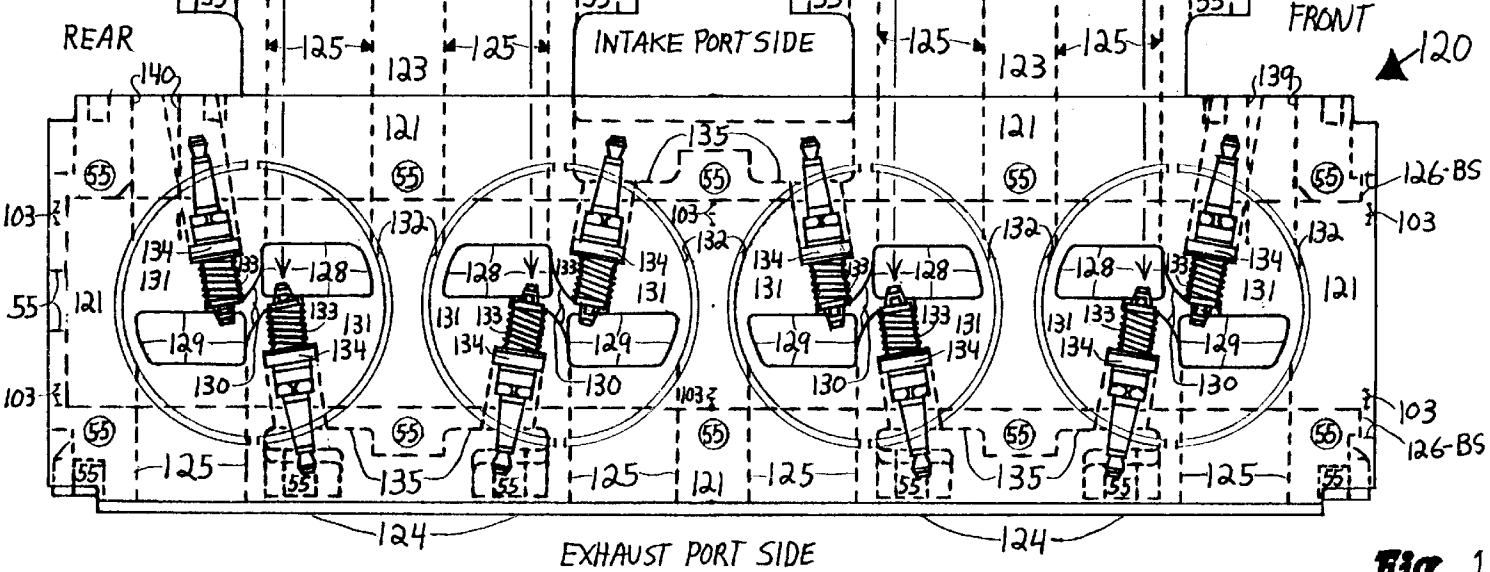

FIG. 127 Depicts similar View of FIG. 121 WITH X-Ray type Phantom Broken Line type View structure Setup, WITHOUT the Valveshaft (B) and Cylinder Bearing Sleeve (B1), Preload Rear Bolt Lock Nut Assembly. (Spark Plug LOCATION ARROWS added).

Figure 128:
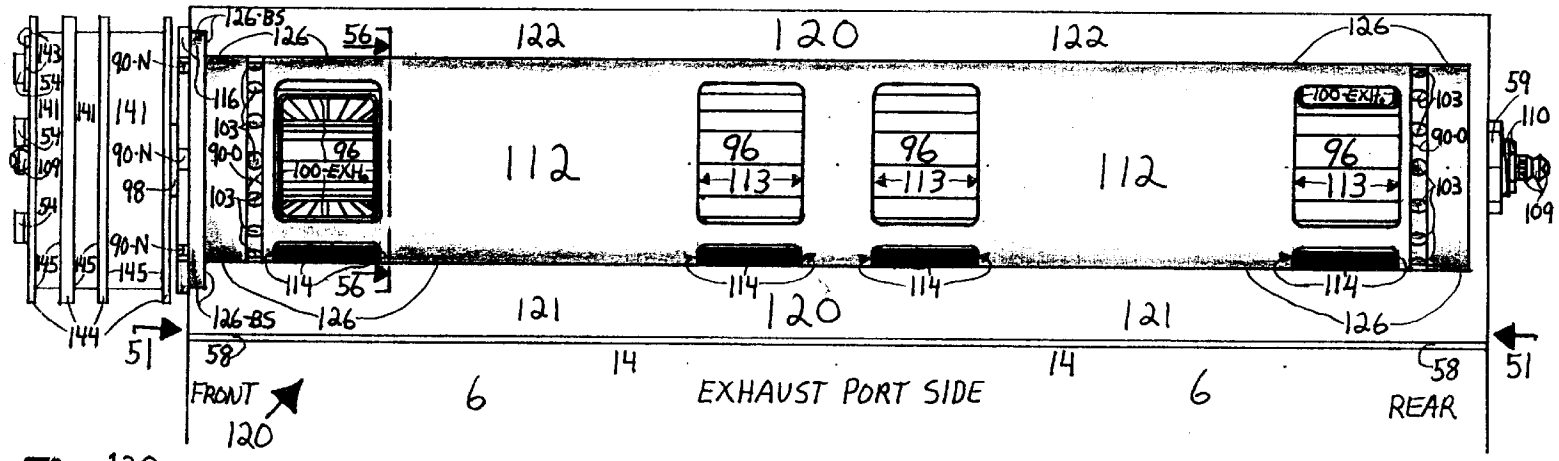
Figure 129:
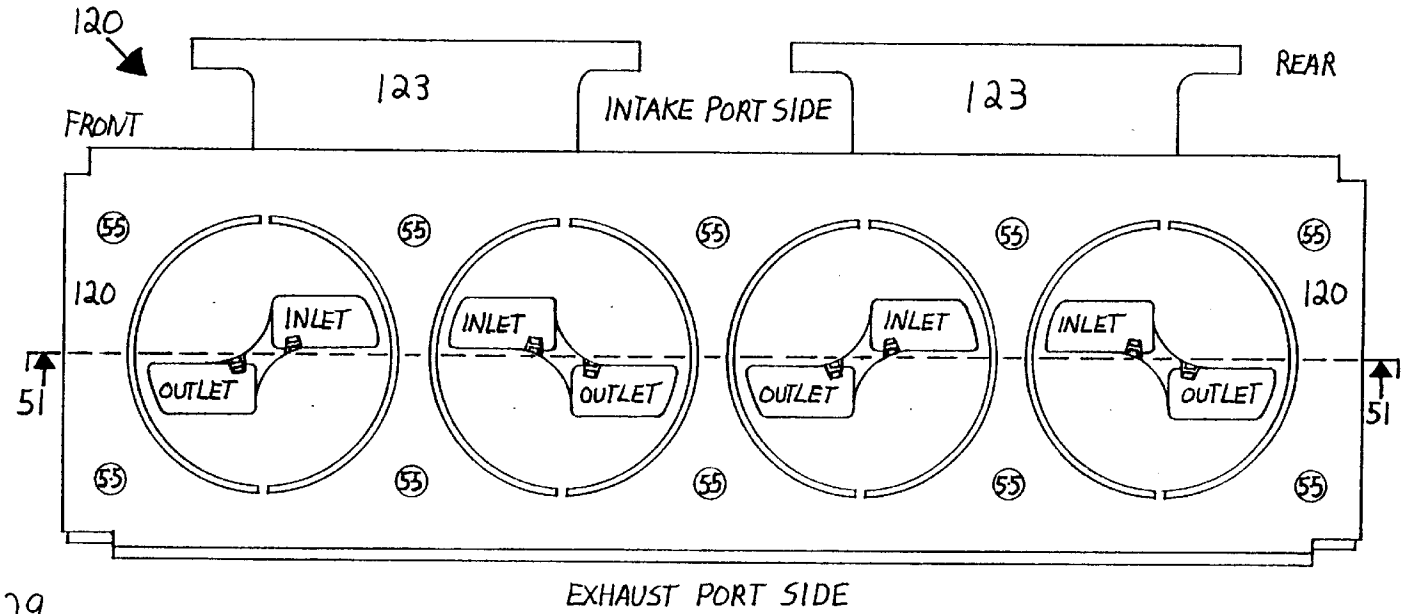
Figure 130:
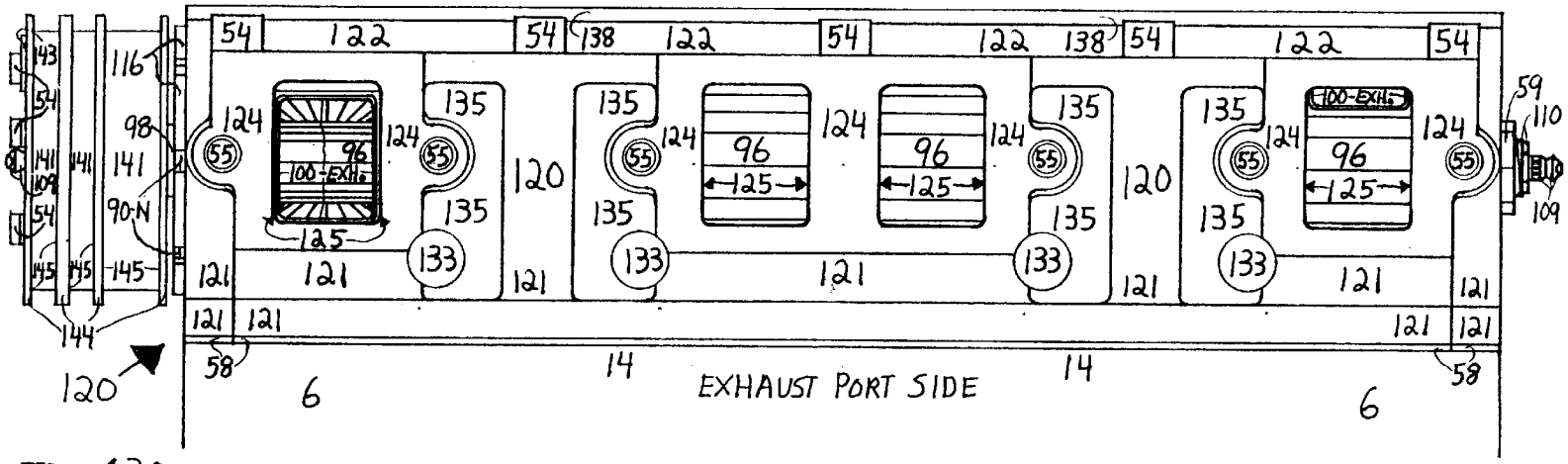

FIG. 128 Depicts CYLINDERHEAD BEARING SLEEVE—Exhaust Outlet Cutout SLOT(S)—side Setup Structure Area 51-51 WITHOUT Exhaust Port Runner side Structure of FIG. 130, to Expose Internal Cylinderhead Bearing Sleeve OUTER Diameter Casing & Fit, Cylinderhead Bearing Sleeve Rear Fresh Air Outlet HOLES & GROOVE, Exhaust Port Outlet Cutout Passage SLOTS, Front Fresh Air Inlet HOLES & GROOVE, FRONT Cylinderhead Bearing Sleeve LIP SEAT Area, section Area 51-51 taken From 51-51 of FIG. 129 Vertical Plane Line.

FIG. 129 Depicts same View Area of FIG. 121.

FIG. 130 Depicts the Exhaust Port side Structure Area of FIG. 128 to Complete OSIV' BRICK WEDGE CYLINDERHEAD of LEFT Engine Block BANK—Cylinderhead (B2) Assembly.

Figure 131:
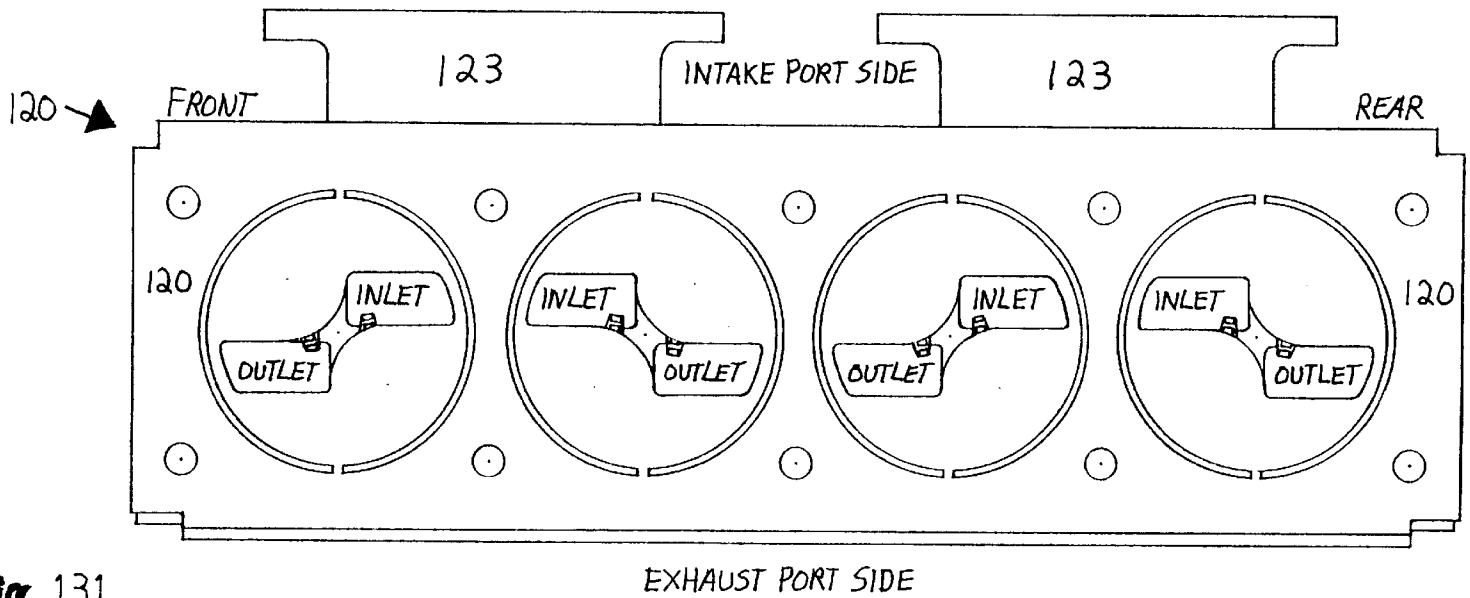

FIG. 131 Depicts same View Area of FIG. 121.

Figure 132:
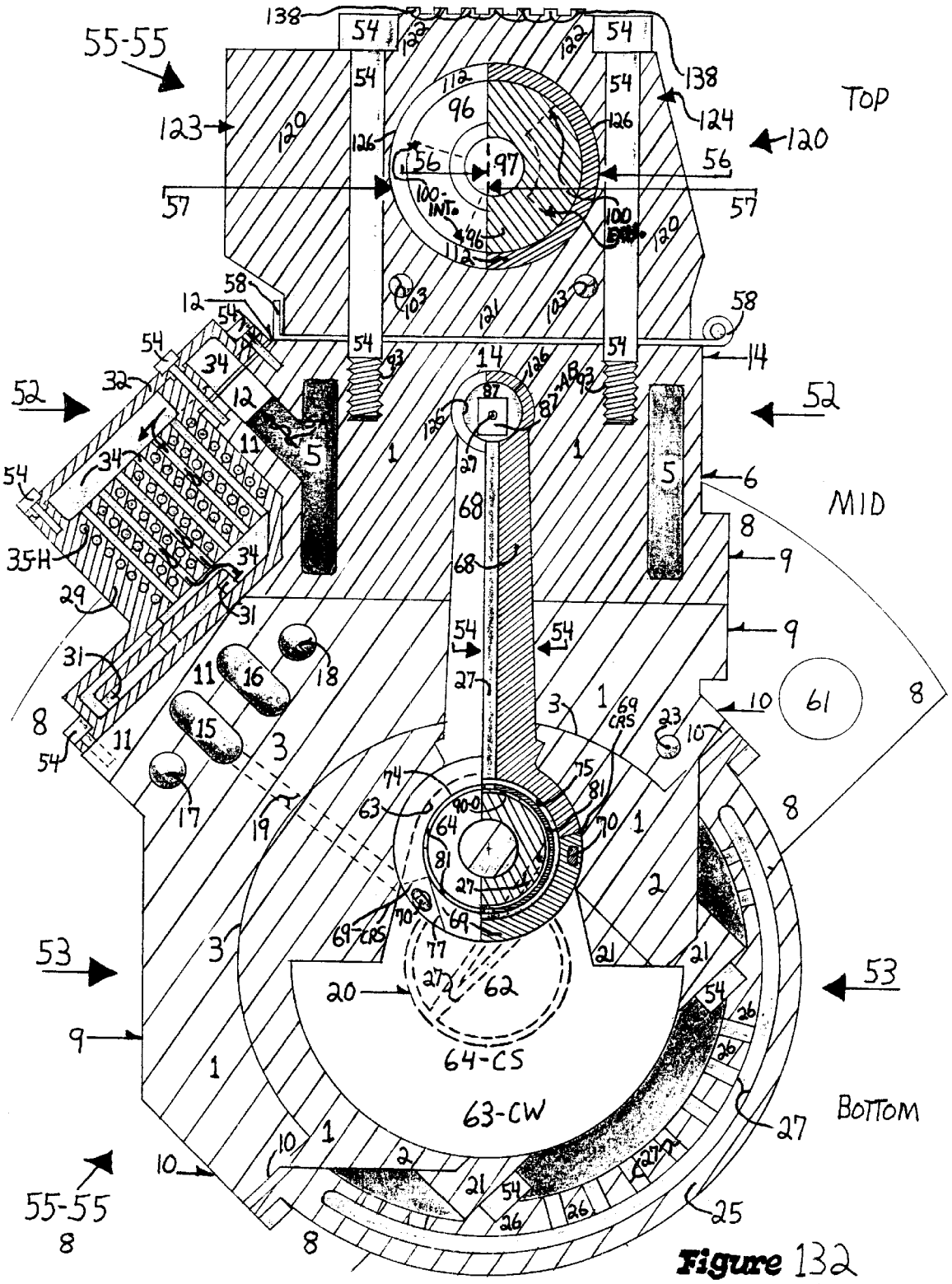

FIG. 132 Depicts the MAIN RIB BULKHEAD STRUCTURE of: Cylinderhead Assembly(s); Upper Engine Block & Valley Radiator Core Assembly(s); Lower Engine Block & Crankshaft Rotation Reciprocating Assembly(s)—WITHOUT Piston & Block Cylinder Barrel Assembly(s); Bottom Engine Block Crankcase Fork Main & Fork Lock Cap and Oil scavenge Pan; View of Strength Structure of the OSIV' Engine & System Technique for the SINGLE & INLINE & LEFT BANK of V-type, Type of Piston Internal Combustion Engine (MEDIUM SCALE DRAWING type)—as which to have REMOVED Fork Lock Connecting Rod(A) for RIGHT Engine Bank side, and shown WITH Cross-Hatch Cross-Cutaway View Area(s) 52-52 From Vertical Plane Line 52-52 of FIG. 13, and 53-53 From Vertical Plane Line 53-53 of FIG. 16, and Cutaway Cross-Hatch of Connecting Rod & Crank Assembly section Area 54-54 taken AWAY DOWN Vertical Plane Line 54-54 of FIG. 61 & 54-54 of FIG. 65, which this Single Engine BANK Setup was formed as if by cutting away RIGHT Engine BANK side—section View 55-55 DOWN—Diagonally—Horizontally—Vertically—ALONG Line 55-55 of FIG. 5, WITH Straight Tube Radiator Core—simply Drawn Technique Design, and PARTIAL BROKEN LINE PHANTOM Area View of; Valveshaft—Exhaust Valve Pocket Area—56-56 WITH Cross-Hatch Cutaway Area to show Exhaust side Area Structure—which was Drawn as REMOVE DOWN Vertical Plane Line 56-56 of FIG. 128, and Valveshaft Intake Valve Pocket Area—57-57 is Extended Forward and Cut DOWN Vertical Plane Line 57-57 of FIG. 122; also of Main OIL Passage—Phantom Broken Line Passage Area Location(s)—Crankshaft Main Journal Area & Throw Arm Pin—partial View area, also Valley Radiator Base Bolt & Oil Passage from Oil Reservoir 15 to Lower Block Crank Main Journal Area, Which Concludes basic OSIV' Engine & System Technique—basic Setup BRIEF DESCRIPTION OF VIEWS OF THE DRAWINGS & DIAGRAM For the making of this OSBAND SUPER INDUCTIONEXHAUSTION VALVESHAFT' ENGINE SYSTEM.

Figure 133:
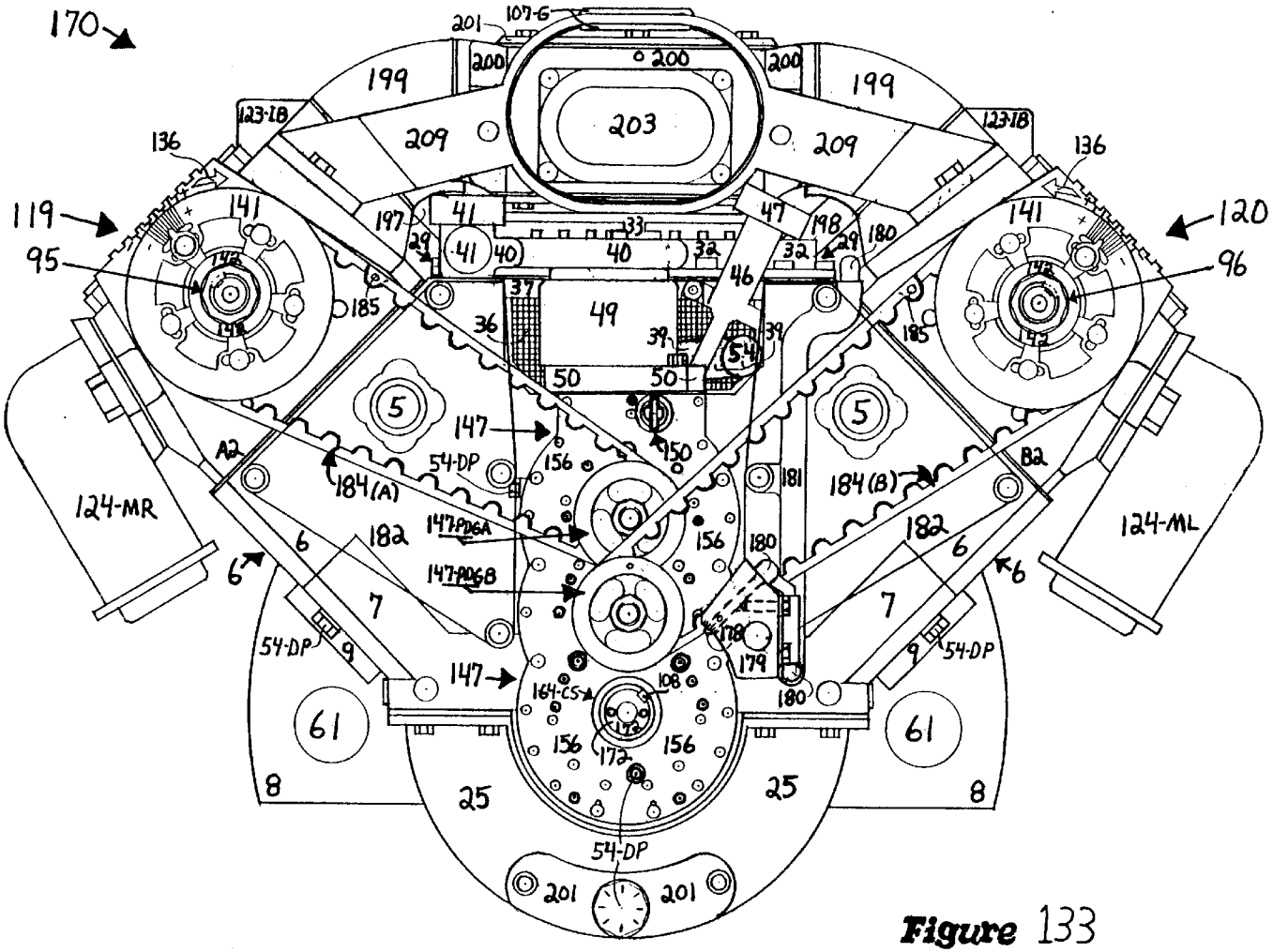

*FIG. 133 can also be used for Official Gazette, it Depicts a same similar View Area of FIG. 1, with Only the MAIN Identified Number(s) & Letter(s)—Items which is Being Presented to show a CLEARER Non-Cluttered type View—which should be Viewed Closely with FIG. 1 for better understanding toward Invention—FRONT Basic Appearance type Setup OSIV' ENGINE FORMATION.

(* * *) Other RUFF SKETCHES on "CHOICE SELECTED COMPANY" section Pages; 1., 3., 10., 32., 47., are also Hand Drawn By Me the Inventor, just to show QUICKER Understanding towards this OSIV' Engine System "Mind Frame Of New Concept Forming Setup".

This CONCLUDES A11 OSIV' Engine System—BRIEF DESCRIPTION OF THE SEVERAL VIEWS OF THE DRAWING—, Thank you.

DETAILED DESCRIPTION OF THE INVENTION

OSIV' Engine—Item Numbers & Letters/Names—(DPL) Description Parts List:

"OSIV' STAGE TWO ENGINE CYLINDER BLOCK ASSEMBLY"

1—Engine Block Main Rib Bulkhead-Area (Front to Rear: #1,#2,#3,#4,#5,)
2—Engine Block Main Rib Bulkhead Fork-Area (V8-type: #1,#2,#3,#4,#5,)
3—Engine Block Valley Bulkhead Base-Area (or Arch Crankcase Area) Dome Line
4—Engine Block Cylinder Barrel Bore-Area
4B—Engine Block Cylinder Barrel-Area
5—Engine Block Cylinder Barrel Water Jacket Passage-Area
5A—Arrow⇝Water Flow-Area
6—Engine Block Cylinder Casing-Area (Stage Two Block Formation)
7—Engine Block FRONT Main Bulkhead Flange-Area
8—Engine Block REAR Main Bulkhead Flange-Area
9—Engine Block Casing Mount Pad-Base-Area
10—Engine Block Casing LOWER Bulkhead Oil Pan Rail-Area
11—Engine Block Casing Valley Base Bulkhead-Area
11RA—Raised Area—of Engine Block Casing Valley Base Bulkhead-Area
12—Engine Block Upper Casing Valley Deck-Area
13—Engine Block Upper Casing Cylinder Deck-Area (RIGHT BANK)
14—Engine Block Upper Casing Cylinder Deck-Area (LEFT BANK)
15—Internal Valley Base Bulkhead-HIGH PRESSURE OIL RESERVOIR-Area (Right)
16—Internal Valley Base Bulkhead-LOW PRESSURE OIL RESERVOIR-Area (Left)
17—Internal Valley Base Bulkhead-VERTICAL & HORIZONTAL-AIR TO OIL Passage-Area
18—Internal Valley Base Bulkhead-VERTICAL & HORIZONTAL-AIR TO OIL Passage-Area
19—Internal Block Main Rib Bulkhead-VERTICAL SLANT OIL Passage-Area
20—Main Rib Bulkhead Fork Bearing & Seal JOURNAL BORE-Area
21—Main Rib Bulkhead Fork Lock-(bearing/seal)-CAP-Area
22—Lower Bulkhead Oil Pan Rail-VERTICAL AIR OIL Passage-Area
23—Lower Bulkhead Oil Pan Rail-HORIZONTAL AIR OIL Passage-Area
24—Lower FRONT Bulkhead Cross Horizontal Oil Pan Rail-OIL Passage-Area
25—Lower Block OIL SCAVENGE PAN-Structure-Area ((1)(2)(3)(4) of 27) on FIG. 26
26—Oil Scavenge Pan—INNER CASING SURFACE/Structure-Area
27—OIL Passage/OIL Flow Arrow—Internal Structure (or Hole)-Area
27H—Horizontal-PASSAGE-Area
27HW-Horizontal Wide-PASSAGE-Area
28—Rear Valley Base Oil Pressure/Volume By-Pass Valve Sending Unit BORE-Area
29—Middle Valley RADIATOR Water/Coolant W/C COOLING CORE UNIT Structure-Area
30—Radiator-S-CURVE-Water/Coolant-Cooling-TUBE (S)/CORE(S)-Area(DownFlowsystem)
31—Radiator—Bottom Water/Coolant Scavenge HOLES & OUTLET TUNNEL Passage-Area
32—Radiator—Top Valley Deck LID Cooling Fin COVER-Area
33—Radiator—Top Cover HEAT DEFLECTER & AIR FLOW DIRECTOR SHIELD-Area
34—Radiator Water/Coolant Passage—Water Flow Arrow—Internal Structure-Area
35—Radiator Air Cooling Tube Cross FIN(S)-Area
35H—Horizontal AIR HOLES/Passage(s)-Area
36—Radiator Front Cooling Core MESH SCREEN—Debris Protector-Area
37—Valley Cross ARCH SUPPORT—Formed-Area
38—Radiator Rear Water/Coolant—PROPELLER & SHAFT HOUSING PUMP NECK-Area
38P—PROPELLER & FIN-Area
38S—SHAFT-Area
38THS—THERMOSTATIC Hot water SWITCH-Area
39—Radiator Front Water/Coolant Outlet Bottom AUXILIARY NECK-Area
40—Radiator Front Top Inlet Water/Coolant FILLER NECK-Area
40P—PASSAGE-Area
401H—Inlet Hole-Area
41—Radiator Filler Neck coolant pressure over flow CAP-Area(30Lb Press. Caps)

42—Rear Valley Base CRANKCASE VENTILATION HOLES-Area (Vertical Setup)
43—Front Valley Base CRANKCASE VENTILATION HOLE-Area (Vertical Setup)
44—Front Valley Base Deck OIL PASSAGE HOLE to OIL RESERVOIR 15-Area
45—Front Valley Base Oil Filler Tube SLANT PASSAGE HOLE to RESERVOIR 16-Area
46—OIL FILLER TUBE-Area
47—Oil Filler Tube DIPSTICK CAP-Area
47PH—Pin Hole-Area (For Air Bubbles-Exit Relief)
48—Dipstick LEVEL CHECKER-Area
49—OIL FILTER-Front Valley Block-Area
50-OIL FILTER HOUSING BASE PLATE-Front Valley Block-Area
51—Engine Block CYLINDER SLEEVE/LINER—Area
52—Engine Block Cylinder Sleeve/Liner LAMINATED SPRING BOOT SEAL-Area
53—Engine Block Water/Coolant Jacket Passage Drain Plug HOLE-Area
54—BOLT/STUD/SCREW-Area
54DP—DRAIN PLUG—or Bolt-Area
55—Bolt HOLE-Area
55SD—Small DIMPLE-Area
55PH—Pin HOLE-Area
55A—ALL THE WAY THROUGH—Bolt HOLE type-⓪-Area
56—WASHER or C-CLIP Lock WASHER-Area
56C—CAP-Area
57—GASKET-Area
58—SHIM GASKET-Area
58SA—SPECIAL ALLOY-3 CV Del West Material-formed SHIM GASKET-Area
59—NUT-Area
60—PLUG—Freeze/Whelch—type PLUG-Area
60WP—WITH PIN Hole—Small Oil Relief type—In PLUG-AREA
61—HOLE-Area (for Electric Starter Drive Gear)

Items—1 thru 61; Descriptive Items or Part(s)-AREAS, basically Formulate the Setup of the -"ON V-CENTER LINE PISTON CYLINDER BORE SPACING-Engine BLOCK BANKS" Stage Two OSIV' Engine System—"Engine CYLINDER BLOCK Assembly"—for V-type & Flat-type & Internal-type—Combustion—Piston Engine FORMATION.

"OSIV' STAGE TWO ENGINE CRANKSHAFT ROTATING RECIPROCATING ROD ASSEMBLY"

62—Crankshaft MAIN BEARING JOURNAL-Area
62CF—Crankshaft FLANGE—Rear-Area
62CFP—Crankshaft FLEX PLATE—(or FLYWHEEL)-Area
63—Crankshaft THROW ARM-Area
63CW—Crankshaft COUNTER WEIGHT-Area
64—Crankshaft Throw Arm PIN Bearing Journal-Area
64CS—CRANKSHAFT-Area

"OSIV' V-LOCK FORK CONNECTING RODS-FREE SPIN BEARING & SEALS-ASSEMBLY"

65—V-Lock Fork Connecting ROD(A)—Right Bank-Area
66—V-Lock Fork Fork Lock CAP(A1)—Right Bank-Area
67—Fork Lock PIN(A2)—for Right Bank ROD(A)-Area
68—V-Lock Fork Connecting ROD(B)—Left Bank-Area
69—V-Lock Fork Fork Lock CAP(B1)—Left Bank-Area
69CRS—Cap-to-Rod SEAT-Area
70—Fork Lock PIN(B2)—for Left Bank ROD(B)-Area
70LS—Lip Seat-Area
71—Fork Connecting Rod(A) JOURNAL BORE—(Cap—INCLUDED)-Area
72—Fork Connecting Rod(A) JOURNAL GROOVE—(Cap—INCLUDED)-INNER-Area
73—Fork Connecting Rod(A) SEAL GROOVE—(Cap—INCLUDED)-INNER-Area
74—Fork Connecting Rod(B) JOURNAL Bore—(Cap—INCLUDED)-Area
75—Fork Connecting Rod(B) JOURNAL BORE—(Cap—INCLUDED)-INNER-Area *GROOVE*
76—GROOVED RAIL—(Formed type)-Area
77—GROOVED TRACK—(Formed type)-Area
78—Bearing Groove—SEAT-Area
78S—SEAT—Formed-Area
79—Seal Groove—SEAT-Area
80—Oil GROOVE-Area
81—FREE SPIN BEARING-Area
81BJS—Bearing Journal SURFACE-Area
82—Free Spin Bearing SEAL-Area
82SJS—Seal Journal SURFACE-Area
83—V-Lock Fork Connecting Rod—TOP—piston Pin BORE-Area Items—62 thru 83; Descriptive Items & Part(s)-Areas, basically Formulate the Setup of the —"Crankshaft rotating—Connecting Rod reciprocating—Free Spin Bearing(s) & Seal(s)—Assembly", (plus further meaning areas), of the—On V-Center Line Piston Cylinder Bore Spacing—Engine Block BANKS, Formulating "OSIV' STAGE TWO ENGINE CRANKSHAFT ROTATING RECIPROCATING ROD ASSEMBLY", (With or Without PISTON ASSEMBLY), for V-type & other Formulated Single-type or Inline-type—Piston Internal Combustion Engine FORMATION.

"OSIV' CROSS FORCE PISTON ASSEMBLY"

84—Cross Force PISTON(A)—Right Bank #2cyl.,#6cyl., Left Bank #3cyl.,#7cyl.-Area
84CBC—Center Bore Cup—Formed-Area
85—Cross Force PISTON(B)-Right Bank #4cyl.,#8cyl.,Left Bank #1cyl.,#5cyl.-Area
85CBC—Center Bore Cup—Formed-Area
86—CROSS FORCE piston DOME-Area
86CFSD—Cross Force Section DISH-Area (Top center piston DOME area)
87—Piston PIN-Area
87PS—Pin SEAT-Area
87AB—ARM BASE (of piston PIN)-Area
88—Piston Pin CUP LOCK-Area
88BE—Beveled Edge—angled clearance-Area
89—Piston Pin Cup Lock LOCK SEAL-Area
89LS—Separator Line—cut type-Area
90—GROOVE—Area
90I—INNER-Groove Diameter-Area
90-O—OUTER-Groove Diameter-Area
90S—SLOT-Groove-Area
90HM—HALF MOON-Groove—for clearance formed-Area
90N—NOTCH—Slot on Lip-Area
91—Lip Groove SEAT—formed-Area
91N—NOTCH Groove—clearance formed-Area
92—LIP—formed-Area
92C—CLEARANCE Area Space-Area
93—THREAD—formed-Area
93GA—Gap Area—formed-Area
94—Piston RING(S)-Area (Four Rings Per Piston—Setup—Formation)
94T—TOP—Compression Piston RING-Area
94MT—Mid.TOP—Compression Piston RING-Area
94MB—Mid.BOTTOM—Compression Piston RING-Area
94B—BOTTOM—Oil Control Piston RING-Area Items 84 thru 94B; Descriptive Items or Part(s) Areas, SIMPLY Formulate—the Setup of the—"PISTON(S)/PIN/RING(S) & CUP LOCK/CUP LOCK LOCK SEAL-Assembly"—for Piston Cylinder Bank(s)—Stage ONE/Stage TWO OSIV' Engine System, Formulating "OSIV' CROSS FORCE PISTON ASSEMBLY" for Internal Combustion Engine Formation.

*[ALL ASSEMBLIES OF ITEMS 62 thru 94B; FORMULATE—"OSIV' STAGE TWO CRANKSHAFT ROTATING RECIPROCATING ROD-PISTON-FREE SPIN BEARING/SEAL-ASSEMBLY"]*.

95—OSIV'—VALVESHAFT (A)—On RIGHT BANK-Area
96—OSIV'—VALVESHAFT (B)—On LEFT BANK-Area
97—Internal Fresh Air PASSAGE & ARROW-Area
98—Front Drive PINION NOSE-Area
99—Rear Support PINION TAIL-Area
100—VALVE—Wedge Cutout Pocket-or-Formed Pocket(s)-Area (INTake or EXHaust)
101—Valveshaft RING SEAL(S)-Area (Piston Ring type(s))
102—Turbine FAN/FIN—formed-Area
103—Air Hole Passage-Area
104—Bearing BACK SEAL-Area
105—Preload BEARING (Roller type)—Tight Press Fit—type-Area
106—Preload Bearing RETAINER-Area
106CL—Indicator CLEARANCE LINE—Diameter-Area
107—SEAL (Neoprene type)-Area
107G—GROMMET—Seal type-Area
107PH—Passage Hole—formed-Area
108—KEY-or-TEETH—formed-Area
109—Grease FITTING-Area
110—Preload BOLT-Area Items 95 thru 110; Descriptive Items or Part(s) Areas, basically Formulate the Setup of the—"OSBAND SUPER INDUCTIONEXHAUSTION VALVESHAFT'"(OSIV')—for Stage One & Stage Two OSIV' ENGINE SYSTEM—"Valveshaft (A) or (B) Assembly", (Stage One Valveshaft(s)—Setup WITHOUT Front/Rear 102 Turbine FAN/FIN formed Area(s)), for Formulated Internal Combustion Piston Engine Formation, (With or Without 111 & 112 Cylinderhead Bearing Sleeve/Valveshaft Cylinder Bearing Sleeve (VCBS)) BELOW COMPONENTS;

111—Cylinderhead BEARING SLEEVE/Valveshaft CYLINDER BEARING SLEEVE (VCBS)-(A1); for Valveshaft(A)—and RIGHT BANK Cylinderhead(A2)-119-Area
112—Cylinderhead BEARING SLEEVE/Valveshaft CYLINDER BEARING SLEEVE (VCBS)-(B1); for Valveshaft(B)—and LEFT BANK Cylinderhead(B2)-120-Area
113—Cutout SLOT(S) for Intake-or-Exhaust—PORT(S)—on (VCBS)Sleeve-Area(s)
114—Cutout SLOT(S) for Inlet or Outlet—CHAMBER POCKET(S)—on(VCBS)Sleeve-Area(s)
115—Retainer Support BORE SEAT—Area (for preload roller Bearing RETAINER)
116—Front Formed Cylinderhead Bearing SLEEVE(S) Retaining LIP-Area
117—Retaining Bolt HOLE(S)-Area (with or without OVAL shape HOLES)
118—0° (DEGREE) MARK at Top Dead Center (VCBS) Sleeve LIP-Area Items—111 thru 118; Descriptive Items or Part(s) Areas, basically Formulate the Setup of the "Valveshaft Cylinderhead (Cylinder) BEARING SLEEVE (VCBS)"—for Stage One & Stage Tow OSIV' ENGINE SYSTEM—"CYLINDERHEAD BEARING SLEEVE (or Liner) (A1) or (B1) Component(s), for Formulated Internal Combustion Piston Engine Formation.

*[NOT NECESSARILY NEEDED OF USE—DEPENDING UPON CYLINDERHEAD MATERIAL AND VALVESHAFT MATERIAL—MATED HEAT FRICTION MATTER TO MATTER RESISTING—DURING HIGH HEAT SPIN-ROTATION—ISSUE(S), AND IF "FORMING THE CYLINDERHEAD'S BORE AREAS" LIKE THE INNER BORE AREAS OF THE "CYLINDERHEAD BEARING SLEEVE".]* of, BELOW COMPONENTS;

119—OSIV' BRICK WEDGE (shape) CYLINDERHEAD (A2)—on RIGHT BANK Block-Area
120—OSIV' BRICK WEDGE (shape) CYLINDERHEAD (B2)—on LEFT BANK Block-Area
121—BASE-Area
121B—BOTTOM
122—TOP DECK-Area
122T—TOP
123—Intake port side—RUNNER(S)—Formed-Area
123IB—Injector Boss/Base-Formed-Area(Optional Safe Area of Intake Port-123-Area)
124—Exhaust Port side—RUNNER(S)—Formed-Area
124MR—Exhaust MANIFOLD/HEADER—Basic formed-(RIGHT Bank)-Area
124ML—Exhaust MANIFOLD/HEADER—Basic formed-(LEFT Bank)-Area
125—Air Passage/Internal Port RUNNER Passage-Intake or Exhaust-Formed-Area
126—BORE-or-Formed CYLINDER-Area
126BS—Bore Seat-Area
127—CROSSFORCE+CROSSFIRE*STARBURST COMBUSTION CHAMBER—Formed-Area
128—Intake-Inlet Combustion Chamber (IICC)—Formed POCKET Passage-Area
129—Exhaust-Outlet Combustion Chamber (EOCC)—Formed POCKET Passage-Area
130—CENTER CROSS FORCE—Formed Combustion Chamber DECK-Area
131—Quinch/Squeeze Surface—Chamber BASE Deck-Area
132—Half Moon GROOVE—Formed-Area (for Cylinder Block Sleeve-Top Lip)
133—Spark Plug BORE—Formed-Area (Single or *Dual BORE-Setup)
134—SPARK PLUG-Area (Single or DUAL PLUG—*"STARBURST Setup")
135—Heat Air Vent Section (HAVS)—Formed-Area
136—ARROW of ROTATION of Valveshaft DIRECTION—Front-Top-Intakeport SIDE-Area
137AD—ARROW Rotation DIRECTION-Area
137—(+)Positive—(c)Chamber-&-(−)Negative-Chamber, Degree Lines or Mark Dividing Top Front Center VERTICAL Plane—On Cylinderhead(s) Area
138—Air Cooling FINS—Formed-Area (Short or Tall-FIN Setup)
139—Fresh Air Inlet PORT—Formed Passage-Area (Front Intake Portside Area)
140—Fresh Air Outlet PORT—Formed Passage-Area (Rear Intake Portside Area)
140A—Air Flow-or-ARROW of AIR-Area Items—119 thru 140A; Descriptive Items or Parts-Area, Basically Formulate the Setup of the "OSIV' Cylinderhead (A2)&(B2)" Structure for Stage One/STAGE TWO OSIV' Engine System "BRICK WEDGE Cylinder Bore CYLINDERHEAD(A2)&(B2) COMPONENTS" for Internal Combustion Piston Engine Formation, to INCLUDE BELOW COMPONENTS;

"OSIV' ADJUSTABLE TIMING PULLEY GEAR/SPROCKET/HUB-FLEX DRIVE BELT(S) ASSEMBLY"

141—Adjustable Valveshaft TIMING PULLEY GEAR/SPROCKET-Area

142—Pulley Gear HUB-Area

143—Timing Mark Needle WASHER-Area

144—Track Guide LIP—Formed-Area

145—Gear TEETH (Half Moon Diameter type) Formed-Area

146—Timing Line(s)-Indicator(+) & (-) MARKS of Degrees—Dividing Top Front

Center Vertical Plane—ON Pulley Gear(s)/Sprocket-Area

Item—141 thru 146; Descriptive Items or Part(s)—Area, basically Formulate the Setup of the—"OSIV' Adjustable Timing PULLEY GEAR/SPROCKET/HUB—for Both (A) & (B) Valveshafts—Component(s)", of Stage One and (STAGE TWO) OSIV'

ENGINE SYSTEM

*Items—95 thru 146 are Combine Formations to basically Formulate THE COMPLETE; "OSIV' BRICK WEDGE CYLINDERHEAD ASSEMBLY",—as a Ready To Bolt On & Run/Operate (type Unit)—for Formulated Internal Combustion Piston Engine Formation—WITH the "OSIV' Roller Gear—Timing Drive Oil Pump—System Unit Case Housing" (OSIV'"R.G./RG.TDOP.SUCH."), & Flex Drive Belts, Different made or Modified Oil Scavenge Pan, Valveshaft or Crankshaft—Trigger IGNITION System, Different made—Intake Manifold/or Block Valley Cover/or OSIV' MULTI POSITION CHANGEABLE INTAKE MANIFOLD BASE & RUNNER SUPPORTS, Water Return Hoses—Linked—from REAR of Conventional Engine Block(s) Area-To-Basic RADIATOR Water Inlet Neck & Radiator Outlet Neck-To-Basic Water Pump Inlet Neck, Fuel Pump & Carburetor or Fuel Injection System, (ADAPTATION MODIFICATION of PRO ENGINE BUILDING-&-In RACING Engine Field) of such OSIV' Engine System Part(s)—IS OF STAGE ONE Setup Formation Use.

OSIV' Roller Gear-Timing Drive Oil Pump-System Unit Case Housing Assembly

"OSIV' (R.G./RG.TDOP.SUCH.) ASSEMBLY"

147—OSIV' Roller Gear-Timing Drive Oil Pump-System Unit Case Housing—(RG.TDOP.SUCH)—WITH or WITHOUT Pulley Drive Gears—(With or Without BOLT/NUT-C-Clip Lock Washer)—and WITH or WITHOUT The Front Half of Pulley Drive Gear section REMOVED—Formed-Area

147PDGA—Pulley Drive Gear (area for valveshaft (A), belt linkup)-Area

147PDGB—Pulley Drive Gear (area for valveshaft (B), belt linkup)-Area

148—Roller Gear Pinion NOSE-Area

149—Crankshaft Nose HOLE-Area

150—Oil Pressure Volume Adjuster, Casing (typical)-Area, (Unit)

151—Adjustable Bolt SHAFT-Area (Jack Screw type)

152—Pin Lock Knob Adjuster-Area

153—Pressure Lock WASHER Plate-Area

154—Pressure Boot Cone SEAL-Area

155—Cooling Oil Pin HOLE(S)-Area

156—Front COVER PLATE-area

157—ROLLER GEAR—For Crankshaft Nose Pinion Teeth-formed-Area

158—ROLLER GEAR—Middle—to drive Belt for Valveshaft(B)-Area

159—ROLLER GEAR—Top—to drive Belt for Valveshaft (A)-Area

160—ROLLER BEARING WHEEL-Area

161—BEARING SHIM SPACER-Area

162—SPACER PIN LOCK (Press Fitted type)—(Carbide Steel—type)-Area

163—RIVET PIN LOCK (Soft'e Typical Crimped type METALS)-Area

164—Formed Unit Case Housing-Area—or Back PLATE-or Plate-Area

165—Formed Scavenge Oil Cooling PASSAGE-Area

166—Formed high Pressure Pumping Oil Outlet PASSAGE-Area

167—BACKSIDE Mating Surface—(Front COVER PLATE)-Area

168—Formed INVERSE RAISED-AREA(S)—(to Seal Off Unit Case Housing Upper & Lower formed Matched Passage INNER GROOVE(S))-Area(s)

169—Formed INVERSE RAISED PIN(S)-Area (to Cool Oil WITHIN Oil Passage Route)

170—FRONT-Area

170N—NOSE-Area & (for "CHOICE SELECTED COMPANY" section Page 10.,Setup)

171—REAR-Area

172—Crankshaft PINION NOSE-Formed-Area

173—Dowel PIN/Guide PIN-Area

174—Crankshaft Nose Trigger Hub/Harmonic Damper/Balancer—HUB-Area

175—Balancer/Harmonic Fluid Damper/PRO-Damper-Area

176—VALVE—Threaded TUBE NUT Cylinder Shape VALVE type—Formed-Area

Items—147 thru 171 items-&-176 item; Descriptive Items or Part(s)-Area, basically Formulate the Setup of the—"UNIQUE Driving Key Force"—of the OSIV' Engine System—for Valveshaft (A) & (B) for Stage One & Stage Two Setup, which is the "OSIV' Engine System's;

"ROLLER GEAR-TIMING DRIVE OIL PUMP-SYSTEM UNIT CASE HOUSING", for Formulated Internal Combustion Piston Engine Formation.

177—Spring By-pass Oil Filter VALVE (Optional Oil Filter By-pass Valve)-Area

177S—SCREEN-Wire or Mesh (Tight Woven Stainless Steel type)-Area

178—Ignition Trigger PIN (typical)-Area

179—Ignition Trigger Support-type BRACKET or MOUNT—Formed-Area

179B—Bracket-Mount for Ignition COIL—Bracket-Area

180—Ignition Coil WIRE-Area

180C—Wire CLAMP—Supporter-Area

181—Ignition Trigger Wire TUBE PROTECTOR-Area

182—GUARD/SHIELD (for Flex Timing Drive Belt(s))-Area

183—Spacer TUBE(S)-Area

184A—Flex Timing Drive BELT (Shorter Length)-Area

184B—Flex Timing Drive BELT (Longer Length)-Area

185—Pin-Screw LOCK KEY—(Flex Belt Formed LINK) Optional-Area

186—Oil Pressure Regulator-By-pass Valve-Sending Unit & Casing-Area

187—Pressure REGULATOR—Formed-Area

188—By-pass VALVE—Formed-Area

189—SPRING—Formed-Area

190—SENDING UNIT & WIRE—(typical)-Area

191—Crankcase-Valley Ventilation CAP—Formed-Area

192—Ventilation TUBE or PIPE—Formed-Area

193—Electric Water Pump-MOTOR—Setup-Area

194—Heat Deflecter SHIELD-Area

195—Electric Water Pump Motor MOUNTING PAD-Area (On Valley Radiator Rear Outlet NECK or REAR Valley Raised BASE Formed-Area)

196—Electric Pump Motor-(DRIVE PINION SOCKET NOSE-INNER GROOVE HUB)-Area

197—Fresh Air Outlet Manifold PIPE(A)-RIGHT Valley BANK REAR—Formed-Area

198—Fresh Air Outlet Manifold PIPE(B)-LEFT Valley BANK REAR—Formed-Area

199—RUNNER(S)—Intake Manifold Support RUNNER (S)—Formed-Area

200—INTAKE MANIFOLD BASE-Formed-Area (Multi Position Changeable—formed type Setup)-Area

201—Block Off PLATE (typical Removable type)-Area

202—Two BBL & Four BBL (Barrel formed Inlet-SPACE) TOP—Formed-Area

203—Two BBL (2-Barrel Throttle Body or Side Draft Carburetor) FRONT Inlet-Area

204—One BBL (1—Barrel Throttle Body or Side Draft Carburetor) REAR Inlet-Area

205—Dual Four BBL(2-4Barrel CARB. or SuperCharger-Inlet(s)) BOTTOM Base-Area

206—Electric Fan SHROUD—Formed-Area (Upper REAR Valley)BLOCK Open Space-Area

206L—Lower-Electric Fan SHROUD-Section—Formed-Area

207—Electric Fan MOTOR(S)—Setup-Area

207L—Lower-Electric Fan MOTOR(S)—Setup-Area

208—Electric Fan BLADE(S)-Area

208L—Lower-Electric Fan BLADE(S)-Area

209—Fresh Air Inlet Manifold-Formed-Area (FRONT Upper BLOCK Valley)-Area

209F—Fresh Air Inlet FILTER-Area (for Fresh Air Inlet Manifold)—(Accessory), type formed item, Viewed On "CHOICE SELECTED COMPANY" section Page 3.-Area Items—172 thru 209F Items; Completes the Descriptive Numbers of Items or Parts LIST—DESCRIPTION—which basically Formulate the SETUP & AREAS of the "COMPLETE STAGE TWO" presented OSIV' ENGINE SYSTEM—Structured Invention—for Formulated Internal Combustion Piston Engine Formation—to which is intended towards—SPORT Racing Pro Fields & the basic WORLD OF RACING type Engine Development Usage.

Description Parts List Concluded.

(A)—ENGINE BLOCK MAKING: Referring to FIG. 28, and (BRIEF DESCRIPTION OF/DRAWING—Paragraph FIG. 28 Depicts), Identified Invention—by Item Numeral 6 of (DPL) Parts List: page 32. As with typical Engine Block Manufacturing Companies—Casting & Forging & Machining Processes of Good Quality Metals are basically used for forming and producing known V8-type Engine Blocks, WITH Staggered (Off V-Center Line) Cylinder Bore Spacing—Cylinder BANKS—so Connecting Rods can be used SIDE BY SIDE on the Crankshaft Throw Arm Pin JOURNAL—together, Not So for—OSIV' Engine BLOCKS of STAGE TWO Form.

The Technique or Method here—of (Making Such)—is to basically start off by (Forming) the Five Forged Steel-or-Forged Aluminum-or-Forged Iron—of Separate PLATES of the Engine Block's MAIN RIB BULKHEAD(S) Area 1 and Engine Block's MAIN RIB BULKHEAD FORK(S) Area 2—Together As Solid Forged MAIN RIB BULKHEAD "PLATES" First. Then CAST or FORM Block Cylinder BARRELS—Bore Area 4 Within/Between the Five MAIN RIB BULKHEAD "PLATES"—Area 1 & 2, then CAST or FORM—Engine Block Cylinder Casing Area 6 item thru 24 item of the (DPL) Parts List: page 32.—WITH INCLUDING Items 3 & 5-Areas.

As for those who are Ordinarily SKILLED in the pertinent area Art of Internal Combustion Piston Engine BLOCK MAKING, the "OSIV' ENGINE—Item Numbers & Letter/Names—(DPL) Description Parts List:" of the SPECIFICATION pages 32. thru 43., are Sequenced in simple basic order for OSIV' Engine System SETUP Making and Producing & Using Formation—WITHOUT Extensive Experimentation.

However, the Extending BULKHEAD FORK 2 Area—can be simply added in Block Forming CAST MOLD areas.

Engine Block Main Rib Bulkhead 1 and it's Bulkhead Fork 2 Areas are typically Numbered as most V-eight Engine Blocks are—from Front to Rear (#1 Main Rib Bulkhead, #2 Main Rib Bulkhead, #3 Main Rib Bulkhead, #4 Main Rib Bulkhead, #5 Main Rib Bulkhead).

Engine Block Valley Bulkhead Base 3 Area—is Formed by basic CASTING MOLD Techniques—of a ARCH or Half Moon DOME place(d)—or—Formed down in between the Main Rib Bulkhead 1 Areas—at a suitable DOME Depth Arch—for—basic Crankshaft "CLEARANCE" Rotating Reciprocating Rod Assemblies—as—the Indication Arch DOME Line 3 Area,—(for Quick Viewing-(Q/V) of FIG. 132)—, which crosses BOTTOM of Formed Engine Block Cylinder BARREL BORE 4 Areas,—Quick Viewing of Arch DOME Line 3 Area of FIG. 5. Broken Line Phantom Radius—which Extends Around to Engine Block Casing Lower BULKHEAD Oil Pan RAIL 10 Area. (MAIN RIB FORK 2 Area—Bolt HOLES 55 Area—shows MAXIMUM Depth-Formed), "MINIMUM HOLE DEPTH IS TO BE REQUIRED—USE—FIRST", to maintain Fork Strength Structure.

Engine Block Cylinder Barrel Bore 4 Area—is Formed by basic CASTING MOLD Process Forming Techniques—by Engine Block Manufacturing Companies—WITH suitable Thickness & Surrounded by (W/C) Water/Coolant Jacket/Passage 5 Areas. The Cylinder Barrel Bore 4 Area(s)—is Setup on the "ON V-CENTER LINE—(EVEN)—CYLINDER BORE SPACING"—to create "NON-STAGGERED" Right & Left Cylinder BANKS WITH VALLEY (&/or Radiator Structure) in Between, simple—BOTTOM Block View FIG. 28 and basic TOP of Block Cylinder Barrel Bore 4 area—for Quick Viewing of FIG. 25—as to compare to other Engine Blocks within "CHOICE SELECTED COMPANY" section Page 1. & others—WITH Written NOTES—and Pages 2. thru 7., which is now considered—OLD STYLE Engine Block Forms.

Engine Block Cylinder Barrel Water Jacket Passage(s) 5 Areas—is Formed by basic known CASTING MOLD Process Forming Techniques—by Engine Block Manufacturing Companies—WITH suitable outer Block Casing THICKNESS areas—WITH enclosed Water Jacket Passage 5 Areas of FIG. 5—with—FIG. 6 for Quick Close Viewing together, and with FIG. 112 for Quick View—which the FRONT-and-REAR Main Rib BULKHEAD 1 Area; (Plates)—MUST be basically Hollowed or Grooved Out in this area to Match Up with other Water Jacket Passage 5 Areas—WITH suitable OUTER Block Casing THICKNESS which encloses Water Jacket Passage 5 Areas,((Q/V) of FIG. 25 TOP View shows; Item 5 Areas in Broken Line Phantom), thus to create a Continuous Oblong of Water Flow—Around Cylinder Barrel Water Jacket Passage 5 Areas & WITHIN Block Cylinder Casing 6 Area, (Q/V) FIG. 10—4B Area(s).

Engine Block Cylinder Casing 6 Area—is as implied and on ((DPL) Item Number/Parts List:) page 32. of SPECIFICATION which is Now Referred to.

Everything Else of this SPECIFICATION Parts List—page 32. thru 43.—is Setup in a Elementary Fashion, YOU View a Figure/Fig. and See the Item Part type Number &/or Letter—then Find it in this (DPL) List section of Pages, and it simply tells You what it Basically is.

Item Numbers of this Description Parts List: Page 32.; 7, 8, 9, 10, 11, 11RA, 12, 13, 14,—are all FORMED by basic known CASTING MOLD Process Techniques—by Engine Block Manufacturing Companies. And Since I've presented Many Basic Drawing Figures—for those who are so basically SKILLED in the Art of Internal Combustion Piston Engine BLOCK Making & Building, could Simply View All the Drawing Figures & DIAGRAM(S)—and basically NOW have (THE MIND Set)—and can then make "ANY" suitable SIZE OSIV' Engine for desired Use.

Internal Valley Base Bulkhead-HIGH PRESSURE OIL RESERVOIR 15 Area—can be Formed by suitable Oblong Shape Solid Graphite (Mold Material type) Rod(s)—in this area—of basic known Casting Mold Setups & Process Techniques—, or can be Formed by suitable Length DRILLING ROD(S)—to bore out such area(s) to form Long Hole or Oblong Hole shape Reservoir 15-and-Reservoir 16 type Tunnel Hollowed Out Areas. The basic suitable Length of these RESERVOIRS—is from FRONT Main Rib Bulkhead 1 Area-to-the REAR (MID) Middle area of Main Rib Bulkhead 1—REAR BLOCK AREA—as basically shown in Broken Line Phantom of FIG. 19 & FIG. 16, While Viewing FIG. 4.

Item 17 & 18 Area(s)—are basically Formed the Same Way—Viewing FIG. 4, FIG. 5, and FIG. 25—AS ITEM 15 & 16—but are NOT AS DEEP nor Long nor Oblong Shaped. These Horizontal Plane—Air to Oil Passages 17 & 18 Areas of FIG. 25—Shows the basic Phantom broken Line—FRONT to REAR Length View of formed Passages. The Vertical Plane—Air to Oil Passages 17 & 18 Areas of FIG. 5 & FIG. 6—Shows these Passages Holes are Formed to Enter the Bottom area of Cylinder Barrel BORE(S) 4 Area—and are Plugged with Plug 60 Item—Flush—with Valley Surface—Casing Valley Base 11 Area. Cool to Warm Air is Forced Ventilated through these passages to help cool HOT Oil from the "Cross Force PISTON(S)" 84 & 85 Items—which the Oil is Pumped into Oil Groove 80 Area of Laminated Spring Boot Seal 52 item and Pumped into Vertical AIR OIL Passage 22 Area—which is also Formed to enter Bottom area of Cylinder Barrel(s) BORE(S) 4 Area—and enters Lower Bulkhead Oil Pan RAIL Horizontal Air Oil Passage(s) 23 Area, the HOT Oil is PRE-COOLED and Forced towards FRONT Main Rib Bulkhead 1 Area-and-Cross Horizontal Passage(s) 24 Areas—to Main (Inlet) Scavenge HOLE 27 Area (for OIL Scavenging) of the (RG.TDOP.SUCH.) "ROLLER GEAR—TIMING DRIVE OIL PUMP—SYSTEM UNIT CASE HOUSING" 147 Item Area—as NOW Viewing FIG. 15 & FIG. 18—Lower BLOCK Broken Line Phantom—Oil Flow Route Passage(s) area, then View FIG. 2 & FIG. 94 to QUICKLY Understand—to see How the Pre-cooled Oil is so Scavenged into this formed 147 Item Unit Case Housing 164 Plate Area—from the BACK SIDE Inlet HOLE(S) Passage(s) 27 Area. The Pre-cooled HOT Oil is Cooled again —Before—entering the Three ROLLER GEAR(S) area-and-Before entering the Oil FILTER 49 Item Area-and-back into HIGH OIL PRESSURE RESERVOIR 15 Area, as shown of FIG. 19, though, the FRONT Main Rib Bulkhead 1 & #1 Area—24 & 27 Oil Passage Areas are (Machined—Matched) WITH (RG.TDOP.SUCH) Back Housing 164 Plate—Main Inlet Oil Scavenge HOLES of 27 Areas to create a Real "TOTAL CONTROL OIL FLOW SYSTEM" Within A Engine-which Oil Passage(s) 27 Area of FIG. 98—Matches Up to 24 Oil Passage(s) HOLE(S). Such OIL then enters the Formed Scavenge Oil Cooling Passage 165 Area—as Shown of FIG. 94.

Internal Block Main Rib Bulkhead-VERTICAL SLANT OIL Passage 19 Area—of FIG. 5 & FIG. 6-and-FIG. 19—, is Formed by Basic CNC Drill Press Machines though at a Suitable Slant angle at the Center Top area of the Main Rib Bulkhead Fork/JOURNAL BORE 20 Area, (typical), Is Continuously "OIL FILLED"—by the HIGH OIL PRESSURE OIL RESERVOIR 15—which is *[PRE-FILLED With A Suitable Similar Or Specified MOTOR OIL—Completely Before Installing Typical OIL FILTER(S) 49 Area Of FIG. 19]*, so even WITHOUT High Oil "Pressure"—, the Down Force of Gravity & Crankshaft Rotation with it's Throw Arm(s) 63—"FORCE" is enough to "SIPHON" OIL through this entire "TOTAL FLOW OIL CONTROL INTERNAL SYSTEM TECHNIQUE", which OIL flows through V-Lock Connecting Rods 65 & 68 Item Areas, to the Piston Pin & Cross Force Piston 84 & 85 Item Assembly.

Main Rib Bulkhead Fork Bearing & Seal JOURNAL BORE 20 Area, & Main Rib Bulkhead Fork Lock-(bearing/seal)-CAP 21 Item(s)—BORE-Areas—are Precision Precisely Formed or Machined WITH Grooves 78 & 79 Areas—to House & Seat the—Two Piece "Free Spin Bearing" 81 Area/Items—Viewing FIG. 5, and the—Two Piece "Free Spin Bearing Seal" 82 Item/Areas—Viewing FIG. 4, to which Groove Seat 78 & 79 Areas—is Shown on FIG. 28—which Main Rib Bulkhead Fork Lock CAP 21 Item—is Machined to Precisely Match, (also Shown in basic Phantom Broken Line area—of FIG. 16).

The Two Piece "Free Spin Bearing" 81 Items/OSIV' Technique—Do Exactly as they are Named or Called, they SPIN Freely in their SEAT and JOURNAL area WITH or WITHOUT OIL-along with Crankshaft Journals—though at a Slower Rotation Rate.

The "Free Spin Bearing" 82 Item Areas/OSIV' Technique—are Two Pieces as well, and are basically Designed & Setup to keep OIL on the Crankshaft Main Journal 62 Area & Crankshaft Throw Arm Pin Journal 64 Area (At All Times Of Engine Running Conditions)—and Within those areas of High Friction—Metal to Material Metal Surface Contacting, WITH Minimum OIL Leakage.

This Method or Technique "WILL KEEP OIL ON JOURNAL AREAS" and Within Bearing areas—at All Times—even during Engine Start-ups & Lower OIL Pressure RPM Operation-Range, thus also helps to insure Oil Flow VOLUME & PRESSURE is going to Piston PIN 87 Item Area & Piston 84 and Piston 85 Item Area(s)—Assemblies—Internal Oil Passages 27 Areas, Grooved Oil Passages 90 & Oil Groove 80 Area(s)—to Maintain "CONSTANT" Oiling On the Inside Diameter of Engine Block Cylinder Sleeve/Liner 51 Area-BORE WALL(S)—or—if Sleeves are NOT used, then to Maintain "CONSTANT" Oiling on the Block Cylinder Barrel 4 Bore Area-WALL, of Viewing FIG. 5 & FIG. 6—together WITH FIG. 19. The OIL is then Dumped back down into BOTTOM Cylinder Spring Boot Seal 52 Item's Oil Groove 80 Area—to continue "TOTAL OIL CONTROL FLOW"OSIV' Engine System Technique/Method, thus NO Large—Nor—Medium Amounts of OIL is "NOT" to be no where in the OIL SCAVENGE PAN 25 Item 26 Area & Crankcase area, (ONLY SMALL AMOUNTS OF OIL).

OILING of this STAGE TWO OSIV' Engine System—is NOT the Old Style-Splash & Drip/Squirt UNCONTROLLED Engine Oiling—type System Design,—which Reserves "HOT" Quarts of OIL Boiling in the Oil Pan & Crankcase areas—To which is a KEY Factor of causing HIGHER EMISSIONS CARBONS to being Released into the Atmosphere (By Internal Combustion Engines).

I (OSIV' System & Inventor/Designer) Realize that Particular Carbons must be Burned once OIL gets HOT or BOILS—while sitting in Oil Pans—trying to cool down. The "KEY" Solution Here—"Is Not To Put Oil In That Situation In The First Place.", (Not simple), of Internal Combustion Piston Engine Design—as the OSIV' Engine System in Stage Two Formation—has so Achieved (by Invention Design—First), & towards this Engine Design Thinking—First.

Lower Block OIL SCAVENGE PAN 25 Item Area—Should be Formed by—FABRICATING Forming & WELDING-Heavy Gage (⅜" MINIMUM Thickness) Stainless STEEL—together WITH Internal Stainless Steel TUBES of Oil. Passages & Tunnel(s)—in suitable areas as Figures Show,—OR—Formed by basic Stainless Steel Casting Mold Process Techniques—by Known Stainless Steel Casting FOUNDRIES & Manufacturing Companies—or—by "CHOICE SELECTED COMPANY" section Page 51. *(MILODON).

It is a basic Half Moon Tub Cylinder Shape Structure/Setup—which is also Formed to Preload & Support-lock the FORK CAP(S) 21 Item Areas & it's 54 BOLT(S) Item Areas—and seal off Lower Block Cylinder Casing 6 Area & Crankcase Areas & Secured to Oil Pan BLOCK RAIL(S) 10 Areas & BOTTOM area of (RG.TDOP.SUCH) 147 Item, WITH suitable Gaskets 57 Area & Bolt(s) 54 Item Areas, as Viewing the FIG. 1, FIG. 5 & FIG. 6, (of basic FRONT Structure areas), FIG. 8, FIG. 9, (of basic REAR Structure Areas), FIG. 13, FIG. 15, FIG. 17, FIG. 18, (of basic REAR & FRONT—SIDE Structure Areas), FIG. 26, (of basic BOTTOM Structure Areas), and All other OUTER CASING type Views. FIG. 26 shows the Basic Location of the Half Moon Arch type Internal-27 Oil Passages in Broken Line Phantom, which are Lined Up with Piston Cylinder Bore Spacing—On V-Center Line.

Four Arch Rows (of Oil Passages) are basically represented for a V8-type Piston Engine or (Inline 4-Cylinder type Engine)—BLOCK of Stage Two Form—FRONT to REAR is (1), (2), (3), (4), of Oil Passages 27-type Areas. These Oil Passages of 27 (Arch type)—can be simply CAST-IN Formed WITH suitable size (J-joint HOOK shape suitable Casting/Forming type Material Rods)—in these areas of the Setup Casting Mold(s)—set-up like 27 Oil Passage Area(s) of FIG. 5 & FIG. 6 Fashion, or Two Quarter Moon (J-J-joint Half Moon shape suitable Casting/Forming type Material Rods), Mold Material type Rods—position on each side of the Casting Mold(s)—WITH ONE long straight Casting Material Rod POSITION at BOTTOM CENTER of the MOLD (or top center of ARCH) TUB Area—along Horizontal Plane—Like the Broken Line Phantom Oil Passage View of FIG. 26 Center Oil Passage 27H Area, and WITH a Curved Long Casting Material type Rectangular Plate—Position just above Passage 27H Area in MOLD(S) as 27HW Horizontal Wide Oil Passage as VIEWED of FIG. 5 & FIG. 6 Shows—& Horizontal Broken Line Phantom area View of FIG. 26, BOTTOM Oil Scavenge Pan 25 Area View.

However, the Lower Block Bulkhead Oil Pan RAIL 10 Area—22 Passage HOLE(S) Areas—is to be PLUGGED 60WP (Plug-WITH Center area "Pin Hole" for HOT OIL Relief-type Cooling Passage Routing-HOLE) as Shown on FIG. 18—(the SIDE View), and 60WP Item as Shown on FIG. 27—(Engine Block Casing Lower Bulkhead Oil Pan RAIL 10 Area & Surface).

This Pin HOLE—made in a-or on a-Small Diameter Size FREEZE PLUG—is Only necessary for "HOT OIL" to Seep through in very small amounts of Oil Spurting under Hot Oil Pressure of Relieving—so such HOT OIL can Cool itself down (as well)—by traveling along the Outer Diameter Wall of the formed Arch Oil Passages 27 Area of 25 Oil Scavenge Pan—of FIG. 6 as Shown. However, a basic "NON-Pin HOLE" Freeze PLUG(S) should be used—and Especially Used if OIL Temperature is NOT (Warm-hot/Hot) enough for particular Climate Performance Operations,—or—Thermostatic Heat Spring Valve type Unit-Plug By-pass Valve Setups—can also be used in THESE 22 Oil Passage Areas—of Plug 60WP & LOWER Bulkhead Oil Pan RAIL 10 Area—of FIG. 18 and FIG. 27.

There are Three basic SETS of Vertical Formed Rows of Oil HOLES 27 Area(s)—Along & Across the Center Horizontal Plane Arch-INNER Casing & Surface 26 Area—to Collect any OIL that enters Crankcase & Oil Scavenge Pan 25 Area—as Viewed on FIG. 19 & FIG. 6 & FIG. 5. This 26 Surface Area is to be properly LINED WITH a Tight Woven Stainless Screen 177S (mesh type) Area—that can be Welded or Epoxy(ied)—securely in it's position, to help stop (Small Metal Fragments from entering the Oil Flow System).

This Oil Scavenge Pan 25—also Houses a suitable Formed FRONT area 201 Plate & Drain Bolt PLUG 54DP Area—WITH Filter/Mesh Screen 177S & Seal 107 Item Areas—are Shown in typical areas to Stop Any OIL Leaks, as Viewed on FIG. 19 FRONT BOTTOM areas—WITH the Slant Main Oil Inlet Scavenge Passage 27 Area—to & for (Roller Gear—Timing Drive Oil Pump—System Unit Casing Housing) 164 Plate Area, BOTTOM Slanted Inlet Oil Passage 27 Area.

The BOTTOM & OUTER Structure 25 Areas—of Oil Scavenge Pan 25 Item Area(s)—FIG. 19 Shows it's "MINIMUM" THICKNESS or (Maximum Thinness) of Drawn View area, FIG. 9 Shows the REAR Structure & Fit of Oil Scavenge Pan 25—Equipped WITH a One Piece Split SEAL 80 Item.

Rear Valley Base Oil Pressure By-pass Valve Regulator Sending Unit "BORE" Hole 28 Area—of FIG. 25 & FIG. 10, is a Basic Bore Hole—Formed deep enough to properly Join Both Oil RESERVOIRS 15 & 16 Areas together—as Shown in FIG. 10—with the Unit Casing 186 Item Area in Position and Pressure Regulator 187 Item Structure Area EMBEDDED at a Slanted Angle WITH Spring 189 Item & By-pass Valve 188 Item Area(s), on it's Needled TUBE Formed Regulator 187 Tip End Area.

When Air Pockets are created in HIGH PRESSURE Side Oil Reservoir 15 Area, this basic type Oil Pressure Regulator By-pass Valve & Spring Unit 186 item Design Setup—will allow 15 RESERVOIR—to BLEED itself of Air Pockets & Air Bubbles—INTO RESERVOIR 16, which interns, Forces RESERVOIR 16 Fresh OIL Supply—into Oil inlet HOLE Passage 27H Area—of the Back or REAR—of the "ROLLER GEAR TIMING DRIVE OIL PUMP/HOUSING Plate 164 Item" of FIG. 98 and 27H of Housing Plate 164 Item of FIG. 93 FRONT area of Housing Plate 164 Item. However, the Oil Pressure Regulator By-pass Valve Sending Unit Casing 186 Area—is Formed from a basic Forged Steel type Casing—WITH simple Drilled & Threaded area & Passage 27 Areas Shown on FIG. 10—of a Solid Forged Steel Rod which is Precisioned Machined or Formed to be Tight Press Fitted & Positioned Correctly in BORE HOLE 28—Where as the Pressure Regulator 187 & Spring 189 & Valve 188 & Sending Unit 190—(Items) can be REMOVED & REPLACEABLE—by suitable Thread 93 Areas-and-Seal 107 Areas—of FIG. 11—typical fashion. And as Viewing FIG. 25, 11RA is "Raised Area" of REAR Valley Block Casing Base Bulkhead 11 Area—because of the Formed Casing Water Jacket(s) Passages 5 Area—For Electric Water/Coolant Pump & Propeller-Setup System.

This Concludes the basic Setup Formation and Explanation of How the OSIV' Engine System—Stage Two ENGINE BLOCK MAKING & Forming Technique—Method—Process—Using—for those Persons who are basically SKILLED in the Art of ENGINE BLOCK Manufacturing—by simply Examining above Figures & Explanations and Properly Building such.

(B)—ENGINE BLOCK VALLEY RADIATOR WATER/COOLANT COOLING CORE UNIT MAKING AND BLOCK VALLEY SETUP: Referring to FIG. 23,—Since this is a UNIQUE New Design & Setup OSIV' Engine System STAGE TWO Technique Invention of itself—in which it is designed—and—is to be Considered as Part of the Engine BLOCK'S Construction Valley "STRENGTH STRUCTURE" Supporting Area(s). As for instance, as is typical as—Engine Block Manufactures that Produce "BARE Block(s)" (Nothing Included)—though the Main Rib Bearing Journal Crankshaft Bore "CAPS" & "BOLTS" are Separate Pieces—though typically—the "Caps" & "Bolts" are Pre-Installed on the BLOCK before typical Purchase(s). The same is applied Here with this OSIV' Engine System STAGE TWO BLOCK Setup-Caps/Bolts & Valley Radiator Unit Area.

The Unique Valley Block Radiator/Unit 29 Item Area—as I've so designed is part of the Engine BLOCK'S Construction—"AND MUST BE RE-PRESSURE TESTED AFTER INSTALLED ON ENGINE BLOCKS"—, Water Pressure Tested In It's Valley BLOCK Position—WITH the typical BLOCK—Water Pressure Leak Test done—by Engine Block type Manufactures—as to be sure NO Cracks nor Leaks are NOT present of Combineed Radiator/Block(s) Setup—as a Benefited Complete USABLE "BARE BLOCK" Unit—Item(s).

Middle (Mid.) Valley RADIATOR Water/Coolant (W/C) Cooling Core Unit 29 Area Structure—Should be made by basic known Casting or Metal Forming type "RADIATOR Manufactures"—like those listed on "CHOICE SELECTED COMPANY" section Page 8.*, which MUST be read entirely—to realize OSIV' Engine System of—Mind Set—for this Valley Radiator—towards Professional Use. Radiator Items 29, 30, 31, 32, & others are within (DPL) Parts List: Page 33.

Radiator—Top Valley Deck LID Cooling Fin COVER 32 Area—is of Removable type WITH Bolts 54 Areas—securing it to the Valley Deck 12 Area. This Cooling Fin COVER 32 Item Area—should be made of a Strong Forged ALLOY Aluminum or Stainless Steel Formed PLATE—as well as for the Formed Water/Coolant (W/C) Filler NECK 40 Area. The Cooling FINS 138 Areas—are Formed Along the Top Horizontal Plane of COVER 32—of Middle Valley area and the 138 FINS extend down into Water Passage 34 top area of the Vertical Plane—as Viewed in FIG. 5 & FIG. 6.

When HOT Water/Coolant Fluid enters 34 PASSAGE Top Area from (W/C) Jacket Passage(s) 5 Area of BLOCK Valley DECK 12 Area, it Flows and Hits the bottom of the 138 FINS to cool itself. The Fins Absorbing this Heat and Ridding this Heat through Top Half of the Fin's 138 Area—in the Upper Valley Block AIR FLOW STREAM & ATMOSPHERE. This "WILL" Allow the Hottest of HOT Coolant/Water to start "Pre-Cooling" Immediately after leaving Cylinder BLOCK (W/C) Jacket Passages 5 Area. The Water/Coolant is then Separated by Center Dividing Formed WALL Cooling Core Unit Formed 29 Area Structure—Which Aid towards further Reducing "OVERALL PRE-COOLED" High Heat (W/C) Temperature of a Engine. After HOT Water/Coolant is Pre-Cooled, it is Siphoned Downward with Gravity Force & Electric Water Pump Motor 196 Item & 38P PROPELLER FIN Area—Suction Force—through Formed S-CURVE type-Water/Coolant-Cooling-TUBE(S)/CORE(S) 30 Area Passages. FIG. 24 Shows Top CORE UNIT Structure Formed 29 Area Deck—WITH many TUBE(S) HOLE(S) 30 Item Area(s) Locations—of basic Setup in a Horizontal Arch Plane ROW(S) Formation. Five basic Rows for RIGHT BANK Cylinder BLOCK & Five basic Rows for LEFT BANK Cylinder BLOCK, as UNIT CORE TUBES 30 Item(s) Area—Averaging: (248 S-CURVE or STRAIGHT-type passage Cooling TUBES "Down Flow System").

The HOT Water/Coolant "FLOW" is Slowed Down and Separated into (One Hundred Twenty Four) Cooling TUBES 30 Item Areas (W/C) Passages—Per Cylinder BLOCK BANK—of a V8-type Engine (Average)—Which interns—further Cools the Pre-Cooled HOT Water/Coolant Flowing Down through the Internal Passages 30 Areas—into LOWER 34 Passage Area—Viewing FIG. 5 & FIG. 6. The Water/Coolant then enters the Radiator-Bottom Water/Coolant Scavenge HOLES & OUTLET TUNNEL Passage 31 Area—which the (NOW) Cool to Warm Water/Coolant is SCAVENGED from the Internal CENTER BOTTOM area of Radiator CORE as shown of (Phantom Broken Line Diameter Circle area) of (FIG. 24)—"TO" Radiator Rear Water/Coolant-PROPELLER & SHAFT HOUSING PUMP NECK 38 Area Formed Structure-and-FORCES Cool to Warm (W/C) Immediately to REAR Cylinder BLOCK Water/Coolant (W/C) Jacket Passage 5 Areas, as Shown of FIG. 25 View.

When the S-CURVED (W/C) Cooling TUBES 30—Heats Up, They WILL FLEX-and-therefore, should be made of suitable "Stainless Steel" HIGH HEAT (W/C) Pressure type TUBES—Formed or Bent to a Pre-Heated S-CURVED Shape—WITH Straight Ends as Viewed on FIG. 5 & FIG. 6.

Radiator Air Cooling Tube Cross FIN(S) 35 Areas of FIG. 5 & FIG. 6 are Cross Horizontal Plane—in there basic suitable Position(s). As typical with Radiator Formation(s), these FIN(S) 35 Item Areas—Draw Heat Away from TUBE (S) 30 Item Areas—and BOTH together—are "AIR-STREAMED COOLED" in the Middle Valley BLOCK Open Space area—WITH the Help of TWO Lower Position—DUAL—Lower—Electric Fan MOTOR(S) 207L Items & Lower—Electric Fan BLADE(S) 208L Items & Electric Fan SHROUD 206 Item—Formed/Setup AREAS—at the REAR Upper BLOCK Valley Open Space Area & Between the Lower-Electric Fan SHROUD-Section 206L Formed Area position, "Sucking" Air through Radiator CORE UNIT 29 Open Space tubes & fins Area—from the FRONT Engine Valley Open Space BLOCK area.

The FIN(S) 35 Item Areas—can be Positioned & Formed Around the Cooling (W/C) TUBES 30 Areas in TWO Basic Ways—as Shown on FIG. 24:

ONE way—is in a simple "Cross Horizontal Plane—Stacked—Quarter Moon Arch Formation", ANOTHER way—is in a simple, "Along Horizontal Plane—Stacked—Non-Arch Formation", for those Persons basically SKILLED in the Art of HIGH Performance & Custom & Professional RACING type Radiator Manufacturing or Making, type Levels.

FIN(S) 35 Item(s)—should be made of a suitably THICK (but not Too thick)—Stainless Steel or Stainless Alloy Aluminum, that can be WELDED IN POSITION & TO THE TUBES 30 ITEM (Completely Around Each Contacting/Mate-Up Areas) *[NON SPOT WELDED, ONLY COMPLETELY WELDED.]*

Then once the RIGHT BANK and LEFT BANK—TUBE (S) 30 Items-and-FIN(S) 35 Items are Formed, they can be Propped/Setup for Different Stages of Casting Processes—of Casting Welding—the Main Strength Structure & Outer Casing & Base & Deck & Tunnel Passage—Structure 29 Areas—to the TUBES 30 & FINS 35 Areas/CORE—and Around such area to Form or Fabricate a WELL MADE suitable "ENGINE BLOCK VALLEY RADIATOR CORE UNIT 29—WITH THE REAR CAST OR WELDED—(W/C) OUTLET NECK 38 AREA TYPE—FOR HOUSING PROPELLER 38P & SHAFT 38S, FRONT CAST OR WELDED (W/C) AUXILIARY OUTLET NECK 39 AREA TYPE, TOP TO BOTTOM—SIDE TO SIDE—FRONT OPEN AREA WIRE MESH SCREEN 177S AREA COVERING TYPE INSTALLED, Complete Unit Area Item(s)".

*FIG. 132 and *OSIV' MODIFIED/COLORED Version (Vr.) V-type Engine of FIG. 5 & FIG. 6 & FIG. 132* (small scale). Shows the STRAIGHT Formed Water/Coolant Passage(s) 34 Area Vertical type & the Air Cooling HOLES 35H Horizontal Passages type Setup Areas, So HOWEVER a Radiator Manufacture or Company FORMS such Engine BLOCK VALLEY RADIATOR 29 CORE UNIT Area, Suitable Materials and THICKNESS MUST BE CONSIDERED—as well WITH "SEALING" Properly "ALL MATING STRUCTURES & SURFACE SEALING AREAS" Before Installing On Engine BLOCK(S) or Casting/Welding & Forming Radiator Core Structure 29 Within Engine BLOCK Valley BANKS Area(S).

FIG. 12 and FIG. 24 Shows the Structure of the Radiator—REAR (W/C) Outlet—Propeller & Shaft—Housing Pump Neck 38 Area Setup Formation. This OSIV' Engine System STAGE TWO Form technique is Designed and basically structured to Allow Quick ELECTRIC WATER PUMP MOTOR 196 Item(s) "Changing"—WITHOUT Loosing Water/Coolant—NOR—Water/Coolant Pressure, and Allow Racers & High Performance Engine Builders—the "Quicker" Changing Ability of Different RPM Speeds—Selections—of Electric Pump Motors—for Different Cooling (W/C) Flow Setups in Changing Climate Weather—also at Different Track Locations—for "Ultra Fine Tuning"—of Engine Water/Coolant Cooling System—WITH a Adjustable AIR Cooling Electric Fan & Shroud, Setups.

Electric Water Pump-MOTOR—Setup 193 Area Item—& type that should be Setup & Used or Manufactured—is on "CHOICE SELECTED COMPANY" section Page 9. * →*, which page MUST BE READ entirely (Notes Included)—which is also Referring towards such similar type(s).

This type of Electric Water Pump System—should work in conjunction WITH the Two Dual Electric FAN Setup (Lower Position) or Single Electric FAN Setup (Top Position)—, if however, the Electric Water Pump MOTOR can-and-should work in conjunction WITH the Two Lower Position Dual Electric Radiator Cooling FANS—(but allowed to run continuously until the Engine Block CYLINDERHEAD(S) "BASE 121 Area" is Cooled Down to about 90° Degrees F. and Shuts Off), within the Shroud REAR Block VALLEY Area, WITH a REAR Valley LEFT BANK Position mounted Thermostatic HOT Water/Coolant Adjustable temperature Level Setting ON/OFF Switch Sending—type unit—Within 38THS Area of FIG. 23.

Electric Pump Motor—(DRIVE PINION SOCKET NOSE-INNER GROOVE HUB) 196 Area that's Shown on FIG. 12, should be Formed to Fit the 38S SHAFT'S Formed 98 PINION NOSE (top) Area—so in order to Turn/Spin the SHAFT 38S Item Area & PROPELLER FIN 38P Item Area—Continuously—WITHOUT Failure—Nor—Leaks at High Heat RPM—to Drive the 38P PROPELLER & FIN Item Area—to Pump Water/Coolant Through Internal Water/Coolant Jacket(s) Passage 5 Areas & Internal (W/C) FLOW System. This basic SETUP Will Allow The Electric Water Pump MOTOR 193 Item to be "QUICKLY" REMOVABLE & REPLACEABLE encases of Electric Motor Failure—Without Loosing Water/Coolant-Nor-Water/Coolant Pressure & Even While The OSIV' STAGE TWO Engine Is Still Running During "Racing Pit Stops".

Radiator Electric Cooling FANS—types—that should be used or Manufactured Custom Tailored Setups—WITH—Shrouds—, is on "CHOICE SELECTED COMPANY" section Pages 18 & 19—Quick Viewing—with FIG. 20 & others.

However, the Radiator FRONT Water/Coolant Outlet Auxiliary Outlet Neck 39 Area of FIG. 24 and FIG. 1—is for "Draining" & "Super Water/Coolant Cooling" Use of a Front Automobile CHASSIS Radiator (Inlet or Outlet) Neck—Flow Connection Passage system setups—which can also be Setup as a Water/Coolant Front Automobile Chassis Radiator RESERVOIR of Fresh/Cool Coolant Fluid/Water—SUPPLY, and Auxiliary OUTLET NECK 39 Area can be typically used to Drain BLOCK VALLEY RADIATOR.

Radiator Front Top Inlet Water/Coolant FILLER NECK 40 Area—is a basic suitable Formed Tube—of a Quarter Moon Curved Arch or Bend—that is to be Completely WELDED or CAST—to Top LID COVER 32 Item FRONT Area—which is to Become—Formed—as part of Radiator—Top Valley Deck LID Cooling Fin COVER 32 Item Area—WITH a basic Setup (30 Lb.) Pound Over Flow (W/C) Pressure type CAP(S) 41 Areas. This area of the NECK 40 Item—should be Formed THICK Enough—using same Material as LID COVER 32 Item type plate-and-also Formed for HOT Water/Coolant & Air Pockets/Bubbles for PURGING—into "Purge type Tank(s)"—(typical available Units)—or Purging into a "Front Automobile Chassis Radiator(s)" For "Supercooling (W/C) Setup(s)".

*So one MUST keep in MIND—that the OSIV' ENGINE & SYSTEM—Is Intended Of *"15,000+ Plus RPM EXTENDED RUNNING USE OPERATIONS"—where a Internal Combustion GAS/FUEL TYPE Engine—receives NO Time To Rest, (such as Ocean/Marine & Aircraft-type Operations).

Rear Valley Base CRANKCASE VENTILATION HOLES 42 Area—of Engine BLOCK, are basic Drilled/Formed type Air Passages—of Vertical Plane Form as Shown on FIG. 10—and—Rear Valley TOP View Location of FIG. 23—WITH Formed Ventilation CAP 191 Item Area & Partial View of Ventilation TUBE 192 Item Areas—and—FIG. 25 WITHOUT Vent./CAP 191: Item & Vent./TUBE 192 Item. This Ventilation of the Crankcase Engine System is (typical), Passages WITH Flow Arrows of Direction of the Crankcase & Blow-by Vapors traveling Upwards to Vent./CAP 191 Item Area—to & through Vent./TUBE 192 Item Area—to the Intake Manifold BASE 200 Item Area—for Combustion Chamber RE-BURNING, basic View FIG. 10.

Front Valley Base CRANKCASE VENTILATION HOLE 43 Area(s)—of Engine Block, of FIG. 25—Mimics Rear Valley Base CRANKCASE VENTILATION HOLES 42 Area(s)—and should be Plugged with PLUG 60 Item—Flush—with Valley Base Bulkhead 11 Area Surface (Using Small Diameter suitable Size Freeze PLUG 60 Area Items), as similar Fashion Shown of FIG. 5 & FIG. 6.

*(QV)—CRANKCASE VENTILATION SYSTEM Internal Air Passage Route—*(Quick View)

FIG. 22 TOP VIEW—1st.—Air enters Front Fresh Air Inlet MANIFOLD 209 Item & Arrow(s) 97 Areas; FIG. 4 FRONT VIEW—2nd.—Air enters FRONT Cylinderhead 119 & 120 Item's 139 Fresh Air Inlet Port Formed Passage Areas; FIG. 4 FRONT VIEW—3rd.—Air enters Front Valveshaft Cylinderhead BEARING SLEEVE 111 & 112 Item's 90-0 Outer Groove Air Passage Areas and 103 Air HOLE Passages Formed Areas; FIG. 4 FRONT VIEW—4th.—Air enters Front Valveshaft Formed Intake 102 TURBINE FAN & 103 Air HOLE Passage Formed Areas; FIG. 4 FRONT VIEW—5th.—Air enters Valveshaft 95 & 96 Item's Formed 97 Internal Fresh Air PASSAGE Areas; FIG. 114 & FIG. 126 Internal SIDE VIEWS—6th.—Air flows REARWARD in Valveshaft's Formed 97 Internal Fresh Air PASSAGE Areas, while Combustion Chamber Air Cooling, and creating "Super Induction of Piston Cylinder & Combustion Chamber FILL UP"—of Air/Fuel—Rich/Lean Mixture; FIG. 9 REAR VIEW—7th.—Air exits the Valveshaft 95 & 96 Item's Formed 97 Internal Fresh Air PASSAGE towards Rear Area; FIG. 9 REAR VIEW—8th.—Air exits Rear Valveshaft's Formed Outlet 102 Turbine Blower Fan and 103 Air HOLE Passage Formed Areas; FIG. 9 REAR VIEW—9th.—Air exits Rear Valveshaft Cylinderhead BEARING SLEEVE 111 & 112 Item's 90-O Outer Groove Air PASSAGE Area and 103 Air HOLE Passage Formed Areas; FIG. 9 REAR VIEW—10th.—Air exits Rear Cylinderhead 119 & 120 Item's 140 Fresh Air Outlet Port Formed PASSAGE Areas; FIG. 9 REAR VIEW—11th.—Air enters REAR Engine BLOCK Valley 197 Fresh Air Outlet Manifold PIPE (A)-and-198 Fresh Air Outlet Manifold PIPE (B), (both being Press Fitted WITH Gasket Maker Sealant—into Valley 11RA BASE—17 & 18 Passage HOLE Areas); FIG. 22 TOP VIEW—12th.—Air flows through Outlet Manifold PIPES 197(A) & 198(B) Items as 97 Arrow Passage Flows—to Vertical Air to Oil Passages 17 & 18 Formed Areas; FIG. 9 REAR VIEW—13th.—Air enters Rear Valley 11RA BASE—17 & 18 Vertical Air to Oil Passages WITH 97 Arrow Flow and Partial Broke Line Phantom View areas and Joins WITH Horizontal Passages 17 & 18 HOLE Areas; FIG. 25 TOP VIEW—14th.—Air exits Rear Valley Holes/Passages 17 & 18 and enters 17 & 18 Horizontal Air To Oil Passages and Flows FORWARD as 97 Arrow Flow—to FRONT Engine BLOCK Valley BASE 11 Area to 43 Vertical Crankcase Ventilation Formed HOLE Areas, thus supplying CRANKCASE with AIR; FIG. 28 BOTTOM VIEW—15th.—Air Flow ARROW 140A—enters Crankcase from FRONT Valley Bulkhead BASE 3 Area—of 43 Vertical Ventilation HOLE Areas, thus Mixing With-Piston Combustion "BLOW-BY" Gases & Oil Fumes—which are SIPHONED Out of Crankcase Area at REAR Valley Bulkhead BASE 3 Area—from 42 Ventilation Vertical HOLES Areas-and-the Mixed Air Flow 140A & Arrows—enters 42 Passage HOLE Areas; FIG. 11 & FIG. 22 (View Together (VT)), FIG. 11 REAR VIEW-&-FIG. 22 TOP VIEW—16th.—Shows the Completed ROUTE—as Air Flow 140A of Crankcase Ventilation as being Siphoned UPWARDS through 42 Ventilation Vertical HOLE Areas-through 191 Ventilation CAP'S 27HW Formed PASSAGE Way—through 192 Ventilation TUBE & 201 Block-Off PLATE—as the Mixed Air Flow 140A & Arrow enters the 200 Intake Manifold BASE Areas—to be Re-Burned in Combustion Chambers & Exhausted through—124MR & 124ML Exhaust Manifold HEADERS—(with or without Exhaust Pipe Systems)—into the Atmosphere—Cleanly.

Front Valley Base Deck OIL PASSAGE HOLE to OIL RESERVOIR 15—44 Item Areas—to Oil RESERVOIR 15 Area—of FIG. 4—is Broken Line Phantom Area & basic DEPTH—which is Formed by basic DRILLING (Vertical Plane HOLE area) Shown of FIG. 25 TOP FRONT VIEW Center Valley Base Deck 11 Area. Oil HOLE 44—is a, or the, "Main Oil Feed inlet Hole/Bore"—to Continuously FILL "HIGH OIL PRESSURE/VOLUME" to Rightside RESERVOIR 15 Area.

Optional Oil HOLE/BORE 44 WITH 177 Item Area-Mimics the Main Oil Feed HOLE 44—but Formed Slightly Larger in Diameter Size to House a suitable size Oil Filter By-Pass Valve Unit 177 Item Area—to be Properly Seated in position—FLUSH WITH the Valley BASE 11 Deck Surface Area. If the Oil Filter gets Clogged—or—of getting Too Much Pressure & Volume Buildup, The 177 By-Pass Valve & Spring—will Open—to Flow OIL Directly to RESERVOIR 15, (typical setup relief valve).

Front Valley Base Oil Filler Tube SLANT PASSAGE HOLE to RESERVOIR 16—45 Item Area—is Formed at a basic SLANT to House Oil Filler TUBE 46 Item Area—as FIG. 4 shows View in Broken Line Phantom area of 45 HOLE as Shown. FIG. 25 Shows TOP VIEW OF 45 Slanted HOLE Area Location—which is typically Formed By DRILL or CNC Drill Press Bore Machines.

OIL FILLER TUBE 46 Item Area—Is Typical—and can be Formed by—Both"Casting Techniques" or "Welding & Shaping Process Techniques" of Forged Steel or Aluminum type TUBES/PIPES, Welding & Machining such Tubes as pictured in the Figures—to be Tightly Press Fitted down into 45 Slant HOLE Area—like in FIG. 2, FIG. 3, FIG. 16 Phantom Broken Line View, and FIG. 23 TOP VIEW. The OIL FILLER TUBE 46 Item is used for FILLING UP the Internal Valley Base Bulkhead LOW PRESSURE OIL RESERVOIR 16 (Left) side Area—(towards Filling Up this OSIV' Engine)—WITH suitable type Specified Engine Motor OIL—MICRON MOLY 10W-30 Blended to EXCEED NEW SJ Performance Level—types—like "CHOICE SELECTED COMPANY" section Page 26.* ✓(Noted Information).

Oil Filler Tube DIPSTICK CAP 47 Item Area—is Formed as One Whole Piece —or—can be Formed separately (of Stainless Steel Dipstick Rod and CAP) and then Welding the Formed Dipstick LEVEL CHECKER 48 Item Area to the Formed 47 CAP, as Setup in FIG. 16, FIG. 2 & FIG. 3. Once the Dipstick LEVEL CHECKER 48 Item type rod & DIPSTICK CAP 47 Areas are formed, a basic Drilled Pin Hole 47PH Area as shown on FIG. 16 should be made to Relieve "Small Air Bubbles" out of OIL RESERVOIR 16 Area. (Thread areas & basic Seal—are Typical).

Dipstick LEVEL CHECKER 48 Item Area—Formed type Rod—is made to Fit Snugly within the Oil Filler TUBE 46 Item—WITH Minimum Clearance—to ONLY Allow Air Pressure Bubbles (of Low Levels) to Escape Out of Oil RESERVOIR 16 Area, basic Views FIG. 2, FIG. 3, FIG. 16, FIG. 23, (Typical Setup).

OIL FILTER—Front Valley Block-49 Item Area—is Drawn as—a BASIC TYPICAL TYPE ITEM, however—the Main thing is—the OSIV' Engine System STAGE TWO FRONT Valley BLOCK LOCATION Technique Setup, which is in Mind to COOL the HOT OIL & Oil FILTER 49 Item Area "FIRST"-and-Positioned in the FRONT Engine Block Casing Valley Base Bulkhead 11 Area—Deck Surface—Open Space Air Stream, as in FIG. 1, FIG. 2, FIG. 3, FIG. 20, & Others Show. The suitable Smallest Size Oil FILTER should be Used-and-basically all that's Needed—though of a High Pressure Volume Quality Types—Formed & Professional Made by Manufactures of the "CHOICE SELECTED COMPANY" section Page 25. *→.

OIL FILTER HOUSING BASE PLATE—Front Valley Block—50 Item Area—should be made by basic Known—Casting or Forge Forming "Engine Block Manufactures" & "Engine Parts Manufactures"—like those on "CHOICE SELECTED COMPANY" section Pages 1. thru 11. The Oil Filter Housing Base Plate 50 Item Area—Should at least be Made of a Suitable Thick Forged Stainless Steel—or—Alloy Aluminum—CUP PLATE BASE—Formed to House Different Diameter SIZES of High Performance type Oil Filter(s) 49 Item Area, and Formed to Secure the Bottom Formed LIP 92 Area of the (Oil Filler TUBE 46 Item Area) TO Valley Base 11 Area Deck Surface—Shown of FIG. 1, FIG. 2, FIG. 3, and FIG. 23 WITHOUT 49 Oil FILTER, (Typical CNC Machining & Forming Work Done).

*However, the Front Valley Block OIL FILTER HOUSING BASE PLATE 50 Item Area—*IS TO BE (INSTALLED & MOUNTED "AFTER" Installation of CRANKSHAFT 64CS Item & "147 OSIV' Roller Gear Timing Drive Oil Pump System Unit Case Housing" Item)/(RG.TDOP.SUCH. 147 Item), Shown of FIG. 2, so the 147 Roller Gear—Timing Drive Oil Pump's—(164 Formed Unit Case Housing/Back PLATE'S—TOP DECK 122 Area Surface)—can be "Evenly Planed/Machined Level"—WITH the Engine Block Casing Valley Base Bulkhead 11 Area's DECK SURFACE—(at FRONT BLOCK Valley Base Area).

*Important Note: (Before Planing & Leveling THIS AREA, All Holes Are To Be Plugged With Suitable Size "SPONGE PLUGS" or "CORK PLUGS" or "RUBBER PLUGS" —so Metal Particles & Dust "DO NOT FALL INTO NO HOLES". Clean Surface of "ALL" Metal Debris & Particles-and-Remove Sponge etc. Carefully while Preventing Particles & Debris from Falling Into—NO HOLES.)—Typical Safety Precautions.

This Concludes the basic Setup Formations and Explanations of How the OSIV' Engine System—Stage Two ENGINE BLOCK VALLEY RADIATOR WATER/COOLANT COOLING CORE UNIT MAKING AND BLOCK VALLEY SETUP & Valley Block Base Area Forming Technique—Method—Process—Using—for those Persons who are basically SKILLED in the Art of Professional ENGINE BLOCK MANUFACTURING-and-CUSTOM & PRO-RACING RADIATOR MANUFACTURING—by simply Examining above Figures & Explanations towards suitable Professional Building & Properly Producing such.

(C)—ENGINE BLOCK CYLINDER SLEEVE/LINER & SPRING BOOT SEAL MAKING AND BLOCK CYLINDER BARREL BORE SETUP: Referring to FIG. 5, FIG. 6, FIG. 112, FIG. 114, which Shows the 51 BLOCK SLEEVE/LINER Item Area Numbers & 4 Block Cylinder Barrel Bore Area Numbers, which BOTH are Listed in (DPL) of SPECIFICATION Pages 32. & 33., to which 51 BLOCK SLEEVE Item Area—Should be Formed or Made by basic known—Casting or Forge Forming—"Engine Block & SLEEVE Manufactures" and "Engine Parts Manufactures"—like those in & on "CHOICE SELECTED COMPANY" section Pages 1. thru 7., & Especially Page 15.* (L.A.SLEEVE).

Engine Block CYLINDER SLEEVE/LINER 51 Item Area—of FIG. 5 & FIG. 6, FIG. 112 & FIG. 114—Shows How the SLEEVE 51 Item is Formed WITH 92 Lip Area-&-93 Thread Area and 126BS Bore Seat Areas, basic TOP area of CYLINDER SLEEVE 51 Item. The TOP Deck Surface 122 Area of FIG. 6 is Formed WITH 91N Notch GROOVE Area to Form Half Moon Circle(s)—as so to Fit Up INTO the Cylinderhead BASE 121 Area—Corresponding—132 Half Moon GROOVE Areas of FIG. 115, so the SLEEVE 51—Can Be TIGHTENED & ALIGNED (Fitting TIGHT Within Entire Cylinder Barrel BORE 4 Area) & Can Be More Quickly Loosened & Replaced—with Different SIZES of Inside Diameter of Bore Sleeve/Liners—for Different Classes of Racing Rules. However, the SLEEVE 51 Areas—is to Fit Snugly Tight in the BLOCK Barrel BORE 4 Area—But Not Crammed in—Nor—Machined Press Fitted.

The BOTTOM Inside Diameter Area of 51 SLEEVE—Houses "Engine Block Cylinder Sleeve/Liner LAMINATED SPRING BOOT SEAL 52 Item Area"—type, as Shown on FIG. 5 & FIG. 6, though Referring to Large Scale FIG. 58 & FIG. 59—Shows all the basic Item Numbers that are within SPECIFICATION (DPL) starting on Page 32.

The Inner Diameter GROOVE 90-I Area—is Formed by basic CNC Machining with CNC Lathe Machine type Tool(s)—(Typical)—for 51 CYLINDER SLEEVES/LINERS. The 51 SLEEVE—27 Oil passage HOLE can be typically Formed by CNC DRILL PRESS MACHINE.

Engine Block Cylinder Sleeve/Liner LAMINATED SPRING BOOT SEAL 52 Item Area—Should be Formed by a "Rubberizing type Manufacture(s)"—who are basically SKILLED in the Art of Producing High Heat OIL & GAS/ALCOHOL RESISTANCE FLEXIBLE RUBBER & NEOPRENE—or—Tire Rubberized Products—or—similar type Manufacture that's known—within "CHOICE SELECTED COMPANY" section Page 15.*.

This OSIV' Engine System Stage Two METHOD TECHNIQUE of this 52 LAMINATED Spring Boot Seal SETUP, is to Guide OIL from the "PISTON(S) 84 & 85 Item Areas"—to—Lower Bulkhead Oil Pan Rail VERTICAL AIR OIL Passage 22 Area (HOLES)—while maintaining suitable Sealing Under Extreme RPM Engine Operations, WITHIN It's Seat "Position". All Sharp Edges MUST be Slightly Rounded & SMOOTH—in a suitable fashion WITHIN "51 CYLINDER SLEEVE/LINER", (Typical Massaging work done).

The 52 LAMINATED SPRING BOOT SEAL—is of the OSIV' Engine System Idea type Design—to Allow the REMOVAL & REPLACING Of Different TYPES & SIZES Of Laminated Spring Boot Seals-or-Basic Non-Sring Boot Seals—And—Different Compressing Pressure RATES—to be MADE & USED. This Setup also Helps Lighten the "Piston Load(s)" at Bottom Crankshaft STROKE Rotation-and-Takes Away Stress On CONNECTING RODS—ON & DURING—the Beginning UPWARD Crankshaft STROKE Rotation.

This 52 LAMINATED SPRING BOOT SEAL—When Setup Properly—will also act like a "Semi-Oil Air Pumping Device" to Help Force Oil Flow along it's Route of—22 Passage & 23 Passage & 24 Passage—Areas, of FIG. 5 & FIG. 6 & others.

The SPRING 189 Area—of FIG. 58—Should be Made of a "Super Clean Hi-Tensile PROALOY™ Steel" that does NOT Break like Tool Steel Wire—Valve Spring Wire (typical) CNC Coil & Heat Treated & Shot Peened, Into Suitable LARGE DIAMETER SHAPE Coil Spring(s)—as FIG. 58 basically Depicts & Setup for Boot Seal Lamination MOLD PROCESS.

The 189 SPRING—should then be Setup and Position in suitable Lamination Boot Seal type MOLD(S)—to Cast &

Mold the RUBBERIZED Neoprene Boot type Material—Around & To—the SPRING(S) 189 Item Area's Outer Surface. The FIG. 58 Shows the Minimum (THINNESS) that should be allowed to Hold the 189 SPRING within in it's Position of the Rubberized Neoprene Boot SEAL 52—LAMINATED Mold Material. (THICKER is Better—but not too Thick to stop Flexibility).

The 51 CYLINDER SLEEVE & 52 LAMINATED SPRING BOOT SEAL(S) Should be Assembled & Process as One Complete Unit Item (and then Install 51 SLEEVE into Engine Block Cylinder Barrel BORE 4 Area), Based On the Crankshaft Stroke/Connecting Rod Length & Piston Length Sizes—because of the Compressing Distance area of 51 LAMINATED SPRING BOOT SEAL of 32-32 Area Position—verses—Bottom of Piston Surface—at (Crankshaft's) Bottom Dead Center Stroke.:

Example; If one Person has a 3⅞" Crankshaft Stroke Rotation—WITH a 7 13/32" Center to Center Line Rod Length—WITH a MINUS(–) 1 1/32" from Top Rod 83 Pin BORE cross Center Line Area—for Bottom Piston Area Surface—the Surface Line will be at 8 5/16" in the Center of the Block Cylinder BORE upper area, (Top Dead Center of Crankshaft Stroke), Now Minus'ing the 3⅞" Stroke to Bottom Dead Center (Crankshaft Stroke)—the Piston Bottom Surface Line Will be at 4 7/16" Down in the Block Cylinder BORE or Sleeve BORE area of (Traveling), DEPENDING ON Engine Block Casing Bank's Deck Height of the Cylinder BANK(S), though this is the Area "LINE MARK" Down in the SLEEVE 51 Inside Diameter Bore—Where a Person would like to begin Conjuring Up His or Her's—OWN Positioning Area of Where to Setup a 52 LAMINATED type SPRING BOOT SEAL, at the Bottom Area of the BORE, (Simple Thought Process).

(The KEY MODE—Here) of the OSIV' Engine System THINKING of "WANTS" is, You WANT to Position the 52 Laminated Spring Boot Seal(s)—Just Wright in the Bottom Inside Diameter of CYLINDER SLEEVE 51 BORE Area 90-I GROOVE—so the Bottom Surface of Pistons—CAN TRAVEL DOWN and—"KISS the Top Surface of 52 Laminated Spring Boot Seal—and—Then Compress 52 Laminated Spring Boot Seal DOWN—just enough to Dump or Deposit OIL into the Middle 80 Oil GROOVE Area & 27 Oil Air HOLE Passage—", Shown of FIG. 58 & FIG. 59, FIG. 5 & FIG. 6.

This Concludes the basic Setup Formations & Explanations of How the OSIV'Engine System—Stage Two ENGINE BLOCK CYLINDER SLEEVE/LINER & SPRING BOOT SEAL MAKING AND BLOCK CYLINDER BARREL SETUP—and Area Forming Technique—Method—Using—for those Persons who are basically SKILLED in the Art of Professional ENGINE BLOCK MANUFACTURING-and-ENGINE PARTS MANUFACTURING—by simple Examining above Figures & Explanations towards suitable Professional Building & Properly Producing such. ((DPL) Description Parts List: Item Numbers 53 thru 61 Item & Areas are typical).

(D)—CRANKSHAFT MAKING AND FORMATION FORMING: Referring to FIG. 16 & FIG. 19 for Basic Item Numbers 62 thru 64 of Crankshaft Setup Areas of the 64CS Crankshaft Item Area—are typically Formed or Made by a Well Known Trusted Specialist in the Art of Professional CASTING or FORGED Forming "High Performance Crankshafts and Rotating Kits or Assemblies"—type Manufactures—Especially like (Cola Crankshaft Inc., colacrank@earthlink.net., California)—or—"CHOICE SELECTED COMPANY"section Pages 32., & 10. *,—(being Referred to).

The Only Major Difference of basic Good Crankshaft Design—"Is The Front Pinion type NOSE Area 170N—*" is to be Formed or Made Differently WITH Formed: LIP-Area(s), GEAR TEETH-Area(s) (as Shown FIG. 93 & FIG. 94—to MATCH 157 Roller Gear—Drive Gear inside Diameter TEETH Area) which is the "PINION NOSE 172 Area" of OSIV' Engine System Stage Two Crankshaft type. However, this is NOT A IMPROVEMENT to basic type Crankshafts—NO, however, This PINION NOSE 172 Area—is Formed To FIT Within the Inner Diameter suitable area of 157 Roller Gear—for Crankshaft PINION—which is to FIT Precisely & Snugly into—though NOT TIGHT—because Crankshafts Need CLEARANCE to Move Slightly Forward & Rearward Along It's Horizontal Plane Position to Prevent Binding,—as basic Clearance areas are Shown in FIG. 104—92C CLEARANCE Area Space(s). (QV)—FIG. 16, FIG. 19, FIG. 27.

Another Difference That's Minor Is—the OSIV' Engine System Crankshaft Throw Arm Pin Bearing JOURNAL 64 Area—of FIG. 16 & FIG. 19, Is NOT As Wide—For Stage Two OSIV' Engine Setups, like basic type Crankshafts on "CHOICE SELECTED COMPANY" section Page 32. & 10.*, however—This Is NOT A Improvement to basic type Crankshafts—NO, Though because of the Compact New Design Setup of Stage Two OSIV' Engine's ("On V-Center Line—Cylinder Bore Spacing V-Block BANKS" —Setup and "V-Lock Fork Connecting Rod(s) Assembly"—Setup) as basically Shown of FIG. 27, and the Stage Two OSIV' Engine Crankshaft 62 thru 64CS Areas—is Formed to suit such NEW Design Setup Technique—THUS this OSIV' ENGINE Crankshaft's "Overall Weight" Will Be Lighter Than (44 Lbs.Pounds), as Shown of "CHOICE SELECTED COMPANY" section Page 10. Superlight Cranks, THUS in essence to Allow New Creations of TRUE OSIV' Engine "ULTRA-LIGHT" type Cranks to be Formed.

This Concludes the basic Setup Formation & Explanations of How the OSIV' Engine System—Stage Two CRANKSHAFT MAKING AND FORMATION—Area Forming Technique—Method—Using—for those Persons who are Professionally SKILLED in the Art of Engine Block "CRANKSHAFT Manufacturing"—By simply Examining above Figures & Explanation towards suitable Professional Building & Producing such.

(E)—CONNECTING ROD(S)—MAKING AND FORMING FORMATION: Referring to FIG. 60 thru FIG. 66, & (QV) FIG. 67 & FIG. 68, & (QV) FIG. 69 thru FIG. 76, & (VQ) FIG. 77 & FIG. 78, & (QV) FIG. 79 thru FIG. 84, (Large Scale) of 65 V-Lock Fork Connecting ROD(A)—Right Bank—Item Area-and-68 V-Lock Fork Connecting ROD(B)—Left Bank—Item Area, is to be Formed by a Well Trusted Known Specialist—in the Art of Professional Casting "AND" Forge Forming—"High Performance Crankshaft Rotating Kits or Assemblies" and "High Performance Connecting Rod(s) & Piston(s)—Reciprocating Kits or Assemblies"—type Manufactures—Specifically Like in or on "CHOICE SELECTED COMPANY" section Pages 10., 32., 33., 34.,(*), 47.*,—and though as referring to All Figure(s) as "FIG.", such as FIG. 60 thru FIG. 84 (of Large Scale type Figures) are basically Drawn for such Persons of Professional Type Connecting Rod Specialist Level Of Manufacturing—so such Persons can Easily See How such OSIV' Engine "V-Lock Fork Connecting ROD(S)"—of STAGE TWO type Setup is to be simply & Professionally Formed and Properly Made.

The OSIV' Engine System "V-Lock Fork Connecting ROD" Technique—Method—here,—Is Setup In A—"Hinge type Formation/Fashion"—towards—THOUGHT MIND'SET—and—MAKING this New Unique "TWO Rods" 65 & 68 Items—to become as—"ONE (swivel type) V-ROD",—(Setup On Crankshaft Throw Arm Pin JOURNAL 64 Areas)—WITH "OSIV' Engine System Free Spin Bearing 81 Item Areas & Seal 82 Item Areas—Technique/Assembly".

The OSIV' Engine System "Free Spin BEARING(S) 81 Item Areas" are Two Piece items-and-"Free Spin Bearing SEAL(S) 82 Item Areas" are Two Piece Items—, which ALLOWS this Stage Two OSIV' Engine System V-Lock Fork Connecting ROD(S) Setup—to become (Factual Created Reality)—WITHOUT Flex Nor Failure at Ultra-High & Extended RPM Operation Use, if appropriate Metal Materials are used-and-Precision Formed—WITH NO ROUGH-NOR-SHARP EDGES.

As with the above Referring Figures—as Drawn, there should be "Rounded Corner Edges In Areas (to prevent Cracks)—as there are Rounded CORNER Edges shown of areas in the above Drawing Figures (Fig.).

However, even the Best Material Metals Used known to Man, over time—with High Heat & Stressing, Metal Will Fatigue & Wear Down—and have to be Renewed & Replaced.

FIRST PRINCIPLE—Of OSIV' Engine V-Lock Fork Connecting ROD(S) of Structure Formation is—"Material Mass Strength" Solid Rods WITH a suitable Size—Vertical 27 OIL Passage HOLE—Center Area of ROD(S)—from BIG Diameter End leading Up To SMALL Diameter End—as FIG. 62 shows (basic "V" Setup Fashion View), and as FIG. 66 shows ON Crankshaft Throw Arm Pin JOURNAL 64 Area (Left Bank SIDE "I" Formation View Fashion),—which is in order to Show HOW to "Feed" or "Flow" OIL from Crankshaft PIN 64 Area to Lubricate It's Journals Surface & Free Spin Bearing(s) 81 Areas & while Supplying OIL to ROD 65 Area Internal OIL Passage 27 Area & ROD 68 Area Internal OIL Passage 27 Area & "Feeding" OIL to both ROD'S Small End 83 ROD Areas & 126 BORE Area—for Lubricating Piston PIN 87 Item Areas & PISTON(S) 84 & 85 Items and Internal Oil Passage Areas—and—to OIL Piston RINGS & BLOCK Cylinder SLEEVE BORE Inside Diameter BORE Wall Areas—as FIG. 33, FIG. 35, FIG. 36, simply Shows. (This Is A True—Internal Oil Cooling of Piston/Rings/Block Cylinder Bore or SLEEVE Bore Wall/—Technique Setup) of Stage Two OSIV' Engine System—"OSIV' Stage Two Crankshaft Rotating Reciprocating Rod—Piston—Free Spin Bearing/Seal—Assembly", which also Helps to Create "TOTAL OIL CONTROL FLOW" OSIV' Engine System Technique/Method—which Coincides WITH SPECIFICATION Page 48. (A)—ENGINE BLOCK MAKING: (Bottom page Paragraph).

The V-Lock Fork Connecting RODS & Fork Lock CAP Areas—Should be Formed of a suitable "CHROME MOLY ALLOY type—Friction & Heat Resistance STEEL" Material—and Made to Fit Snugly Together—but Not Tight—so in order to Allow OIL to squeeze through to High Friction Heat Areas—With Minimum Oil Flow & Pressure Lose.

The TOP Area 83 ROD(S)—Has Formed 79 Seal Groove Areas—to House HIGH HEAT Resistance Neoprene O-Ring type SEALS 107 Item(s)—so to KEEP OIL on Piston PIN 87 Item's Outer Diameter High Heat Fiction Surface Areas—as Shown of FIG. 66 and other typical Views.

SECOND PRINCIPLE—Of OSIV' Engine V-Lock Fork Connecting ROD(S) of Structure Formation is—"Precision FIT and FUNCTIONALITY Without FLEX & FAILURE" in which the Big END FORK Design Setup & Locking FORK to the Big END CAP Area—"Is The Key & Best Method towards Preventing Flex/Failures"—WITHOUT typical Rod Bolts/Screws & Nuts THAT STRETCH—STRIP—& BREAK.

PROBLEM: The Problem is Not the Material Metals of the Rod Bolts & Cap Screws & Nuts—of basic Connecting Rods—NO, the Problem is the basic Old Style Design Setup of Conventional Connecting Rod's "Big END" that Flex & Stretch TOO MUCH—under High Heat Friction & Extended High RPM Engine Operations.

Thus, It's like trying to Torque Tighten—a Bolt/Nut Head—With a Wrench partially half way on the Middle area of the Bolt/Nut Head—, the Wrench Fork Tip areas Will FLEX & SLIP Off the Bolt/Nut Head—or—Will STRIP the Bolt/Nut Head's Outer Surface area. (Not Good).

Though with the OSIV' Engine "V-Lock Fork RODS"—to which FORKS "Extend Beyond The Crankshaft 64 PIN JOURNAL Area's—Cross Center Line point", Its Like—Putting the Wrench FULLY-ON Beyond the Middle area of the Bolt/Nut Head (Crank Throw Arm Pin JOURNAL 64 Area) and Torque'ing & Tightening is DO'able—WITHOUT Fork Tip areas—Flexing Nor Stripping Bolt/Nut Head's Outer Surface area—Nor—Stretching & Breaking Bolts under High Heating & Stressing of Rod FORK Item Area—During Extreme RPM Engine Operations.

V-Lock Fork Fork Lock CAP(A1)—Right Bank—66 Item Area, &

V-Lock Fork Fork Lock CAP(B1)—Left Bank—69 Item Area(s)—are Formed to SLIDE Into-&-To Be Snugly TIGHT Fitted Into—ROD "FORK" Area—and—SEATED TIGHTLY—by Means of suitable Vice Clamp(s) Tools—then the Pin Lock HOLES 55PH Areas are Precision CNC Drilled through or Formed—, for the "Fork Lock PIN(S) 67 & 70 Items"—which are to be "TIGHT PRESS FITTED & QUICK PRESS REMOVABLE-TYPES"—by Means of a Large Size Riveting type PLIES—Formed Tool Press type Device. Though the "Fork Lock PIN(S) 67 & 70 Items"—Locks the ROD'S "FORK" to the "CAPS"—in order to Become ONE Solid ROD—and or—As to Become ONE V-Lock Fork ROD—once all parts are Assembled On The Crankshaft Throw Arm PIN JOURNAL 64 Area—((QV) FIG. 62). In this Fashion Technique, there is NO basic way a Screw Bolt/Nut can be Flex-Stretched & Threads Stripped—Nor—Broken—, simply because—OSIV' Engine System V-Lock Fork Connecting RODS—Technique Method—DO NOT USE SUCH Old Style Design "CAP Screws/Bolts/Nuts"—type Setups.

And to Conclude, these are the Two basic PRINCIPLES derived for such Structural Formation of Making & Forming such FORK RODS of the OSIV' Engine System Stage One & STAGE TWO Technique Setup Method.

* 68 V-Lock Fork Connecting ROD(B) Item & 69 V-Lock Fork Fork Lock CAP(B1) Item & 70 Fork Lock PIN(S)(B2) Items—(the Assembly) is ALREADY STRUCTURALLY SETUP FOR BASIC CONVENTIONAL ENGINES & CRANKSHAFTS USAGE—which are designed for Staggering the Connecting Rod(s)—Side by Side—On Crankshaft's Throw Arm Pin Journal 64 areas—to serve their purpose—for NON-Stage & Stage One & Stage Two type OSIV' Engine System Setups Using V-Lock Fork RODS with or without Free Spin Bearings & Seals Setup.

* 65 V-Lock Fork Connecting ROD(A) Item & 66 V-Lock Fork Fork Lock CAP(A1) Item & 67 Fork Lock PIN(S)(A2) Items—(the Assembly) is ALREADY STRUCTURALLY SETUP TO BE USED WITH—68 V-Lock Fork Connecting ROD(B) Item & 69 V-Lock Fork Fork Lock CAP(B1) Item & 70 Fork Lock PIN(S)(B2) Items—Assembly, For V-lock Fork Connecting ROD Setup for Stage Two OSIV' Engine System Setup for NON-STAGGERING ENGINE BLOCK BANKS.

Everything Else of the OSIV' Engine System V-Lock Fork Connecting RODS—is typical, Thus Refer to (DPL) Item Number/Description Parts List & Figures of Separate Component Pieces (FIG. 67 thru FIG. 84 thru FIG. 90) Of Large Scale Views.

However, FIG. 65 Shows The Basic Fit & Location of Fork Lock PIN 67 Item—and—Fork Lock PIN 70 Item—in their Position. Both Fork Lock PINS 67 & 70 Items SHOULD BE FORMED WITH suitable LIP(S) 92 Area—to Help Keep the Fork Lock PINS "Equally" in their Position—which Locks the ROD Fork Area and "WILL HELP PREVENT THE ROD FORK BIG END AREAS FROM SPREADING & FLEXING OUTWARDS". The Fork Lock PINS—Should be Formed by "CHOICE SELECTED COMPANY" section Pages 31. & 35.*"ARP", (Noted Information Included).

QUICK VIEW FIGURES OF REFERRING;

Referring Now to FIG. 67, FIG. 68, Shows the New typical-Item 65 V-Lock Fork Connecting ROD(A)'S "Big End",—is Shown by itself—To Help Towards Further Understanding of Formation & Towards Properly Making—for those Persons who are so Professionally SKILLED in such Art of Manufacturing Custom High Performance Racing Engine CONNECTING RODS.

Referring Now to FIG. 69, FIG. 70, FIG. 71, FIG. 72, Shows the New typical—Item 66 V-Lock Fork Fork CAP (A1),—For—Item 65 V-Lock Fork Connecting ROD(A)'S "Big End", as the "Fork Lock CAP(A1) 66 Item"—Is Shown By Itself—To Help Towards Further Understanding of Formation & Towards Properly Making—for Persons who are so Professionally SKILLED in the Art of Manufacturing Custom High Performance Racing Engine CONNECTING RODS.

Referring Now to FIG. 73, FIG. 74, FIG. 75, FIG. 76, Shows the New typical—Item 67 Fork Lock PIN,—For—Item 65 V-Lock Fork Connecting ROD(A)'S "Big End",—and For—Item 66 V-Lock Fork Fork CAP(A1)—which the Fork Lock PIN(S) 67 Items—Should be Formed of a suitable Forged Steel 8740 CHROME MOLY or ARP2000 MATERIAL (by "CHOICE SELECTED COMPANY" section Page 35.*),—which It's "92 LIP Areas" are Formed Flexible Enough Without Breaking—as being able to PRESS-FIT the PIN 67 Item—TIGHTLY INTO it's ROD FORK 65 & LOCK CAP 66 Item's Formed HOLE(S) 55PH Area Locations—and—Can Also Be Quickly PRESS REMOVABLE.

Referring Now to FIG. 77, FIG. 78, Shows the New typical—Item 68 V-Lock Fork Connecting ROD(B)'S "Big End",—is Shown by itself—To Help Towards Further Understanding of Formation & Towards Properly Making—for those Persons who are so Professionally SKILLED in such Art of Manufacturing Custom High Performance Racing Engine CONNECTING RODS.

Referring Now to FIG. 79, FIG. 80, FIG. 81, Shows the New typical—Item 69 V-Lock Fork Fork CAP(B1),—For—Item 68 V-Lock Fork Connecting ROD(B)'S "Big End", as the "Fork Lock CAP(B1) 69 Item"—Is Shown By Itself—To Help Towards Further Understanding of Formation & Towards Properly Making—for Persons who are so Professionally SKILLED in the Art of Manufacturing Custom High Performance Racing Engine CONNECTING RODS.

Referring Now to FIG. 82, FIG. 83, FIG. 84, Shows the New typical—Item 70 Fork Lock PIN,—For—Item 68 V-Lock Fork Connecting ROD(B)'S "Big End",—and For—Item 69 V-Lock Fork Fork CAP(B1)—which the Fork Lock PIN(S) 70 Items—Should be Formed of a suitable Forged Steel 8740 CHROME MOLY or ARP2000 MATERIAL (by "CHOICE SELECTED COMPANY" section Page 35.*),—which It's "92 LIP Areas" are Formed Flexible Enough Without Breaking—as being able to PRESS-FIT the PIN 70 Item—TIGHTLY INTO it's ROD FORK 68 & LOCK CAP 69 Item's Formed HOLE(S) 55PH Area Locations—and—Can Also Be Quickly PRESS REMOVABLE.

Referring Now to FIG. 85, FIG. 86, FIG. 87, FIG. 132, Shows the New typical-Item 81(two piece) "FREE SPIN BEARING(S)" Setup Items—Shows Both Pieces Together—&—One Piece Shown By Itself of FIG. 87—, though Different (Larger) "DIAMETER & WIDTH & LENGTH" Sizes—are to be Formed for Crankshaft MAIN BEARING JOURNAL 62 Area-&-Engine Block's—Main Rib Bulkhead Fork Bearing & Seal JOURNAL BORE 20 Areas—of FIG. 5, FIG. 6, FIG. 16, FIG. 28, Shown Views, and also Formed For Items 68 V-Lock Fork Connecting ROD(B) & 69 V-Lock Fork Fork Lock CAP(B1)—of—Area 74 Fork Connecting Rod(B) JOURNAL Bore Areas—to Further Help Understand Formation—with—FIG. 62—, towards Properly Making—for those Persons who are so Professionally SKILLED in such Art, Specifically Like the Manufactures of "CHOICE SELECTED COMPANY" section Page 35.*, for the Fork Lock PINS 67 & 70 Items, and for the (Two Piece) FREE SPIN BEARINGS 81 Items—for Precision type Forming, (FIG. 87 is One Piece View).

Referring Now to FIG. 88, FIG. 89, FIG. 90, Shows the (FIG. 88 One Piece) New typical Item 82 (two piece) "Free Spin Bearing SEAL"—Setup Items—by themselves, though Different (Larger) DIAMETER & WIDTH & LENGTH—Sizes—are to be Formed For Crankshaft 62 Area & 20 Main Rib Bulkhead FORK Bearing & Seal JOURNAL BORE—Areas—of FIG. 5, FIG. 6, FIG. 16—Quick Views—, and Formed to Fit Snug TIGHT Within Item 65 ROD'S Big End 73 Area—Shown in FIG. 66, FIG. 68, and Within Item 66 ROD'S CAP Big End 73 Area—Shown in FIG. 66, FIG. 69, and Within Item 65 ROD & 66 CAP—71 Journal BORE Area—Shown in FIG. 66, FIG. 16, FIG. 28—Item 20 Areas, to Further Help Understand Formation WITH FIG. 60 & FIG. 66—, Towards Properly Making For those Persons who are so Professionally SKILLED in the Art of Manufacturing Heavy Duty High Heat Friction Resistance Nylon/Neoprene Rubber/Polyurethane(s) type Products, like on "CHOICE SELECTED COMPANY" section Pages 15. & 18.*→. All other Item Numbered Areas Are Typical.

This Concludes the Basic Setup Formation & Explanations of How the OSIV' Engine System—CONNECTING ROD(S)—MAKING AND FORMING FORMATION of Stage One & STAGE TWO "OSIV' V-LOCK FORK CONNECTING RODS—FREE SPIN BEARING & SEAL—ASSEMBLY"—are of Making and Area Forming Technique—Method and Using—for those Persons who are so Professionally SKILLED in the Art of Engine Block "Crankshaft & Connecting Rods/Kits or Assemblies", of High Performance & PRO-Racing Level-type-Manufacturing Fields, by simply Examining Above Figures and Explanations—Towards Professionally Making & Suitably Building and Producing such.

(F)—PISTONS, Piston PIN, Piston Pin CUP LOCK, Piston Pin Cup Lock LOCK SEAL, Piston RINGS—MAKING AND FORMING FORMATION: Referring to FIG. 29 thru FIG. 57—for Basic Item Numbers 84 thru 94B of the OSIV' CROSS FORCE PISTON ASSEMBLY Setup Areas of the Item-84 Cross Force PISTON(A)—and—85

Cross Force PISTON(B), Item 87 Piston PIN, Item 88 Piston Pin CUP LOCK, Item 89 Piston Pin Cup Lock LOCK SEAL, Item 94 Piston RINGS, and Areas—is to be Formed by a Well Known Trusted Specialist in the Art of Professional CASTING & FORGE FORMING "High Performance Crankshaft Rotating Kits or Assemblies"-and-"High Performance & PRO Racing—Connecting RODS & PISTONS Reciprocating Kits or Assemblies"—type Manufactures—Specifically like those in/on "CHOICE SELECTED COMPANY" section Pages 10., 11., 12., 14. (12*✓), 15., 32., 34.,*, 47.*,—and as for;

Referring Now to FIG. 29, FIG. 30, FIG. 41, FIG. 42, FIG. 53, FIG. 54, FIG. 55, FIG. 56, FIG. 57,—Basic: OUTER APPEARANCE STRUCTURE(S) (Large Scale Figures),—for such Persons of Professional Forming of Pistons-type-Specialist LEVEL of Manufacturing—who can EASILY SEE How Such "OSIV' Engine CROSS FORCE PISTON(S)—Assembly"—Stage One/TWO :type Setup IS TO BE FORMED AND SIMPLY MADE.

The OSIV' Engine Cross Force PISTONS—Items 84 & 85, and Their DOME 86 Item Areas, is Formed to COINCIDE WITH Cylinderhead(s) 119 & 120 Item's "CROSSFORCE+CROSSFIRE*STARBURST COMBUSTION CHAMBER 127 Formed Areas", ((QV)—FIG. 30, FIG. 42,-WITH-FIG. 109, FIG. 115, FIG. 121, FIG. 127).

The OSIV' Engine System "Cross Force PISTONS" 84 & 85 Items—New Technique Method—is Setup On A Basic DOME 86 Area Structure Pattern—which is Small Enough to Fit Up Into Combustion Chamber POCKET(S) 128 & 129 Areas—WITHOUT HITTING THE WALL Area of Chamber(s) 128 & 129 Area-Nor-the OSIV' Valveshaft 95 & 96 Items-and-the CENTER CROSS FORCE—Formed Combustion Chamber 130 DECK Area(S) as Shown in FIG. 112, FIG. 113, FIG. 124, FIG. 125.

This Above OSIV' Engine System Method Technique—ALLOWS for Many New Modifications to be Developed & Done for Precise Combustion Chamber POCKET & Piston DOME—Compression Ratio Setups—and—Different Performance Design Shapes to Be Formed—as a Engine Builder or Racer or—Piston & Cylinderehead Manufactures—so Choose to Form—For Quicker Fine Tuning Performances—of a OSIV' Engine type Setup or New Improved Valveshaft Engine.

Though The Main New Unique Setup Here is—the "Dual Spark Plug STAR*BURST" Method Setup Within the Center Areas of Cylinderhead's BASE of OSIV' Engines—which can be Easily Formed Now. (Whereas—typical GM/FORD/DI-CHRY—WEDGE Cylinderheads—Handles NO EXTRA SPACE for "Dual Spark Plug Setups"), though OSIV' Brick Wedge Cylinderheads—Allows similar Method Spark Plug/Bore Setups in Mind—as GM/FORD/DI-CHRY & Non Hemi or Hemi Cylinderheads, though NOW the DUAL SPARK PLUG "STAR*BURST" Setup—can be Formed With Simplicity for "WEDGE CYLINDERHEADS".

QUICK VIEW OF REFERRING;

Referring to FIG. 30 & FIG. 42, the DOME Shape 86 Area—are the SAME—, though FIG. 42's PISTON 85 Item's DOME is in a "Reverse Position". However, both Cross Force PISTONS 84 & 85 Items—are Setup WITH "Four" Piston RING(S) 94 Items—Basic Location Areas. The Reason for the Added Item 94MB Piston RING (of Low Tension types)—is to Help Control & Pre-stop Excessive OIL Flow & OIL Pressure/Volume—from Entering into Combustion Chamber(s)—at High & Ultra High RPM Engine Operations. (BECAUSE);

*OIL—Is Pressurized DIRECTLY IN Piston's 90-O GROOVE Outer Diameter—80 Oil Groove Formed Area—and—Upon Cylinder Wall 51 Inner Bore Sleeve(s) Areas—instead of Old Style OIL Splash/Squirt/Drip/Technique of Hot Dirty OIL sitting in Oil Pan. Thus this New Way—is part of the OSIV' Engine's "OIL Flow Control"/"TOTAL CONTROL OIL FLOW" System Technique—which allows many Great Benefits towards Cooling & Internal Cooling PISTONS & Lubricating Cylinder Wall(s) & Cooling Cylinder Wall(s) & OIL Cooling/Oiling Piston and Ring Areas—WITH "Continuous CLEAN Filtered Warm OIL First"—instead of Splashing Uncontrolled DIRTY Hot Non-Filtered OIL upon the Block Cylinder Sleeve Bore Walls—from Crankshaft & Rod Squirt Holes & Oil Pan/Crankcase Areas.

PISTONS:—Should At Least Be—Formed FORGED of a High Silicon 4032 Aluminum—Or Better & Stronger Materials. PREFERABLY BY "CHOICE SELECTED COMPANY" section Pages 11.*, 12.*, 47.*, & other similar types.

Piston RINGS:—Should At Least Be—Formed For "Extreme Duty Operations"—of Ultra High RPM Heat Enduring Materials—of Engine Running Usage—As Like & By "CHOICE SELECTED COMPANY" section Page 36.*,—(As Presented)—though WITH a Additional GAPLESS Low Tension Piston RING in 94MB Item Area Position—of FIG. 29 & FIG. 30—Piston Areas.

Piston PIN 87 Item-AND-,

Piston Pin CUP LOCK 88 Item, Item Areas;

Should At Least Be—Formed Forged of the same types of Piston Materials or Better Types—or Formed Forged of a High Quality (9310 ALLOY CP/CV) Piston Product Materials—of Basic High Heat/Friction Resistance & Light Weight High Strength "SOLID" Forge Chrome Moly Alloy Steel type CUP(S) 88 Item & Billet Formed type PIN(S) 87 Item—, as FIG. 53, FIG. 54, FIG. 55—Item 87 PIN Shows—and—FIG. 56—Item 88 CUP LOCK Shows & Other Figures Shows—towards Basic Formation to be Formed by a Professional type Manufacture Like/by "CHOICE SELECTED COMPANY" section Page 12.* CP/CV Products, Dept.

Piston Pin Cup Lock LOCK SEAL 89 Item Area—Should At Least BE—Formed of a Compressed Nylon Teflon Neoprene—High Heat Oil/Gas/Alcohol/Nitro/Friction Resistance—Non-Breakable/Though Flexible Enough To Be Installed & Removed—WITHOUT CRACKING—type Materials, or a suitable "HYPER FLEX™ Performance Polyurethane—Energy Suspension—Formed Materials", of or by "CHOICE SELECTED COMPANY" section Pages 18.*→, 15.*.

Referring to FIG. 31 & FIG. 43—Which shows the basic Piston Setup WITHOUT Piston RINGS 94 Items, "ALL SHARP EDGES MUST BE SLIGHTLY REMOVED—SO MINER CRACKS WILL NOT OCCUR OFTEN" During High RPM use.

Referring to FIG. 32 & FIG. 44—Which shows the basic BOTTOM VIEW OF PISTON(S) 84 & 85 Item Areas & Upper/TOP—ROD Small END 65 & 68 Item Areas—Cross Hatch Section, the 89 CUP Lock LOCK SEAL, 88 CUP LOCK, 87 Piston PIN, and Inside Inner 122 TOP DECK Area of PISTON(S), ALL in there Position of basic Setup of suitable Outer Appearance Formed Areas—(Except ROD'S TOP/Small End Area—Is Cutaway Cross Hatch Section),—Shown to Help Further Understand Formation of Cross Force PISTONS 84 & 85 Items/Areas, towards Proper Making for Those Persons SKILLED in the Professional Art of Engine Block PISTONS/Piston PINS/Piston RINGS/& Custom Type Parts Manufacturing, on a High Performance & PRO-Racing Level—type Field.

Referring to FIG. 33 & FIG. 45—Which shows the basic Internal Structure of the PISTON 84 & 85 Item Areas—of HOW the V-Lock Fork Connecting RODS 65 & 68 Item's 83 TOP Bore Area—Journals the 87 Piston PIN Item (WITH SEALS 107 Item Areas)—Which Piston PIN 87 Item is Formed TO BE SEATED UP INTO PISTON'S Center Bore Cup 84CBS-&-85CBS Formed Areas—of FIG. 33 & FIG. 34—and—FIG. 45 & FIG. 46.

The 88 CUP LOCK-and-the PISTON 84 & 85 Item Areas—is Formed WITH Inner Diameter & Outer Diameter type THREAD 93 Areas—WITH Matching 90-O & 90-I GROOVE—Outer & Inner Diameter type Areas (For Internal Oil Flow Routes), through PISTONS—though the 88 CUP LOCK—Secures Piston PIN 87 Item in It's SEAT—(VERY TIGHTLY)—as which the CUP LOCK 88 Item is "Schemed" To Become As The PISTON'S "INNER STRENGTH STRUCTURE & SUPPORT", Also—So the PISTON'S 121 BASE Area (or Skirt)—Can Not FLEX or OVER EXPAND (Like Old Style Piston Skirts Do)—, though as Viewed on FIG. 33, & FIG. 45, to which 89 Lock SEAL Item is Formed to "Pressure Lock & Seal"—88 CUP LOCK Item in It's Position—so it (the Piston Pin CUP LOCK 88 Item) CAN NOT BACK OUT-NOR-MOVE-NOR-TURN,—Viewed all in their Position of Basic Setup—of suitable Appearance Formed Areas—to Further Help Understand Formation of CROSS FORCE PISTONS 84 & 85 Items—Towards Properly Making—for Persons SKILLED in the Professional Art of Engine Piston(s) Manufacturing of High Performance & PRO-Racing Level—Custom Parts Making Field.

Referring to FIG. 35, FIG. 36, PISTON 84 Item Setup, and FIG. 47, FIG. 48, PISTON 85 Item Setup,—Shows Basic Cross Hatch Structure Formation—for Further Understanding Formation—towards Properly Making—for Persons SKILLED in the Professional Art of Engine Piston(s) Manufacturing of High Performance & PRO-Racing Level—Custom Parts Making Field.

Referring to FIG. 37, FIG. 38, PISTON 84 Item Setup, (Front View Position type), and Referring to FIG. 49, FIG. 50, PISTON 85 Item Setup (Front View Position type), Shows Basic Structure Formation—for Further Understanding Formation—towards Properly Making—for Persons SKILLED in the Professional Art of Engine Piston(s) Manufacturing of High Performance & PRO-Racing Level—Custom Parts Making Field.

Referring to FIG. 39, FIG. 40, PISTON 84 Item Setup, (Front View Position type), and Referring to FIG. 51, FIG. 50, PISTON 85 Item Setup, (Front View Position), Shows Basic Cross Hatch Structure Formation—and Basic Formation—for Further Understanding Formation—towards Properly Making—for Persons SKILLED in the Professional Art of Engine Piston(s) Manufacturing of High Performance & PRO-Racing Level—Custom Parts Making Field.

*PIN 87 (Piston PIN 87 Item) of FIG. 53, FIG. 54, FIG. 55,—Is Unique In It's Structural Type Design—Because the 87 PIN'S—87AB "ARM-BASE" Areas—is UNIQUELY DIFFERENT from basic Piston Pins—which DO NOT HAVE "ARM-BASE" Areas. However, this is Not A Improvement to a Typical Piston Pin—Simply because there is NO Piston Pin Created Like—OSIV' Engine Piston PIN 87 Item & Areas.

The 87AB ARM BASE Areas—are Setup Formed "Off Center" as the DRAWING FIGURES Shows. However—, this Technique & Method—Allows for "Quicker Compression LEVEL Ratio Changes Of The Piston"—from a "Low Compression Ratio LEVEL Range Bracket"—to a—"High Compression Ratio LEVEL Range Bracket"—Piston Setup—, By A Simple Turn—Upside Down of Piston PIN 87 Item's viewed Position—which is then Re-Seated & Re-Installed Back Into Position Of PISTON'S 84CBS & 85CBS "Center Bore Cup Areas"—WITHOUT Having to Buy or Use nor Install—Different Sets of Pistons—and—Having to Re-Break the Engine In—(All over again to Seat Piston & Rings)—after Piston Cylinder Block Bores have Been RE-HONED or Bored;

Piston PIN Compression Ratio-Low or High LEVEL Range Change Of Piston Setup EXAMPLE:—When PIN 87 Item is installed in "High C.R.POSI." (High Compression Ratio Position), the Whole Piston is Vertically RAISED Up Higher In the Block's Piston Cylinder or Sleeve BORE—as being Positioned to the Connecting Rod's TOP Small End 83 Area—and (vice-versa) for "Low C.R.POSI."—Setting. However, in High C.R.POSI., Naturally—the Engine Block Upper Casing Cylinder Deck 13 & 14 Area "Deck Height" of FIG. 4, FIG. 5 & FIG. 6**, & *OSIV' MODIFIED/COLOR Version (Vr.) V-type Engine View, is to be CHECKED/MEASURED & Machined "Planed Evenly"—to what the PISTONS 84 & 85 Item's—122 TOP Surface Deck Height (ends up at)—or—(is) as Installed Measured of Combined CENTER LINE to CENTER LINE ROD LENGTH & Crankshaft Stroke At (TDC) Top Dead Center—Position—Total Length & Piston Length Compression Formed Deck Height, thus Would be (10.75:1 C.R.) to (11.00:1 C.R.) AVERAGE Engine Block Setup "HIGH RANGE LEVELS of Compression Ratio Bracket";

A Few Ways This Can Be Done—of this New OSIV' Engine System Technique Method,—ONE WAY—is typical as to just Disassemble the Engine and set Piston PIN 87 Item in Desired Compression Ratio LEVEL Range Bracket, and Properly RE-ASSEMBLE Engine for Running Operations. Another Way is Below;

QUICKER PISTON COMPRESSION RATIO LEVEL RANGE CHANGE:—"High or Low" LEVEL RANGE Setting Changes—can be Setup To Be Done—as to—REMOVE;

Oil Scavenge Pan 25 Item,

Rotate Crankshaft Appropriately—to gain best closest access to 89 Cup Lock Lock SEAL Item—and Remove with a Custom Made Long Reach Needle Nose type PLIERS—by Sticking the Needle Noses into 55SD HOLES of FIG. 32, FIG. 37 & FIG. 44, FIG. 49—and Twist/Turn PLIERS "Clock Wise"& "Joggle" the Lock SEAL 89 Item out of It's Piston Groove SEAT—and (Pull Up) or (Pull Down) the Lock SEAL 89 Item and Let It Drop Down or Rest in the Block Cylinder Sleeve BORE & on Connecting ROD—or—Rest on Top of 52 Laminated Spring Boot SEAL Item, Remove 88 CUP LOCK Item with a Custom Made Long Reach Custom Fashion type Semi-TORQUE WRENCH (Open End type) & Twist/Turn CUP LOCK 89 Item "Counter Clock Wise"—WHILE HOLDING Connecting ROD Firmly with Suitable "Flat Mouth/Non-teeth Vice Grip Tool" and Either (Pull the Cup Lock Up) or (Let the Cup Lock drop Down) & Rest on Connecting ROD & 89 Cup Lock LOCK SEAL—, Rotate Crankshaft slowly—Only To Push Piston Upwards—just enough to Separate Piston PIN 87 Item FROM the PISTON'S (84CBC Center Bore Cup Area) Slot Formed Areas—by Slowly Reversing Crankshaft Rotating, once Separated, Carefully TURN Piston PIN 87 Item—To It's "Low" or visible "LO./L" position—WITH a Long Reach Custom Made Suitable Fashioned Type PLIERS,—Then USING the CUP LOCK 88—As A Guide For Piston PIN 87—To Be Re-Seated & Bolted Back Up Into The PISTON'S 84CBC Area's 90S SLOT(S)—of FIG. 34—Though WHILE Carefully Rotating Crankshaft to POSITION the Piston PIN 87 & CUP LOCK 88, and then Tighten & Torque Tighten CUP LOCK 88, and then Re-Install Cup Lock Lock SEAL 89 (using reverse procedure of Removing).

(This same basic procedure—is REPEATED & DONE TO THE OTHER PISTONS & CYLINDER SLEEVE BORE AREAS);—To Which Now, the Compression Ratio LEVEL Range Bracket—would be (8.75:1 C.R.) to (9.00:1 C.R.) Average "Low" LEVEL Range Compression Ratio Bracket, TO WHICH ALL FIGURES ARE SHOWN IN IT'S "LOW C.R.POSI." POSITION SETTING—OSIV' Engine Piston Setup. OIL Should Leak Out During the Above Compression Ratio Level Change Process—Though It's Not Enough To Harm nor Damage This Engine, Just Re-Install Oil Scavenge Pan 25 Item & Start Engine & Fill Oil RESERVOIR 16 Area by Poring Fresh Clean Specified OIL Into OIL FILLER TUBE 46 Item by Removing Item 47 DIPSTICK CAP & Re-Install 47 DIPSTICK CAP, and go back to Racing or Driving & Running/Tuning Engine Operations.

This Concludes basic Setup Formation & Explanation—of Items 84 thru 94B on (DPL) Pages 35., 36., of HOW the OSIV' Engine Stage One & Two—PISTONS, Piston PIN, Piston Pin CUP LOCK, Piston Pin Cup Lock LOCK SEAL, Piston RINGS—MAKING AND FORMING FORMATION—of OSIV' CROSS FORCE PISTON ASSEMBLY Setup Techniques—Methods—Using—for those Persons Professional SKILLED in the Art of Engine Block PISTON(S) & Piston PIN(S) MANUFACTURING & Custom Made High Performance & PRO-Racing Level Field Parts—who can EASILY SEE & Understand by simply Examining Above Figures & Explanations—Towards Professionally Building & Producing such.

(G)—Osband Super Inductionexhaustion Valveshaft(s) Stage ONE & STAGE TWO—MAKING AND FORMING FORMATION: Referring to FIG. 112, FIG. 124, (QV) of Item 95 OSIV' VALVESHAFT(A)-and-Item 96 OSIV' VALVESHAFT (B), & Item Areas—and Necessary Supportive Components or Parts or Areas—, Is to be Formed by a Well Trusted Suitable Company or Manufacturing Specialist in the Art of Professional CASTING or FORGE FORMING & (DURA BONDING/COATING Of High Heat & Friction Resistance—DUPONT Type TEFLON COATING Of Metals—That's Slick & Friction Resistance and WILL NOT PILL OFF—NOR—FLAKE OFF—NOR—CHIP OFF—Which Is GAS/ALCOHOL/NITRO/OIL/WATER/AIR DUST/HIGH HEAT FIRE/ICE COLD FROST/"RESISTANCE"—,—or—Persons SKILLED in the Art of a Basic Metal COATINGS known as "PLASMA MOLY" or "Mahle Factory Applied Phosphate Grafal™ Graphite Coatings" types.)—, and PRO' SKILLED At Forming "High Performing Cylinderhead Assemblies"—and—"High Performance Camshaft Assemblies" or Kits-type Manufactures—Specifically Like Those In & On "CHOICE SELECTED COMPANY" section Pages 15., 16., 17., 32., 47., or a suitable Professional "High Performance Crankshaft type Manufacture"—like on "CHOICE SELECTED COMPANY" section Pages 10.*, 32.*, and Perhaps Others.

QUICK VIEW OF REFERRING;

Referring to DIAGRAM:1—&—DIAGRAM:2—and—DIAGRAM:3—&—DIAGRAM:4, (for Quick Viewing Schematics);

Osband Super Inductionexhaustion Valveshaft'/"OSIV'" (Is Pronounced Like "AH-SIV")—is Setup—Formed or Made—like a "Oversize Camshaft" WITHOUT Cam LOBES, or like a "Crankshaft" WITHOUT It's Throw ARM & Throw Arm PIN & Counter Weights Shapes,—OR—even more like a Car's Driveshaft WITH "Cutout Wedge Pockets" on it,—OR—Formed From A SOLID ALUMINUM ALLOY POLE (about 3½" to 4" in Diameter & about 2' Feet Long for Average Small & Medium Big Block V-8). (However Formed)—;

The OSIV' "VALVESHAFT(S)"—is basically Designed to be Setup—To Spins/Rotates ONCE every time the Crankshaft Spins/Rotates TWICE, during the Crankshaft's FOUR CYCLE (4-STROKE)—Completed TOTAL of 720° of Rotation Turning,—where as—the OSIV' VALVESHAFT' Only Completes 360° of Rotation Turning. In Simply Terms—Crankshaft SPINS TWICE & OSIV' VALVESHAFT(S) SPINS ONCE—, (2 to 1 RATIO), as typical Camshafts Do.

However, the OSI-VALVESHAFT' (shorter title name)—Functions—works in "Degrees Of Rotations" or (CYCLES) WITH Engine's "Crankshaft, Connecting Rod(s), Piston(s), Rotating Reciprocating Assembly"—connected/linked—TO—"(RG.TDOP.SUCH.)/Roller Gear—Timing Drive Oil Pump—System Unit Case Housing 147 Item & Areas", WITH—"Adjustable Timing Flex Drive Belt Pulley Gear (setup) System"—and—Correct or Accurate "VALVESHAFT TIMING" During the Piston & Crankshaft's INTAKE CYCLE STROKE—COMPRESSION CYCLE STROKE—(Ignition Spark/Combustion Timing During Cycle Stroke)—POWER TORQUE CYCLE STROKE—EXHAUSTION OUTLET CYCLE STROKE—To Complete "ONE FULL ENGINE RPM (Revolution Per Minute) CYCLE"-of-the Crankshaft's 720° Degrees of Calculated Rotation Turning, in which the Crankshaft Turns 360° Degrees (One Complete Revolution)—PLUS—Turns Another 360° Degrees (One Complete Revolution)—EQUALING=720° Degrees—(for a completed FOUR STROKE CYCLE ENGINE REVOLUTION) Turning.

This Concludes QUICK VIEW OF REFERRING;.

OSIV' VALVESHAFT' (A) 95 Item—Is Setup To Rotate "CLOCKWISE" ↻.

OSIV' VALVESHAFT' (B) 96 Item—Is Setup To Rotate "COUNTER CLOCKWISE" ↺.

This basic known Method is also REFERRED TO in "DISCLOSURE DOCUMENT No.469282" Page ⑥ Item Two Question.

DESIGN/SETUP;

The OSIV' Engine system & It's VALVESHAFT(S)—is Designed & Setup For "Numerous" Unlimited Performance(s) Type MODIFICATIONS—where as the Old Style Basic CAMSHAFT Engine System (is OK)—, It Can Not Even Come Close To Achieving such Enduring ULTRA RPM Operations & New Unlimited Performance Potential Of HIGHLY FUEL/POWER EFFICIENT MODIFICATIONS of the OSIV' Engine. (Typical Bragging Rights type Statements Used by Engine Builders, Designers, & Racers.), though;

One Different Simple EXAMPLE IS:—OSIV'—VALVESHAFT'S Formed "VALVE—Wedge Cutout Pocket—100 Item Areas"—"SIZE", "LOCATION & SHAPE TYPE", "ANGLE & DEPTH SIZE", (ALONE),—verses—Best Known CAMSHAFT'S System Setup Of "LOBE LIFT", "LOBE SEPARATION", "FLAT TAPPET LOBES", "ROLLER TAPPET LOBES", "POPPET VALVE HEAD & STEM SIZE", "VALVE SPRING TYPES", "ETC.",—Well just with the OSIV' "VALVE POCKET SIZE 100 Areas" Category Of MODIFICATION Setups "ALONE"—that can be Formed (as Viewed on FIG. 112 & FIG. 124), 100-INT.(for INTake) VALVE Pocket Areas & 100-EXH.(for EXHaust) VALVE Pocket Areas, either Formed "WIDE"or "NARROW"—or—Forming 100-INT.

VALVE Pocket "WIDER" than 100-EXH. VALVE Pocket, Can Drastically Change (Capacity Flow Measurements) or CFM Flow Rates & Performance towards FINE-ULTRA HIGH RPM-PERFORMANCE TUNING LEVELS of Engine Operations—Whereas as—Camshaft(s) Must Apply Tremendous Pressure & Friction to LIFT & PUSH a "Poppet Valve & Spring-System Setup" OPEN—SO FAR-&-Rely On "Marginally" Different Diameter Sizes of the Poppet Valve HEAD & Cylinderhead Combustion Chamber Valve SEATS—just to make "Minimal Changes" of CFM FLOW RATES. Thus towards doing such, a Camshaft Engine system, A PERSON "MUST" Drain & Remove Major Engine PARTS—such as—"DRAINING WATER COOLANTS", & Remove "INTAKE MANIFOLD & EXHAUST MANIFOLD/HEADERS", "VALVE COVERS", "CYLINDERHEADS",—&—then have to Remove "VALVESPRING RETAINER LOCKS & RETAINERS", "VALVESPRINGS",—&—then have to Remove "VALVES", "VALVESEATS from the Cylinderheads"—(just to get ready TO install Larger or Smaller Poppet Valvehead Diameter Sizes)—Before Doing Proper Machine Work & Re-Installing Everything Correctly WITH Lube & Sealants-&-Including Re-Torquing the MAJOR PARTS/BOLTS & NUTS/RE-ADDING WATER COOLANTS—ETC.—To The Engine BLOCK—&—You Have To Re-Break the Engine Inn—To Seat Poppet Valves & Valvesprings-and/or-(A Complete Camshaft & Valve system KIT/ASSEMBLY) etc. before properly Running & Racing the Engine . . . ,—Where As—;

The Great OSI-VALVESHAFT(S)—is "Designed Setup" to be Much More QUICKER'LY Removable & Re-Installed—, as Fast or Faster than the Worlds Best Known Race Engine Mechanic would take to Remove & Re-Install a typical CAMSHAFT on a Race Engine that just Completed A Quarter Mile Run at a Drag Strip Track . . . ,

OSIV' VALVESHAFT' QUICKER REMOVAL & RE-INSTALLATION:

By Simply Lining Up Items 147PDGA & 147PDGB "Pulley Drive Gear(s)" & Crankshaft at Top Dead Center (TDC) 0° Intake Crankshaft Cycle Stroke—as—FIG. 1 Shows, and Insert A Suitable Size Nail or Pin "INTO" Items 147PDGA & 147PDGB Pulley Drive Gear's 55 Bolt HOLE Area—To Retain Alignment—, NOW BY SIMPLY REMOVING; Flex Timing Drive Belt(s) 184(A) & 184(B) Item's "185 Pin-Screw LOCK KEY" & Disconnect Flex Timing Drive Belts & only remove from 141 Adjustable Valveshaft TIMING PULLEY GEAR/SPROCKET Item Areas & Re-Connect Flex Timing Drive Belt(s) (so in-order not to loose Pin-Screw LOCK KEY) & let the Belts Hang Freely under Valveshaft Pulley Gear Sprocket 141 Item(s) of FIG. 1, NOW Removing Items 141 TIMING PULLEY GEAR/WITH Item 142 Pulley Gear HUB—by removing—Items 56 C-CLIP Lock WASHER & 59 NUT, then put the 59 NUT & 56 C-CLIP Lock WASHER back on Valveshaft's Pinion NOSE 98 Area "Fully"—as Shown of FIG. 112 & FIG. 124, then Removing Item 106 Preload Bearing RETAINER & It's (Eight) Retaining BOLTS 54 Item Areas Shown of FIG. 2,—AND—Simply Pull The OSIV' VALVESHAFT(S) Out. (Enlargen or Reshape or Rotary File the Valvepocket—or—Apply JB WELD Material or "GOODSON'S Two Part-Epoxy 500° Port Reshaping Material" types—to make Valvepocket Smaller With Reshaping TOOL-or-the Valvepockets Can Be Pre-Machined Formed for Securing Different SHAPES & SIZES of "DETACHABLE or POP'IN Valvepocket type SLEEVE Wedge Cups—that can be Pried & Popped Out With simple Flat Head Screwdriver") or Clean & Change Ringseals or Roller Bearings & Seals,—or—Re-Install Another OSIV' VALVESHAFT(S) Complete Assembly, Grease/Lube Bearings—AND—Install VALVESHAFT(S) Using (www.goodson.com) "BAND RING COMPRESSOR Kit/Tool GPS-98 Order No." types, INSTALL BY USING REVERSE PROCEDURE OF REMOVING, Install Retainer 106 & Bolts 54 Items, (take off 56 C-CLIP Lock Washer & 59 NUT Items, Install 142 HUB with 141 PULLEY GEAR, Install 59 NUT & 56 C-CLIP Lock Washer, and Now turn/Rotate VALVESHAFT'S 141 Pulley Gear/Sprocket to TOP "0°" Alignment MARK Area On OSIV' CYLINDERHEADS, Disconnect Flex Timing Drive Belts—and—Install Flex Timing Drive BELTS 184A & 184B Items Properly With 185 Pin-Screw LOCK KEY as FIG. 1 Shows, REMOVE THE Inserted PIN/NAIL That's IN Items 147PDGA & 147PDGB Pulley Drive Gears, Reset Ignition System SPARK Firing ORDER TIMING Correctly, Start OSIV' Engine and Run Hard & Go Back Racing or Do Fine Engine Tuning Operations.

SIMPLE—QUICK—DURABLE—HIGH POWER/FUEL EFFICIENT ENGINE—Designed Method Technique of Mind Set & Meanings—of what OSIV' Engine System further represents—to which the Above statements is partially about & towards a Real Comparison type EXAMPLE.

This Concludes One Different Simple EXAMPLE IS:—and—DESIGN/SETUP;—.

FORMING OR MAKING THE OSIV' VALVESHAFT' (S)—Is Quite Simple (especially by just Examining DIAGRAMS & Other FIGURES)—. However, they can be Setup for CNC/CAD-CAM CASTING—or—CNC MILLS/FORGE METAL MACHINING & FORMING TYPE PROCESSES, Noted On "CHOICE SELECTED COMPANY" section Pages 39. thru 41.—, or Proper Welding & Pre-Finished Machining & High Heat Resistance Materials of Bonding/Coating & Re-Machining Finish Processes.

However, as I (The Inventor/Designer) Sees', the Simplest METHOD Towards Making Such, is to Simply View DIAGRAM:1-&-DIAGRAM:3—to Have the "Mind Set" towards Understanding & Knowing How to.

LENGTH & DIAMETER OF OSIV' VALVESHAFT'(S)—Are Determined By The Length Of The "ENGINE BLOCK CYLINDER CASING DECK 13 & 14 Item Areas-and-PISTON CYLINDER BORE SPACING & BORE DIAMETER SIZE SETUP"—as viewed & basically Shown of FIG. 112, FIG. 114, for VALVESHAFT 95 Item & 95(A) Areas,-and-of FIG. 124, FIG. 126, for VALVESHAFT 96 Item & 96(B) Areas.

However, for typical Big Block V8 Stage TWO OSIV' Engine Compact Style DIMENSION—(which was the Platform used to Derived Invention Standard SIZE)—as Almost Like a GM BUICK/CAD/CHEVY/OLDS/PONTI/1964–74 Yrs.—though with FORD & CHRYSLER & BUICK type Cylinderhead Similar BOLT HOLE Patterns—as on "CHOICE SELECTED COMPANY" section Pages 1., 2.*, 3.*, 4.*, 5.*, 6.*, 7.*,—Though WITH OSIV' Engine Stage Two ENGINE BLOCK STRUCTURE SETUP Techniques & Methods, Formed Type Areas. Or Such Can Be Incorporated Into Those Manufacture's CNC/CAD-CAM CASTING MOLD FORMATION PROCESS OF MAKING.

However, "SIX" Specified Material Formed POLES/SHAFTS (Hollow or Solid)—of a Suitable LENGTH SIZE about (23" inches to 24" inches LONG), TWO-(3" inch Dia. SIZES) & TWO-(3½" inch Dia. SIZES) & TWO-(4" inch Dia. SIZES), of DIAMETER TYPE PAIRS,—Would Be Suitable—Which Would Total THREE SETS of SHAFTS to begin with. (2–3" Dia. Shafts for SMALL BLOCK V8), (2–3½" Dia. Shafts for MEDIUM/LARGE BLOCK V8), (2–4" Dia. Shafts for LARGE/BIG BLOCK V8), Is The Basic Standard Use Towards SETUPS Of—OSIV' Engine System—"V8 Engine Size Category Setup(s) & Method(s)".

THE SHAFT(S)—are then Placed in Suitable Lathe CNC Diameter Degreeing type MACHINE(S)—that can MARK or SLIGHTLY SCORE & MEMORIZE Degree Lines Being Formed On the Shafts—from (0°/360° (TDC) MARKING) OF "1° of INCREMENT LINE SPACING MARKS" Along Horizontal Plane—All The Way Around The ACCURATE Outer Diameter SIZE SURFACE For DEGREEING OF THEIR Surface Perimeter Of Each SHAFT'S Diameter Size Being Degreed/Marked—Along It's Full Horizontal Length.

Once the CNC (Computer) has the (0°/360°) Degree "MARK-FIXED POINT" Programmed In—WITH the Length & Accurate Diameter Size of a particular SHAFT(S), the CNC LATHE/DRILL MILLING AXES MACHINE—can be Setup or Programmed to CUTOUT/ROUTER CUTOUT/-OR-DRILL OUT/BORE OUT/HOLLOW OUT/etc.-and-Shape or Form the Item(s) "100 VALVE-Wedge Cutout Pocket Areas", At A Particular Programmed DEPTH/WIDTH/SHAPE/LOCATION/DIAMETER OPEN SPACE VALVE POCKET GAP LENGTH/VALVE POCKET SPACING/NUMBER OF VALVE POCKETS TO BE FORMED/DIAMETER RING SEAL GROOVE LOCATION & WIDTH & DEPTH/ETC.—Formed On The SHAFTS, like Items 95 & 96 VALVESHAFT(S) of FIG. 112 & FIG. 124—as typically Drawn.

In Essence, "Its The Similar REVERSE OPPOSITE of the way You or Camshaft Manufactures—would Form a typical known Camshaft".

Also In Essence, the Larger the Diameter of the VALVESHAFT(S)—the Larger the VALVE—Wedge Cutout Pocket 100 Item Area—will typically be. Thus Power Output Levels—of such OSIV' Engine System—Can Be Increased—WITHOUT "NO BASIC STRAIN" On Valveshaft(s)—Engines, UNLIKE Old Style Camshaft—(Valve & Spring Setup) type Engines.

RING SEAL 101 Item—, Valveshaft RING SEAL(S) 101 Item Areas & Locations—are Typical, which are basically Setup On Valveshafts—to STOP Excessive Compressed GASES/AIR-FUEL MIXTURES/BLOW-BY/COMBUSTION FLAME & HEAT/etc.—From Escaping Cylinderhead's Combustion Chamber Pocket 128 & 129 Areas of FIG. 113 & FIG. 125,-and-Separates 100 INTake & 100 EXHaust Valveshaft—Wedge Cutout POCKET(S) Areas-&-Helps Prevent FRESH and BURNT Gases From Mixing with each other at ULTRA HIGH RPM Engine Operation Levels, as Setup Drawn of FIG. 112 & FIG. 114, FIG. 124 & FIG. 126.

VALVESHAFT(S) 101 RING(S) Items—Perform Similar Basic Duty As Basic Piston Ring(s) Do,—BUT DO NOT: SCUFF—UP NOR DOWN WITHIN-OR-ON IT'S CYLINDER BORE WALL, though they are ALLOWED TO SEMI SPIN IN & ON IT'S 111 & 112 CYLINDERHEAD BEARING SLEEVE(S) INSIDE DIAMETER BORE WALL SURFACE. The RINGS can be made of a "Silicon Nylon Graphite Teflon Coated"—Crack Proof Material(s), or Should At Least Be "PLASMA MOLY COATED IRON DUCTILE"—type RINGS (just like typical Piston Rings are made), Which Should FIT SNUGLY—WITHOUT BINDING—Within Formed (90-0 OUTER-Groove Diameter-Areas) of the VALVESHAFT' (S) 95(A) & 96(B) Item's Surface Areas.

These 90-0 OUTER-Grooves Formed On The Valveshafts—FOR THE ITEM 101 RING(S)—, Are Formed By CNC LATHE MACHINES—at a suitable Diameter Groove DEPTH & WIDTH "CUT"—Around Outer Diameter Surface Location Areas ON VALVESHAFT'(S). However, "All Sharp Areas IN GROOVES & RINGS—MUST BE REMOVED"—, by slightly Filing or Sanding & Rounding or Beveling Off ALL SHARP EDGES & GROOVE CREVICE SUNKEN CORNERS—to Help Prevent Cracks from Forming ON 101 RING(S) & VALVESHAFT'S GROOVE EDGES & OUTER DIAMETER SURFACE AREAS. (Typical Finish Machining & Message & Polish Work Done.) The WIDTH of each Formed 90-0 GROOVE for RINGS is typical—though Should be Made/Formed of a Suitable WIDTH for It's Individual LOCATION AREA ON THE SHAFT—As Basically Drawn.

PINION NOSE 98—Front Drive PINION NOSE Area—Of VALVESHAFT'(S) 95 & 96 Items, Is Typically Formed For Installing A "O-RING Type Snugly Fitting 104 Bearing BACK SEAL" (Teflon Coated Neoprene type) & A TIGHTLY PRESS FITTED "Preload Roller BEARING 105 Item—, And Is Formed Like Any Other Known Type Drive Pinion(s), like basic Drive Pinion Gear of a Car's Rear End Differential Unit—though Setup WITH A Formed (0°) Degree KEY 108 Area Item Location—to LINEUP & PRESET & LOCK the 142 Pulley Gear HUB Item—In Position—for Accurate Valveshaft Timing Rotation (Without Slipping) WITH Crankshaft 64CS Item Rotation & Item 147 (RG.TDOP.SUCH)'S 147PDGA & 147PDGB Pulley Drive Gear(s) Items Rotation & Items 184A & 184B Flex Timing Drive BELT(S) Rotation—Basically As Setup & Shown Of FIG. 2, And Then View FIG. 1.

However, a 109 Grease FITTING Area Item type Nipple & Typical 27 Oil Passage Area—, is Formed to Allow the "Bearing Grease" to Fill the 105 Preload BEARING (Roller type) Area Item Setup, basically Shown of FIG. 114 & FIG. 126—which is Typical.

A THREAD 93 Area is Formed—WITH—A Basic Diameter GROOVE for the 56 C-CLIP Lock WASHER Item Area type—to Secure Item 59 NUT—Which Locks 142 Pulley Gear HUB Item(s) IN-PLACE—so it does NOT COME OFF from "98 Front Drive PINION NOSE Area—During Engine Running Operations.

PINION TAIL 99—Rear Support PINION TAIL Area Of VALVESHAFT'(S)—Is Typically Formed For Installing A "O-RING Type Snugly Fitting 104 Bearing BACK SEAL" (Teflon Coated Neoprene type) & A TIGHTLY PRESS FITTED "Preload Roller BEARING 105 Item—as Shown On Basic Views FIG. 114 & FIG. 112-and-FIG. 126 & FIG. 124,—though, as well as for the Front Pinion 98 NOSE SUPPORT Area—is also typically Formed to Install a 105 Preload Roller BEARING—Tight Press Fitted—, (Both Installed WITH Snugly but NON-BINDING Slippable Fitting O-RING 104 Bearing BACK SEAL—which Outer Diameter Surface Area is Formed to Fit SNUGLY Against Cylinderhead BEARING SLEEVE 111 & 112 Item's Formed Inside Diameter Bore Wall Surface as above Figures Show, to which SEAL(S) Should Be Made Of Firm Compressed HIGH HEAT Resistance Teflon Coated Neoprene Rubberized Type—Material) used.

At this point of (A SOLID FORM SHAFT/POLE) OSIV' VALVESHAFT' Formation Forming, the 97 Internal Fresh Air PASSAGE & ARROW Area—"BORE HOLE" is Formed by a LONG Suitable Size Drill Bit/Drill/Bore Press/Lathe—type CNC Machine, Starting at the REAR Center Point Of 99 Rear Support PINION TAIL Area—DRILLING TOWARDS FRONT—98 Front Drive PINION NOSE—AND STOP DRILLING BORE DEPTH—Just Before Reaching 98 NOSE PINION SUPPORT Area—Where Preload 105 Bearing BACK Surface Begins, as Drawn of FIG. 114 & 126—Shows. This 97 Internal Passage is—PLUGGED WITH Item 60 PLUG—with suitable size Press Fit Freeze PLUG (Aluminum or Alloy type)—Tight Press Fitted—"FLUSH" with Edge of 99 Rear Support PINION TAIL'S End Surface, "TO WHICH BASICALLY 'CONCLUDES' THE NON-STAGE & STAGE ONE (Osband Super Inductionexhaustion Valveshaft'(s) 95 & 96 Item & Areas)—WHICH AT THIS POINT OF FORMATION FORMING—THEY ARE & WOULD BE FACTUALLY READY FOR ENGINE OPERATIONS AND USABLE PARTS", thus is also the MAIN SETUP PLATFORM TECHNIQUE for OSIV' VALVESHAFT'(S) Stage One & STAGE TWO ENGINE SYSTEM SETUP TECHNIQUE METHODS.

THE STAGE ONE OSIV' VALVESHAFT' Setup—, is "NOT" formed with Front & Rear 102 Turbine (Cooling) FAN/FIN Area Items—NOR—with Front & Rear 103 Air Hole Passage Item Areas—NOR—with Front & Rear 90-O Outer Diameter GROOVES & Item 103 Air Hole Passage Areas—OF/ON—Items 111 & 112 Cylinderhead Bearing Sleeve (Front) Areas—Shown of FIG. 4 (FRONT VIEW)-&-FIG. 9 (REAR VIEW),—NOR—with Items 139 Fresh Air Inlet PORT Passage(s) (Front)-&-Items 140 Fresh Air Outlet PORT Passage(s) (Rear)-OF-(Front & Rear Area(s) of Items 119 & 120 OSIV' BRICK WEDGE CYLINDERHEAD(S)—), Therefore—NO NEED FOR Item 209 Front Fresh Air Inlet Manifold,—NOR—Items 197 & 198 Fresh Air Outlet Manifold PIPE(S) (A)&(B), "For OSIV' VALVESHAFT'(S) To Be Operational"—of the OSIV' Engine System Stage One SETUP FORMATION—to which the OSIV' Engine System STAGE TWO (SETUP) Is Based Upon.

STAGE TWO—OSIV' VALVESHAFT' Engine System Formation Continues;

Referring Back To FIG. 112 & FIG. 124, The Item 102 Turbine FAN/FINS—Formed Area WITH Cross Lines—of Front & Rear Outer Diameter Areas of VALVESHAFT' Area View, Is Formed By Basic ROUTER DRILL type CNC MACHINE that's capable of Cutting Various Curves/Angle Patterns & Cutting Out Routed Sections & Forming Routed Sections, to Form Curved FIN RAISED Areas as Drawn of FIG. 4 (for Front 102 Item FAN/FIN(S)—Inlet VALVESHAFT' Area), and as Drawn of FIG. 9 (for Rear 102 Item FAN/FIN(S)—Outlet VALVESHAFT' Area).

The DEPTH of the Shaded Curved Routed Out Areas of the Turbine FAN Grooves—is NOT too Deeply Formed—in order NOT to Interfere with Item 101 Valveshaft RING SEAL Areas (Front & Rear Locations) of FIG. 112 & FIG. 124, (Formed at a typical—Suitable—DEPTH of Safeness).

Referring to FIG. 114 & FIG. 126, the 103 Air Hole Passage(s)/Areas—At Front & Rear Of 97 Internal Passage(s) of Valveshaft Areas—, Is Formed By CNC DRILL PRESS MACHINES-or-Drilling Hole at suitable SLANT Angle—Between Formed 102 FAN/FIN Raised Areas—Around Diameter Areas of 98 Pinion BASE Areas—and—Around Diameter Areas of 99 PINION TAIL Base Areas, to Allow Fresh Air In & Out of 97 Internal Fresh Air Passage Area, as Drawn & Shown in FIG. 4 & FIG. 9 while Viewing FIG. 114 & FIG. 126—for Further Understanding Formation.

After the 102 Turbine FAN/FIN Areas & 103 Air Holes are Formed, the VALVESHAFTS are Setup In; CNC Lathe Machine(s)—to Mill Cut Down—102 Turbine FAN/FIN(S) "Outer Diameter" FIN Area(s) for Safe Suitable Clearance In-Order For; NOT Making Friction Contact WITH The Items 111 & 112 Cylinderhead Bearing SLEEVE'S (Front & Rear—INNER BORE Area)—as FIG. 4 FRONT VIEW Area Shows-&-FIG. 9 REAR VIEW Area Shows, as Viewed WITH FIG. 114 & FIG. 126. This also Allows Fresh Air to CIRCULATE All The Way Around Outer Diameter Area Of The Formed 102 Turbine FAN(S)—before Interring the 97 Internal Fresh Air Passage (Front Valveshaft Area)—and Allows Fresh Air to CIRCULATE All The Way Around Outer Diameter Area Of The Formed 102 Turbine FAN(S)—after Exiting the 97 Internal Fresh Air Passage (Rear Valveshaft Area)—FIG. 9, In-Order To Supply Air to (Items 17 & 18 Internal Valley Base Bulkhead—VERTICAL & HORIZONTAL—AIR TO OIL Passage-Areas).

*"WARNING CAUTION"*:

[ONLY—CNC MILL OUT or DRILL OUT or FORM A PASSAGE WAY FROM ITEM "100-INT." INTake VALVE-Wedge Cutout Pocket-Area, THROUGH TO ITEM "97 Internal Fresh Air Passage-Area"—AS—FIG. 5, FIG. 6, FIG. 10, FIG. 108, FIG. 110, FIG. 112*, FIG. 114*, FIG. 120, FIG. 122, FIG. 124*, FIG. 126*, FIG. 132 (100-INT. in broken line phantom), and *OSIV' MODIFIED/COLORED Version(Vr.) view. DO NOT DRILL THROUGH-NOR-MILL ALL THE WAY THROUGH "NO" (100-EXT. EXHaust VALVE-Wedge Cutout Pocket-Areas)—and—THE BOTTOM OF EXHAUST VALVEPOCKET MUST RETAIN SUITABLE WALL "THICKNESS" SO COMBUSTION FLAMES/FIRE DO NOT BURN THROUGH NOR CAUSES CRACKS TO FORM. EACH VALVEPOCKET IS TO BE CORRECTLY STAMPED LABELED OR ENGRAVED—"INT" or "EXH"—TO PREVENT CONFUSION. CLEAN VALVESHAFT THOROUGHLY & CONTINUE BUILDING.]*

BALANCING & WEIGHING:—All Rotational or Moving PARTS—Should At Least Be Properly BALANCED & WEIGHED.

The Balance & Weighing For A "PAIR/SET" Of OSIV' VALVESHAFTS For V-type Engine—Should Be Of "CLOSE EQUAL WEIGHT" & "PRECISION SPUN BALANCE"—like a typical Crankshaft or Camshaft or Driveshaft—Is Balanced-and or-Weighed, WITH IT'S (Front & Rear) TIGHT PRESS FITTED PRELOAD ROLLER BEARING(S) 105 ITEMS—"IN THEIR POSITION AS INSTALLED ON THE VALVESHAFTS"-&-WITH Items 142 Pulley Gear HUB & 141 Adjustable Valveshaft TIMING PULLEY GEAR/SPROCKET & 59 NUT & 56 C-CLIP Lock WASHER (Assembly)—ALL BOLTED TO Valveshaft's 98 PINION NOSE Area,—SPUN BALANCED to at Least *9000 RPM Level Range*—For Ultra High Performance Applications & Engine Operating Range-Levels. This Concludes—the Basic Setup Formations & Explanations of HOW the OSI-VALVESHAFTS are made. However, the Valveshafts are to be—Precision & Polished—Slick Smooth type Diameter Surface Finished—and—"Fitted Very Snug"—(like a Alternator Shaft-or-Water Pump Shaft, is Fitted in it's Bore Journal)—Within The "Cylinderhead Bore" (if bearing Sleeve/Line is not used)—or—Within "Cylinderhead BEARING SLEEVE(S) 111 & 112 Item's Inside Diameter BORE WALL—Precision Polished—Finish SURFACE Area(s)."

This Concludes the Setup Formation & Explanation—of Items 95 thru 110 on (DPL) Page 37., of HOW the OSIV' Engine System Stage One & STAGE TWO—(OSIV') Osband Super Inductionexhaustion Valveshaft(s) Stage ONE & TWO—Item(s) 95 OSIV' VALVESHAFT(A)-&-96 OSIV' VALVESHAFT(B), and necessary supportive Parts & Components—Assembly, of (G)—Osband Super Inductionexhaustion Valveshaft(s) Stage ONE & STAGE TWO—MAKING AND FORMING FORMATION:, Techniques—Methods & Using—For Persons or Company/Manufactures That Are Professionally SKILLED in the Art Of—Professional METALS & ALLOY STEELS CUSTOM CASTING-&-FORGE FORMING & GRAPHITE/TEFLON/SILICON/PLASMA MOLY-type BONDING & COATING—of High Strength Light Weight METALS or Metals such as SILICON MAGNESIUM(S), SILICON ALUMINUM(S), SILICON NODULAR IRONS, SILICON ALLOY STEELS, TITANIUM ALLOY STEELS, and other Non-Metals Such As POLYURETHANES, NYLONS, NEOPRENE RUBBERS,-Type Forming-, and of Forming "High Performance Cylinderheads/Assemblies", "High Performance Camshafts/Assemblies" or "High Performance Crankshafts/Rotating & Reciprocating Assemblies or Kits"—type Manufactures—, of PRO-RACING Engine Field Levels—For Further Understanding By Simply Examining Above Figures & Explanation Matters—Towards Professionally Building & Producing Such.

(The "CHOICE SELECTED COMPANY" section Page 39., 40., 41.,*, Is Included—for further understanding of CNC & CAD-CAM type Manufacturing Processes that should be used for correct Formation Of The—OSIV' VALVESHAFT(S) & ENGINE PARTS—that such Articles MUST BE READ to fully realize the OSIV' Engine System "Mind Frame-Set of Thinking/Concentration Thought Process"* Towards Proper"SAFELY" Making & PUBLIC POPULATION HIGHWAY/STREET USING & WORLD OF AUTO RACING—Field Use), Concluded.

(H)—CYLINDERHEAD CYLINDER BEARING SLEEVE/LINER(S), CYLINDERHEAD(S), PRELOAD BEARING RETAINER(S), SEAL(S)—MAKING AND FORMING FORMATION OF: Items 111(VCBS)(A1) and 112(VCBS)(B1) Cylinderhead BEARING SLEEVE(S)/Valveshaft CYLINDER BEARING SLEEVE(S) (VCBS), 119(A2) and 120(B2) OSIV' BRICK WEDGE CYLINDERHEAD(S), Items 106 Preload Bearing RETAINER(S) & 107 SEAL (Neoprene type)—For 106 RETAINER Which Is Part Of "OSIV' STAGE TWO VALVESHAFT CYLINDERHEAD ASSEMBLY", Items 104 Bearing BACK SEAL(S) Which Is Part Of "OSIV' STAGE TWO VALVESHAFT CYLINDERHEAD ASSEMBLY", or areas—Is To Be Formed By A Trusted Specialist in the Art of Professional CASTING or FORGE Forming "High Performance Cylinderheads—KITS or Assemblies", "High Performance Cylinder SLEEVES/LINERS—For Engines", "High Performance Preload Roller BEARINGS & RETAINERS & Bearing Back SEALS & Custom Formed SEALS"—type Manufactures, Specifically like those in/on "CHOICE SELECTED COMPANY"section Page 12., 15., 16., *, & 10., 32., *, types, or suitable Professional High Performance Engine Block Manufacture types on Pages 2. thru 7., *.

*NOTE;

As I (The Inventor/Designer) Sees', the OSIV' BRICK WEDGE "Star*Burst" CYLINDERHEAD(S) (quick quoted short title name slogan), Should be Formed Before the Items 111- & 112-Cylinderhead BEARING SLEEVES/LINERS, Towards the order of Formation—to which—the "Brick Wedge Star*Burst Cylinderheads" MUST BE SETUP FOR A PARTICULAR SIZE & TYPE OF ENGINE PISTON CYLINDER BLOCK (V-type/Inline-type/Single or Multiple Piston Cylinder-type etc.) First, So Proceed WITH BELOW OSIV' BRICK WEDGE (Solid/Shape) Internal Cylinder BORE-CYLINDERHEAD(S) paragraph, "BEFORE THE" (Number Sequenced (DPL) SPEC. Page 37. thru 38. Listing Setup of 111 & 112 Cylinderhead BEARING SLEEVE(S) Items & other Areas).

OSIV' BRICK WEDGE—(solid)/(Shape)—"Internal Cylinder BORE" type CYLINDERHEAD(S) Item 119 ((A2) RIGHT BANK Engine Block)—AND—Item 120 ((B2) LEFT BANK Engine Block)—, Should At Least Be Formed By CASTING MOLD PROCESSES & Formed Of or From—"A355 to A357-T6 ALUMINUM ALLOY Materials",—or—FORGE OF "HIGH SILICON 4032 ALUMINUM Materials",—or—"NODULAR IRON Materials",—or—"STAINLESS CAST OR FORGED STEEL Materials",—Towards Forming WEDGE BRICK (S)/BILLET(S)-WITH-Deep Cylinder BORE HOLE type Cylinder Cup—Along CENTER Horizontal Plane Internal Area.

However, since these OSIV' BRICK WEDGE "HEADS" DO NOT REQUIRE WATER/COOLANT (W/C) Pockets/Jacket PASSAGES, a typical Casting/Forging Mold Process Technique can be Setup—in a Rectangular Wedge "Semi Pyramid" ⏥ Brick Fashion—, and the BORE is Basically Formed WITH a Iron of Steel or Aluminum—thick Graphite layered Coated/Bonded—Suitably Thick Cylinder Tube shape PIPE CUP—(totaling 3Three Pairs)—TWO-($2^{31}/_{32}$"0.Dia. SIZES for SMALL BLOCK V8 Brick Wedge CYLINDERHEAD(S)), TWO-($3^{15}/_{32}$"0.Dia. SIZES for MEDIUM/LARGE BLOCK V8 Brick Wedge CYLINDERHEAD(S)), TWO-($3^{31}/_{32}$"0.Dia. SIZES for LARGE/BIG BLOCK V8 Brick Wedge CYLINDERHEAD(S))—, EACH SET/PAIR Being Position Down In & Along The CENTER HORIZONTAL Plane—About (½" inch ) away from Bottom or Rear Wall Of The MOLD, just like the Setup of Items 111 or 112 Cylinderhead BEARING SLEEVE—Is Drawn & Positioned of FIG. 110 & FIG. 116, FIG. 122 & FIG. 128, Within the Casting Mold, (simple).

The "CASTING MOLD"—(of course)—Should Be A Little Wider & Longer In LENGTH than the Actual "Brick Wedge Cylinderhead" Being Formed. A suitable Press or Pounding Device Setup Machine—can be Setup to POUND or PRESSURE PRESS the Pre-Cooled HOT Metal Material—Down Into the MOLD (basic known compacting processes) to "SOLID FORGE FORM"—THESE—OSIV' BRICK WEDGE CYLINDERHEAD(S)—Into A Pre-Finished typical shape as Figures Show, "Thus Basically Forming SOLID FORGED Cylinderhead(s)" at a basic Metal Forming Engineering Foundry—like ACORN ENGINEERING CO. CITY OF INDUSTRY, CALIF., and others in "CHOICE SELECTED COMPANY" section Page 16.* (AFR).

CASING SIDES OF MOLD(S)—can be Setup WITH Intake PORT & Exhaust PORT-Areas—of THICK GRAPHITE COATED/BONDED STEEL Rectangular or Oval shape RODS—that are Long Enough to be suitably Positioned to reach OUTER Diameter BORE Area—of the Cylinder BORE—to be Formed,—Thus To Form Area 125 PORT RUNNER Passages, (typical & simple) though as to Form Structure as Shown of FIG. 108, FIG. 120, FIG. 113, FIG. 125, FIG. 5 & FIG. 6, FIG. 9, FIG. 10,—125 PORT RUNNER PASSAGE Areas & 126 BORE Areas (Partial Broken Line Phantom Section). The Area 139 Fresh Air Inlet PORT (Broken Lone Phantom) Front Area & Area 140 Fresh Air Outlet PORT (Broken Line Phantom) Rear Area—Both Can Be Formed The Same Basic Way—as well.

However The Process, the OSIV' Engine System Method—Here—is to FORM or MAKE "SOLID Brick Wedge Shape—Cylinder Bore—CYLINDERHEAD(S)"—WITH the—Cylinder BORE—Along The Horizontal Plane-Center Area To House Valveshaft(s)—WITH or WITHOUT—Cylinderhead BEARING SLEEVE(S).

Once This Process ABOVE is properly Produced, ALL other areas of The OSIV' BRICK WEDGE CYLINDERHEAD(S) can be (*Precisely Machined Individually Or On Interchanging Position PLATES On CNC MILL(S) Type Machines. Also, OSIV' Engine DESIGN can be Developed/Processed on CAD-CAM type Machines—as Defined on "CHOICE SELECTED COMPANY" section Pages 39., 40., 41.), & 46.—shows quick example Setup of Combustion Chamber POCKETS in Broken Line Phantom—On Old Style Cylinderhead—GM/CHEVY Type Casting.

Now with the Above In Mind, WHILE Referring to FIG. 109, FIG. 115 (BOTTOM DECK View—LEFT BANK Cylinderhead)-and-FIG. 121, FIG. 127 (BOTTOM DECK View—RIGHT BANK Cylinderhead)—Shows HOW the basic Setup Forming-or-(CNC Machine Milling) is simply done to Router CUTOUT & FORM typical Area 127—"CROSS FORCE+CROSS FIRE STAR*BURST COMBUSTION CHAMBER(S)" Formed Area WITH or WITHOUT "Dual 134 SPARK PLUG(S) & 133 Spark Plug BORE/HOLE Area(s)" Technique AREA SETUP Formation.

133 Spark Plug BORE(S)—Areas, are typically Formed At A SLANTED ANGLE—Under The OSIV' VALVESHAFT(S) & Cylinderhead's Center Cylinder BORE 126 Area—Within the Thick Formed SOLID BASE 121 Area—, which is also Viewed on FIG. 114 & FIG. 126,—though Formed Across The Horizontal Plane At A SLANT ANGLE of FIG. 115 & FIG. 113-and-FIG. 127 & FIG. 125.

The 133 Spark Plug BORES—Are Also Position At A SLANT (Wide V-Type) ANGLE Along Vertical Plane—as Formed & Shown of FIG. 10 & FIG. 11 (REAR View Areas).

Though ONE SPARK PLUG—would prove Efficient Enough for basic Lower Level Performance Operations—to Ignite Compressed Air/Fuel Mixture—However, the Intake PORT 123 Area (Valley Side) SPARK PLUG Setup Is "NEW"& Is To Be FORMED & USED FIRST—upon the OSIV' Engine System—, if Dual Plug Setup IS NOT USED IN YOUR CHOICE OF SETUP, because the Single Plug (Non-Star*Burst Setup) Spark Plug Per Combustion Chamber Of & On Intake PORT 123 Area (Valley Side) of Cylinderhead's "BASE 121 Areas"—Stay "LESS HOTTER"—than on Exhaust PORT 124 Area Side—121 BASE Areas. This also means—Spark Plug Ignition WIRES stay "LESS HOTTER"—than being on Exhaust PORT Side. (This also contributes to Internal Combustion Chamber COOLING—because the Spark PLUGS Do Not Get As "Red Melting HOT"—as they do on Exhaust PORT Base Side.)

This OSIV' System Technique—has "Many-Many" Benefits of this type Setup—Especially for Racers & Engine Mechanic Tuners who have to change Spark Plugs in Quick Situations (Bad/Failed Plug Issues)—in stead of having to Wait Until Exhaust Manifold HEADERS to Semi-Cool Down—then Remove & Install Plugs—UNDER the HOT HEADERS (Odd Style Positions).

Referring Back to FIG. 109 & FIG. 121, The 132 Half Moon GROOVE Formed Area—is Formed by basic CNC Machining at a suitable Safe Depth—to which the TOP RIM Area of the Engine Block Cylinder SLEEVE(S) 51 Item—Fits Snugly Up Into—"Creating A Total Seal Of COMBUSTION CHAMBER"—So there can be NO typical (Cylinderhead to Block)/Item 58 SHIM GASKET "Blow Out" nor Failure—(During Extreme High Heat RPM Engine Operations), Setup as FIG. 114 & FIG. 126 shows.

Block Cylinder SLEEVE(S) 51 Item's—Top RIM Area is typically "Notched" to coincide WITH the "93GA GAP AREA" between 132 Half Moon GROOVE(S). The coinciding "Notch Groove/Slot" of Item 51 SLEEVE'S "LIP" is also Formed to be THE "Alignment Marks" For Positioning Of The BOTTOM Area Of 51 SLEEVE(S)—(Cross Horizontal Plane Area 27 Oil Passage HOLE(S))—As Diagonal Viewed Position On FIG. 5/FIG. 6.

However, at the FRONT of each OSIV' BRICK WEDGE CYLINDERHEAD Area(s)—Are Formed "126BS BORE SEAT(S) Areas" For SUPPORTING Items 111 & 112 Cylinderhead BEARING SLEEVE'S—116 Front Formed LIP Area—, at a SAFE Suitable Bore Depth-with-BOLT HOLE(S) 55 Areas—, as FIG. 110, FIG. 112, FIG. 122, FIG. 124, Shows. This can be simply Formed by suitable Boring & Drilling-with-CNC Machines, as well.

ALL other basic Item Numbers/Areas—are Typical—just as Viewed.

This Concludes the basic Setup Formation & Explanations of HOW the OSIV' Engine System Stage One & STAGE TWO "OSIV' BRICK WEDGE—(solid)/(Shape)—"Internal Cylinder BORE" type CYLINDERHEAD(S)"—are of Making & Formation Technique—Method & Using—for Further Understanding by simply Examining Above Figures & Explanations—towards Professionally & Suitably Building and Safely Producing Such.

CYLINDERHEAD CYLINDER BEARING SLEEVE/LINER(S) Item 111 ((A1) for RIGHT BANK Cylinderhead)-AND-Item 112 ((B1) for LEFT BANK Cylinderhead)—, Should be Formed by a suitable Engine Cylinder Block SLEEVE/LINER—type Manufacture like "CHOICE SELECTED COMPANY" section Page 15.* (L.A.SLEEVE). (*Perfect Personal Choice.)

The OSIV' Cylinderhead BEARING SLEEVE—is Formed of—at least—IRON' ALLOY OF NICKEL-SILICON-& HARDENED CARBON CHROME WITH MOLY 2000—as "CHOICE SELECTED COMPANY" Specifies—of a GOOD TYPE MATERIAL—that is BEST suited for "FRICTION HIGH HEAT RESISTANCE" & who are Professionally SKILLED at Making & Producing SLEEVES/LINERS—as making it a Science & a Art.

Referring to DIAGRAM:2, and DIAGRAM:4, which Shows HOW the basic Setup Formation of Making—Both Cylinderhead Cylinder BEARING (type) "SLEEVE(S)"—for the OSIV' Engine System Technique Method, while Viewing FIG. 110 & FIG. 116—(Basic Outside Diameter Setup Formed Areas) for RIGHT BANK Cylinderhead Cylinder BORE 126 Area, and Viewing FIG. 122 & FIG. 128—(Basic Outside Diameter Setup Areas) for LEFT BANK Cylinderhead Cylinder BORE 126 Area, However—Both OSIV' "SLEEVES" 111 & 112 Items—is Formed In A Similar Fashion As The Sleeve Shown On "CHOICE SELECTED COMPANY" section Page 15."*→, EXCEPT that—OSIV' SLEEVES WOULD BE ABOUT 3THREE TIMES LONGER (for V8 or InLine-4 type Blocks)—and—About (6.350 mm Thick or ¼" Thick)—and—Larger Overall Diameter types—for basic Formation Forming Setups for -Large Big Blocks- -Medium Big Blocks- -Small Block-type Engines, for Cars, Trucks, SUV'S, Boat, Aircrafts, Motor Cycles, type Vehicles.

The 118 (0°) Degree Mark—is Formed at Top Dead Center of Both 111 & 112 Cylinderhead BEARING SLEEVE'S 116 LIP Area—which is typical as Shown of FIG. 2 & FIG. 3, (Its the Smallest NOTCH to be Formed ON These LIP Areas). This Allows for proper Inlet/Outlet Combustion Chamber Pocket(s) "ADJUSTING"—for making the Combustion Chamber Passage OPENING "SMALLER"—or—Intake Port INLET "SMALLER" and Exhaust Port OUTLET "SMALLER", (for another "New" type of High RPM Performance "TUNING"—of Different Levels of OSIV' Engine System Operations.) This also aid(s) in the correct Alignment of Combustion Chamber POCKETS & Intake Port INLET and Exhaust Port OUTLET—of the Cylinderhead BEARING SLEEVE Areas.

c̄—is Negative Chamber, —&—, ć—is Positive Chamber)—WITH the (0° Degree Mark) in Between/Center, which is Formed On The FRONT Cylinderhead—TOP 137 Area(s) of Both OSIV' BRICK WEDGE CYLINDERHEADS.

However, the 117 Curved Broken Line Phantom "OVAL HOLES"—Areas—which are

However, the 117 Curved Broken Line Phantom "OVAL HOLES"—Areas—cont.; Formed by CNC Machine Drill/Mills—Within the INNER Diameter Area of (116 Front Formed Sleeve Retaining LIP Area(s))—as Shown of FIG. 2, FIG. 112, FIG. 114, DIAGRAM:2, DIAGRAM:4.

Thus—the Cylinderhead BEARING SLEEVES are Precision Finished to FIT "Snugly Tight"—though NOT TOO Tight—so in order to ALLOW the SLEEVE to be TURN (with suitable Custom Made Form Horseshoe Wrench Tool) Snugly TIGHT Turning Adjusting—Within the Cylinderhead's Cylinder BORE 126 Area(s)—Shown of FIG. 110 & Others. Partially Concluded.

PRELOAD BEARING RETAINER(S) Item 106 Areas—For Preload BEARINGS of (Roller type)—is Formed basically like any other Preload Bearing RETAINER-or-Pinion Supporters—Which typically comes With Preload Roller Bearings and Seals—, like those on "CHOICE SELECTED COMPANY" section Page 12.* *→, Which can also be Formed for the OSIV' VALVESHAFTS—by this such PRO Manufacture. However, as FIG. 114 & FIG. 126—Shows How Item 106 RETAINER(S) Front & Rear Item Areas—are simply Setup to be Suitably Made to Preload On ROLLER Bearing(s)—(FIT)—which Houses Front Item 107 SEAL Within RETAINER 106 "Front Area Journal GROOVE/Seat.

This just Shows How such a simple Typical type Method Setup can be Simply Formed for Item(s) 106 Preload Bearing RETAINER (Front & Rear Area(s) of Valveshaft & Cylinderhead Bearing Sleeve Areas), though Within Area 116 Front Formed Bearing SLEEVE'S Retaining LIP Area(s), of FIG. 112, FIG. 114 and FIG. 124, FIG. 126.

The Item 106 Preload Bearing RETAINERS—HOUSED Within FRONT & REAR Areas of Item 111 & 112 Cylinderhead BEARING SLEEVE(S)—are to be Precision Finished On Their OUTER Diameter Surface Areas—to Fit "SNUG TIGHT" in their Formed Cylinderhead BEARING SLEEVE'S—Inner Diameter Bore SEAT(S)—type Areas, basically as Drawn of FIG. 112, FIG. 114,-&-FIG. 124, FIG. 126, (Typical)—as well WITH ALL other Numbered Item Areas, just Refer (OSIV' ENGINE (DPL) Parts List:) on SPECS. Pages 32. thru 43. However, (8)Eight 54 BOLT(S) & 55 HOLE(S) for (Front Preload Bearing RETAINER(S) 106 Items) & (Front Cylinderhead BEARING SLEEVE(S) 111 & 112 Item's 116 LIP Seat Areas) & (Front CYLINDERHEAD(S) 119 & 120 Item Areas)—, are Setup in a basic "Degree" Diameter Spacing Fashion—to SECURE THESE "COMPONENTS" TO THEIR FRONT DIAMETER FORMED AREA(S) OF THE "OSIV' BRICK WEDGE (Cylinder Bore) CYLINDERHEAD(S)—and—such is to be Setup Precisely for "Quick Removal & Changing & Adjusting/Secured Setting—and—Many Type Modifications Of "Ultra Fine TUNING" & Testing, on ALL TYPES of Levels of WORLDLY PRO RACING FIELDS of Operations-TO-Basic Street Use Levels Of Operations.

This Concludes the basic Setup towards Forming the "SLEEVES", "RETAINERS", "SEALS", "PRELOAD ROLLER BEARINGS", for the OSIV' VALVESHAFT(S).

The Items & Areas of 54 BOLT(S)/STUD(S) & 55 Bolt HOLE(S)—Areas, are Setup in a Typical Fashion—, 55 Bolt HOLE(S) Areas—are ALL Formed WITH basic CNC DRILL MILL PRESS Machines, & Also Setup to Form/Match (4)FOUR Cylinderhead BOLT HOLES to the Engine BLOCK—Per Piston Cylinder Block BORE (Deck Surface). However, Item 55 Bolt HOLES of FIG. 109, FIG. 115, FIG. 121, FIG. 127, FIG. 132, Shows the Basic Safe MAXIMUM "Closeness" of the Bolt HOLES 55 Area(s) Formed next to the 126 Cylinderhead BORE "Within the Cylinderheads"—as if to use Large THICK Size Item 54 Bolts or Studs. (Typical Safeness As Drawn).

Items 138 Air Cooling FIN(s)—of Top Cylinderhead Areas—are Formed by Basic CNC Mill/Drill Cutting Press Machines—that can CUT STRAIGHT or SNAKE CURVE (Deep or Shallow) type GROOVES Along The TOP Area of CYLINDERHEADS—from FRONT to REAR (typical). However, the TOP MIDDLE/CENTER "FIN" Is "ALIGNED" With Top Dead Center (TDC) (0°) Degree Mark-to also Indicate Center Area of the Cylinderhead—as Shown of FIG. 2, FIG. 3, FIG. 132 TOP Area—and as Shown at a Angle—of FIG. 20 TOP—Basic V8 OSIV' Engine Setup Appearance View. (Which is also Two InLine Four Piston Cylinder Block(S)—basically mated together in V Fashion.)

Item 103 Air HOLE(S) Area(s)—are CAST/FORGED Formed—or—Basic CNC DRILLED with—(Long Reach Drill Bit/Rod)—from FRONT to REAR/REAR to FRONT—"All the way Through" (SAFELY) of Correct Location of FRONT & REAR "FACE AREA" of OSIV' BRICK WEDGE CYLINDERHEADS, Along Horizontal Plane.

This Concludes basic Setup Formation & Explanations of HOW the OSIV' Engine System STAGE TWO (Partial Stage One)—;

"OSIV' BRICK WEDGE (STAR*BURST) CYLINDERHEAD(S)—ASSEMBLY" to Complete basic (H)—CYLINDERHEAD CYLINDER BEARING SLEEVE/LINER(S), CYLINDERHEAD(S), PRELOAD BEARING RETAINER(S), SEAL(S)—MAKING AND FORMING FORMATION OF—The Technique Method & Using—for those Persons or Companies/Manufactures—Who are Professionally SKILLED in the Art of Engine Block "High Performance Cylinderhead(s)" type Manufacturing, "High Performance Cylinder SLEEVE/LINER(S)" type Manufacturing, "High Performance Preload Roller Bearing & Seal(s)" type Manufacturing, by Simply Examining Above Figures & Other-and-Explanations—towards DIAGRAMS and even Further Understanding(s) of "GOOD & BEST WAYS" Towards Professionally Suitably Building and Producing such.

(I)—MULTI-POSITION CHANGEABLE INTAKE MANIFOLD BASE, INTAKE MANIFOLD SUPPORT RUNNER(S)—MAKING AND FORMING FORMATION OF: Item 200 OSIV' Multi Position Changeable INTAKE MANIFOLD BASE type Setup Structure-&-Item(s) 199 OSIV' Intake Manifold Support RUNNER(S) type Setup Structure(s), BOTH are to be Formed by a Specialist In The Art of Professional WELDING or CASTING or FORGE FORMING of "High Performance Intake Manifolds & Cylinderheads"—Manufacturing, Specifically Like those in/on "CHOICE SELECTED COMPANY" section Pages 17.*, 16., 39., 40., 41.,*, Type(s).

QUICK VIEW OF REFERRING;

Referring to FIG. 20, FIG. 21, FIG. 22, (Basic TOP View Areas), FIG. 2, FIG. 5, FIG. 6, (Basic FRONT View Areas), FIG. 8, FIG. 10, (Basic REAR View Areas), (Small Scale Figure)—for those Persons or Companies & Manufactures who are Professionally SKILLED in Such Art—Which Can Easily See How Such OSIV' Engine System "Multi Position Changeable Intake Manifold & Support Runner(s)" STAGE TWO type Setup—is to be Suitably Formed & Professionally & Simply Made.

This OSIV' Engine System Intake Manifold of Multi Position Changeability Technique Method—Is Setup To ALLOW QUICK "Safe" Changes for Different Track Racing Setup for FINE TUNING of OSIV' type Engines or NON OSIV Type Engines—towards Many Different Performances of Particular POWER LEVELS of Operational Usage.

The Unique—Item 200 INTAKE MANIFOLD BASE (Multi Position Changeable "BASE") Item Area—is Formed to be "TURNED" Upside Down-and-Repositioned In Place—to Allow a "Higher Rise" Setup & "Dual (4)Four Barrel Carburetors" or a "Super Charger Blower Unit" Setup effect, towards "High Induction Fuel System Items". However, as Drawn—the Item 200 Manifold "BASE"—(Is In It's LOW RISE Position) and basically Setup for—(2) Two-or-(4)Four "Barrel"—SINGLE type Carburetor or Throttle Body Induction Fuel Systems.

The 200 Manifold "BASE" Item is also Formed to Be "TURNED"—From FRONT to REAR-and-Repositioned In Place—for Different types or Sizes of—"Single (1)Barrel Side Draft Carburetor"—or—"Single (1)Barrel Throttle Body"—Induction Fuel Systems, or "TURNED" Back To Original Position As Drawn On Figures—for Different Types or Sizes of—"OVAL Single (1)Barrel Side Draft Carburetor"/"Single (2)Barrel Side Draft Carburetor"-or-"OVAL Single(1) & (2)Barrel Throttle Body"—Induction Fuel Systems.

The 200 INTAKE MANIFOLD BASE—is Formed To Separate From It's "Two 199 Support RUNNER(S)—Items—as Drawn, and Formed for Two basic 54 BOLT(S)—(FRONT Inner Areas, MID Outer Areas, REAR Inner Areas)—to be Quickly & Safely REMOVED-&-Re-Installed (Suitably) to Allow "OSIV' 200 Multi Position CHANGING of 'BASE'—To Take Place", WITHOUT REMOVING "199 RUNNER(S) Supports", Thus the 199 RUNNER Item(s) are Formed to be Attached & Quickly & Safely REMOVABLE—from OSIV' BRICK WEDGE CYLINDERHEAD(S) 119 & 120 Item's "Intake Port side RUNNER(S) 123 Areas"-to which-are Secured by (2)Two 54 BOLT(S) (FRONT 123 Port RUNNERS/199 RUNNERS—Areas) & (REAR 123 Port RUNNERS/199 RUNNERS—Areas), Per Cylinderhead Intake PORT(S) 123 & Support RUNNER(S) 199—SIDE mate-up bolt/hole AREA(S)—which is suitably Formed to Allow Safe Removal & Installations of "Other Types" of Modified Intake Manifolds—, of "Engine Builders or Racers" OWN CHOICE, (Typical).

The OSIV' Multi Position Change/Intake Manifold 200 BASE & RUNNER(S) Support 199 Item(s)—Should At Least Be Formed Of (A355 to A357—T6 ALUMINUM ALLOY type Materials)—or—"Stainless Steel Forged or Cast Materials"—or—"Nodular Iron type Cast Materials"—or—"Forged High Silicon 4032 Aluminum type Materials"—or—"Professionally Welded Together—BILLET 6061-T6 Aluminum or Forge Steel Alloy type Materials"—of Thick Walled High Strength & Rust Resistance Materials towards ALCOHOL, AV/JET FUEL, & NITRO/NOS, Fuel Induction Type Setup Systems.

However, "STRENGTH & THICKNESS" of Material FORMED STRUCTURE towards 200 "BASE"& 199 "RUNNER(S)" Items—Is Considered "FIRST PRIORITY"—BEFORE Lightness & Custom Porting/Polishing Jobs—Are To Be Done Or Takes Place—BECAUSE; *—(This OSIV' Engine System Technique STRUCTURE—Drawn Design Upper Valley Block Area Of Forming Setup—is a "KEY" Part of SUPPORTING THIS ENGINE'S VALLEY BLOCK "STRENGTH STRUCTURE" Areas—in keeping the V-BLOCK Area's "VALLEY"Together & Rigid—while Helping to Support "Item 29 Middle Valley RADIATOR W/C COOLING CORE UNIT Structure Area"—from High HEAT EXCESSIVE SPREADING/BLOCK FLEXING—Under Ultra High RPM High Heat Temperatures & Harmonic Vibrations of Engine Operations.)

However, if "BASE" 200 Item—is TURNED UPSIDE DOWN, a REAR Corresponding 55 Bolt HOLE is Formed to Match-up WITH Item 206 Electric Fan SHROUD—Top Center 54 BOLT—for proper Securing of Item 206 FAN SHROUD-to-Item 200 "BASE" FRONT or REAR Area(s).

Referring to FIG. 21 & FIG. 22—which is to be Viewed Together—for Further understanding Item 200 INTAKE MANIFOLD BASE & 199 RUNNER SUPPORT(S)—towards Internal Air Passage Ways/Strength Structure/Mate-Up/—Formed Areas. However, FIG. 21 (Basic SHADED View)—Focuses Only On "TOP MID VALLEY" OSIV' 200 "BASE"-&-199 "RUNNER" SUPPORT(S)—Setup Technique & Item 58 Shim "GASKETS"—for Proper Forming & Producing.

Item 58 Shim GASKET(S)—Separates Item 200 BASE-from-Item 199 RUNNER(S)-and-(2)Two Smaller Individual "58 Shim GASKETS"& Separates "199 Support RUNNER(S)" from OSIV' Cylinderhead(s) 119 & 120—Intake Port side 123 RUNNERS, which is Shown of FIG. 6—in-which 199 RUNNER(S) are Formed WITH a suitable 92 LIP Area—at Lower Inner Edge Area—to Help "Support" Item 200 INTAKE MANIFOLD BASE—As Drawn, Thus the 'Term' "RUNNER Supports" is also Implied as Conceived, also of This OSIV' Engine System Technique Item Method Use.

QUICK VIEW REFERRING; Concluded.

ULTRA HIGH POWER/VERY HIGH EFFICIENCY & FUEL USE SEEKING;

Because of the Very High Efficiency SEEKING—towards "High & Ultra High POWER OUTPUT" Rates of Entire OSIV' Engine & System Design Setup, Forming & Making "THIS" type of Engine (Correctly Suitable)—Allows for "Compact Lowest Rise Profile" Design Forming—of Upper BLOCK Valley "OSIV' 200 INTAKE MANIFOLD BASE" & "199 RUNNER(S) SUPPORT(S)"—TYPES—*With Using "LESS MATERIAL"& "Much LESS METAL FORMING MATERIAL AREA SPACE"—than basic NON OSIV Engines & NON type Positional Changeable Intake Manifolds (Shown on "CHOICE SELECTED COMPANY" section Page 17.*.) Which are "Higher Riser Types" which are usually installed on "Unnecessary Oversize Big/Monster Cubic Inch Engine BLOCKS" Just to make NON-Fuel Efficient Average High Power for such Engines, though Intake Manifolds—that might Barely FIT WITH Large & Small type Carburetors—On a basic V8 Engine under Standard Racing Stock Car Hoods (Without the Air-Filter/Cleaner Unit).

SIMPLE COMPARISON;:

As the (875 HP 719 FT/LBS.)—Graph Chart Claims—(though is a highly respected Company here in California—as I've always believes), and as a OSIV' Engine System "Quick Example Comparison" on This Company's Graph—of Their "Oversize Extra Large Big BLOCK Engine" of (540 Cubic Inch Displacement (C.I.D.) Engine etc.). Forming or Building or Producing—Same Size "Oversize Extra Large Big BLOCK Engine" of (540 Cubic Inch Displacement (C.I.D.) OSIV' Engine etc.), at 7000 RPM (While Using Less Fuel)—OSIV' ENGINE(S) Would Deliver (975 HP @ 7000-RPM & 819 FT/LBS @ 6000-RPM) Operations. (Its Just A Typical Graph) However, where Company's Graph Engine Setup Starts "Loosing/Dropping Torque & Horse Power" & "Using Excessive Fuel Beyond 6000 RPM", the OSIV' ENGINE & SYSTEM is "Of The Design Setup To CONTINUE GAINING & INCREASING Torque & Horse Power—WHILE—NOT Using Excessive Fuel Beyond 6500 RPM—7000 RPM—7500 RPM etc.", as well as for HP (Horse Power) & RPM Gains "Beyond 8000+(RPM)/9000+(RPM)/10,000+(RPM)"—and—"ABOVE DELIVER ABILITY".

When OSIV' Engines are Developed and Produced WITH "The Best Performance Mode(s) Of Professional Ultra Level Of Racing Engine Building Intentions In Mind", the OSIV' Engine System STAGE TWO Setup WITH It's "Multi Position Changeable Intake Manifold BASE 200 Item" & "Port-RUNNER(S) Supports 199 Item(s)", 15,000+(RPM) to 18,000+(RPM)—is Very Achieve-able—(Depending Only On How Strong Crankshaft Rotating or Reciprocating Rod/Piston Assembly/Kits—Are Well Developed & Can Withstand)—"With No Major Strain On OSIV' Engines"—UNLIKE Camshaft/Poppet Valve & Spring Engines. (Simple Comparison Concluded).

THE REASONS WHY OSIV' Engine System Boast Claims—of producing such "Highly Efficient Power Output"—for a "Internal Combustion Type Engine", is simple because—I as the Inventor/Designer—Knows that "Conventional Old Style Camshaft & Poppet Valve/Valvespring Engine Setups"—"ROB" or "STEAL" and "STRAINS" Highly Fuel Efficient/High Power Output of the Internal "Combustion Ball Of FIRE/FLAME" of such Old Style Engines. The main result is "Non-Efficient and Excessive Unnecessary Fuel Usage and Oil Wasting & Burning". Basically because the Average Racing type VALVESPRING CAMSHAFT ENGINE—Has To COMPRESS the Valve's "SPRING"—about (0.600" inches or ⅝" inches)—(PER One Spring!), and that One Single "Valvespring"—takes about (400 to 450 "POUNDS of Force" to be Compressed)—which the "Internal Combustion FIRE BALL"—MUST DO, (by Pushing or Moving PISTON—via CONNECTION ROD—via CRANKSHAFT—via TIMING CHAIN/BELT—via CAMSHAFT with or without Lifters/Push Rods/Rocker Arms/—before Valvespring is Starting to be Compressed). For V6 & V8 Engines WITH "Two Valve & Spring(s) (SET) Per PISTON & CYLINDER BORE, the POUNDS OF FORCE Holding Back The "Internal Combustion Ball Of FIRE"—IS GREATLY DOUBLED—as Equaling About (800 to 900 Pounds Of Force)—to which in simple Terms/Means—the "Combustion Ball of Fire" needs (Excessively MORE Air/Fuel Averages) to Move that Unnecessary Extra Applied 800–900 Pounds of Force—to do It's Job of Moving & Pushing the PISTON—(Turn or Rotate Crankshaft) WITH that Valve "SPRING" Pressure Pounds Of Force Applied, Thus "NEEDS" OF; (Excessively More Air), (Excessively More Higher Compression Ratio Pistons), (Excessively More Higher Octane/Fuel Rate Levels), (Excessively More Larger Air/Fuel Mixturing Carburetors/Injectors), (Excessively More Hotter Ignition Spark & Amps/Voltage), "All To Work From"—(Excessively More Larger & Higher RISE—Low Profile Ram Air Type—Port RUNNERS Intake Manifolds—Like Company's Advertisement Shows), to Only Develop Typical Big Block Power of (800–875 Horse Power Rating at 7000 RPM) & (700–719 Foot Pounds of Torque Power Rating at 6000 RPM)—from a (Oversized Extra Large Big Block V8-540 Cubic Inch Displacement C.I.D., Big Block "B/B" Engine Setup), (a medium big block NASCAR Winston Cup V8 350 C.I.D. Engine Setup—can do that—& Are Known of Developing 850 HP 750 FT/LBS.), WHERE AS—the OSIV' Engine & System—DO NOT HAVE SUCH (Over Combined Excessive "ABOVE" Burdens)—PLACED UPON THE "Combustion Fire BALL Flame"—by OSIV' Engine DESIGN & System Setup. Thus the Lowest/Lightest/Smallest/-OSIV' Engine's Riser Profile MULTI POSITION CHANGEABLE INTAKE MANIFOLD BASE 200 Item & Smallest/Shortest/-199 RUNNER(S) Support Technique—is all that's basically Needed & Conceived, which is basically Formed towards—Suitable Needs Of This "Highly Efficient High Power Output OSIV' ENGINE & System.

The "Internal Combustion" IGNITING/EXPLOSION/BURNING BALL OF FIRE/FLAME/—of the OSIV' Engine System—DOES NOT HAVE TO WORK/EXPLODE SO OVERLY EXCESSIVELY HARD—to Push or Move the "PISTON(S)", Technically because of "NO VALVE SPRING(S)"—Thus No (Excessive 800 to 900 Extra Pounds of Force) Is Unnecessarily Being Placed UPON/AGAINST "Combustion/Explosion".

This is "Why" the OSIV' Engine & System and I as the Inventor/Designer—can "BOAST" such Claim(s) & "WHERE/HOW" this Highly Efficient High Power Output "Achieveable Gain" Is Mostly Coming From—, Of A OSIV' Type Internal Combustion/Piston Racing type Engine, WITHOUT Valve/Spring/Camshaft—Problems & WITHOUT "Valvetrain" Major STRAIN Upon Engine During High (RPM) Engine Running Operations Which Still Causes Drastic Failures To This Day.

To Realize The Valve/Spring/Camshaft Old Style Design—Setup Problems—(Especially Circle Oval Track Racing) Like "National Association for Stock Car Auto Racing" ("NASCAR" SERIES EVENTS)—which also create Non-High Efficient Internal Combustion Power Output Problems—Which is "NO SECRET", if to Consider One Of The Wisest NASCAR WINSTON CUP SERIES "CAR & Engine Builder(s)" (R. Childress, R. Hendrick, R. Yates) as of 2002, these Cars Average About (2½ to 3½ MPG) Miles Per Gallon of Race Fuel—On A GOOD High Speed Racing Day at the Big Oval Tracks. However, They Basically RUN a Medium Size Big Block (350 to 360 C.I.D.) up to about 8000–9000 RPM and Braking Valve "Springs" is Not Uncommon—or even other Engine Parts. However, the basics MUST BE READ to fully see "WHERE" the OSIV' Engine System MIND-SET thinking level is at;

By Reading "CHOICE SELECTED COMPANY" section Pages 42., 43., 44., 45.,(*)—and Underlined Highlight Areas for Quick Notations Of Referring Problems—which the OSIV' Engine & System CAN NEVER BASICALLY HAVE—, as being as Internal Combustion Piston Engine.

Now After Reviewing those Above "CHOICE SELECTED COMPANY" section Pages, to which brings the Conclusion Though Process Back Towards The Basic Reason-WHY-OSIV' Engine(s) & a Lowest "LOWRISE PROFILE" Induction Intake Manifold Setup—of Small Size Is All That's Practically Needed—, & To Form This New OSIV' Engine Item 200 Multi Position Changeable INTAKE MANIFOLD "BASE"& Items 199, RUNNER(S) Supports. Thus of the Formation Design Setup—"Is To Be Quick Removable & Installing—, (Though To Be Safe & Simple Minded).

The "ULTRA HIGH POWER/VERY HIGH EFFICIENCY & FUEL USE SEEKING", Also Involves (J)—

INTERNAL AIR COOLING—STAGE TWO OSIV' ENGINE SETUP SYSTEM:—(Techniques & Methods of Paragraphs). ULTRA HIGH POWER/VERY HIGH EFFICIENCY & FUEL USE SEEKING is (Partially Concluded).

However, FIG. 21 & FIG. 22, the 123 Intake Portside Area—which Mates WITH Item 58 Shim GASKET & 199 RUNNER(S) Supports—Area—is Drawn to Show the "MAXIMUM THINNESS" of these Formed Made—Cast or Forged—type Area "WALL", WHICH are to be Formed Abit More "THICKER". View FIG. 20 with FIG. 21 & FIG. 22, and its simple to See that the TOP Area(s) are Drawn as Being Cut Away from Items 200 & 199,—though FIG. 20 is of (Small Smaller Scale) than the others. FIG. 22 Points out All Other Basic Item Numbered Formed Areas of the OSIV' Engine Upper BLOCK Valley TOP View. The (OSIV' Engine (DPL) Description Parts List:—SPECS. PAGES 32. thru 43.), Should Always be Referred to, Especially for Quick Viewing Of Items or Areas—For Quicker Understanding of NEEDS.

This Concludes the basic Setup Formation & Explanations of How the OSIV' Engine System STAGE TWO "OSIV' Multi Position Changeable INTAKE MANIFOLD 'BASE' with intake manifold SUPPORT RUNNER(S)—ASSEMBLY" to Complete basic (I)—MULTI-POSITION CHANGEABLE INTAKE MANIFOLD BASE, INTAKE MANIFOLD SUPPORT RUNNER(S)—MAKING AND FORMING FORMATION OF—The Technique Method & Using—for those Persons or Companies/Manufactures—Who are Professionally SKILLED—in the Art of Engine Block "High Performance Intake Manifold(s)" type Manufacturing —and—"High Performance Cylinderhead(s)" type Manufacturing, by simply Examining Above Figures & Others—and—Explanations towards Further Understanding—towards Professionally—Suitably Building and Producing such.

(J)—INTERNAL AIR: COOLING—STAGE TWO OSIV' ENGINE SETUP SYSTEM—REAR & FRONT BLOCK VALLEY ITEM(S)—MAKING AND FORMING FORMATION OF:

Item(S) 197 Fresh Air Outlet Manifold PIPE(A)—RIGHT Valley BANK REAR-Area, —and—Item 198 Fresh Air Outlet Manifold PIPE(B)—LEFT Valley BANK REAR-Area, —and—Item 209 Fresh Air Inlet Manifold—FRONT Upper BLOCK Valley-Area, —and—Item 209F Fresh Air Inlet FILTER (Accessory)-Area,;

Should be Formed by a Suitable Company/Manufacture—in the Art of Professional Type "Air FILTERS & Air Filter CLEANER HOUSING UNITS"—Making & Custom Forming—for "High Performance Racing Engines"—type Manufacturing Companies like those On "CHOICE SELECTED COMPANY" section Page 3.*→, (***),—or—"Oil & Air FILTERS"—type Manufacture On "CHOICE SELECTED COMPANY" section Page 25.*→. While Referring to FIG. 1, FIG. 4—(FRONT Views),—and—FIG. 8, FIG. 9—(REAR Views),—and—FIG. 20, FIG. 22—(TOP Views),—For Quick Basic View Setup Structure Areas—, for those Persons & Company Manufactures—Professionally SKILLED in Such Art—that can Easily See HOW such OSIV' 197 Fresh Air Outlet Manifold PIPE(A) & 198 Fresh Air Outlet Manifold PIPE (B) & 209 Fresh Air Inlet Manifold & 209F Fresh Air Inlet FILTER, STAGE TWO Setup—(& can be a Optional Stage ONE Setup, With Modification Work Done)—, is to be Suitably Professionally Custom Formed & SAFE/SIMPLY Made (which are typical).

Item 209 Fresh Air Inlet Manifold—Item Areas (FRONT Upper BLOCK Valley Area)—is to be Formed From A Fairly "THICK" Cast or Forged & Welded—Stainless Type STEEL—which WILL NOT FLEX—NOR—BEND Excessively Under High Heat & (255+ MPH Mile Per Hour HOT Wind Type Pressures—or Suitable)—because Item 209 INLET Mani.(Manifold) is "Designed Positioned"—In High Wind Pressure "AIR FLOW STREAM" Area of FRONT Engine BLOCK Upper Valley (Open Space Area), as Figures Show. It Should Also Be Formed STRONG & THICK Enough To Support Basic Type Mounting "BRACKETS"& "DRILL THREADED FORMED BOLT HOLES"—that are suitable for Helping to Secure Any "ACCESSORIES", like a (HPV—Ignition Coil Base or Bracket Setup On "TOP Area"—like On "CHOICE SELECTED COMPANY" section Pages 20.←*, 21.*→; Fuel PUMPS—Page 22. *→; A/C & ATL. BRACKETS—Pages 23., 24.,*→—"When Necessary".

This Front Fresh Air Inlet 209 MANIFOLD Item—is also to be Structured Formed to Help Prevent—FRONT Upper Valley BLOCK & PISTON CYLINDER BANKS & FRONT CYLINDERHEADS Areas—From "FLEXING OUTWARDS"—by Suitable Made 54 BOLT(S) which Secures & Locks "IT"tightly to Each Cylinderhead(s) 119 & 120 Item's Front Area Intake Portside 123 (SAFE TYPE) Area—as Drawn in Above Figures.

The Item 209 Inlet MANIFOLD—97 Internal Fresh Air PASSAGE Way Area—is to be Formed to Mate-up WITH Area 139 Fresh Air Inlet PORT(S) (Front Area) of Item(s) 119 & 120 Cylinderhead's Front 123 Area (Typical Safe Areas).

The LARGE OVAL SHAPE—Middle Formed Area of Item 209 Fresh Air Inlet Manifold—Type, is to be Formed Thick & Strong Enough To HOUSE—Suitable Formed Item 177S (Tight Woven) "Stainless Steel type MESH SCREEN LINING"—that's (EPOXY) GLUED IN—in Inner Diameter Surface Area "Completely"—to Help Prevent "Excessive"—WATER MOISTURE & DIRTY AIR PARTICLES—from entering Area 97 Internal PASSAGE, Thus which OVAL SHAPE 209 Area—is also to be Formed to HOUSE A "Custom Fitted" & "Custom Made" (Tight Fitting) High Performance Type "AIR FILTER"—Specifically by a Professional Manufacture like on "CHOICE SELECTED COMPANY" section Pages 3.←*→, 25. *→, (a Small Sketch of BOTH suitable Items of OSIV' FILTER 209F Item, and the Fresh Air Inlet MANIFOLD 209 Item, Setup type SHAPE is provided on Page 3. (***), for those Companies who can Professionally Make & Produce such.)

As Referring Back to FIG. 4-and-FIG. 20, a suitable Formed Area 107PH Oval/Oblong type PASSAGE HOLE—is Formed at the TOP Center Area of Item 209 Fresh Air Inlet MANIFOLD—and Fitted WITH a "Solid"Tight Fitting Item 107G GROMMET Neoprene Rubberized Type SEAL Material.

This 107PH HOLE-Area—is basically used when a Stock Carburetor & Large Top Mount "Air CLEANER UNIT" is Used—to which a basic Formed Stainless Steel TUBE is Hooked-Up to Air Cleaner UNIT (basic or Cowl Induction Type) and Safely Routed & Fitted to 107PH HOLE Area (Prior Removal of Item 107G GROMMET). In this Type Of Setup, TWO basic Formed 201 Block Off PLATE(S) Items—are used to block off FRONT & REAR sides of Item 209 Fresh Air Inlet MANIFOLD—"LARGE Formed OVAL SHAPE" Open Areas—using the Item 209F FILTER'S "LIP 92 Areas as "Ready Made Seal(s)" for Position Mate-up Area, as FIG. 15 TOP/SIDE Area View—That's Partially Shown. TWO Item(s) of 54 BOLT(S) Locations On FRONT 209 Fresh Air Inlet MANIFOLD & TWO Item(s) of 54

BOLT(S) Locations on REAR 209 Fresh Air Inlet MANIFOLD—are suitable Areas to Secure Item(s) 201 Front & Rear BLOCK OFF PLATE(S) (Not Drawn). Though Item(s) 54 BOLT(S) Heads are Drawn as On FIG. 1, FIG. 20, FIG. 21, FIG. 22, On 209 Item.

*This Setup of the OSIV' Engine System STAGE TWO—Technique Method—of DUAL Item(s) 201 Block Off PATES on Item 209 Fresh Air Inlet MANIFOLD & Item 209F Air FILTER, WITH A Formed HOLE Passage In Item 107G GROMMET (Without Removing It From 209 Fresh Air Inlet Manifold), & WITH Epoxy Secured Item 177S Tight Woven Mesh SCREEN—type Lining, WITH a suitable TUBE "Linked" to Air CLEANER of Carburetor-or-Injector Throttle Body—Items, "To Which is Especially considered for Marine Use—Water Craft Use & Wet/Cold Weather—and—Dirt/Dusty Desert/Off Track Off Road Pavement Use", to give Extra Help towards Preventing Excessive Moisture/Salt Moisture/Dirty Particles etc.—from Entering Into OSIV' Engine(s).

*This also Coincides WITH THE—OSIV' Fresh Air Internal Combustion Chamber VALVESHAFT"Cooling System" Technique—, is basically Designed & Setup towards "Ultra High Performance Efficient" Power Producing Engine Operations. By doing this, this "OSIV' Fresh Air Internal Combustion Chamber Cooling" type System—"Allows COLD to COOL to WARM AIR—to Always & Continually—Interring Combustion Chamber(s)", of a Internal Combustion Piston type Engine—WITH OSIV' type STAGE TWO Setups.

This basically Helps to keep Combustion Chamber & Piston Top Area & Block Cylinder Bore Top Area—"Ultra High RPM Heat Temperature—DOWN or LOWER" than what the Average Best Racing Internal Combustion Camshaft & Poppet Valve/Spring type Engine built Produces—or—can do toward such Internal Combustion Chamber/Piston/Bore/—"AREAS", BECAUSE:

(FIRST factual reason of WHY); "No Poppet-Stem VALVES nor VALVESPRING Assemblies".

(SECOND factual reason of WHY); "Poppet-Stem Valves & Valvesprings Assemblies—HOLDS Tremendous HEAT within Combustion Chamber & Boils Oil Under Valve Covers, Especially those EXHAUST VALVES & VALVESPRINGS".

(THIRD factual reason of WHY); "Pop/Valves—are Seated In Combustion Chamber & Upper Piston Cylinder Block TOP BORE Areas, Which make these areas STAY Extremely HOT".

(FOURTH factual reason of WHY); "Pop/Valves ARE PUSHED/POPPED Into the Middle of Combustion Chamber—towards Block Cylinder Deck Bores—which Continuously FORCES the Tremendous HEAT—Unnecessarily & Excessively—Into Piston's TOP DOME Area & Radiates outwards to Cylinder Bore Top Wall Surface Area, Continuously Keeping Internal Combustion (After Burnt) 'High HEAT' IN SUCH Areas—at Higher Heat 'LEVEL RANGES'—over Excessively & Unnecessarily".

(FIFTH factual reason of WHY); "The OSIV'—Osband Super Inductionexhaustion Valveshaft' & Engine System Invention (OSIV' Engine System)—DO NOT & IS NOT a Poppet-Stem Valve & Valvespring/Camshaft & Cylinderhead Combustion Chamber of Conventional Old Style type Assemblies—Engine Setup Systems". Thus is basically Concluded.

Though "OVERALL" Cylinderhead(s) Ultra High Heat Temperature of about (1600° F. "Degrees" in Combustion Chambers) & Entire Engine Operating High Heat Temperature LEVEL RANGE—will be Much Lower—at about (1000° F. "Degrees" in Combustion Chamber—"Surrounding Surface Area") & Entire Engine Operating High Heat Temperature LEVEL RANGE—will be between (100° F. to 200° F. "Degrees" Normal/Warm)—(200° F. to 300° F. "Degrees" Racing/Warm to Hot)—(300° F. to 400° F. "Degrees"Abnormal/Hot)—Setups established for Radiator & Engine Block Water/Coolant Jacket Passages of Coolant temperatures—"GAUGES", for OSIV' Engine System—thus Heat Temperatures will be Lower for OSIV' Engine System Operations—than The Best/Better Built Racing type Conventional Valve/Sprig/Camshaft/—Internal Combustion/Piston Engine (of Gas/Race Fuel/Air Mixture Type), though "HYDROGEN CONVERSION" for One Engine—can also be "Conversioned Better" to Another, like the OSIV' Engine.

However, for "Racing World Engines Of Internal Combustion/Piston Setups", running between (8000 to 10,000 RPM up to 16,000 RPM)—on Big Oval Tracks like INDY/Indianapolis, DAYTONA, TALLADEGA, and others, for (400/500/600 MILES)—Averaging (2.0 to 2.5 MPG/Fuel Usage) "Without Using Excessive Fuel"—and "Small to Mid(Medium Size Big Blocks)—250 to 300 to 360 Cubic Inch Displacement (C.I.D.) V6/V8 Indy Style/Nascar Winston Cup Style/—Engines of Allowable Setup Types, WITHOUT BLOWING THE ENGINE UP (as a whole) Would be extremely costly and close to impossible, WITHOUT Valvetrain Replacement & Rebuild. Whereas, the OSIV' Engine & System—WITH Same Size V6/V8 (C.I.D. Engine) and Team/Indy or Nascar Winston Cup "CHASSIS" etc. complete type Setups & Running Between (5000 to 10,000+ RPM up to 18,000+ RPM)—WOULD NOT BE UNCOMMON FOR "OSIV' Engine(s)", But DOING SUCH much more Efficiently WITHOUT "Using Excessive Fuel"—Running 300/400/500/600/700/800/900/1000+/- MILES & "BEYOND" Averaging A Respectable (5.5 to 6.5 MPG/Fuel Usage) Depending On Transmission (number of Gears/Ratios & Rear Axle Gearing Setup Ratios/Tire Size etc.), Though At A Much LESSOR COST & WITHOUT blowing up & Rebuilding after every Single Race, By Using OSIV' ENGINES—"If Built Professionally & Given Professional Realistic Opportunities.

Such Other Reason Why—such High Power "High Efficient" RPM Operation & OSIV' Engine DURABILITY—Is Possible, is because of the OSIV' Engine SYSTEM & DESIGN—and—It's OSIV' "Fresh Air Internal Combustion Chamber" Valveshaft "Cooling System" Technique Setup. However;

(EXAMPLE REASON FACTOR)—"Racing"—When a INDY or NASCAR type(s) of Setup Engine is Racing many other Engines (in cars) around the Track and Along the Straight Away(s)—in "Warm to Hot Heat Air Drafting—Close Bumper to Bumper Position" at "Wide Open Throttle"—of Carburetor/Injector Throttle Body position, (30 to 40 Engines/Cars) racing, More & Higher "Heat Air Draft Temperatures" is produced by the Engine(s) behind the Car that's in front of it. Here, the OSIV' System of "Thought Awareness"—is that—by the time This "Heated Air Draft Flow (say 120° F.)"—joined WITH "Air Flow Fuel Mixture (say Normally 50° to 70° F. of the "Front Leading Car") "—enters those Poppet Valvestem & Valvehead Diameter Area type—Combustion Chamber type Engine Areas, this Preheated "Heated Air Flow Fuel Mixtures"—is Now "HOT VAPORIZED AIR/FUEL MIXTURE", (in essence—the Air/Fuel mixture is About 30% to 40% Pre-burnt Used Up—before it's compressed by Hot Piston & before being Ignited—thus impossible to produce a real/true "High Power—Highly Fuel Efficient Combustion" power output engine), especially even at 7500 to 8500 RPM @ (180+ MPH Speeds). There is NO Setup Way to Setup "Internal Combustion Chamber Cooling", to Cool Chambers & TOP Piston Dome—nor—Top Cylinder Bore-Area(s)—of These "Poppet Stem Valves & Valvesprings Assembly Design type Engines"—, Like the OSIV' System-Engine CAN. Now when Cars come to the TURN/CORNER of the Track, the Carburetor's or Throttle Body's 'Throttle Blade' is CLOSED—or—"Semi Closed Throttle Position", those types of Internal Combustion Camshaft Pop-Valve & Spring Engines (at this point) are Receiving "NO INTERNAL CHAMBER/PISTON COOLING"—Nor Air—Nor Heated Air/Fuel Mixture—While the Combustion Chambers/Pistons & Upper Internal Bore Wall Areas—are Extremely Hot. This is when—"Piston/Cylinder Bore FLEX Occurs & Metal Fatigue is in Serious Friction Play—toward many Internal Block Areas—until "Throttle BLADE position is back at WIDE OPEN position".

The OSIV' System "Thought Of Awareness" HERE, is that—the Crankshaft/Rods/Pistons/Assembly—is moving so Very Very Fast when "Throttle Is CLOSED/SEMI CLOSED Position" (During Deceleration Of Engine RPM-winding down), the PISTONS BECOME A "High Heat Friction & Suction PUMP"—(while the engine is reving down from 9000 RPM to 6000 RPM)—the Pistons Have NO Where To Suck In Air To BREATH—except from "Exhaust Pop-VALVE—Intense Highly Heated Combustion Chamber Area" (which Pistons—So Does Do), SUCKING BOTH POPPET VALVES OFF & FROM THEIR VALVESEATS—Sucking In Hot Heat Burnt Gases & Pre-Heated Hot Intake Manifold Vapor Gases, (to which I Inventor/Designer-FIRST DISCOVERED To Call *"De'Acceleration VALVEFLOAT"*) . . . , Though Sucking Most High Heat from "Exhaust Chamber Passage(s)"—at the same time Intake Pop-Valve is Sucked Open—While Throttle Blade Is Closed, & then Compressing such High Heat when BOTH Pop-Valve(s) are Closed, & then Pushing Some High Heat Out of Cylinder Bore & Combustion Chamber (During Exhaust Valve OPEN—Crankshaft Stroke Rotation Cycle/Exhaust Camshaft Lobe Lift OPEN Rotation Cycle), though All of which—is Like a Human/Person—trying to run a Mile Track Olympic Race—while carrying a (6¾"×2¹⁵⁄₁₆" tall & diameter Tupperware Cup or Aluminum Can Cup) & putting this Cup Quickly & Snugly over your Mouth & Chin—Before each Corner/Turn of the Track—and—Continue running "WITHOUT" Breathing through your Nose—and—then taking Cup off Mouth & Chin at the Beginning of each Straight Away. Continue such for One or Two Miles, & Believe This—"The Internal Human Body & Brain WILL NOT LIKE SUCH"—and—neither does a Internal Combustion Engine.

However, "The Metal Fatigue Effect" of Piston & Block Cylinder Bore—under Intense Hot High Heat—is like putting that same Cup Tightly back over your Chin & Mouth—Holding Cup Firmly While trying to take Deep Long Breaths WITHOUT Breathing through your Nose—& While Feeling and Realizing the amount(s) of the "FLEXING & FATIGUING" of the "Cylinder Shape WALLS of the Cup" is what the Block Cylinder Bore WALL Does. (Now Warming up the Cup & doing Such—, A Big Increase In "FLEX" is Realized), (Heating Up the Cup to be "Hot" & Doing Such—A Big Serious Increase In "FLEX" is Realized). A fairly knowledgeable Person can quickly realize (that with Metal to Metal), this "FLEXING" would NOT be good for Piston(s)—that has to travel Up & Down in such Flexing Cylinder Cup or Block Cylinder Bore, though Increased High Heat Friction—is the Effect that WILL BE Created & such is NOT good. Thus Old Style Camshaft/Pop-Valve/Valvespring Setup—Promotes "NON-Efficient Internal Engine Metal Fatiguing & Unnecessary High Heat Friction Wearing". This Concludes—Such other Reason Why—/(EXAMPLE REASON FACTOR)—.

*PREVENTION; The OSIV' Engine System's "Fresh Air Internal Combustion Chamber & Internal VALVESHAFT 'Cooling System' Technique"—Helps towards Preventing this type of Excessive "Non-Efficient Internal Engine Metal Fatiguing" & "The 30% to 40% of Pre-burnt Heated Vaporized Air Flow Fuel Mixture", Thus Creating A Real True "High Power Output/Highly Efficient Combustion"—Internal Combustion Power Producing Type Engine of "OSIV'" Operation(s). Simply by ALLOWING FRESH AIR INTO COMBUSTION CHAMBER 127 Area(s) of FIG. 109-and-FIG. 121 (of OSIV' Brick Wedge Cylinderhead(s)), When "THROTTLE BLADE" is at SEMI CLOSED & CLOSED Position—or—at WIDE OPEN THROTTLE Position.

Since the Problem is at "Semi Closed & Closed Position"—During High RPM "DE'ACCELERATION VALVEFLOAT", the OSIV' STAGE TWO System Setup Cures Such . . . —, by Drawing/Sucking Fresh Air through It's FRONT Formed "102 Turbine FAN/FIN(S) Areas—at the Same Time During Piston & Crankshaft's Intake Cycle STROKE—which Such Air Through Area(s) "100 INTake VALVE Wedge Cutout Pocket"—through Area(s) 97 Internal Fresh Air PASSAGE—Hole Formed Area(s) at the BOTTOM of 100 INTake VALVE POCKET Area, which "FILLS" the Block Cylinder BORE WITH Fresh Air—by the TIME the Crankshaft's "Throw Arm PIN Bearing Journal 64 Item Atea "Reaches BOTTOM DEAD CENTER (BDC)" of Rotation of Crankstroke, then the VALVESHAFT(S) Rotates & CLOSES OFF "100 INTake VALVE'Pocket"& "128 Intake Inlet Combustion Chamber (IICC) Formed POCKET Passage Way—Area"—and—then the Piston(s) Compresses the Fresh Air during Upward Crankstroke to (TDC)—(which is the Internal Combustion Chamber/Top Piston Dome/Top Block Cylinder Bore/—"COMPRESSED COOLING PROCESS"), Keeping Cylinder Bore Wall Straighter & Much LESS HOTTER than Old Style Motors,—and—then the Piston & Crankshaft Rotates back Down to (BDC) "Collecting High Heat"—while—VALVESHAFT(S) Rotates & Begins to OPEN "129 EXHaust—Outlet Combustion Chamber (EOCC) Formed POCKET Passage Way—Area"—and—Then this "Collected High Heated Compressed AIR"—Is Pushed Out Of Block Cylinder BORE & Cylinderhead's Combustion Chamber(s)—Through "129 EXHaust/Chamber POCKET" & VALVESHAFT'S "100 EXHaust VALVE Wedge Cutout Pocket" Area(s), Out Through Cylinderhead's "124 Exhaust Port side RUNNER(S) Formed Area(s)" & Item(s) "124MR & 124ML Exhaust MANIFOLD/HEADER(S) Areas"—Into The Atmosphere—To Complete THIS PROCESS. The OSIV' Engine System's "Fresh Air Internal Combustion Chamber & Internal VALVESHAFT 'Cooling System' Technique"—THUS INVENTED & CONCLUDED.

Though towards Human/Person Feeling(s)—, Its basically like putting that same Cup over your Mouth & Chin—that has the Bottom Cut Off of the Cup—&—Placing your Hand/Palm over the Bottom Open Area of Cup—"Firmly"—then taking Long Deep Breath through your Nose—then Pinch your Nose Closed WITH One Hand/Fingers—&—Blow Air Into the Cup to make it "EXPAND"—Without letting Excessive Air Escape from PALM—&—then Release your NOSE and take One Deep Breath Through your NOSE—&—Pinch your Nose Closed—While—Blowing Air Into the Cup—&—"Allow" Lots of Air to Escape from the Bottom of the Cup & Palm/Hand Area—By Slightly TILTING your Hand. Towards a Human/Person feeling(s)—as a point of view—That's basically HOW The OSIV' Engine System's "Fresh Air Internal Combustion Chamber & Internal VALVESHAFT 'Cooling System' Technique"—Works & Somewhat Would Feel Like If YOURSELF was such a OSIV' Engine(s), "Though at a Much Much FASTER RATE, about as Quick Of A Process As The "Engine's RPM CYCLE of Operation"—As Fast As (5000 to 7000 RPPM (RePetitions Per Minute)), Thus *PREVENTION;—Is Concluded.

Item(s) 197 Fresh Air Outlet Manifold PIPE(A)-&-198 Fresh Air Outlet Manifold PIPE(B), Structure Areas of FIG. 8, FIG. 9, (REAR View), FIG. 20, FIG. 21 & FIG. 22, (TOP Block VALLEY Views)—of Item(s)—Are to be Suitably Formed—the Same Way as their Sister Item "(Front) 209 Fresh Air Inlet Manifold"—Forming Process or Welding Processes—, though Different Downward Angle PIPE(S) are suitably Shaped/Formed—as Drawings Show, (Typical).

These Fresh Air Outlet Manifold PIPES—are Formed & Positioned Suitable enough to ROUTE Fresh Air from Cylinderhead's REAR Valley Intake Portside "123 Area(s)—140 Fresh Air Outlet PORT-Formed Passage Area(s)"—to "11RA Raised Area of (REAR) Engine Block Casing Valley Base Bulkhead Area (DECK)"—into "17 & 18 Air To Oil VERTICAL Passage—Area Holes. The PIPE'S End Areas—are Formed WITH Suitable Length Cylinder TUBE Shapes—which can At Lease Be—Heavy Hand Pressure FITTED—WITH "SEALANT"—Tightly Snug Down Into 17 & 18 Passage HOLES as Above Figures suitably Shows. "Gasket Maker" on the "CHOICE SELECTED COMPANY" section Page 24.*→, is suitable for all types of basic typical areas which Need "Sealing" properly—of typical Mate-up "Surfaces". (Especially by particular 54 BOLTS & 55 HOLE for Bolt's type Areas).

This Concludes the Basic Setup Formation & Explanations of HOW the OSIV' Engine System Stage TWO (Internal Air Cooling)—"Fresh Air Internal Combustion Chamber & Internal VALVESHAFT 'Cooling System' Technique"—"209 Fresh Air Inlet Manifold/177S SCREEN/107G GROMMET/209F FILTER/201 Block Off PLATE(S)/—Assembly —and—197 & 198 Fresh Air Outlet Manifold PIPE(S)—ASSEMBLY" to Complete Basic (J)—INTERNAL AIR COOLING—STAGE TWO OSIV' ENGINE SETUP SYSTEM—REAR & FRONT BLOCK VALLEY ITEM(S)—MAKING AND FORMING FORMATION OF:—The Technique Method & Using—for those Professional Manufactures in the Art of "High Performance Air Filter & Air Cleaner Housing Units & Oil Filter"—making, by simply Examining All Above Figures & Explanations—towards Further Understanding—towards Professionally—Suitably Building and Producing such.

*(K)—OSIV' (R.G./RG.TDOP.SUCH.)—ROLLER GEAR—TIMING DRIVE OIL PUMP—SYSTEM UNIT CASE HOUSING—MAKING AND FORMING FORMATION OF:

Item(s) "147 OSIV' RG.TDOP.SUCH." & Internal Component Items & Areas/Unit—ASSEMBLY —and—"OSIV' RG.TDOP.SUCH. Pulley Drive Gear(s)" Item "147PDGA (for Valveshaft 95(A))—RIGHT Engine Bank Cylinderhead 119,-&-Item 147PDGB (for Valveshaft 96(B))—LEFT Engine Bank Cylinderhead 120,—MAKING;

QUICK VIEW OF REFERRING;

Referring to FIG. 91, (BRIEF DESCRIPTION—Paragraphs FIG. 91 thru FIG. 107, Depicts—"if necessary for Further Quick View towards understanding"), IDENTIFIED UNIQUE OSIV' ENGINE SYSTEM INVENTION—By Item Numeral 147 of (OSIV' Item/(DPL) Part List:) SPEC. Page 40.

Item 147 Roller Gear—Timing Drive Oil Pump—System Unit Case Housing,—is to be Formed from "Suitable Ultra Light FORGED CHROMOLY type ALLOY STEELS" of Forged Billet Type PLATES of a suitable "THICKNESS"—or of a suitable "Forged Stainless Type Steel or Silicon 4032 Aluminum", basic type Materials that will "Not Expand nor Flex—Excessively under High Heat & High Internal OIL Pressures—that causes Cracks in Thick Casings—type DURABILITY MATERIALS USED".

This System Unit Case Housing 147 Item and Internal Roller Gear(s) 157, 158, 159, Item(s)-&-Internal Formed Case Housing & Front Cover-Plate(s)-Areas, are to BE "Computer-Aided Designed (CAD)" and "Computer-Aided Manufacturing (CAM)", or CAD-CAM PROCESSED & CNC MACHINED towards Precision Concept—to Production Process & CNC MACHINING—by Professionals in such Art—such as like—Those In/On "CHOICE SELECTED COMPANY" section Pages 39., 40., 41., or can be Formed by a Suitable Manufacture that Produces "1 Piece Flywheels" that are On "CHOICE SELECTED" COMPANY" section Pages 37.←*. 47.*. QUICK VIEW OF REFERRING; Concluded.

Quick Method Towards Forming This Unit—is of the "Mind-Set" of MAKING A BASIC "Timing Chain Cover Plate" for a particular size "V"—type Engine Block or "Inline"-type Engine Block. (Similar like what's on "CHOICE SELECTED COMPANY" section Page 37.—GM-types)—though of TWO(2) Solid Formed PLATE(S) pieces—Formed & Shaped of OSIV' RG.TDOP.SUCH. drawn Figures.

Place such similar Kind Of Basic Pattern Shape—or—Formed Template(s) ON (2)Two (Preformed 1 Piece Flywheel(s) "That Has NO Machined HOLES" On Them—nor—"Outer Diameter Gear Teeth Area(s)" On Them)—type Solid Flywheels—Also On "CHOICE SELECTED COMPANY" section Page 47. JUN **→, and simply Cutout Such Pattern SHAPES.

BOTH Basic Formed PLATES—are then Machined Planed FLAT/EVEN—On Both SIDES of Each PLATE—so they can "Sandwich Mate-Up Together". One(1) PLATE is simply MARKED "156 Front Cover Plate"—and—One(1) PLATE is simply MARKED "164 Unit Case Housing Back Plate"—.

Where As The Item 156 Front COVER PLATE is Setup to be CNC-Machined/Formed—Like of FIG. 101, FIG. 102, FIG. 103, FIG. 104, FIG. 105, FIG. 106, FIG. 107, Quick Structure Views.

Where As The Item 164 Formed Unit Case Housing Back PLATE—is Setup to be CNC-Machined/Formed to "HOUSE" Roller Gear(s) 157, 158, 159, Items—and—other type CNC MACHINED Routed Out Oil Groove Passage Ways, Formed like of FIG. 92, FIG. 93 FIG. 94, FIG. 95, FIG. 96, FIG. 97, FIG. 98, FIG. 99, FIG. 100, FIG. 104, FIG. 105, FIG. 106, FIG. 107, Quick Structure Views.

ALL other basic Numbered Items/Areas—are Within "OSIV' Engine—Item Numbers/(DPL) Description Parts List:—as usual—and—is always Referred to, (SPEC. Pages 32. thru 43.).

After BOTH PLATES are Formed Precisely Suitable to "Sandwich FIT" & "Mate-up Together SNUGLY", a Item 58SA "Special Alloy-3" Shim GASKET Plate—of About 1/16" (0.0625" inches) to 5/64" (0.0781" inches) THICK is to be CNC Formed & Fitted MADE—to Conform WITH Item "156 Front Cover PLATE'S 167 BACKSIDE Mating Surface (Shaded Area)"—as FIG. 103 Represents, and "Thickness" Shown of Item 58SA Shim GASKET—On FIG. 104, FIG. 105, FIG. 106, FIG. 107,—Which This 58SA Shim "TYPE" GASKET Made of a (CV-DEL WEST ALLOY 3 MATERIAL)—Acts Like A Basic "Surface Bearing Plate" that will "Dissipate Heat" Seven Times Faster Than IRON (Ductile type Iron Material)—Through & To—the Item 156 Front Cover (formed) PLATE—Thus Allowing Internal HOT OIL & ROLLER GEARS & HEAT FRICTION—To COOL Themselves More Quickly.

The "CV-DEL WEST ALLOY 3 (or Special Alloy) MATERIAL SHIM GASKET Type PLATES"58SA Item can be basically Developed By "CHOICE SELECTED COMPANY" section Page 46.**→. And a suitable "Gasket Sealing Compound" on "CHOICE SELECTED COMPANY" section Page 24.*→, Should Be Used ON BOTH SIDES (Of Appropriate Area) to Completely "Surface SEAL" Item 58SA Shim GASKET to 167 Mate Surface Areas of FIG. 103-and-164 Areas of FIG. 93. All Other Numbers & Items are typical—as to CNC-Machine Forming the "168 RAISED Areas & 169 Cylinder Shape COOLING PINS—Higher Raised Areas & 126 BORE Hole Areas—WITH—126BS Bore SEAT Area's 79 Seal GROOVE SEAT (S) (of Broken Line Phantom Area) & the 78S SEAT Formed Areas (for SEALS), as Shown of FIG. 103 (is to be Viewed With) FIG. 104, for suitable Understanding—towards—Professional Forming & Creative Thinking & Building.

ROLLER GEAR(S) FORMING SETUP—OF; Item 157 ROLLER GEAR (Drive Gear)—For Crankshaft Nose Pinion Teeth 172 Formed Areas; Item 158 ROLLER GEAR (Middle)—to Drive Flex Belt 184B for Valveshaft 96(B) Item; Item 159 ROLLER GEAR (Top)—to Drive Flex Belt 184A for Valveshaft 95(A) Item;—

While Referring to FIG. 92, FIG. 93, FIG. 94, FIG. 104, FIG. 106 & FIG. 107, (Typical Structure Quick Views), Are To Be (CAD-CAM & CNC MACHINED Formed)—of a Light Weight High Strength & High Heat Friction & OIL Resistance—NON-Flexible Solid FORGE type "Special Alloy"—BODY Material(s) for "Severe-Duty" Operations, WITH Crowned Bearings & Outer Race/Wheel—Formed by Professional Manufacture of "CROWER type Roller Tappets"—as Specifically Like "CHOICE SELECTED COMPANY" section Page 32.*, As Referred.

The ROLLER GEARS—verses—ROLLER TAPPETS (as a Professional Company—can easily See)—can be Setup the "Same Way"—as to Make OSIV' ROLLER GEAR(S) (of the Gear's Teeth Areas)—Just By Looking At Above Drawing Figures-&-"CHOICE SELECTED COMPANY" section Page 32.(* * *) & Roller Tappet(s).

However, All Three "GEARS"—(Without Roller Bearings & Race/Wheels), are Setup FORMED—Like Any Other Type Basic Known "PINION DRIVE GEAR"—or—"CRANKSHAFT NOSE"& Main Bearing Journal, (Though Removing COUNTER WEIGHT and THROW ARM & PIN BEARING JOURNAL—Areas)—Though Made/Formed WITH suitable "THICK" & "PROPER DIAMETER SIZE" type Crankshaft Rear "FLANGE"—type Formed Area (WITHOUT NO BOLT HOLES) as the typical Quick Sketch shows with OSIV' Notations On "CHOICE SELECTED COMPANY" section Page 32.,—though Professionally "SETUP" & Formed "Structured"—As Item(s) 159 & 158 & 157—Roller Gear(s) are,—of FIG. 92, FIG. 93, FIG. 94, FIG. 104, FIG. 106 & FIG. 107,—and Precision Made & Weighed (158 & 159** Roller Gear(s) Should Be Of Equal Weight)—By CNC Machine Processes & Balanced Weighed.

As Referring to FIG. 94 & FIG. 104, the ROLLER GEARS are Setup On CNC LATHE/MILL MACHINE to Form Outer Diameter Clearance "80 Oil GROOVE (Depth & Width)—&—Suitable GAP Width/Depth to FIT & HOUSE Crowned Roller Bearing & Race-or and-Spacer 161 Item & Roller Bearing WHEEL 160 Item & (Spacer PIN LOCK 162 Item Press Fitted Carbide Steel type) & (RIVET PIN LOCK 163 Item Soft'e Metal Crimping Types), AREAS—which are typical for Roller Bearing/Wheel & Race/Spacer type Setups.

However, Item "157 ROLLER GEAR(S)"—is Formed By CUTTING OFF/REMOVING—It's "Front Drive 98 PINION NOSE Area"—or is—"Preformed WITHOUT A 98 PINION NOSE Area"—, (before installing "IT" in It's 126 BORE of Case Housing)—(Simple & Typical), and a Basic Suitable Size Diameter 126 Bore HOLE is Formed At It's Center Point Dot—(FIG. 92)—(To Fit Crankshaft's 172 PINION NOSE—(FIG. 93) )-&-the 145 Gear TEETH Half Moon—suitable Diameter/Depth Size 55 HOLES are CNC Drilled/Milled "ON THE REAR Backside of These 157 ROLLER GEAR(S)"—to Form Inverted RAISED Gear TEETH 145 Areas—To "Match FIT"—Crankshaft Front PINION NOSE 172 JOURNAL-&-Formed Gear TEETH 145 Areas—"SNUG LOOSE FIT", as typically Drawn of FIG. 92, FIG. 93, FIG. 94, FIG. 104,—To Which, these basic suitable Depth 55 HOLES (To Form Inverted Gear TEETH) are Drilled from the Backside of 157 ROLLER GEAR(S) (NOT ALL THE WAY THROUGH)—"In Order To Keep Front ROLLER GEAR (Bore Area) SOLID"—All The Way Around "IT'S"Front Inner Diameter 126 Bore HOLE Formed Area—as FIG. 92 & FIG. 104 SHOWS—(Basically For Strength Structure & PREVENTING EXCESSIVE OIL Pressure/Leakage (OUT of FRONT 172 Crankshaft PINION NOSE Area—) Towards & Not Passing the SEAL(S) 107 Item Setup Area(s)—Shown Of FIG. 104.

145 GEAR TEETH Area—of ROLLER GEAR(S)—are Setup & Formed In "Degrees Of A Diameter Circle"—to Establish "NINE(9)"basic CENTER POINT Areas for the "145 Half Moon Rounded Gear TEETH Areas"—and—Another "Counter NINE(9)" basic CENTER POINT Inverted Half Moon "TEETH GAP" Areas—is typically Formed of a LARGER Half Moon Diameter Formed "93GA GAP Area(s)"—CNC-Drilled or MILLED Machined Formed Areas—of the Diameter DOT Point Location(s)—which Factually Forms the 145 Gear TEETH Areas—"On A (20° Degree Gap (FIG. 93)) Point to Point SEPARATION", as Shown of FIG. 92 & FIG. 93.

However, this "93GA GAP Area" is Formed Large Enough for the Item 160 ROLLER BEARING WHEEL(S) of All GEARS to "MESH TOGETHER"—"Precisely & Snug Tightly" as the ROLLER GEAR(S) Rotate. The ROLLER GEAR(S) formed With Roller Bearings (Needle Pin Bearings) Should Be Fitted "TIGHTLY" In Their "126 BORE Location Area(s)", as basically DRAWN.

The OUTER DIAMETER of each Produce ROLLER GEAR Formed—is to Be Precisely Formed Equal MEASURED—and ALL Three ROLLER GEAR(S) 157, 158, 159,—are to be the "EXACT" SAME (Closest) OUTER DIAMETER SIZE as SUITABLY AS POSSIBLE "WITHIN ((+) or (–) 0.0001" inches).

MICRO POLISH SMOOTH FINISH; All Noticeable Metal to Metal Friction Internal Areas Should Be MICRO POLISHED FINISHED. The Micro Polished Finished—"126 BORE Area(s)" of Item 164 Housing PLATE—"Is To All Be The EXACT SAME (Closest) Diameter Size of It's (Outer Diameter) ROLLER GEAR(S) (Precisely Measured)—((–) 0.0001" inches) If So Needed For Tight Press Bore FITTING. However;

THE ROLLER GEAR(S) FITTING—, "Shrink ROLLER GEAR(S) By Cooling/Freezing THEM To (−40° F.)"—and Insert Them In The "EXACT" Same Setup Position as Typical Drawings Figure Show—, (Into Their 126 BORE FORMED Areas & 126-BS BORE SEAT Area Surface—of FIG. 95), and Setup Positioned as FIG. 92 & FIG. 94 Shows.

APPLY "GASKET SEALING COMPOUND"—On All Typical Areas Of Item "164 Formed Unit Case Housing Back PLATE'S" (FRONT MATE-UP SURFACES) Adequately, and Simply Install Item "156 Front COVER PLATE"—WITH It's (already Preset-up & Sealed-Appropriate 58SA Shim GASKET & Custom Made Neoprene O-Ring Type 107 SEAL(S)), and 54 BOLT(S) "Tightly Installed" into Formed 55 Bolt HOLE(S) THAT DO NOT GO ALL THE WAY THROUGH the Case 164 Housing PLATE—that have 93 THREAD(S) Formed Areas of "Notations" ON/OF FIG. 94—thru—FIG. 97, *(FIG. 96 View). This Is A Precaution to Keep Both PLATES "Sandwiched Together" before Installing THIS Pre-Completed "147 RG.TDOP.System Unit Case Housing"—On The FRONT Engine Block, as Shown Of FIG. 106 & FIG. 107, & Then FIG. 91, & Then Eventually Of FIG. 133 FRONT Engine BLOCK Installed Setup. ROLLER GEAR(S) FORMING SETUP—OF; Is Concluded.

The Item 150 Oil Pressure Volume Adjuster & Casing (typical)-Area(s)—Casing Unit, as Now Referring to FIG. 91, FIG. 104, FIG. 107 & *FIG. 106,—is to be Formed WITH "Extra Super Tough Duty Intention(s) In-Mind". The Item 150 Casing Area is to be Formed OF or FROM a suitable BILLET FORGED Stainless type ALLOY STEEL, WITH a "Split Cup BORE Inner Hole (type)"—to House Item "151 Adjustable Bolt SHAFT (Adjuster)"—Formed of (CHROME MOLY 8740 ARP MATERIAL & TYPE) Like On "CHOICE SELECTED COMPANY" section Page 35.*, and Setup To House A Properly Formed (8740 CHROME MOLY ARP MATERIAL type Corresponding Item "176 VALVE—Threaded TUBE NUT Cylinder Shape VALVE type Jack NUT")—(Cylinder Shape WITH Raised RAILS to Fit Within CUP BORE'S "Split(s) Slot(s) Guide Track type Areas)—which moves along Item 151 Jack Screw type SHAFT'S 93 Threaded Areas "Tightly But SMOOTHLY", which is All Sealed Off by a Custom Formed "High Heat Oil & High Heat Temperature Resistance" HEAVY DUTY COMPRESSION Neoprene Cone Shape "154 Pressure Boot Cone SEAL—Item"—type, that is Fitted WITH a "153 Pressure Lock WASHER Plate Item" (Made Of 4150 or 4140 CHROME MOLY STEEL)—Similarly Formed Like A Old Style Valvespring "RETAINER" like on the "CHOICE SELECTED COMPANY" section Page 46. "OSIV' 153" type, to which is Installed Positioned & Secure LOCKED with a (CHROME MOLY 8740 ARP MATERIAL) type Formed "152 Pin Lock Knob Adjuster Item"—as Shown On Figures Above & Others. A Item "58 SHIM GASKET (O-Ring type Seal)—of Compressed Neoprene Type Material—is Used to Help Prevent High Pressure OIL Leaks—is to be Tight Fitting Around Item 150 CASING Unit Mate-Up Area—WITH Suitable Gasket SEALANT—to—Item 156 COVER PLATE'S "170 FRONT Surface Area(s).

The Item(s) 54DP or 54-DP "DRAIN PLUG" Bolt(s) (On FIG. 98, FIG. 99, FIG. 100) Upper Rightside of Item 164 Case Housing PLATE—is (Typical), and basic "Gasket Maker" Sealant—On "CHOICE SELECTED COMPANY" section Page 24.*→, Is Applied To This BOLT'S "Threads & Its' Head's Mate-Up Surface" to Prevent OIL Leaks—to which This "UNIT 164 CASE'S 54-DP Drain PLUG Upper Rightside Area's 27 Passage HOLE"—Is Linked To "HIGH OIL PRESSURE RESERVOIR 15 Area", to Allow This 15 RESERVOIR to be OIL Drained. As with FIG. 91, Item 156 COVER PLATE'S Bottom Off-Center Area On 170 FRONT Surface Area's "54-DP Item"—is a suitable Drain Plug BOLT—To Drain OIL From "147 R.G.TDOP.SUCH." Assembly Item Area, To Which The CRANKSHAFT Should Be Turned/Rotated Back & Forth—To Insure MOST OIL Is Drained—When OIL Changes Takes Place. (Install ALL 54DP or 54-DP Drain Plug BOLTS WITH "Gasket Maker" On Thread Areas "Nicely"& "Non-Messy".

As Referring Back to FIG. 91—and—FIG. 104, the OSIV' (RG.TDOP.SUCH.)—147-PDGA "Pulley Drive Gear (A)" For Right Cylinderhead Engine Bank-&-147-PDGB "Pulley Drive Gear (B)" For Left Cylinderhead Engine Bank, are to be Setup Formed as the Same Exact Diameter Sizes of the "ROLLER GEARS" 157, 158, 159, Items. The Pulley Drive Gear's "145 Gear TEETH" Raised Area(s)—are to be the Same "Half Moon Diameter Formed Size—AS—The Diameter Size Of The "160 ROLLER BEARING WHEEL or Outer Race"—Basically Consisting Of NINE(9) HALF MOON DIAMETER SHAPED "145 Gear TEETH" Formed Areas—Suitably CNC-CAD-CAM-MACHINE PROCESS FORMED to Correctly & Safely Drive (Super Heavy Duty High Performance Custom MADE "184(A) & 184(B) Flex Timing Drive BELT(S)"), WITHOUT Causing Unnecessary—NOR—Excessive Flex Belt WEAR/MAULING—NOR—Heat Friction & Misalignment.

A Basic "108 KEY-Way/90HM (Half Moon) GROOVE"—Is To Be Properly Formed In The Inner Diameter BORE Area(s) of "Pulley Drive Gear's Center Journal Bore Area"—to Coincide WITH "ROLLER GEAR'S 98 Pinion NOSE Area(s)" (FIG. 104 View) & 108 Formed HALF MOON Shape KEY-or-TEETH Area(s). The PULLEY DRIVE GEAR is to be Precisely CNC-MACHINED to Fit "SNUG TIGHT" On ROLLER GEAR'S Pinion NOSE 98 AREA(S).

The Pulley Drive Gear(s) 147PDGA & 147PDGB—Should Be Formed of a suitable "RUST FREE" (All Billet 6061-T6 ALUMINUM) of "NO" Polishing Clear Powder Coat —or—Black Hard Finish, Made By A High Performance Racing Engine Specialist type Manufacture—in the Art of "Pulley Systems For High Performance Engines" as on "CHOICE SELECTED COMPANY" section Pages 23.*→, 24.*→, *.

At this Point, when This OSIV' Engine System's (RG.TDOP.System Unit Case Housing) is properly Completed & Pressure/Volume Pumping Output "TESTED"& "LEAK PRESSURED TESTED" & "ROTATION OF ROLLER GEARS TESTED"—etc./Safe & Complete Of Making, IT is basically Installed Properly On The FRONT Area(s) Of Engine (Blocks—as Shown of FIG. 4,)-&-FIG. 104, WITHOUT & WITH the Crankshaft Assembly & Pre-Already Installed On Engine Block—as FIG. 3, FIG. 2 FIG. 1, FIG. 133, and other Views. Once the Item. 58 Shim GASKET has been SEALED WITH "Gasket Sealing Compound",—To The Back Mate-up Surface "171 REAR Area(s) of FIG. 98—and ALL HOLE Areas & Open Space Areas are Formed to Precisely "Matched-Up" WITH "164 Case Housing's 171 REAR Surface Area" & Corresponding FRONT Engine Block Surface Area(s) (FIG. 4 type View):, "Gasket Sealing Compound" On "CHOICE SELECTED COMPANY" section Page 24.*, is APPLIED—Covering Entire 171 REAR Area Surface—or—REAR Of GASKET'S Mate-up Surface Area(s) to FRONT Engine Block's Surface, "And Just Before Installing (147 RG.TDOP.SUCH) To FRONT Engine Block", TURN/ROTATE or SET Crankshaft To (TDC 0° #1cyl. Piston) & TURN/Align Both 147PDGA & 147PDGB "Pulley Drive Gear's 55 Small Bolt HOLE(S) On Outer Diameter LIP" (FIG. 91 View)—and Insert A Small NAIL/PIN through these HOLES to Secure Such Position—and Install The "147 OSIV' RG.TDOP. SUCH." Item—On Engine Block & Crankshaft's Front PINION NOSE 172 Area.

Once Item 147 OSIV' (RG.TDOP.SUCH)—is Properly Torqued of "ALL" BOLTS (to engine block)—, The TOP Valley Base Front "Deck Surface" BLOCK Area 11—(QV FIG. 25, FIG. 23) is to be Machined Planed EVENLY/Flat WITH Item 147 (RG.TDOP.SUCH.)'S "122 TOP DECK Area Surface"—as Shown of FIG. 91 & FIG. 4 & FIG. 2, to Properly MOUNT and INSTALL—Item(s) "177 Spring By-pass Oil Filter VALVE (Oil Filter By-pass Valve Unit type)"-&-"46 OIL FILLER TUBE with 47 Oil Filler Tube DIPSTICK CAP"-&-WITH "Gasket Maker Sealant"-&-them Install Item(s) "50 OIL FILTER HOUSING BASE PLATE—Front Valley Block-Area WITH Made 58 SHIM GASKET & Gasket Maker Sealant"—; as Setup On FIG. 19 and FIG. 16 and Then FIG. 3, FIG. 2, FIG. 1,—basically Shows to Complete this OSIV' Technique Setup.

This Concludes the basic Setup Formation & Explanations-on HOW the OSIV' Engine System Stage ONE & Stage TWO—"OSIV' Roller Gear—Timing Drive Oil Pump—System Unit Case Housing Assembly" "OSIV' (R.G./RG.TDOP.SUCH.) ASSEMBLY" 147 Item *UNIQUE NEW Unit—Assembly"and "SUPPORTING PARTS"—to Complete Basic *(K)—OSIV' (R.G./RG.TDOP.SUCH.)—ROLLER GEAR—TIMING DRIVE OIL PUMP—SYSTEM UNIT CASE HOUSING—MAKING AND FORMING FORMATION OF:—for those Professional Manufactures in the Art of Engine Parts Manufacturing—Who are Capable Of Simply Seeing How This Item Is To Be MADE—by simply Examining above Figures & Others—and Explanations towards Further Understanding & Creative Improving—Towards Professionally Building & Producing Such.

Item(s) "141 Adjustable Valveshaft TIMING PULLEY GEAR/SPROCKET"-&-Item "142 Pulley Gear HUB"-&-Item "184A Flex Timing Drive BELT (Shorter Length)"-&-Item "184B Flex Timing Drive BELT (Longer Length)"-AND/OR-Assembly For OSI-Valveshaft(s), are to be CNC-CAD-CAM-MACHINE PROCESS FORMED—By A Professional Type Company or Manufactures—in the Art of Forming & Making "High Performance Camshaft SPROCKETS & GEAR SETS of 'Adjustable Style'—Types", as On "CHOICE SELECTED COMPANY" section Page 47.(***), 48.--, —Or For A Complete "High Performance Pulley Gear Serpentine Type Custom Setup-or-Deep Groove V-Belt Type Pulley Systems Custom Setups" on "CHOICE SELECTED COMPANY" section Pages 23., 24.,*--,—MAKING;

QUICK VIEW OF REFERRING;

While Referring to FIG. 1, FIG. 20, FIG. 13, FIG. 17, FIG. 114, FIG. 126, FIG. 91,—for Quick Understanding Of Formation Structure View, and Other Suitable Figures—for suitably Forming Setup Areas, for those Persons & Company Manufactures Who Are Professionally SKILLED in such Art—Who Can Easily See How Such OSIV' Valveshaft's "141 Adjustable Valveshaft TIMING PULLEY GEAR/SPROCKET"-&-Item "142 Pulley Gear HUB"—Should be Professionally Formed or Made, or of a Complete "OSIV' Valveshaft (DUAL BELT) Adjustable Timing Flex Drive Belt Pulley Gear Sprocket System" type MATCH Setup/Package Kit(s), which can be Formed & Produced for OSIV' Engines—towards Professional Racing & Non-Racing DESIGNING from "CAD-CAM CNC-MACHINING PROCESS" & Simply Made.

ALL Numbered Items and Areas and Structures are Basic & Typical—Like any other type Pulley Gear System. However, the Item "141 Adjustable Pulley Gear(s)"—Is To Be The "EXACT" Formed Of "145 Gear TEETH (Half Moon Diameter Size) Setup MADE Area(s)—as—The Item(s) "147PDGA & 147PDGB Pulley Drive Gear's Formed 145 Gear TEETH of Half Moon Diameter Size",—Except TWICE The Gear RATIO Diameter Size, WITH "Eighteen(18) Half Moon Shaped 145 Gear TEETH". (THUS):

Item "147 Pulley Drive GEAR(S)"—(HAVE: 9-TEETH),

Item "141 Adj. Pulley GEAR(S)"—(Have: 18-TEETH),

ALL Numbered Items and Areas and Structures are Basic & Typical—cont.;

which Allows the "OSIV' VALVESHAFT(S) to Rotate SLOWER"than Crankshaft(s)—, THUS Allowing "OSIV' CRANKSHAFT 64CS Items" To Rotate "TWICE as FAST" Than OSIV' VALVESHAFTS.

The Item(s) "141 Adjustable Valveshaft TIMING PULLEY GEAR/SPROCKET"-&-Item "142 Pulley Gear HUB"—is typically Formed—Similarly Like A Basic "Camshaft Adjustable Timing Sprocket" on "CHOICE SELECTED COMPANY" section Pages 47., 48.,—But The OSIV' "Types" are to be Formed "About TWICE As Long/Wide"—as if TO PUT TWO(2) Adjustable Camshaft "SPROCKETS" Together—WITH "Track Guide Rail/Lip" type DIVIDERS Item(s) "144 Track Guide LIP Formed Areas"—On Basic Areas Of "SPROCKET'S Outer Diameter Areas" to Make ("ONE(1)" 141 Adj. Pulley Gear/OSIV' type Sprocket) Item, as *FIG. 20 & Other Figures Show.

This Helps To Prevent—the "Super Extra Heavy Duty THICK—Extra Deep Groove V-Belt"—THROW or EXCESSIVE MISALIGNMENT—During Ultra High RPM & 300+ MPH Speed WIND PRESSURES (as in Bonneville/Salt Flat Racing) Performance Operations—of OSIV' Engines—to which "Those Typical Style Camshaft Adjustable Timing Sprockets" (Are Known For "Belt THROWING FAILURE"), To Which They "DO HOT HAVE 144 Track Guide LIP(S) Formed Areas".

Three(3) Basic Belt "GUIDE TRACKS"—Are Formed On The Item 141 Adj. Pulley Gear/Sprocket, (F-(Front)/M-(Middle)/R-(Rear))—, As Noted On Item(s) 141 of FIG. 20 TOP View Setup. These Open Space Tracks On 141 Pulley GEAR(S), Are To Be Used For "ANY TYPE BELT DRIVE ACCESSORIES", (With suitable formed brackets & bolts—support setups). Accessories such as; (*Belt Drive Fuel Pumps), (Belt Drive Water Pumps), (*Belt Drive Ignition Distributors), (*Belt Drive Generators/Alternators), (Belt Drive Supercharger/Blowers), (*Belt Drive A/C Air-Condition Pumps), (Belt Drive Fans), (*Belt Drive Power Steering Pumps), (Reverse Rotation Belt Drive Accessories). Some Accessories can even be Turned Around/Setup Mounted In "Reverse Position"—FOR PROPER (Guide Track Setup On 141 Pulleys) FOR PROPER BELT DRIVE ROTATION OPERATIONS. This OSIV' Engine System Is Setup/Designed to be Highly Versatile—"Versatile System". THIS IS WHY BOTH (184A & 184B Flex Timing Drive Belts) ARE TO BE OF "Super Extra Heavy Duty-High Performance (▽↔ V-Belt Type Forms Preferred)".

ALL 145 Gear TEETH of Item(s) 141 Adj. Pulley Gear/Sprocket(s)—and—147PDGA & 147PDGB Pulley Drive Gear(s) of (RG.TDOP.SUCH.)-and-The 157 ROLLER GEAR—158 ROLLER GEAR—159 ROLLER GEAR,—Are Basically Setup On A (20° Degree Center Line Gap Separation)—On A Suitable Size Diameter Circle Perimeter Line, (FIG. 93, FIG. 91 FRONT Views)—to which the "Flex Drive BELT(S) Designed Formed TEETH of Half Moon Diameter Rounded Shape SIZE Setup—IS TO SO MATCH". The Item "147 OSIV' RG.TDOP.SUCH.—WITH—Pulley Drive Gear(s)—UNIT ASSEMBLY"—WOULD BE CONCLUDED FOR "Adaptation To—Ready Available After Market Custom Made Staggered Old Style Conventional Engine BLOCKS".

Item(s) 184A & 184B Flex Timing Drive BELT(S)—are to be Formed "Thick & Durable Enough"—to Form a Suitable STRONG "Separation Area" for a Safe Setup Item 185 Pin-Screw LOCK KEY (Or Flex Belt Formed Separation LINK & LOCK) Optional—Area Setup—For Quick Safe Removal & Installation Changes (Similarly like Motorcycle Chain Link Key)—though 185 Pin/Key LINK Area Item as Shown On FIG. 1.

This Type Of Setup Is For—When The Flex Belt(s) Becomes—Old/Used Up/Worn Down/Flimsy & Excessively LOOSE, "A NEW FLEX BELT CAN BE QUICKLY INSTALLED.

Item(s) 182 GUARD/SHIELD(S)—(FIG. 1 & FIG. 133) Can Be Formed Of "Durable Clear Plexi-Poly Plastic Urethane type Material-or-Heavy Gage Stainless Steel or Alloy Aluminum Plates-type Metal. They are Setup Drawn—to at Least—Cover/Shield—the Main FRONT Air Windage Pressure Stream Area—For "Belt Guarding". However, a Custom Molded/Fabricated "Belt Protect Shroud Guard Cover" can also be made to COMPLETELY COVER Entire "Flex Drive Belt/Pulley Gear Sprocket/Pulley Drive Gear/—Setup System", to be Secured To The FRONT SURFACE Areas Of Engine BLOCK & CYLINDERHEADS. QUICK VIEW OF REFERRING; Is Concluded.

These Item(s)/Number(s)—182, 184A & 184B, 141 & 142, 147PDGA & 147PDGB, Parts Basically Formulates & Makes Up The "OSIV' Adjustable Timing Pulley Gear/Sprocket/HUB/Flex Drive Belt(S)/Guard-Shield/—ASSEMBLY" System, as Noted Partially In "—BRIEF DESCRIPTION OF THE SEVERAL VIEWS OF THE DRAWINGS—" FIG. 2 Depicts—Paragraph.

This Concludes The Basic Setup Formation & Explanations of HOW the OSIV' Engine System Stage ONE & Stage TWO—"OSIV' Adjustable Timing Pulley Gear/Sprocket/HUB/Flex Drive Belt(S)/Guard-Shield/—ASSEMBLY", to Complete Basic (L)—OSI-VALVESHAFT'S—OSIV' ADJUSTABLE TIMING PULLEY GEAR/SPROCKET/HUB-FLEX DRIVE BELT(S)/GUARD-SHIELD/—ASSEMBLY" ITEM(S)—MAKING AND FORMING FORMATION OF:—for those Professional Manufactures in the Art of Engine Parts Manufacturing "High Performance & Racing Pulley Gears/Sprockets" & "High Performance Flex Timing Drive Belts & Custom Pulley Systems"—Who are Capable Of Simply Seeing HOW These Items are to be Professionally Made—by simply Examining above Figures & Others—and Explanations towards Further Understanding & Creative Improving—Towards Professionally Building & Producing Such.

The DETAILED DESCRIPTION OF THE INVENTION

OSIV' ENGINE SYSTEM—Technique—Method:

Explanation, Process Of Making and Using Invention; (STAGE TWO FORM PRESENTED)—,

IS CONCLUDED.

(M)—BASIC ASSISTANCE—Towards Custom Making—and for—Accessories, Brief Explanations towards suitably building "Complete/Safe/Highly Efficient/High Power Output/—Internal Combustion OSIV' Engine Basic Setup", towards typical Researched & Developed—Running Engine Operation(s) & Process—of All Accessory Types & Needs, can be simple located by many Professional Sources and Manufactures, Engine Building Specialist—and Companies, within "CHOICE SELECTED COMPANY" section Pages—Which Is Being Referred To;

(M-1) ENGINE IGNITION SYSTEMS—(*Crankshaft Trigger Types), (*Camshaft Converted—Swap To VALVESHAFT—Trigger Types), (Belt Drive Distributor/Magnetos Types), are suitable for OSIV' Engine System's Basic Needs.

(Crankshaft Trigger Types); On "CHOICE SELECTED COMPANY" section Pages 19., 20.,"*→", and FIG. 20 (TOP View)-and-FIG. 13 (SIDE View)—Shows How A Basic "Crankshaft Trigger Ignition Pickup" Setup & Area can be simply Setup Formed towards Location. The Item "174 Crankshaft Nose Trigger HUB"—can be suitably Formed and Made for Item "175 Balancer/Harmonic Damper/Combined Magnetized Balancer/—Area", to be Setup Like FIG. 16 & FIG. 19 as basic Setup Structure Shows. Item "179 Ignition Trigger Support type BRACKET/MOUNT—Area"—can be suitably Formed to House Item "178 Ignition Trigger PIN (typical) Area"—which Item 179 Bracket—Should Be Formed From A Suitable "Forged Stainless type Steel". Item "181 Ignition Trigger Wire TUBE PROTECTOR Area"—can be Formed From Suitable Size Basic "Stainless Steel—Bendable TUBING", bent to suitable Curving Shapes—and Secured Welded to Small Brackets & bolted to Engine Block WITH suitable Short Length Item 54 BOLT(S), (Basic PRO-LEVEL of fabrication simple techniques). The Item "180 Ignition Coil WIRE (Trigger Pickup)"—is simply Routed Though the TUBE PROTECTOR—and Both are Installed Onto the FROM Engine Area.

The Item "179B Bracket-Mount" for Ignition COIL type Box Mounting—is at the TOP Area in "Broken Line Phantan"—of FIG. 4—to Show HOW such can be Made to Mount On Top Of Front Item "209 Fresh Air Inlet Manifold". This Item 179B BRACKET—should be Formed from a suitable "Stainless Steel"—and Secured to Item "209 Fresh Air Inlet Manifold" with suitable Short Length Bolts.

Item "134 Spark PLUG(S)"—of FIG. 10 and Others, Should At Lease Be Of The Quality Type as on "CHOICE SELECTED COMPANY" section Page 7."*", and "Spark Plug Ignition Wires (NOT Drawn On Figures) Should At Lease Be Of The Quality Types as on "CHOICE SELECTED COMPANY" section Page 21."*→" "Custom Fit" for "DUAL PLUG Per Combustion Chamber/Piston Cylinder Bore" Setups. (Spark Plug GAP-0.035" inches to 0.055" inches) for basic Starting Base TEST.

Ignition Firing Order "FIRING SPARK PLUGS"—is SET like any other—GM-Buick/Chevy/Pontiac/-type Engine (Between 0° to 12° Degrees AT or BEFORE TOP DEAD CENTER (A/BTDC)—Crankshaft Of Full Compression Stroke).

(Valveshaft Trigger Types); Can be setup like Camshaft Trigger Type-WITH Trigger Ignition Wheel "incorporated In or On Valveshaft(s)'s"—Item 141 Adjustable Timing "Pulley Gear/Sprocket(s)"—types, WITH a Custom Made Item "179 Ignition Trigger Support-type BRACKET"-&-Item "178 Ignition Trigger PIN" & Pickup Wire/Coil Wire Area, Mounted & Setup on FRONT TOP Area or Valley Intake Port Front Area of/on the OSIV' CYLINDER HEAD(S), (At A Basic Safe-Suitable Location—Bolted Securely By Front Area—by Item 141 Pulley Gear/Sprocket(s)).

(Belt Drive Distributor Types); As Shown Of "CHOICE SELECTED COMPANY" section Page 21."→", Which can be Setup and Mounted On FRONT Area of—"OSIV'

CYLINDERHEAD(S)" and Geared For Accurate Rotation IGNITION FIRING. (Firing Order is based upon Crankshaft Setup), and since I (Inventor/Designer) Being a Three Time GM Car Owner & Proud Enthusiast;

Firing Order Sequence Of CYLINDERS: "1-8-3-6-5-7-2"—(V8-type) Engines, Is Believed To Be The Best & Well Known "Setup Firing Order" To Be Selected.

This OSIV' Engine System & System—is Designed/Setup—for All Kinds of Versatility Type Modifications. However, the Preferred "Ignition System Of Complete Setup"—and—"A Engine Management System"—is focused towards "ELECTROMOTIVE ENGINE CONTROL INC."—of the "CHOICE SELECTED COMPANY" section Page 20., of including "ELECTRONIC FUEL INJECTION"—Type Setups. (M-1) ENGINE IGNITION SYSTEMS—Concluded.

(M-2) ENGINE CARBURETOR (S)—BASIC SYSTEMS—(Holley 2BBLS and Holley 4BBLS), (750 QUADRAJET STAGE III), (2G 500 CFM type 2BBLS), (WEBER 2BBLS Side Draft type),—typical types as on "CHOICE SELECTED COMPANY" section Page 38."*", can be simply Used WITH appropriate type "CARB.SPACERS" on "CHOICE SELECTED COMPANY" section Page 36."*→", for Mounting On Item "200 OSIV' Multi Position Changeable Intake Manifold BASE"—of FIG. 1, FIG. 20 & Others. (M-2) ENGINE CARBURETOR(S)—BASIC SYSTEMS—Concluded.

(M-3) ENGINE FUEL INJECTORS—OF BASIC SYSTEMS—"Non-Electronic & Electronic" (Tune Port Fuel Injectors), (Throttle Body Injectors), That are WITH—(Single Trottle Body-and or-Single Barrel type(s)), (Two Barrel type(s)), as on "CHOICE SELECTED COMPANY" section Pages 38. "", 20. "→" (Four Barrel Throttle Body type(s)), Setups can be simply Used WITH Item "200 OSIV' Multi Posi. Change. INT. Manifold BASE(S)) of FIG. 1, FIG. 20, & Others—however, This New Unique OSIV' Engine System—of Setup & Design, For "Fuel RAIL & INJECTORS"—type, is that they are to be MOUNTED ON TOP OF Item(s) 119 & 120 "OSIV' BRICK WEDGE CYLINDERHEAD'S" Intake Port RUNNERS 123 Areas—that have (123IB or 123-IB Injector Boss/Base Area)—Formed Safe Area(s)—as FIG. 1, FIG. 20 and as Other Views Shows.

A basic Bore HOLE—for Injector Installation—(as *OSIV' MODIFIED/COLOR Version(Vr.) View Shows)—can be Formed "At A VERTICAL SLANT" Down "Center Point Area" of 123-IB Boss/Base (with CNC Drill/Mill Press Machines) which will Allow Injector(s) to Squirt "COOL FUEL" Directly Into "COMBUSTION CHAMBER(S)".

Injector SQUIRT Timing Frame Average: (Between 45° Degrees 'BICRSI @TDC' "Before Intake Crankshaft's Rotation Stroke Is At Top Dead Center"—TO—28° Degrees 'AICRSP TDC' "After Intake Crankshaft's Rotation Stroke Passes Top Dead Center"), which this OSIV' SYSEM Allows For "Wide & Long GAP(S) of Injector SQUIRTING & SPRAYING Adjustable Setups"-OR-"Narrow & Short GAP(S) of Injector SQUIRTING & SPRAYING Adjustable Setups" (Custom Taylor/Ultra Fine Tuning/Low- Mid-High- Ultra High-RPM Power Tuning/Minimum Fuel Usage Towards Residual Efficiency Tuning—Setups). All THIS basically Means—is the Fuel Spray "PATTERN Feather Shape/Stream—Do NOT Necessarily Have To Touch (Internal Hot Wall Areas) Of—Intake Manifold RUNNER (S)—nor—Cylinderhead(s) Intake Port RUNNER(S)-nor-Combustion Chamber Walls Before Air/Fuel Mixture is Compressed, (Unlike Conventional Old Style Camshaft/Pop-Valve & Spring Engines—Which Partially VAPORIZE & BURNS AIR/FUEL MIXTURE Flowing On It's Way to HOT Combustion Chambers & Pop-Valvestem/Pop-Valvehead Areas—Pre-burnt Before Compressed, "Thus LESS FUEL EFFICIENT")—to which instead of typical Fuel Injector(s) Setup—Makes A LONG FUEL SQUIRT SPRAY Of Travel, Where as the OSIV' Engine Systen Setup HERE—Will basically/typically be Setup for "Short Injection Fuel Spraying"—DIRECTLY INTO COMBUSTION CHAMBER POCKET(S) 128 Areas of FIG. 113 Quick View, thus further "Creating Highly Fuel Efficient Use" & "Highly Efficient Combustion—High Power Output Developing".

In this Fashion as a Example, the OSIV' "V8"Engine System—Engine(s) Type Setup—can Produce "Fuel Mileage & Emission Standards"—on the levels of the "Highly Respected GM Buick V6 Engine" & Power—which is well know to (us) Buick V6 & V8 Enthusiast—that such V6 Engine Can Produce About (26 to 27 Miles Per Gallon of Fuel) using, if Geared Properly. Thus which—the OSIV' Engine being Setup in V8 & V6 Fashion—Bigger or Smaller or Similar Small Size—as the beloved Buick V6 Engine (for Population Public—Pollution Control Usage), the Power Level & Fuel Mileage for "OSIV' Engines" will typically be about (1½ to Double—Overall Potential Average Power LEVEL & Mileage Range) Per Gallon of Fuel Usage. This could be well suited for SUV(S) & HEAVY DUTY TRUCKS & OTHER EXTRA LARGE TRANSPORT MACHINES & CRAFTS—that Deal with Moving Large s of "Weight"—from one place to another.

However, (this OSIV' Injector(s) ON Cylinderhead(s)—also Simplifies "Intake Manifold(s) & Support Runner(s)" EXCHANGE for Racing Use), WITHOUT Removing "Fuel Rail Injector FUEL LINES" & It's Setup System. (M-3) ENGINE FUEL INJECTORS—OF BASIC SYSTEMS—Concluded.

(M-4) ENGINE HARMONIC BALANCER/DAMPER/FLYWHEEL FLEX-PLATE—BASIC SYSTEMS—(PRE-MAGNETIZED BALANCER type On "CHOICE SELECTED COMPANY" section Page 19.), (Fluidampr Balancer types On "CHOICE SELECTED COMPANY" section Page 37.), (PRO/RACE Performance Harmonic Dampers type On "CHOICE SELECTED COMPANY" section Page 37.), are typically Setup & Used On FRONT "Pinion NOSE 172 Area" of Crankshaft—as basically Shown of FIG. 16 & FIG. 19—which Item "175 Balancer Damper Area"—is Fitted To A Basic "174 HUB Item"—ON—"172 Crankshaft Nose Area".

(Flywheel—Flex-Plate)—type On "CHOICE SELECTED COMPANY" section Pages 37., 47. "*→", are typically Setup & Used On REAR "Crankshaft FLANGE 62CF Area" of Crankshaft(s)—as basically Shown of FIG. 16 & FIG. 19,—Which Item "62CFP or 62-CFP Crankshaft FLEX PLATE Area"—Is Formed & Fitted To Basic "62CF Crankshaft FLANGE—Rear—Area". (M-4) ENGINE HARMONIC BALANCER/DAMPER/FLYWHEEL FLEX-PLATE—BASIC SYSTEMS—Concluded.

(M-5) ENGINE ELECTRIC STARTER—UNIT SYSTEM—(High Torque Starter type With Solenoid) On "CHOICE SELECTION COMPANY" section Page 21."*-ST", which can be Custom Fitted To "Engine Block REAR Main Bulkhead Flange 8 Area(s)"—On Right or Left—Engine Bark Side(s), In or Through Formed "61 HOLE Area"—for Starter Drive Gear,: (Typical Area), of FIG. 1 FRONT View Hole Area, & Other View Figures. (Starter Not Drawn On Fire Views). (M-5) ENGINE ELECTRIC STARTER-UNIT SYSTEM—Concluded.

(M-6) ENGINE ELECTRIC FUEL PUMP—BELT DRIVE FUEL PUMP—UNIT SYSTEMS—(High Performance Electric Fuel Pump) On "CHOICE SELECTED COMPANY" section Page 21."*-EFP",—AND—(High Performance Belt Drive Fuel Pump) On "CHOICE SELECT COMPANY" section Page 22."*→", which can be Custom Fitted/Mounted—to FRONT Engine Block LOWER RIGHT OR LEFT "bank" Areas—of Area "7 Engine Block FRONT Main Bulkhead Flange" Area, (for Both Types of Electric or Belt Drive—"Fuel Pumps"), With Suitable Brackets & Bolts, or they can Mounted to "Guard-Shield(s) 182 Item(s)" Safe Areas-or-Other "Upper Safe Engine Block" Areas. (M-6) ENGINE ELECTRIC FUEL PUMP—BELT DRIVE FUEL PUMP—UNIT SYSTEMS—Concluded.

(M-7) ENGINE FUEL FILTER(S)—BRAIDED STAINLESS STEEL LINE(S)—PLUMING SYSTEMS—(High Flow Fuel Filter(s)) On "CHOICE SELECTED COMPANY" section Page 22.,—AND—(Braided Stainless Steel Lines) On "CHOICE SELECTED COMPANY" section Page 22.,—Should Be USED to Setup a Proper Pluming System—Routed Fuel Flow—From Fuel Cell/Tank—to—"Filter"—to—"Fuel Pump"—to—"Another Filter"—to—"Carburetor(s) or Fuel Rail/Injector(s) System"—type Setups. (M-7) ENGINE FUEL FILTER(S)—BRAIDED STAINLESS STEEL LINE(S)—SYSTEMS—Concluded.

(M-8) ENGINE OIL FILTERS—DISPOSABLE UNIT TYPE SYSTEMS (High Performance & Racing type—Oil Filters) On "CHOICE SELECTED COMPANY" section Page 25."*→", is to be Used—in the "49 OIL FILTER Area"—In Front Engine Block Valley Area—of FIG. 1, FIG. 2, FIG. 3, FIG. 20, and Other Figures. (Note—A Specified "Motor OIL" on "CHOICE SELECTED COMPANY" section Page 26."*", Should At Least Be Used In OSIV' Engines—and Poured Into "44 Oil Passage HOLE"-to-OIL RESERVOIR 15 Formed Area—of Shown Location "44 OIL PASSAGE HOLE" of FIG. 23 (TOP Front Block Valley Area View) Location, "Filling Up 15 RESERVOIR" With a Suitable Funnel—and then ROTATE CRANKSHAFT a few times & REFILL UP 15 RESERVOIR AGAIN—before Installing Item "49 OIL FILTER(S).)

The "16 OIL RESERVOIR"—is to be Filled WITH the (Same or Better) Engine MOTOR OIL—as On "CHOICE SELECTED COMPANY" section Page 26."*",—OR—as the same OIL pored into "15 RESERVOIR". Simply by REMOVING Item "47 Oil Filler Tube DIPSTICK "CAP"—and Pouring the OIL into "46 Oil Filler TUBE", and—ROTATE CRANKSHAFT A Few More Times—&—REFILL UP the "46 Oil Filler TUBE (All The Way Up To The Top Rim Area"-and-CAREFULLY Install "47 DIPSTICK CAP", Tightly—Without SPILLING OIL, (Note: This Is The Basic Design Method & Procedures For OIL CHANGES for the OSIV' ENGINE Stage TWO Setup Form—which is to be done Every Time The OIL Needs Changing & After OIL is DRAINED COMPLETELY FROM THIS ENGINE.), of FIG. 1, FIG. 20. (M-8) ENGINE OIL FILTERS—DISPOSABLE UNIT TYPE SYSTEMS—Concluded.

(M-9) ENGINE BLOCK VALLEY RADIATOR—WATER/COOLANT FLUID USE—TYPE SYSTEM—(Non-Water Base or Waterless Type "Coolant Fluids" Is Mandated As OSIV' Engine Stage TWO Use—Is Specified)—of "EVANS(NPG) COOLANT" On "CHOICE SELECTED COMPANY" section Page 26.*.

However, if WATER is Used In OSIV' Engine's Stage ONE or Stage TWO-Setups, A Suitable Water "SUPER COOLANT ADDITIVE" Fluid—Like "RED LINE WATER WEITER" types On "CHOICE SELECTED COMPANY" section Page 26."→"—Should Be Used In Stage ONE Setups of OSIV' Engines-AND-("Must Be Used" in Stage TWO OSIV' Engine Setups)—, simply because of New Design OSIV' ENGINE BLOCK'S "29-Middle Valley Radiator (W/C) Cooling CORE UNIT'S-Positioned Technique"—(which is in a Constant "Medium High Heat Range Area" of these Engine BLOCK Valleys) of FIG. 5 & FIG. 6, FIG. 23 & FIG. 24. However, the "30-LBS. Pound Pressure Relief CAP" Item 41 CAP(S) Areas—On TOP & FRONT Position of Item "40 Radiator Front Top Inlet FILLER NECK"—is to be REMOVED (The TOP Position CAP) NOT FRONT CAP-and-Then Pour "Waterless EVANS (NPG) Coolant" Into TOP-40 Radiator FILLER NECK Inlet HOLE—until Engine Block Valley Radiator Is Completely Full—up to the Rim of "40 Radiator FILLER NECK"—Until NO BUBBLES ARE VISIBLE—, Re-Install 41** CAP. This is the basic procedure steps taken/done—After Changing This OSIV' Engine Radiator's Coolant Fluid. (M-9) ENGINE BLOCK VALLEY RADIATOR—WATER/COOLANT FLUID USE—TYPE SYSTEM—Concluded.

(M-10) ENGINE CARBURETOR(S) OR THROTTLE BODY(S)—LINKAGE/CABLE—TYPE SYSTEMS—(Linkage—Throttle & Kickdown CABLES) On "CHOICE SELECTED COMPANY" section Page 48. "LOKAR", High Performance & Custom types Setups—Should Be Used On OSIV' Engines—Suitably & Professionally. (M-10) ENGINE CARBURETOR(S) OR THROTTLE BODY(S)—LINKAGE/CABLES-TYPE SYSTEMS—Concluded.

(M-11) ENGINE ELECTRICAL ALTERNATORS-AND-12 VOLT TO 18 VOLT DRY CELL BATTERY—TYPE SYSTEMS—(Dual Alternator(s)—Setup) or (Single Alternator—Setup)-and-Types That Should Be Used, Are On "CHOICE SELECTED COMPANY" section Pages 49."*""*→"& 50."*→", WITH "DYNA-BATT" Dry Cell Battery. (Plus basic Notes provided ON Those Pages).

(Dual Alternator Setup)—is the "6-Pound Mini-Racing Alternator"—which is Setup WITH Suitable Bracket and of "Super Heavy Duty type Flex Belt"—With A Safely Formed Item "185 Pin Screw LOCK KEY Belt LINK Area"—(For Quick Removal & Installation)—for RIGHT BANK FRONT of "119 OSIV' Cylinderhead Area—Coinciding WITH "CLOCK WISE" VALVESHAFT'S "141 Pulley Gear Sprocket ROTATION, and WITH the "10-Pound '74' Special Alternator"—which is Setup WITH Suitable Bracket and "Super Heavy Duty type Flex Belt"—With A Safely Formed Item "185 Pin Screw LOCK KEY Belt LINK Area"—(For Quick Removal & Installation)—for LEFT BANK FRONT of "120 OSIV' Cylinderhead Area—Coinciding WITH "COUNTER CLOCK WISE" VALVESHAFT'S "141 Pulley Gear Sprocket ROTATION.

(Single Alternator Setup)—Should Consist Of The "10-Pound '74' Special Alternator" Which Is "THE STANDARD" For OSIV' Engine Stage ONE & Stage TWO Setup USAGE—BECAUSE, It Can Be Setup/Mounted On Either—Engine Block Cylinderhead/Bank Front Area—& Because This Alternator Will Charge Battery "While Spinning In Either Direction".

Thus Will Make It More Simplified To Setup—A/C Air Condition Pump(s) and P/S Power Steering Pump(s) & Other Belt Drive Pumps.

(FIG. 1, FIG. 133, FIG. 20: and Other—Shows Plenty Of Areas To Choose From—to Mount & Setup "Dual or Single alternator(s)"—ON Front Engine Bank & Cylinderhead Bank—AREAS—by Valveshaft's "141 Pulley Gear Sprocket(s).)

(M-12) "AIR FILTER"UNIT—ENGINE CARBURETOR(S) OR THROTTLE BODY(S)—UNIT SYSTEM—(High Performance Re-Usable Types)—Should Be Used On OSIV' Engines—Made By "CHOICE SELECTED COMPANY" section Pages 3.(ACCEL), 25.(K & N),—Type Manufactures. (M-12) "AIR FILTER" UNIT—ENGINE CARBURETOR(S) OR THROTTLE BODY(S)—UNIT SYSTEM—Concluded.

(M-13) ENGINE BLOCK REAR UPPER VALLEY ELECTRIC FAN MOTOR(S) 207, 207L, & FAN BLADE(S) 208, 208L, & ELECTRIC FAN SHROUD 206, 206L,—SETUP SYSTEMS—Should Be Custom Made By "CHOICE SELECTED COMPANY" section Pages 18. (PERMA-COOL), 19.(SPAL),—type Manufactures, and Installed In Position-Setup Like FIG. 20, FIG. 7, FIG. 13, FIG. 17,—to which (207L Lower Dual Fan SET—Electric Motors) are to be Setup WITH Thermostatic Adjustable Temperature Heat Level Cooling ON/OFF SWITCH—Set To Turn "ON" These Dual Electric Motors—when Coolant Temperature Reaches (100° Degrees F.) to which these Electric Motors—Should Be Hooked Up To BATTERY & ALTERNATOR(S)—(in case Battery Fails—or—in case Alternator Fails).

The Larger & TOP (207 Single Electric Motor/Fan)—is to be Setup WITH Thermostatic Adjustable Temperature Heat Level Cooling ON/OFF Switch—Setup To Turn "ON" This Single Electric Motor/Fan—When "Rear Engine Block Valley Cylinder Cylinderhead's Intake Portside BASE-Area" Bank—Reaches (95° Degrees F.) to which "Thermostatic Adjustable Type Heat Temperature Switch"—is also to be Link Connected to "193 Electric Water/Coolant Pump MOTOR", and BOTH Properly Link Connected—to Battery. (NOT Alternator-nor-Starter Solenoid).

Both Water/Coolant Electric Pump Motor & Large Single TOP FAN Electric Motor—is Allowed to be—"Run Continuously"—until Engine Block's Valley Rear Area Cylinderhead's (121-BASE)—Is Cooled Down To About (95° to 90° Degrees F.) and Shuts Off, which is Suitable—Regardless If OSIV Engine Is Running or Not. (Typical Engine Cooling Methods). (M-13)—Concluded.

(M-14) ENGINE BLOCK "MOTOR MOUNT"—Should At Least Be Formed WITH "Steel" & "Hyper-Flex" Performance Polyurethane Material or Made By "CHOICE SELECTED COMPANY" section Page 18.*→ (enter Energy Suspension) and Custom Made to Mount OSIV' Engine Block Casing Mount PAD 9 Areas (Suitably)—of FIG. 1, FIG. 13, FIG. 17, Views. Or Setup to be Bolted to Engine Block Outer Casing as On (*OSIV' MODIFIED/COLOR Version(Vr.) V-type Engine VIEW Figure. (M-14) ENGINE BLOCK "MOTOR MOUNTS"—Concluded.

(M-15) ENGINE FUEL/GAS/AV-FUEL/ALCOHOL/—USAGE—(Unleaded Premium/Methanol Types)—Starting Research Test of basic OCTANE (89 to 104-Levels)—of Basic Use, or Typical RACING FUELS, Should Be USED—towards OSIV' Engines. Nitrous Oxide Boosting FUEL(NOS) Systems—Should Be Used Professionally & With Safety. (M-15) ENGINE FUEL/GAS/AV-FUEL/ALCOHOL/—USAGE—Concluded.

(M-16) OSIV' ENGINE ITEM 25 "OIL SCAVENGE PAN"—Lower Block Structure Area—UNIT—is to be Made By This Specified—"CHOICE SELECTED COMPANY" section Page 51."*"(MILODON)—to which I The Inventor/Designer—BELIEVES—that are Mare than just Professionally Qualified To Form & Develop "OSIV' Engine 'OIL SCAVENGE PAN(S)'", but are Considered Experts In The Art—to Making & Producing Custom Made OIL PANS—such as OSIV' Engine Type "Oil Scavenge Pans". (Though this is NOT a "ACCESSORY"—but though a "NEEDS"—towards the Better/Best of Believed—Suitable Manufacture Type—in such Art Forming, is "ACCESS" to such Company of the NEEDS), Especially for the OSIV' Engine Stage TWO Setup, to which This NEW Type Design "Oil Scavenge Pan" of this OSIV' Engine System, is so intended for. (M-16) OSIV' ENGINE ITEM 25 "OIL SCAVENGE PAN"—Concluded.

(M-17) OSIV ENGINE ITEM(S) 124MR & 124ML "EXHAUST MANIFOLD/HEADER(S)"—Structure Area Items—can be Made By "CHOICE SELECTED COMPANY" section Page 52."*"(HEDMAN HEDDERS)—to which are well Experienced Towards Making & Developing A Professional Type "EXHAUST HEDDER"—Best Suited for this OSIV' ENGINE—as Inventor/Designer Believes. (Though NOT A "ACCESSORY"—but though a "NEEDS"—towards the Better/Best of Believed—Suitable Manufacture Type—in such Art Forming, is "ACCESS" to such Company of the NEEDS), for OSIV' Engine Stage ONE & STAGE TWO Setups, for "Best Suited HEDDER", is so intended for. (M-17) OSIV' ENGINE ITEM(S) 124MR & 124ML "EXHAUST MANIFOLD/HEADER(S)"—Concluded.

(M-18) OSIV' ENGINE NUTS & BOLTS & WASHER & FASTENER/LOCKS"—Should Be Formed By "CHOICE SELECTED COMPANY" section Page 35.*(APP),—to which are Best Believed—Manufacture In Such Art, of Designing & Forming & Producing These Such "ACCESSORIES". (M-18) OSIV' ENGINE "NUTS & BOLTS & WASHERS & FASTENER/LOCKS"—Concluded.

What I claim as my invention and design & technique(s)/method(s) is:

1. A four-cycle internal combustion engine radiator cylinder block and rotary valveshaft system for an internal combustion engine comprising:

a means for continuously oil cooling, water and air cooling, internal engine block cylinders, pistons, and rotating valveshaft cylinderheads, without separate external radiator coolers;

further comprising—a liquid and air flow cooling and passageways, combined middle engine cylinder block valley radiator core located structures, having rear valley mounted electric air cooling fans and electric water coolant pump, and having front engine block valley, front mounted oil filter housing base plate and oil filter, communicating with two, below positioned:

internal cylinder block valley base horizontal cavities of oil reservoirs;

between two internal cylinder block valley base, horizontal and communicating vertical, cavities of air to oil passageways, vertically communicating downward through bottom respective, first and second or right bank and left bank, engine block cylinder barrels and walls, and cylinder barrel's sleeve liner walls or bores, having respective bottom inside diameter grooves, securing respective laminated spring boot oil seals, and flow-routing air and oil to opposite bottom communicating internal:

first and second or right bank and left bank, engine block casing lower bulkhead oil pan rails, having vertical communicating horizontal air-oil passageways of cavities, vertically communicating downward from and through opposite bottom respective, first and second or right bank and left bank, engine block cylinder barrels and walls, and cylinder barrel's sleeve liner walls or bores, having opposite respective bottom inside diameter grooves, securing respective opposite diameter side on laminated spring boot oil seals, and flow-routing air-oil vertically into, and horizontally forward through:

communicating internal first and second or right bank and left bank, engine block casing lower bulkhead oil pan rails, having communicating horizontal air-oil passageways, extending to front engine block cylinder casing;

being within combined middle engine block valley bulkhead base, and engine block upper casing valley decks;

and being within combined middle engine block valley bulkhead base, having combined crankcasing arch triangular dome under engine block valley bulkhead base, being combined;

vertically and horizontally in acute angular relation to, and in between, and above, and triangularly arching doming around crankshaft's outer diameter perimeter rotating and reciprocating assembly, and being combined to at least:

one front most, and one rear most, axially spaced related, engine block main rib bulkheads, having center central vertical and vertical slant, internal main oil passageways, communicating from a:

high oil pressure oil reservoir, within said internal engine cylinder block, communicating valley base horizontal oil reservoirs of cavities;

flowing oil to engine block's main rib bulkhead's crankshaft journal bores having combined extending main rib bulkhead forks:

having inner matching grooved rails connected to, matching outer grooved tracks, on main rib bulkhead fork lock caps, secured with common bolt holes and bolts being internally vertical positioned in extended:

main rib bulkhead fork ends and main rib bulkhead fork lock cap's shoulder ends;

and said main rib bulkhead's extending forks and connected said fork lock caps, having inside diameter journal bores:

having axially spaced diameter bearing and seal grooved seats, rotatably supporting axially spaced matching outer diameter surfaced positioned, two flat cylindrical shaped pieces, of free spin bearings, being between two pairs of axially spaced matching, outer diameter surfaced positioned, two flat cylindrical shaped pieces of free spin bearing oil seals, structures in combination and spaced relation to each other, axially of said crankshaft rotating and reciprocating assembly, and rotatably supporting said crankshaft rotating and reciprocating assembly;

and said front most and rear most, engine block main rib bulkheads, combined extending main rib bulkhead forks, connected main rib fork lock caps and free spin bearings and oil seals being set axially, horizontally, and spaciously apart of said crankshaft;

to including multiple engine block main rib bulkheads, combined extending main rib bulkhead forks, connected main fork lock caps, having in acute angular relation to one another, and each other, to comprise central said middle engine block valley bulkhead base, being combined to:

upper first and second or right bank and left bank, engine block casing valley base bulkheads;

having first and second or right bank and left bank, block cylinder barrel's water jacket passageways extending to:

combined front most to rear most, upper engine block, upper casing valley decks, first and second or right bank and left bank, mounting surfaces and gaskets, having multiple rectangular water coolant outlet passageways between vertical positioned common bolt holes and bolts, securing mounted communicating top water coolant inlet passageways, on bottom mounting surfaces, on right side and left side, of top lid cover, mounted to said block valley radiator core structure deck surfaces;

being combined and connected to, and within:

first and second or right bank and left bank, engine block cylinder barrel's outer walls, and block valley bulkhead's cylinder casings, and being combined upon said engine block valley bulkhead base, combining to said engine block main rib bulkheads;

and which said engine block valley radiator core located structures, having rear mounted electrical air-cooling fans, working in-conjunction with, electric water coolant pump communicating with said valley radiator core structure having:

internal liquid flowing, down flow system of passageways, being multiple vertical internal holes or s-curve tubes, combined to:

multiple air flow cooling horizontal positioned cross fins, or along horizontal plane positioned tunnel holes, being vertically stacked as having horizontal air flowing passageways in between;

and said liquid flowing, down flow system of passageways, having below communicating internal water coolant collector cavities having:

internal central bottom along horizontal plane positioned, water coolant scavenging tunnel structure, having central communicating water coolant scavenge holes in horizontal diameter spaced positions, communicating with said internal water coolant collector cavities;

and said water coolant scavenging tunnel structure's internal passageway cavity is communicating to said engine block valley radiator core having:

front bottom water coolant outlet auxiliary neck;

and said water coolant scavenging tunnel structure's internal passageway cavity is communicating to said valley radiator core having:

rear bottom water coolant outlet neck base, having vertical positioned water coolant bore hole, housing and rotatabley supporting a pump propeller having center vertical axis shaft, sealed within said valley radiator core's rear bottom water coolant outlet neck base, having common above mounted electrical water pump motor, driving said propeller vertical axis shaft that's communicating to rear engine block valley base, having:

internal outlet flowing water coolant passageways communicating with first and second or right bank and left bank, rear engine block cylinder barrel's water coolant jacket passageways, therein being combined to:

lower said middle engine block valley bulkhead base;

combined crankcasing arch triangular dome bulkhead;

and being combined to, and horizontally in between, and downward, in acute angular relation, to at least:

one said front most, and one said rear most, engine block main rib bulkheads, and to outer perimeter lower edge of said combined main rib bulkhead extending forks, and around the bottom areas on said first and second or right bank and left bank, block cylinder barrels, and being combined horizontally between, and to, outer lower edges on said engine block main rib bulkheads, and upper outer sides, on combined said extending main rib bulkhead forks, comprising—said first and second or right bank and left bank, engine block casing lower bulkhead oil pan rails having:

inverted horizontal parallel base surfaces, being parallel to central engine block crankshaft and main bearing journals and said engine block main rib bulkhead's extending fork's bearings and seal journal bores, and center cross axis point;

being in between said engine block casing lower bulkhead oil pan rails, comprising a triangular curved peeking arching crankcase dome bulkhead base internal structure being combined to, and below, said engine valley block bulkhead base, comprising engine block valley bulkhead base arch crankcase dome, and dome line inner surface cavity structure, in acute angular relation to each other, having:

outward extending non-staggered on center V-line cylinder block cylinder barrels, and cylinder bores positioning, and spacing;

axially of said crankshaft, and being respectively in conjunction with said first and second or right bank and left bank, engine block casing valley base bulkheads having:

extending said engine block upper casing valley decks;

and outer said engine block casing lower bulkhead oil pan rails of bases, extending to engine block upper casing cylinder decks;

all respectively combining horizontally and vertically in acute angular relation, between, and to:

engine block front main bulkhead flange, and front engine block cylinder casing;

and outer edges on said engine block main rib bulkheads;

engine block rear main bulkhead flange, and rear engine block cylinder casing;

combined to a first and second or right bank and left bank, top mounting cylinder deck surfaces, being combined to a said first and second or right bank and left bank, engine block cylinder barrel's outer walls, and having inner bores securing removable said cylinder barrel's sleeve liners, and said engine block cylinder barrel wall's extending outer ends having:

said combined first and second or right bank and left bank, engine block upper casing cylinder decks—cylinder head mounting surfaces, having common bolt holes and bolts therein, and having included common water coolant jacket passageway holes therein, flowing water to cool valveshaft cylinderheads;

said first and second or right bank and left bank, engine block casing lower bulkhead oil pan rails with inverted horizontal parallel base surfaces with internal vertical air-oil passageway cavity holes, having:

communicating common oil relief ball valve units, including spring valve units, including pin hole freeze plug units, therein;

being sealed and joined up at the said block casing lower bulkhead oil pan rails inverted horizontal parallel base surfaces, with common bolt holes and bolts securing matching gasket, with a fixed matching mounted oil scavenge pan crankcase cover having:

communicating oil relief holes and bolts holes in mounting base and surfaces, combining to a halfmoon diameter tub shape wall, with combined rear square bulkhead platform;

and said oil scavenge pan tub wall having:

internal halfmoon diameter oil cooling and scavenging passageways, with inner tub wall, having diameter degree spaced positioned, communicating crankcase cavity inlet oil holes, communicating from said engine block casing lower bulkhead oil pan rail's internal vertical air-oil passageway cavities, cooling and directing oil flow through said oil scavenge pan wall—to central bottom internal horizontal oil scavenge hole, communicating to front slant internal vertical oil scavenge hole passageway within front oil scavenge pan tub bulkhead;

and said oil scavenge pan tub's inner wall surface having:

fixed common mesh screen lining, clearing said crankshaft rotating and reciprocating assemblies, and;

said oil scavenge pan tub's inner wall surface and fixed common mesh screen lining, is pressing upon said engine block main rib bulkhead fork lock cap's bolt heads, and;

sealing up entire crankcase cavities, with common bolt holes and bolts securing said oil scavenge pan to said first and second or right bank and left bank, engine block casing lower bulkhead oil pan rails, and combined front most and rear most, engine block:

front main and rear main, bulkhead flange oil pan rail's inverted mounting surfaces;

to which said engine block's front main bulkhead flange internal:

first and second or right bank and left bank, lower front bulkhead cross horizontal oil pan rails having internal oil scavenging passageway holes, communicating from outer block casing, through internal said lower bulkhead oil pan rail's horizontal air-oil passageways, towards central engine block main rib bulkhead's crankshaft main journal bores outer spacing perimeter;

communicating to, a first and second, horizontal main oil scavenge passageway holes, communicating to front engine block casing surface having mounted matching gasket, and a crankshaft nose driven, vertical positioned, multiple gear drive oil scavenging and oil cooling, combined oil pumping system unit case housing device having:

a internal bottom vertical slant hole with upper horizontal joined oil scavenge passageway hole, communicating to said oil scavenge pan's front bulkhead wall having said vertical slant oil scavenge passageway hole, communicating to said oil scavenge pan's bottom central horizontal internal oil scavenge hole, having:

bottom front common bolt holes, bolts, gasket, and block-off plate, having joined threaded oil drain plug bolt, with fixed inner mesh screen filter tube and oil seal, a means for cleaning scavenge oil flowing into said oil scavenge pump device, being secured therein;

which said multiple gear drive oil cooling and oil scavenging, combined oil pumping system unit case housing device, having:

join various cooling oil grooved cured passageways and oil holes, a means which cools and re-routes siphoned, and scavenged oil flow, under pressure, back to said oil filter housing base plate and oil filter;

and into said engine block valley front base bulkhead and deck, into said internal block valley base bulkhead's high pressure oil reservoir cavity;

by rotation motion of below interconnecting supported crankshaft, extending in said engine block valley base arch crankcase cavity dome, and said crankshaft being further rotatably supported with:

first and second or right bank and left bank, common connecting rods and rod bearings, common pistons and piston wrist pins and piston rings, assemblies;

and including connecting rods having internal oiling passageways, and having:

combining big ends into a swivel hinge V-lock forks connecting rods, having:

fork lock caps, fork and cap lock pins, and said free spin bearing and seals, connecting rods assemblies;

having extended small ends, swiveling and supporting:

said first and second or right bank and left bank, piston's assemblies, including raised cross force top dome structure pistons with common piston rings, being secured to said connecting rod's small ends, with piston wrist pins, having piston pin cup locks, with piston cup lock lock seals, assemblies;

located and reciprocating in said first and second or right bank and left bank, engine block cylinders;

and respectively linked connected to said rotatable crankshaft for reciprocating movement, towards and away from said crankshaft, and between top dead center and bottom dead center positions, and said crankshaft being rotatably supported by said engine cylinder block's said main rib bulkhead's combined extending main rib bulkhead forks with said main rib bulkhead fork lock caps, with said vertical positioned common bolt holes and bolts and locking bolts, and first and second or right bank and left bank,:engine block upper casing cylinder deck's cylinder head mounting surfaces having:

common cylinder head shim gaskets with common cylinder head bolt holes with bolts, securing first and second or right bank and left bank, internal rotatable valveshaft' cylinderheads, to said first and second or right bank and left bank, engine block cylinder's extending outer ends, partially defining first and second or right bank and left bank, internal combustion chambers;

including with said internal rotatable valveshaft' cylinderhead's valley intake port's mounting surfaces securing:

upper middle engine block valley, common air/fuel mixture primary carburetors or throttle bodies and block-of plates, fixed to—a multiple position changeable intake manifold base having, front, rear, top, bottom, air/fuel inlet port passages;

and said intake manifold base having:

internal open plane horizontal rectangular cavity, having cross horizontal plane opposite sides or air/fuel outlet side ports, having equally spaced outer first and second sides of vertical cut mounting surfaces, with shim gaskets and bolt holes and bolts;

communicating with, and mounted between, and fixed to, matching communicating first and second, inlet manifold support runner's, mounting surfaces having:

bottom support lip on first and second, block valleyside air/fuel said inlet intake manifold support runners having arching curved internal passageways, with communicating air/fuel outlet ports, having equally spaced outer first and second, block valleysides of mounting surfaces, fixed in slant, in acute angular relation to each other, having vertical cut mounting surfaces with shim gaskets, common bolt holes and bolts;

communicating with, and mounted between, and fixed to:

communicating said valveshaft' cylinderhead's first and second, valleyside's matching communicating mounting surfaces and main airfuel inlet intake port runner's internal passageways, being combined to said mounted first and second or right bank and left bank, internal rotatable valveshaft' cylinderheads;

and being positioned above said engine block upper casing valley deck's sides, and said engine block cylinder decks;

and respectively communicating to and with:

central horizontal positioned, internal circumference diameter perimeter cylinderhead's valveshaft cylinder bore walls, and having included cylinderhead bearing cylinder sleeve liner walls, being of adjustable and quick removable cylinderhead bearing cylinder sleeve liner walls, and inside diameter bore's surfaces, rotatably supporting internal first and second or right bank cylinderhead valveshaft' and left bank cylinderhead valveshaft'—both being a single supported rotatable solid cylinder shaped and structured shaft, per said cylinderhead, and having:

three axially spaced dividing, outer perimeter ring grooves, securing piston rings or common ring seals, dividing axially spaced—85° outer perimeter diameter gap averaged inlet intake valves, and 90° outer perimeter diameter gap averaged outlet exhaust valves, being wedge shaped cutout pockets for valves;

comprising—opening and closing of communicating passageways during rotation of said valveshaft;

and said valve pockets, being of two rotating valve pockets per said combustion chamber or said piston and block cylinder bore;

comprising—said single solid valveshaft having:

first and second or right bank and left bank, said inlet intake valve wedge shape cutout pockets;

communicating with center axis horizontal plane positioned, internal fresh air and air fuel mixture passageway bore holes, both being rotationally sequenced timed and positioned axially on said valveshafts, for first-cycle air/fuel intake crankshaft rotation stroke, of timed communication with said valveshaft' cylinderhead's internal first and second, main air/fuel inlet intake port runner passageways, and to intake inlet combustion chamber pocket passages, within internal first and second or right bank and left bank, crossforcing+crossfiring combustion chambers, having:

central dividing center cross force structures;

having catercorner axially spaced positioned, rectangular oblong shaped intake inlet combustion chamber pocket passageway's walls—having:

communicating cross horizontal angled positioned threaded bore hole securing ignition spark plug, and having opposite catercorner axially spaced positioned, rectangular oblong shaped exhaust outlet combustion chamber pocket passageway's walls—having:

communicating cross horizontal angled positioned threaded bore hole securing ignition spark plug;

comprising—dual spark plug combustion chambers in said combustion chamber pocket wall's vertical passageways, positioned axially below and within said rotatable valveshaft' cylinderhead's mounting bases, having:

above central location, horizontal positioned, said valveshafts' within said cylinderhead's central horizontal plane positioned internal cylinder bores, having bearing cylinder sleeve liner's walls;

and being centrally above and within perimeter of said engine block cylinders having sleeve liners or bores;

and said single solid valveshaft having first and second or right bank and left bank, said outlet exhaust valve wedge shaped cutout pockets, being rotationally sequenced timed and positioned axially on said valveshafts, for fourth-cycle burnt gases exhausting crankshaft rotation stroke, of timed communication—from, and with, said cylinderhead's internal first and second, exhaust outlet combustion chamber pocket passageways, within said first and second or right bank and left bank, crossforcing+crossfiring combustion chambers, having:

said central dividing center cross force structures, separating said opposite catercornered axially spaced positioned, rectangular oblong shaped exhaust outlet combustion chamber pocket wall's vertical passageways;

communicating to, and with, opposite side of same said central horizontal positioned, internal circumference diameter perimeter, cylinderhead's valveshaft cylinder bore walls;

having same said included cylinderhead, internal cylinder bore, bearing cylinder sleeve liner walls, being of adjustable and quick removable cylinderhead bearing sleeve liner walls,—communicating to matching catercornered, axially spaced internal communicating:

first and second or right bank and left bank, internal burnt gases, outlet exhaust port runner's passageways only, having communicating outer end exhaust ports with vertical slant mounting surfaces with common axially spaced, and cross horizontal plane positioned, bolt holes and matching gaskets;

communicating to, and mounting:

first and second or right bank and left bank, common exhaust outlet manifold header pipe's internal communicating passageways, being secured to said exhaust ports with common bolts, and being positioned connected above said first and second or right bank and left bank, engine block upper casing cylinder deck's outer casing sides;

further including:

said first or right bank cylinderhead valveshaft' (A) being turned-in clockwise rotations, and said second or left bank cylinderhead valveshaft' (B) being turned-in counter-clockwise rotations;

both said rotatable valveshafts having:

front common extending drive pinion nose snouts, having common axially spaced preload roller bearing,back seals, with common preload roller pin bearings;

both said rotatable valveshafts having:

rear common extending support pinion tail snouts, having common axially spaced preload roller bearing back seals, with common preload roller pin bearings;

and both said valveshaft's communicating center axis horizontal plane positioned, internal fresh air, and air fuel mixture passageway's bore hole rear ends, having common freeze plug cap seals, therein;

comprising first stage or stage one, said rotatable valveshafts and engine systems, and for being a second stage or stage two said rotatable valveshaft's platform and engine systems;

and said both rotatable valveshafts having further included:

front axially spaced, based, circumference diameter suction turbine fin shaped curved grooves, having communicating axis diameter spaced positioned air holes, communicating with said center axis horizontal plane positioned, internal fresh air and air fuel mixture passageway bore holes, about said front pinion bases, having axially spaced positioned, front common extending drive pinion nose snouts, having internal center axis communicating cross-center axis, oil grease packing hole, with common grease fitting valve;

having common axially spaced preload roller bearing back seals, with common preload roller pin bearings, having rear axially spaced based circumference diameter blower turbine fin shaped curved grooves, with communicating axis diameter spaced positioned air holes, communicating with said center axis horizontal plane positioned, internal fresh air and air fuel mixture passageway bore holes;

about said rear support pinion tail snout's bases having:

axially spaced rear common extending support pinion tail snouts, having common axially spaced preload roller bearing back seals, with common preload roller pin bearings;

and said communicating center axis, horizontal plane positioned, internal fresh air and air fuel mixture passageway bore hole ends, having common freeze plug cap seals, therein;—comprising:

said second stage or stage two said rotatable valveshafts and engine system;

and both said stage one and stage two rotatable valveshafts, further having included:

common front and rear axially spaced, preload bearing retainers;

said front preload bearing retainers, having center axis bore hole, having common inside diameter o-ring groove securing o-ring seals, and outer perimeter lip having—eight diameter spaced positioned, horizontal bolt holes;

said rear preload bearing retainers having:

common center axis oil grease packing hole passageway;

and said front and rear, preload bearing retainers, being commonly fixed and journaling said front and rear, preload roller pin bearings, supporting and rotatable securing, said rotatable valveshafts;

within said first and second or right bank and left bank, rotatable valveshaft' cylinderhead's said central horizontal positioned, internal circumference diameter perimeter, cylinderhead valveshaft cylinder bore walls;—and being within said included:

adjustable and quick removable cylinderhead bearing cylinder sleeve liner walls,—having front and rear, outer diameter surface circumference, axially spaced grooved air passageways, with diameter degree, equally spaced, common air hole passages,—being axially aligned, and communicating with:

said rotatable valveshaft's front and rear, turbine fin grooves;

said cylinderhead bearing cylinder sleeve liners having:

front outer perimeter diameter circumference, axially spaced, common extending lip with rim, having inner perimeter lip seat surface, with eight diameter spaced positioned, horizontal curved oval bolt holes with bolts;

being fixed and secured within front face, of said first and second or right bank and left bank, valveshaft' cylinderheads and said central horizontal positioned, internal circumference diameter perimeter, cylinderhead's valveshaft cylinder bore walls, having:

rear back wall central, center axis common bore holes, with matching threaded preload adjusting bolt, with center axis oil grease packing hole, with common grease fitting valve, and preload bolt lock nut;

cylinderhead bearing cylinder sleeve liners, being further secured in front face surfaces of said cylinderheads having:

matching diameter bore lip groove seat surfaces, having eight positioned, perimeter diameter, equally spaced, horizontal threaded bolt holes with bolts therein;

further including, front most first, and front most second, valleysides of said rotatable valveshaft' cylinderheads having:

communicating fresh air inlet ports with slanted mounting surface passageways, between axially spaced bolt holes, said fresh air inlet passageways,—being aligned and communicating to, said first and second, said cylinderhead bearing cylinder sleeve liner wall's front outer circumference diameter axially spaced grooved air passageways;

with communicating mounted, central front most upper engine block valley, fresh air inlet manifold, having combined wide central oval shaped air filter housing, having inner surface mesh screen lining, with top vertical air passage hole, having common grommet boot seal, and securing common wide central oval air filter unit;

to include with or without front and rear common block-off wide oval plates, and having first and second, internal communicating wide arching air passageways, with extending outer ends, having mounting surfaces, and being axially between two common mounting bolt holes with matching gaskets;

being mounted in between right and left, cylinderhead banks, in inverted acute angular relation to each other's opposite cylinderhead,—to said front most first, and front most second, valleysides on said rotatable valveshaft' cylinderhead's said communicating fresh air inlet port's slanted mounting surfaces, and passageways, and said fresh air inlet manifold, being secured with said bolt holes and bolts;

further including:

rear most first, and rear most second, valleysides on said rotatable valveshaft' cylinderheads, having communicating fresh air and air fuel vapor's outlet ports, and slanted mounting surfaces, with passageways between axially spaced bolt threaded holes;

and said vapor outlet passageways, being aligned and communicating to:

said first and second, cylinderhead bearing cylinder sleeve liner wall's rear outer circumference diameter, axially spaced, grooved air passageways;

and said fresh air and air fuel vapor's outlet port's slanted mounting surfaces with passageways, having said mounting surfaces with common bolt holes and matching gaskets, and bolts securing matching communicating:

rear most first, and rear most second, valleysides on rotatable valveshaft' cylinderhead's, fresh air and air fuel vapor's outlet manifold pipes, having internal passageways extending downward at a slant angle, and communicating into said rear middle engine block valley base, having said two, internal valley base bulkhead, vertical air to oil passageways;

further including said first and second or right bank and left bank, rotatable valveshaft' cylinderheads,: having included:

bottom mounting base surfaces, having two halfmoon diameter grooves, per said rotatable valveshaft' cylinderhead's combustion chamber,—matching and allowing, said engine block cylinder sleeve's or liner's included top deck raised lip rim, having two opposite diameter side, notch grooves,—match fitting up into said cylinderhead's bottom mounting base surface's halfmoon diameter grooves;

having common matching surface cylinderhead mounting shim gasket in-between;

a means sealing said combustion chambers and said engine block cylinder bores having said engine block cylinder sleeve liners of bore's deck surface;

and said first and second or right bank and left bank, rotatable valveshafts, and said first and second or right bank and left bank, valveshaft's cylinderhead bearing cylinder sleeve liners, as assemblies, being located centrally below:

first and second or right bank and left bank, valveshaft' cylinderhead's top deck's base areas, with top surfaces having common horizontal, and vertical raised, air cooling fins between lowered air grooves;

and said first and second, valveshaft' cylinderhead's main air/fuel inlet intake port runner's top wall deck and surfaces, having:

first and second, fuel injector bosses/bases platforms, having slant and vertical bore holes with threads, securing first and second, common electric fuel injectors devices, communicating at least partially into said first and second, main air/fuel inlet intake port runner's internal passageways;

and the said rotatable valveshaft' cylinderheads being:

solid cast or forged metal, brick wedge shaped casing, cylinderheads;

and having included common internal water coolant cavities and passageways, communicating with said first and second or right bank and left bank, engine block cylinder deck's water coolant jacket passageways, between four common vertical positioned, internal bolt holes with bolts, per said engine block cylinder and piston bore housings, securing said rotatable valveshaft' cylinderhead's bottom mounting base surfaces there on;

respectively including upper rear said engine block valley location positioned, electric fan shroud structure having:

two lower positioned, common electric fans;

and one upper positioned, large diameter, common electric fan;

all three said electric fans being wired connected to common electrical thermostat heat switches, being commonly mounted in rear said engine block upper casing valley decks and inner sides, and into said cylinderhead's rear valleyside mounting bases;

and said switches being linked-up connected to said electrical water pump motor, and connected to a:common belt drive electrical alternator charging unit, and electricity storage batteries;

to which all three said electrical fans which draws or sucks air through said middle engine cylinder block valley radiator core structured, air cooling passageways, and said upper block valley air flow stream spaces, from said front engine block valley and valleyside's open space air flow areas;

and while said electrical water coolant pump motor, is circulating water coolant through said:

rotatable valveshaft' cylinderhead's communicating internal water jacket passages, communicating engine block middle valley radiator core structure internal water passageways, and joined communicating internal engine block water coolant jacket passageway and cavities therein;

further respective first and second or right bank and left bank, said rotatable valveshaft's front drive pinion nose snouts having included:

common mounted adjustable valveshaft rotation timing pulley gears, having axially spaced outer diameter circumference track guide lips, or dividing raised track rails, rotation securing first and second or right bank valveshaft'(A)'s, and left bank valveshaft'(B)'s, matching halfmoon diameter circumference gear teeth, pulley flex timing drive belts;

linkup connected to said front central engine block casing mounted:

said crankshaft nose driven, vertical positioned, multiple cog gears, or multiple roller wheel 40° spaced gear teeth, multiple cog pinion snout gears, geared drive oil scavenging/siphoning/cooling/oil pumping system unit case housing, with matching front cover plate, joining device,—having internal vertically housed,—bottom positioned, middle positioned, top positioned, said cog gears;

and said top positioned and middle positioned, said cog gears having:

common front extending pinion noses or snouts, rotationally supporting and securing, external, first top and second middle, axially spaced vertical positioned, matching connected belt gear teeth, pulley timing drive gear members, being half the diameter and circumference smaller/sizes, of said adjustable valveshaft's rotation timing gears;

having said flex timing drive belts connected;

and programming TWO-360° of complete rotations of said crankshaft, to ONE-360° of complete rotation of said valveshafts—a means for four-cycle engine operations;—and towards opening and closing said:

first and second or right bank and left bank, inlet intake air fuel mixture, and outlet exhaust burnt gases, rotatable valveshaft' cylinderbead's combustion chamber pocket passageways;

and including both said first and second, rotatable valveshaft's first and second:

intake and exhaust, valve wedge cutout shape pockets, communicating with said first and second, inlet intake and outlet exhaust, ports and runners passageways;

and further respectively included with said crankshaft having, common rear end diameter circumference shaped, crank flange having:

common mounted flex-plate flywheel, with securing bolt holes and bolts, and said flex-plate flywheel communicating with said engine block rear bulkhead flange's mounted common electrical starter motor's matched corresponding starter engaging gear, having electrical solenoid unit starter device, being wire connected to electricity storage battery and ignition starter switch;

and said crankshaft further having:

front end extended nose snout, common rotating mounted, crankshaft pre-magnetized ignition trigger balancer with hub;

and being with included, front said engine block casing mounted, corresponding common bracket mounted:

trigger ignition pickup pin wire being—distributorless ignition timing with spark plug electricity firing coils and electricity firing wires, being common engine electrical ignition mounting kit systems, being commonly mounted to said engine, being linked-up connected to single and, said dual spark plugs per said rotatable valveshaft' cylinderhead's combustion chamber, igniting said air/fuel mixture before and during top dead center crankshaft rotation second-cycle compression stroke;

and said first and second or right bank and left bank, rotatable valveshaft' cylinderheads, having:

front common mounted, common belt drive fuel pump devices, having common fuel line hoses being connected to common fuel cell tank, and said fuel line hoses being connected to said mounted common carburetors or throttle bodies;

with including fuel rail lines, commonly mounted to said first and second, valveshaft' cylinderhead's mounted said first and second, common electric fuel injector system devices;

and said first and second or right bank and left bank, valveshaft' cylinderheads, having:

front top mounted, said first right cylinderhead bank clockwise rotating belt driven common electricity charging alternator, having positive output volt wires connected to,—said rear engine block valley electrical water pump motor's positive input terminal;

and said alternator's positive output volt wires connected to said:

bottom dual fans, and upper top single fan, shroud positioned, rear engine block valley air/cooling electrical fan motor's positive input terminals;

working in conjunction with said rear engine block valley mounted, heat thermostat on/off adjustable temperature switch, linked-up connected to said common electricity storage battery, or linked-up connected to said engine starter motor's electrical solenoid;

with said electrical ignition coil firing timing system, for said electrical ignition spark plug systems, being joint-connected with said storage battery;

and having front top mounted, said second left cylinder bank counter-clockwise rotating belt driven directional electricity charging alternator, being mounted for auxiliary batter storage purpose;

and said front engine block having:

first and second, common flex timing drive belt's guarding shield, or windage protectors, front engine covering shroud,—being commonly mounted with tube spacers and bolts, to said front engine block casing, and to said front rotatable valveshaft' cylinderhead's casing, first and second or right bank and left bank, front face surface and outer perimeter casing surface areas;

comprised four-cycle engine and engine system.

2. An four-cycle internal combustion engine cylinder block and engine—in accordance with claim 1 and further including axially spaced first front, second middle, third middle, fourth middle, fifth rear—said engine block main rib bulkhead's extending fork's and fork lock cap's, bearing and seal main journal bores having:

inner diameter circumference common groove seats, having said two piece free spin bearings being—two halfmoon diameter circumference wide flat formed surface pieces of freely spinning bearing structures, having matching 180° central outside diameter circumference surfaced oil grooves, having communicating oil passageway holes through said bearing surface walls, being between two combining formed axially spaced outside diameter circumference surfaced—raised guide rails, combined formed assemblies of a two piece free spin bearing assemblies;

and said two piece free spin bearing structures, being positioned between two sets of axially spaced—said free spin bearing oil seals being—two pairs of two halfmoon diameter circumference, narrow flat formed surfaced pieces of freely spinning bearing oil seals—having:

matching 180° one-sided outer edges, of diameter circumference formed raised lips/rails—combined formed assemblies, of said two piece free spin bearing oil seals assemblies;

and said two piece free spin bearing structures, and said two piece free spin bearing oil seal structures, of combination assemblies, and both said assemblies being rotatably supported by said engine cylinder block arch crankcase's, combined main rib bulkhead's, combined main rib bulkhead's extending forks with connected main rib bulkhead's fork lock caps and bolts, of said structures, being in spaced relation to each other—axially of said crankshaft;

and rotatably supporting and securing said crankshaft's main bearing journals—having common internal cross-drilled oil passages—communicating to, and through, throw arm pin journals and, further supporting and rotatably securing said crankshaft having, common counter weights being opposite ended of combined crankshaft throw arms having, common internal drilled oil passages, and having in between combined throw arm pin journals having, central diameter circumference oil groove, with communicating common internal drilled oil passages with throw arms, and rotatably supporting said:

swivel-hinge V-lock forks, connected fork lock caps, connected forks and cap's locking pins, combination connecting rods, comprising big end's—of said connecting rods assemblies,—rotatably supporting a smaller common diameter circumference set pair of said:

two piece free spin bearings and, being between said two sets of two free spin bearing oil seals;

and either assembly being axially spaced and rotatably secured within said big ends of said connecting rods assemblies having:

first and second or right bank and left bank, extended rectangular rods or structures, having central internal vertical oil passageways from said big ends, extending and communicating, to/with, small ends—having common journaling bore holes and inner surfaces,—swivelly supporting two axially spaced, inner surface diameter circumference, formed grooves, securing two o-ring oil seals;

and said small end's journal bore holes, swivelly supporting outer diameter circumference surfaces, of said:

first and second or right bank and left bank, piston wrist pins—having opposite ends of formed arm bases or shoulders, and having off-center central—internal horizontal plane—center axis oil passage hole,—communicating internal central vertical cross axis oil passage hole—communicating to central outer diameter circumference surfaces—formed oil grooves; having top and bottom, outer surfaces, central horizontal crossing oil groove notches;

and said opposite end's formed arm bases/shoulders, being formed positioned partially off-center vertically of horizontal center axis—towards programming high or low compression ratio piston height changeability;

and said formed arm bases/shoulders, supporting and connected and secured to said first and second or right bank and left bank, pistons—having formed:

inner piston center bore cup,—having vertical parallel, horizontally, axially, spaced—two slot grooves, being connected and partially securing, to said first and second or right bank and left bank, piston wrist pin's arm bases/shoulders, and said inner piston center bore cups having outer surface diameter circumference threads and off-central diameter circumference oil groove—communicating to matching threaded connecting first and second, said piston pin cup locks's formed inner and outer diameter circumference threaded surfaces—having communicating off-central diameter circumference oil grooves—having communicating opposite area, internal horizontal oil holes, through walls, and communicating with said piston wrist pin's arm bases/shoulders—off-center internal horizontal plane central axis oil passage holes;

and said piston pin cup locks, having:

formed bottom base bolt, having inner bore circumference beveled edges and outer diameter perimeter circumference base plate—having outer edge diameter circumference raised rim lips, and being further, matched thread connected, and secured, to said piston's walls having inner diameter circumference bore surfaced matching threads,—having matching communicating off-central diameter circumference oil grooves,—and below inverted formed diameter circle mounting surfaces having outer perimeter circumference inverted rim groove lip seats, and below formed diameter circumference piston cup lock lock seal grooved seats,—having below formed bottom diameter circumference angled beveled edges;

and said pistons wall's inner diameter circumference, off-central diameter circumference oil grooves, having:

at least four 90° spaced, horizontal communicating oil holes of passageways, communicating to four outer diameter piston's walls/skirts surfaces,—having 90° spaced vertical formed oil grooved slots—with bottom slant edges;

and further having communicating, off-central diameter circumference, outer piston wall surface's oil groove, having above vertical spacing, of four common diameter circumference positioned formed—piston ring grooves, supporting and securing four various common, low and medium, tension piston rings,—and said formed piston ring grooves having:

at least five internal communicating vertical, common oil relief passageway holes, spaced 15° apart—between said 90° spaced vertical formed oil groove slots, and communicating to bottom internal said piston walls and walls/skirts common internal outer diameter perimeter areas,—communicating to said bottom piston walls/skirts—formed bottom diameter circumference angled beveled edges,—communicating with connected bottom formed first and second said:

piston cup lock lock seals, being secured in said piston's inner diameter circumference walls/skirts,—formed diameter circumference piston cup lock lock seal grooved seats, having below formed bottom diameter circumference, angled beveled edges and, said piston cup lock lock seals, having outer diameter perimeter beveled edge oil groove's—base circle, having outer edge diameter circumference raised lips,—having formed horizontal oil relief grooved slots, being spaced 15° apart—between said 90° spaced—vertical formed piston outer wall/skirt oil groove slots,—and communicating with bottom said piston ring groove's internal vertical oil relief passageway holes;

and said piston cup lock lock seals, having common separator line, vertical cut, between two common spaced, small dimple vertical holes, for removal and installation;

and further secure locking said piston's formed cup locks therein, comprising—said pistons assemblies, being commonly fixed and coordinated below upper first and second or right bank and left bank, piston's top deck surfaces,—and having included:

first and second or right bank and left bank, upward extending top central, opposite sided-curved, catercornered, center cross-force structures—combined catercornered positioned,—rectangular/oblong shaped, vertical raised platform domes—having center diameter, partial circular, formed cross-force section—sunken dish, and being commonly matched formed—fitting up into mounted said:

first and second or:right bank and left bank, rotatable valveshaft' cylinderhead's—matching internal said first and second, cross-forcing+cross-firing, combustion chamber's inlet intake and outlet exhaust, combustion chamber pocket's passageways,—clearing said first and second rotatable valveshafts—comprising said piston assemblies;

respectively being located in said first and second or right bank and left bank, engine block cylinder's bores, and having included said first and second, engine block cylinder sleeve liners/bores,—for reciprocating movement towards and away from said crankshaft, and between top dead center and bottom dead center, crankshaft rotation stroke positions,—and respectively connected to said common crankshaft;

and including said common crankshaft having:

nine combined, front nose formed, halfmoon diameter circumference gear teeth—being axially spaced and spaced 40° apart, or having common slotted grooved pinion gear teeth, around outer perimeter circumference surface, and matched angled beveled edges and, said piston cup lock lock seals, having outer diameter perimeter beveled edge oil groove's—base circle, having outer edge diameter circumference raised lips,—having formed horizontal oil relief grooved slots, being spaced 15° apart—between said 90° spaced—vertical formed piston outer wall/skirt oil groove slots,—and communicating with bottom said piston ring groove's internal vertical oil relief passageway holes;

and said piston cup lock lock seals, having common separator line, vertical cut, between two common spaced, small dimple vertical holes, for removal and installation;

and further secure locking said piston's formed cup locks therein, comprising—said pistons assemblies, being commonly fixed and coordinated below upper first and second or right bank and left bank, piston's top deck surfaces,—and having included:

first and second or right bank and left bank, upward extending top central, opposite sided-curved, catercornered, center cross-force structures—combined catercornered positioned,—rectangular/oblong shaped, vertical raised platform domes—having center diameter, partial circular, formed cross-force section—sunken dish, and being commonly matched formed—fitting up into mounted said:

first and second or right bank and left bank, rotatable valveshaft' cylinderhead's—matching internal said first and second, cross-forcing+cross-firing, combustion chamber's inlet intake and outlet exhaust, combustion chamber pocket's passageways,—clearing said first and second rotatable valveshafts—comprising said piston assemblies;

respectively being located in said first and second or right bank and left bank, engine block cylinder's bores, and having included said first and second, engine block cylinder sleeve liners/bores,—for reciprocating movement towards and away from said crankshaft, and between top dead center and bottom dead center, crankshaft rotation stroke positions,—and respectively connected to said common crankshaft;

and including said common crankshaft having:

nine combined, front nose formed, halfmoon diameter circumference gear teeth—being axially spaced and spaced 40° apart, or having common slotted grooved pinion gear teeth, around outer perimeter circumference surface, and matched fitted into said inner diameter circumference bore surfaces of said multiple gear drive oil scavenging/oil pumping system unit case housing device's bottom vertical positioned cog gear,—having:

inverted halfmoon diameter circumference gear teeth or slotted inverted pinion gear teeth, on said crankshaft nose driven, multiple roller wheel gear;

and said crankshaft front nose said gear teeth—being positioned axially in front of said crankshaft's front most main bearing journal, and being behind extending said crankshaft's front nose snout/shaft having grooved keyway in outer perimeter surface and having:

two common opposite area positioned holes, securing common dow pins, in the front end face, of said nose snout/shaft surface;

having center axis common threaded bolt hole and bolt, securing said rotatable mounted crankshaft pre-magnetized ignition trigger balancer with hub;

towards balancing said crankshaft throw arms, having said opposite ends of formed rotation counter weights, and accurately balancing opposite end rotation weights of said:

throw arms, throw arms pin journal, free spin bearings and seals, connecting rods assemblies,—including big end's swivel hinge V-lock forks—with fork lock caps—with fork locking cap pins, extending rod structure—with small ends, o-ring seals, piston's assemblies—with piston wrist pins—with piston's cup locks—with cup lock lock seals—with piston's rings;

all combined weights—being commonly connected to first and second or right bank connecting rod(A) and left bank connecting rod(B),—both big ends being inner diameter circumference, and outer diameter circumference,—being internal connected joining, as swivel hinge big ends—of connecting rods, and having:

vertical central internal oil passageways from said big ends, extending to said small ends, communicating journal bores/surfaces;

and which said second or left bank connecting rod(B) big ends having 16.5° common angled extending parallel forks, having:

common horizontal oblong pin bore holes, in extended ends,—having vertical grooved split slotted cap-to-rod mounting seats—in between,—and mounting matching grooved lip railed fork lock cap,—having common matching horizontal oblong pin bore holes, in extended ends,—and being secured and commonly locked with matching horizontal positioned, press-fixed, fork and cap locking pins;

and said connecting rod(B) big end and cap, having central inside diameter circumference journal oil groove bearing seat, commonly securing and rotatable supporting, said two halfmoon diameter circumference—flat surface pieces—of freely spinning bearings, to said crankshaft's throw arm's—rod pin journal bearing surface, outer diameter circumference area;

and said connecting rod(B) big end fork locking cap having:

internal bottom central, vertical, and join horizontal, communicating oil passageway holes;

and said connecting rod(B) big end having:

top internal central, joined horizontal, oil passageways—communicating through said vertical, central, internal oil passageway—extending to said small end;

and which said first or right bank, connecting rod(A) big ends having 45° common angled extending parallel forks, having:

common horizontal oblong pin bore holes, in extended ends,—having vertical grooved, partial split, slotted cap-to-rod mounting seats in between,—and having mounted, matching grooved, lip railed, fork lock cap,—having common matching, horizontal oblong pin bore holes, in extended ends,—having:

common horizontal oblong pin bore holes, in extended ends, on said fork lock cap, having 18.5° angled clearance cutaway, on left rail cap-to-rod seat end;

and said connecting rod(A) big end and fork lock cap,—having formed central inside diameter circumference, axially spaced, journal bore and inner journal bore groove seat—having:

inner center diameter circumference halfmoon oil groove, communicating from said vertical central—internal oil passageway, to bottom inner center diameter circumference area—on left inside flank journal bore groove,—of said connecting rod(A) big end fork locking cap;

and respectively which said connecting rod(A) big end left fork, having center axially spaced, halfmoon diameter circumference, split slotted—spaced gap,—comprising a full split left fork/forks—having:

said second or left bank, connecting rod(B) extending through,—proving combining, join swivel action, during crankshaft rotation,—and further journaling and rotatably securing, said connecting rod(B) big end and—fork lock cap and—fork/cap locking pins;

and said connecting rod(A) big end and fork lock cap, journal bore's outer edges having:

formed diameter circumference, common groove seats, rotatably securing, axially spaced positioned, common—said two sets of two pieces—of free spin bearing oil seals,—within said connecting rod(A) big end and fork cap, axially spaced journal bore's inner groove lip edges,—and all rotatably supported, secured, with said connecting rod(A) big end fork lock cap, being secured and commonly locked with two ovally oblong shaped, horizontal positioned, press-fitted, matching big end fork and cap—locking pins;

to said crankshaft throw arm's—rod pin journal bearing surface,—comprising tight precision rotation, reciprocation movement, towards and away from said crankshaft,—and between top dead center and bottom dead center, crankshaft rotation positions.

3. An four-cycle internal combustion engine cylinder block and engine—in accordance with claim 1 and further including a front central engine block main rib bulkhead casing surface, mounting a said crankshaft rotation driven:

multiple internal cog/gear, and having, two same matching diameter circumference—meshing upper vertical positioned—cog pinion/gears;

including said roller wheel gear teeth—cog/gear;

and multiple roller wheel gear teeth—cog pinion/geared;

lubricating oil siphoning/scavenging—combined oil pumping—combined oil cooling, system unit case housing—front covering plate—device;

and said front matching cover plate—having three common main central, vertical stack I-formation—horizontal positioned, common formed bore holes,—having:

inner diameter circumference surfaced, axially spaced diameter circumference grooves, securing common o-ring oil seals, and partially rotationally supporting—a top positioned—and middle positioned,—said cog pinion/gears—having:

protruding pinion journal nose/shafts, rotatably supporting external common timing belt pulley drive—rotation gears;

and said combination unit device,—scavenging oil from communicating, connected, said lower engine block crankcase, said oil pan—having internal oil scavenging passage hole—and passageways, and scavenging oil from said first and second or right bank and left bank, engine block front lower bulkhead flange casing's—internal cross horizontal plane oil passageway's—communicating horizontal oil passage holes,—communicating to rear surface—having gasket with oil inlet—main scavenging holes, to said device system unit case housing's—rear communicating horizontal, main oil inlet, scavenging holes,—routing scavenged oil flow, to and through, common formed:

joining various cooling oil grooved, curved passageways;

around outer spaced diameter perimeter—of inner diameter degree spaced positioned—common mounting bolt holes and bolts, and three joining—central vertical positioned—diameter circumference—interconnecting bores/seat—gear housings;

and said joining various cooling oil grooved, curved, passageways,—flowing oil:

between outer most diameter space, diameter perimeter, of outer diameter degree spaced—positioned, common mounting bolt holes and bolts,—and between said inner diameter degree spaced positioned—common mounting bolt holes and bolts and, communicating to said three joining central—vertical positioned, diameter circumference, interconnecting bores/seat-gear housings;

and said joined various cooling oil grooved—curved passageways,—having:

a top, off-center, vertical positioned, internal oil outlet—communicating bore hole, in top deck mounting base and surface, with a off-center top—horizontal positioned—front internal oil outlet—communicating front surface bore hole;

and said joined various cooling oil grooved—curved passageways,—having:

two upper—ovally curved spaced—internal bore grooved holes, communicating all the way through said unit case housing, having clearance, communicating grooved—rear surface area, behind or below or in back—of said joined various cooling oil grooved—curved passageways,—and connecting to said two upper—ovally curved spaced—internal bore grooved holes,—towards flow-routing scavenged oil through a said joined various cooling—oil grooved—curved passageway, communicating to said three joining central—vertical positioned—diameter circumference—interconnecting bores/seat-gear housings,—that's rotatably supporting at least—three vertical meshing positioned, crankshaft driven—said cog/gears;

bottom bore seat having:

a crankshaft nose/pinion journal, diameter circumference, clearance bore hole—formed at center axis position;

and having said crankshaft nose/pinion journal—diameter circumference clearance—bore hole, formed at center axis position—and having said crankshaft nose/pinion journal—protruding through, and interconnecting to, inner diameter circumference bore—inverted gear teeth—of said cog/gear, being axially positioned within said bottom bore seat housing,—driving/rotating, two above—vertical positioned said cog pinion/gears;

one meshing cog pinion/gear, within said middle bore seat housing;

one meshing cog pinion/gear, within said top bore seat housing;

and being axially positioned within said middle and top, bore seat housings;

and said two above meshing cog pinion/gears having:

common formed central axis, front journal diameter circumference extending pinion noses, having:

common formed keyway grooves—or pinion grooved teeth,—along axis, outer surface perimeter;

and common front area threads and diameter circumference lock grooves, and internal center axis bore hole cavities;

and including said three cog/pinion gears, having axially paced diameter circumference, gear teeth—having center dividing, diameter circumference, axially spaced grooves—having diameter degree positioned—roller wheel gear teeth, being rotatably supported, and secured to, internal axis pin locks,—being positioned spaced—40° apart, about the outer diameter circumference—gear formed teeth perimeter locations, on said three cog/pinion gears,—comprising:

(9)nine roller wheel gear teeth—per cog/pinion gear;

and further comprising roller gears, and pinion roller gears, therein;

and said top bore seat housing, rear backing surface wall, having:

upper off-center vertical location, horizontal—oil siphoning hole, communicating through, wall and gasket, to said engine block valley bulkhead base's—low oil pressure—internal oil reservoir;

and communicating with said top bore seat housing and, said top cog pinion gear/roller cog pinion gear;

and said top bore seat housing—rear back casing wall, having:

opposite area, upper off-central vertical location—horizontal oval oil draining groove—rear surface shallow cavity hole;

communicating to internal, back casing wall, upper cross-horizontal plane, internal oil drain plug hole—threaded passageway, securing common threaded drain plug bolt, for oil draining—said engine block valley bulkhead base—high oil pressure—internal oil reservoir;

and respectively to which said cog/pinion gears, or roller cog/pinion gear's—rotation motion, of scavenging and siphoning, all incoming oil flow through said various oil cooling—curved grooved passageways, and force pumping said all incoming oil flow, through said various oil cooling, curved grooves, of high oil pressure outlet grooved passageways,—within said unit case housing, having:

mounted matching shim gasket;

and said front cover plate, having:

two shallow, common halfmoon diameter spaced—circumference—seat/seal grooves, securing common halfmoon diameter circumference oil seals, about outer perimeter of bottom said bore hole;

included:

matching formed inverse raised area's—inner grooves having (9)nine formed inverse raised pins/oil cooling pins, extending within a—rightside said various cooling oil grooved—curved passageway;—and—

(9)nine formed inverse raised pins/oil cooling pins, extending within a—leftside said various cooling oil grooved—curved passageway;

interconnecting, inner surfaced areas, formed on said front cover plate—back/rear surface,—and being mounted and secured with common bolt holes and bolts, to said unit case housing there-to, and to, said front central engine block main rib bulkhead casing surface,—supplying oil to—top said off-center vertical positioned, internal oil outlet communicating bore hole—in top deck mounting base—having:

common vertical, threaded bolt holes;

having common communicating shim gasket, and partially fixed/mounted said oil filter housing formed base plate—having fixed said oil filter;

flowing cleaned, cooled, warm high pressure oil—to said engine block valley bulkhead base—said internal valley base bulkhead—high pressure oil reservoir;

and further including/having, a top area communicating said joining various cooling—oil outlet route—internal passageway, to said vertical off-center positioned bore hole—having said communicating, front vertical off-central, horizontal positioned—bore hole, communicating through matching shim gasket, and through matching mounted—said front cover plate, and supporting a common formed oil pressure/volume adjuster valve—having:

center axis—threaded bore hole, with inner adjuster bolt shaft jack screw—having rear tip—diameter circumference—axially spaced groove with lock washer;

and having pressure boot cone seal, and fixed pressure lock washer plate—secured with pin lock knob adjuster, of front area, to said adjuster bolt shaft jack screw's front end,—and fixed in a case housing, therein,—having common outer diameter circumference—matching threads and, shim gasket washer, preventing oil leaks,—towards adjusting oil pressure and oil volume flow, to said mounted oil filter housing base plate and, top mounted common disposable oil filter unit and, said engine block valley bulkhead base—high oil pressure—internal oil reservoir,—in response to crankshaft/engine operations;

comprising such:

roller gear, timing drive oil pump, system unit case housing/front cover plate—device;—respectively having said:

two external belt pulley—rotation timing drive gears, having common center axis bores, with inner diameter circumference surfaced—inverted keyway or teeth grooves, matching and being, rotatably supported, axially to said—two above internal cog/pinion gear noses,—being secured with common lock nuts and, C-clip lock washers,—in set rotation positions having included, same matching said (9)nine common diameter circumference—axially spaced and location formed,—halfmoon circumference shaped gear teeth, as mimicking said—internal cog/pinion gears and, roller wheel cog/pinion gear's teeth—being outer diameter spaced—40° apart—about the outer diameter perimeter circumference location,—being axially spaced between, outer perimeter circumference formed—raised rim lips, and rotation driving—two said flex timing drive belts, connected to said first and second rotatable valveshaft's front nose mounted—common matching—said pulley gears;

including said adjustable rotation timing pulley gear members;

toward said rotatable valveshaft cylinderhead's operations, in response to crankshaft/engine operations—thereto;

including a common formed—oil filler neck tube and dipstick level checker cap, being fixed into—front area of said block casing valley base bulkhead's—internal valley base—low pressures oil reservoir, having:

slant angle, communicating bore hole, and said oil filler neck—being secured by said oil filter housing base plate;

and having a rear most, vertical bore hole, having common—oil pressure by-pass valve sending unit, communicating in said internal valley base—high and low pressure oil reservoir, therein.

4. A internal engine valley—water cooling, water pumping, radiator core/unit—having:

fixed central, rear, air suction electric cooling fans;

having bottom rear, fixed, electric water pump;

and including a common formed—water filler neck with pressure relief/siphon spring valve cap, joined to, top—front central—inlet passage area, communicating valley radiator core lid cover, having common spaced, raised, air cooling fins—being partial water cavities;

flowing cooled water through communicating rear engine valley casing's—internal water jacket cylinder barrel passageways, and being positioned or combined over—internal engine valley base bulkhead and oil reservoir cavities, between vertical joined, horizontal air-to-oil passageways, on cylinder block—for:

cooling internal combustion, all-terrain, marine, air-craft, high performance racing engines;

including said cylinder block—having:

reinforced, in acute angular related, extending main rib bulkhead forks—with main journal axis bores having—internal oil reservoir—vertical—communicating passageways, to joined connected, main fork locking caps with bolts, touching bottom crankcase oil scavenge pan, rotatably securing freespin two piece bearings—axially between—two sets, of two piece freespin bearing oil seals;

to included, main journal crankshaft having—throw arm rod pin journal, rotatably supporting, freespin two piece bearings, axially between, two sets of, two piece freespin bearing oil seals, within securing, first and second—swivel hinge—big end(s) connecting rods/pistons/piston wrist pins/piston rings—rotating assemblies, extending therein comprised arch bulkhead crankcase dome cavities, having:

outward extending, first and second, water jacket cylinder barrels/sleeve liner walls, in more or less—90° angular relation to each other;

having included, first and second, outer end cylinder head mounting decks, combined to, extending middle—said valley radiator core's top decks—having:

communicating water jacket passages, between threaded bolt holes with bolts, securing matching gasket with said radiator cooling fin lid/cover, with heat deflecter shield;

having included, mounting, first and second, internal rotary—front/rear positioned turbo fan—solid, single, valveshaft—having:

center axis bore hole—intake wedge valve pockets—only, and having exhaust wedge valve pockets, thereon, being axially spaced between ring seals, being rotatably supported in water jacketed cylinderhead's internal cylinder bore walls;

having included, common fixed, being over, said valley radiator core/unit:

an air/fuel multi-inlet changeable manifold base;

electric fuel injecting, first and second—intake air/fuel mixture—valleyside—inlet ports/passages on cylinderheads;

with catercornered, opposite side, first and second—exhaust burnt-gases outlet ports/passages, having common fixed, exhaust manifold header pipes, on cylinderheads;

and having communicating said rotary turbo fan valveshaft, centrally in-between, and centrally over, communicating, first and second—catercornered spark plugged—air/fuel inlet combustion chamber passageways, with opposite catercornered, first and second—spark plugged, burnt/gases outlet combustion chamber passageways;

of comprised internal dual spark plug combustion chambered mounting base, rotary turbo fan valveshaft cylinderheads, having included, communicating, matching gasket and water jacket passageways—between bolt holes with bolts;

and said cylinderheads having included, above, first front/rear and second front/rear, valleyside's—port passageways, communicating to said first and second valveshaft's—front and rear turbo fans, having fixed/mounted, communicating front valley—fresh air inlet manifold, and rear valley—fresh air outlet manifold pipes—communicating to rear—said internal valley base bulkhead's—vertical/horizontal air-to-oil passageways, communicating through cylinder block's bottom cylinder's—inner circumference positioned—air/oil groove seats, to front vertical, air-to-oil crankcase cavity passages;

and said rotary turbo fan valveshaft cylinderheads-being secured to communicating, matching, first and second—outer ends of block cylinder's—cylinder head mounting decks, having matching water jacket passageways—between threaded bolt holes—having bolts, and partially defining said—dual spark plug combustion chambers, overlying included first and second—axially spaced—multiple cylinder barrels/sleeve liner walls—having bottom inner positioned, circumference, air/oil groove seats, securing laminated spring boot oil seals—having outer groove passageway—communicating with said internal valley base bulkhead's horizontal air-to-oil passages and, opposite area—internal lower bulkhead's oil pan rail's—vertical/horizontal air-oil passages, communicating to said front engine block casing's—mounted crankshaft nose driven, vertical positioned, multiple roller gear—timing drive oil cooling pump—unit case housing—front covering plate—device, having:

external—top and middle positioned, axially spaced, pulley drive gears, with belt/chain—connecting to said—first and second, rotary turbo fan—solid single valveshaft—having common pulley gear driving members, for rotating;

and while cooling and circulating oil through—front central block valley casing base bulkhead deck and, including a fixed—oil filter housing base—having fixed oil filter, flowing cleaned, cooled, oil, back to said—internal valley base bulkhead's high pressure oil reservoir and, through said engine, during crankshaft's rotation between top dead center and bottom dead center—rotation positions—of engine operations, comprising a:

water radiator, over oil reservoirs, cooling system—cylinder block,—crankshaft rollergear timing drive oil cooler pump,—rotary turbo fan super inductionexhaustion valveshaft—over dual spark plug combustion chambers—cylinderheads,—multi-air/fuel inlet changeable manifold base,—engine system;

for—four-cycle:

all-terrain, marine, air-craft, multi-cylinder, internal combustion—high performance racing engines.

5. The four cycle internal combustion engine radiator cylinder block and engine of claim 1 including plurality of engine block cylinders surrounding reciprocating—pistons supporting piston ring seals, supporting piston wrist pins, connected to connecting rods, connected to multiple axially space pin journals supported between multiple-pairs of crank-throw-arms supported to multiple center-axis main journals supporting counter-balanced opposite end throw-arm counter-weighted rotatable crankshaft, with said block cylinders being equally spaced above and along the crank-shaft main center-line axis extending outward from crank-case in acute 60° or 90° angle being a first and second or right cylinder block bank and left cylinder block bank, non-staggered V-center line acute angular relation cylinder barrel bore spacing, to each other, and said plurality of engine block cylinders being combined between multiple axially spaced positioned, internal main rib bulkheads/webs having in acute V-angular related vertical extending main rib bulkhead forks having partial crankshaft main journal bores and, having inner grooved rail tracks securing matching connected fork locking caps having partial crankshaft main journal bores and, locking bolts, rotatably supporting said multiple axis main journaled crankshaft, there-to said engine radiator cylinder block.

* * * * *